US007008760B1

(12) United States Patent
Yoneyama et al.

(10) Patent No.: US 7,008,760 B1
(45) **Date of Patent: *Mar. 7, 2006**

(54) SILVER HALIDE COLOR PHOTOGRAPHIC LIGHT-SENSITIVE MATERIAL AND METHOD OF FORMING A COLOR IMAGE

(75) Inventors: Hiroyuki Yoneyama, Minami-ashigara (JP); Yasuaki Deguchi, Minami-ashigara (JP); Yasuhiro Yoshioka, Minami-ashigara (JP); Hidekazu Sakai, Minami-ashigara (JP); Katsuyuki Takada, Minami-ashigara (JP); Yoshiro Ochiai, Minami-ashigara (JP); Shin Soejima, Minami-ashigara (JP); Kentaro Okazaki, Minami-ashigara (JP)

(73) Assignee: Fuji Photo Film Co., Ltd., Kanagawa-ken (JP)

( * ) Notice: This patent issued on a continued prosecution application filed under 37 CFR 1.53(d), and is subject to the twenty year patent term provisions of 35 U.S.C. 154 (a)(2).

Subject to any disclaimer, the term of this patent is extended or adjusted under 35 U.S.C. 154(b) by 0 days.

(21) Appl. No.: 09/573,333

(22) Filed: May 18, 2000

(30) Foreign Application Priority Data

| | | |
|---|---|---|
| May 21, 1999 | (JP) | 11-141966 |
| Jun. 10, 1999 | (JP) | 11-164216 |
| Jun. 10, 1999 | (JP) | 11-164452 |
| Jun. 11, 1999 | (JP) | 11-166036 |
| Jun. 11, 1999 | (JP) | 11-166054 |
| Jun. 11, 1999 | (JP) | 11-166070 |
| Jun. 15, 1999 | (JP) | 11-168273 |

(51) Int. Cl.

| | |
|---|---|
| ***G03C 1/795*** | (2006.01) |
| ***G03C 1/93*** | (2006.01) |
| ***G03C 7/38*** | (2006.01) |
| ***G03C 7/30*** | (2006.01) |
| ***G03C 1/035*** | (2006.01) |

(52) U.S. Cl. ..... 430/363; 430/383; 430/496; 430/533; 430/536; 430/963; 430/503

(58) Field of Classification Search ..... 430/533, 430/536, 496, 963, 383, 363, 503
See application file for complete search history.

(56) References Cited

U.S. PATENT DOCUMENTS

| | | | | |
|---|---|---|---|---|
| 5,422,232 | A * | 6/1995 | Asami et al. | 430/963 |
| 5,445,924 | A * | 8/1995 | Kawai | 430/963 |
| 5,462,845 | A | 10/1995 | Yoshioka | 430/505 |
| 5,474,884 | A | 12/1995 | Okazaki | 430/553 |
| 5,512,425 | A * | 4/1996 | Kase | 430/533 |
| 5,556,737 | A * | 9/1996 | Nakamura | 430/533 |
| 5,780,215 | A * | 7/1998 | Ito | 430/533 |
| 5,783,373 | A * | 7/1998 | Mydlarz et al. | 430/567 |
| 5,783,378 | A * | 7/1998 | Mydlarz et al. | 430/567 |
| 5,817,448 | A * | 10/1998 | Hayashi et al. | 430/963 |
| 5,853,926 | A * | 12/1998 | Bohan et al. | 430/350 |
| 5,853,965 | A * | 12/1998 | Haydock et al. | 430/536 |
| 5,856,051 | A * | 1/1999 | Yau et al. | 430/537 |
| 5,866,282 | A | 2/1999 | Bourdelais et al. | 430/22 |
| 5,874,205 | A | 2/1999 | Bourdelais et al. | 430/496 |
| 5,888,643 | A | 3/1999 | Aylward et al. | 428/315.9 |
| 5,994,046 | A * | 11/1999 | Kawai | 430/558 |
| 6,132,945 | A * | 10/2000 | Saito et al. | 430/558 |
| 6,171,751 | B1 * | 1/2001 | Mourey et al. | 430/536 |
| 6,171,773 | B1 * | 1/2001 | Bergthaller et al. | 430/558 |
| 6,291,148 | B1 * | 9/2001 | Aylward et al. | 430/536 |
| 6,296,995 | B1 * | 10/2001 | Camp et al. | 430/536 |

* cited by examiner

*Primary Examiner*—Richard L. Schilling
(74) *Attorney, Agent, or Firm*—Sughrue Mion, PLLC

(57) ABSTRACT

Disclosed is a silver halide color photographic light-sensitive material having at least three silver halide emulsion layers different in color sensitivity from each other on a reflective support, wherein said reflective support is one selected from the group consisting of the following (a), (b) and (c):

(a) the reflective support is a water-resistant resin-coated support, and at least one layer of the water-resistant resin layers between the support and the silver halide emulsion layers is a biaxially oriented polyolefin layer having micropores, (b) the reflective support is a water-resistant resin-coated support, and at least one layer of the water-resistant resin layers between the support and the silver halide emulsion layers is a biaxially oriented polyolefin layer having micropores, and between the polyolefin layer and the silver halide emulsion layers, a polyolefin layer having no micropore is provided, and (c) the reflective support is one prepared by coating onto at least the side of the emulsion-coated surface of the support with a composition having a white pigment mixed and dispersed in a resin containing at least 50 wt % of a polyester synthesized by polycondensation of a dicarboxylic acid with a diol, and wherein the silver halide emulsions in the silver halide emulsion layers each comprise silver halide emulsion grains with a silver chloride content of 95 mol % or more. Further, a method of forming a color image by the use of this silver halide color photographic light-sensitive material is also disclosed.

51 Claims, No Drawings

SILVER HALIDE COLOR PHOTOGRAPHIC LIGHT-SENSITIVE MATERIAL AND METHOD OF FORMING A COLOR IMAGE

FIELD OF THE INVENTION

The present invention relates to a silver halide color photographic light-sensitive material having rapid processing suitability, and to a method of forming an image by using the same.

When stating in more detail characteristics of each embodiment, the present invention relates to a silver halide color photographic light-sensitive material that has less fluctuation in photographic properties during storage, or due to varying storage conditions, for the silver halide color photographic light-sensitive material in an unexposed state.

Further, the present invention relates to a silver halide color photographic light-sensitive material improved in curl characteristics and surface smoothness, having high sensitivity, and improved in storage stability of the silver halide color photographic light-sensitive material in an unexposed state, and in image stability after processing, with good color reproduction.

Further, the present invention relates to a silver halide color photographic light-sensitive material with improved image quality. The present invention relates in particular to a silver halide color photographic light-sensitive material that can realize excellent tone reproduction in a plurality of exposure system, without a particular limit to an exposure device.

Further, the present invention relates to a color photographic light-sensitive material excellent in surface smoothness and surface gloss, with less desensitization upon pressurization or bending of the light-sensitive material, thus showing excellent handling properties, as well as to a method of forming a color image by using the same.

Further, the present invention relates to a color photographic light-sensitive material excellent in surface smoothness and surface gloss, with less fogging upon pressurization on the light-sensitive material, particularly upon application of force causing abrasion marks, thus being excellent in handling, as well as to a method of forming a color image by using the same.

Further, the present invention relates to a photographic print that is highly resistant to deformation and bending, thus hardly collapsing even if several hundred sheets thereof are piled up; a silver halide photographic light-sensitive material giving the same, and a method of forming an image to give said photographic print.

BACKGROUND OF THE INVENTION

In the field of photographic processing service in recent years, silver halide color photographic light-sensitive materials of high image quality, which can be easily (simply) and rapidly processed, are desired for improved service for the user, or as a means of improving productivity. At present, a light-sensitive material containing a high-silver chloride emulsion, which material can be processed for a color development time of 45 seconds, with a total processing time of 4 minutes or less, is usually employed. However, the silver halide color photographic light-sensitive material is not satisfactory with respect to ease and processing speed compared with other color systems (e.g. an electrostatic transfer system, a thermal transfer system, and an ink jet system), and there is a demand for further enhancement of processing easiness and speed.

Stabilization of the photographic properties of a silver halide color photographic light-sensitive material after processing is always desired. In particular, there is a need for improved fluctuation in fog and sensitivity under varying conditions during storage of a light-sensitive material in an unexposed state. Particularly with fluctuation in fog, the white background is greatly affected, to significantly deteriorate image quality.

As techniques to improve the white background, there are techniques to improve the washing of sensitizing dyes and irradiation-preventing dyestuffs, to improve it by using a fluorescent brightening agent, and to improve the packing density of a white pigment in a support (base), in addition to reducing fog of the silver halide emulsion. For example, attempts to improve an absolute value of whiteness by using a specific support are described in JP-A-10-333277 ("JP-A" means unexamined published Japanese patent application), JP-A-11-52513, JP-A-11-65024, JP-A-6-250331, JP-A-6-167772 and JP-A-6-167775. However, the techniques described above do not reach drastic or radical improvements, and further improvements have been desired.

On the other hand, a paper support laminated with polyethylene has been usually used as a support for color paper. The polyethylene-laminated paper support is a technique that is useful in reducing the burden of washing and drying, and in imparting rapid processability, by improving the water resistance of the support and preventing a processing solution from penetrating into the paper. Further, the polyethylene-laminated paper support is also advantageous, in that the whiteness of the light-sensitive material can be improved by dispersing and containing a white pigment, such as titanium oxide, in polyethylene.

However, if it is attempted to further improve whiteness and sharpness, there is a limit to the density of titanium oxide dispersed in polyethylene, and thus the polyethylene-laminated paper support is not necessarily satisfactory.

On the other hand, if a polyester-series resin is used as a laminate material, the resulting support is far advantageous in the respect that smoothness is high, while a white pigment can be dispersed in high light packing, whereas there are difficulties in production, such as the burden of high costs and insufficient adhesion of the coated material. Thus further improvement and new support techniques have been desired.

As a result of various eager studies, the present inventors have found that a support, whose whiteness is improved by dispersing titanium oxide or/and forming pores, in a biaxially oriented polyolefin resin, is used in combination with a pyrazolotriazole-type magenta coupler represented by the following formula (I):

formula (I)

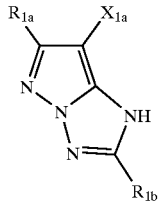

wherein, in formula (I), $R_{1a}$ and $R_{1b}$ each independently represent a hydrogen atom or a substituent, and $X_{1a}$ represents a hydrogen atom or a group that can be split-off by reaction with an oxidized product of a color-developing agent, thereby a silver halide color photographic light-sensitive material having high sensitivity and improved significantly in sharpness, whiteness, curling properties, and color reproduction, can be prepared.

However, when the above support and the pyrazolotriazole-type magenta coupler with a relatively low pKa value, represented by formula (I), were used, it was found that there are the problems that the sensitivity of the magenta-color-forming layer is changed with the lapse of time during long-term storage of the light-sensitive material, and that the gradation in the shoulder part is soft-toned. In particular, the sensitivity of the roll-processed light-sensitive material is significantly changed during long-term storage, and further improvements have been desired.

In recent years, various color imaging means different from the silver halide color photographic system, such as the ink jet system, the thermal transfer system, and the electron photographic system, have been developed and proposed. Compared with these methods, the silver halide color photographic system is excellent in image quality and costs. However, these systems have been rapidly developed in recent years, and the image quality in these systems has approached those in the silver halide color photographic system.

Further, the range of utilization of image to be printed is enlarged due to development of the technique of forming artificial images by computer (computer graphics).

Accordingly, even in the silver halide color photographic system, there is a demand for further improvements to realize higher image quality, while maintaining its superiority in costs.

For attaining higher image quality in silver halide color photographic light-sensitive materials, many techniques have been developed from various viewpoints. For example, mention can be made of the technique of gradation design, as described in JP-A-3-68938, as well as the techniques of improving whiteness by use of a resin coated paper in place of a baryta paper, or by use of a coupler excellent in color reproduction, as described in JP-A-5-150418, and by use of a support containing a fluorescent brightening agent, as described in U.S. Pat. No. 4,794,071.

In addition to these techniques, recently, a method of comprehensively improving image quality by computer processing of information on an image upon printing, onto a print material, of the image recorded on a material for photographing, is put to practical use (for example, Digital Mini-Lab System Frontier, trade name, manufactured by Fuji Photo Film Co., Ltd.). In this method, the printing of an image onto the print material is conducted not by a conventional method of exposing the print material to a light passing through a developed film having a negative image recorded thereon, but by a method of exposing the information on an image to a light in a scanning exposure system using a combination of a DMD (digital mirror device), a polygon mirror, or the like, with a light source, such as a laser or LED.

In such an exposure system, a shorter exposure time per picture element is advantageous to reduce the exposure time for the image as a whole, from the viewpoint of improvement on processing operation efficiency. At present, the exposure time per picture element in an exposure device in the scanning exposure system utilized in practice, is substantially $10^{-4}$ seconds or so, which is extremely short compared with the exposure time (about 1/10 second) in the conventionally used exposure device.

To keep up with such a short-time exposure, print materials for scanning exposure are also commercially available. To maximally demonstrate the superiority in costs and the convenience in the silver halide color photographic system, however, there is a need for print materials to which both the scanning exposure system and the conventional system can be applied; that is, print materials that are applicable to a wide range of exposure time. Some of such print materials are commercially available (e.g. Fuji G Color Film Super FA-FC/FA-FT, trade name, manufactured by Fuji Photo Film Co., Ltd.).

In spite of many such efforts to improve image quality, the current silver halide color photographic light-sensitive materials cannot satisfactorily keep up with the change in the exposure system. By way of example, there is the case where such materials are not satisfactory with respect to the expression of metallic texture (feeling) or the expression of images whose density is greatly changed in fine regions, as observed in a vivid space figure frequently used in computer graphics. In particular, this problem was significant in images formed in the scanning exposure system.

Color photography makes use of a method of obtaining a dye image, through development processing of a light-sensitive material having a dye-forming coupler and a silver halide emulsion on a support, with an aromatic primary amine color-developing agent, and the sequential reaction of a resultant oxidized product of the developing agent with the dye-forming coupler. To enhance this color-development processing more easily and rapidly is required very strongly in the industry of color photography, and a very large number of improvements have been added thereto, and new and faster systems have been developed every few years.

For processing speed enhancement, it is necessary to think about reducing the time in the respective steps of color development, bleach-fixing, washing, and drying. As a method for enhancement of processing speed, for example, International Published Patent WO87-04534 discloses a method of rapid processing with a color photographic light-sensitive material using a high-silver-chloride silver halide, as a photographic emulsion, and it is described therein that use of the high-silver-chloride emulsion is preferable from the viewpoint of rapid processing. By these efforts, a method of printing, onto a silver halide color printing paper for a high-silver-chloride print, of an image taken on a color negative film, is widespread as a method of rapidly and easily obtaining a high-quality image.

Further, in recent years, prints of various sizes, such as panorama size, high-vision size, or the like, can be easily obtained, according to the diversification of user needs. In such prints, there is a demand not only for size but also for smoothness and gloss for the texture of the print material, and supports meeting this demand are under development.

For example, European Patent EP-0507,489 discloses that a support for print superior to generally used polyolefins in smoothness and gloss on the surface thereof, can be obtained by use of a polyester as a water-resistant resin.

The present inventors studied silver halide color photographic light-sensitive materials superior in surface smoothness and gloss, particularly color photographic printing paper. As a result, a support for print superior to generally used polyolefins in smoothness and gloss on the surface thereof, can be certainly obtained by use of a polyester as a water-resistant resin. In this case, however, the following disadvantages were revealed: that desensitization occurs at pressurized or bent sites of the light-sensitive material, and further that fog is occurred on the light-sensitive material upon pressurization, particularly upon occurrence of abrasion marks.

Against this problem, JP-A-6-167771 discloses that the problem of easy occurrence of desensitization of a light-sensitive material using a polyester as the support, upon pressurization of the light-sensitive material during long-term storage, can be reduced by adding a silver halide emulsion sensitized with selenium, tellurium, or gold, to the light-sensitive emulsion layer. However, as a result of further extensive study, the present inventors found that pressure desensitization occurring upon pressurization of the light-sensitive material is further worsened by a combination of the silver halide emulsion and a blue-sensitizing dye, and further by making the layer thinner for rapid processing. Accordingly, further improvements have been desired.

On the other hand, against the above-mentioned problem, JP-A-6-289532 discloses that fog occurring at pressurized or bent sites of the light-sensitive material using a polyester as its support, can be reduced by defining a specific content of calcium in the light-sensitive material. However, the light-sensitive material is actually hardly bent by excessive force in the step of photographic printing, and there are many cases where a high-quality image cannot be realized due to fogging upon occurrence of abrasion marks during transportation or handling, without knowing such marks. In this respect, the disclosure neither fully solves the problem nor is practically usable.

Accordingly, it has been desired to develop a technique to reduce abrasion fog, without deterioration of surface gloss and smoothness.

For the silver halide color photographic light-sensitive material, a method of color-development processing, with a color-developing agent, of an exposed light-sensitive material containing three kinds of yellow, magenta, and cyan photographic couplers in three kinds of light-sensitive emulsion layers different in color sensitivity from each other on a support, is widely known. As the support, a white opaque support is used, and so-called RC raw paper, having polyolefin laminated on the paper, has been used particularly as a support for color paper.

In the case of this color paper, a print photograph with glossy texture is preferred by the general user in recent years, but if the glossiness by light reflection is too strong, it may be difficult to observe the print surface.

On the other hand, in the case of printing at the request of a user who dislike glossiness or desires printing with immensity (massive proportion), a color paper using so-called framed RC raw paper, such as a matte surface, silk surface, or the like, having a previously-surface-treated RC raw paper, is subjected to printing. However, the print on the color paper using the framed RC raw paper exhibits too strong light reflection depending on the position of the light source for observation, and it cannot be said that an immensity and satisfactory image pattern (design) can be perfectly obtained.

In addition, methods of improving surface glossiness by achieving a matte effect, through fine grains contained in the surface or the inside of a light-sensitive material, are disclosed, for example, in JP-A-61-147248, JP-A-1-142630, JP-A-6-75331, and JP-A-7-261342, and the print obtained by these methods can provide a design with some degrees of immensity, but there is the disadvantage that the processed print is easily damaged during conveyance and transportation, or it is easily curled (warped) when the print is left at low humidity.

Accordingly, a method of using both a predetermined or greater amount of porous fine grains and latex in the light-sensitive material, thereby lessening damage on the print and preventing curling under low humidity, is disclosed in JP-A-10-104794, but it cannot be said that prevention of curling when the print is left in high humidity is satisfactory.

Conventionally, toughness of image-displaying elements including silver halide photographic light-sensitive materials, has been pursued. The image-displaying element is a material displaying an image, including drawings, letters, figures, or the like, in addition to photographs, on a support comprising a paper and/or plastic. Up to now, development has been made mainly from the viewpoint of image storability in pursuing toughness, and in recent years, the viewpoint of toughness against physical destruction, such as deformation, bending, or cracking, has become important. This is because, as a result of the technical developments made hitherto, in particular related to silver halide photographic light-sensitive material, images can be stored and appreciated for dozens of years under usual storage conditions, and thus a materials resistance to physical deformation or destruction, upon attachment to a wall via pushpins or an adhesive tape, and upon bending due to wind or repeated attachment, has become important.

As a result of study aimed at preventing physical deformation or destruction, the present inventors found that, when a resin which is composed of a polyester as a main component described, for example, in JP-A-6-167775, is coated on a raw paper, thereby increasing the rigidity of the resultant support, this support can exhibit physical strength as high as several times that of a conventional photographic print of a paper support coated with polyethylene. Meanwhile, it was also found that the same effect can be achieved in a method of obtaining a photographic print having resistance to cracking due to deformation or bending, as disclosed in British Patent GB-2325750.

However, it was found that, when a photographic print using a support having physical strength increased by these methods, is subjected to continuous printing, using an automatic developing machine and/or an automatic cutting machine, the corners of the print, which should usually be right-angled, are not right-angled and tend to have shapes with sharp burrs, after several thousand sheets are printed. If these burrs are present, when several hundred sheets of photographic print are tried to stack flat to pile them up, they easily collapse without being piled up vertically. Accordingly, such the photographic prints are not preferable, since they are inferior in stacking (piling-up) property, thus disadvantageously increasing the burden in working in laboratories.

SUMMARY OF THE INVENTION

An object of the present invention is to provide a silver halide color photographic light-sensitive material having rapid processing suitability. Another object of the present invention is to provide a method of forming an image by use of the silver halide color photographic light-sensitive material.

In particular, still another object of the present invention is to provide a silver halide color photographic light-sensitive material with less fluctuation in photographic properties during storage, or under varying storage conditions, of the silver halide color photographic light-sensitive material in an unexposed state.

A further object of the present invention is to provide a silver halide color photographic light-sensitive material using a combination of a specific pyrazolotriazole-type magenta coupler excellent in photographic characteristics, and a support having a biaxially oriented polyolefin resin layer, which material has high sensitivity and improved in fluctuation with the lapse of time in photographic characteristics, such as sensitivity, gradation, or the like, during long-term storage.

A further object of the present invention is to provide a silver halide color photographic light-sensitive material improved in the expression of an image whose density is greatly changed in fine regions represented by a drawing expressing metallic texture or the like.

A still further object of the present invention is to provide a highly-convenient silver halide color photographic light-sensitive material of high-image quality, with applicability to a wide range of exposure time.

Another further object of the present invention is to provide a silver halide color photographic light-sensitive material that is excellent in surface smoothness and gloss, and excellent in handling capability, due to less desensitization upon bending or pressurization of the light-sensitive material.

A still further object of the present invention is to provide a silver halide color photographic light-sensitive material that is excellent in surface smoothness and gloss, and excellent in handling, due to less fogging upon pressurization, in particular upon application of force causing abrasion marks on the light-sensitive material.

Further another object of the present invention is to provide a silver halide color photographic light-sensitive material that is excellent in curl resistance, with less damage after processing, and with less fluctuation in photographic properties during storage, or under varying storage conditions, in an unexposed state.

Further, still further object of the present invention is to provide a photographic print that is highly resistant to deformation and bending, thus hardly collapsing even if several hundred sheets thereof are piled up. A still further object of the present invention is to provide a silver halide photographic light-sensitive material for giving the photographic print.

Another still further object of the present invention is to provide a method of forming an image for giving the photographic print.

A still further another object of the present invention is to provide a method of forming a color image by using each of the silver halide color photographic light-sensitive materials.

Other and further objects, features, and advantages of the invention will appear more fully from the following description.

DETAILED DESCRIPTION OF THE INVENTION

As a result of eager study, the present inventors have found the above-described objects can be achieved by the following means:

(1) A silver halide color photographic light-sensitive material having at least three silver halide emulsion layers different in color sensitivity from each other on a reflective support, wherein said reflective support is one selected from the group consisting of the following (a), (b) and (c):

(a) the reflective support is a water-resistant resin-coated support, and at least one layer of the water-resistant resin layers between the support and the silver halide emulsion layers is a biaxially oriented (stretched) polyolefin layer having micropores, (b) the reflective support is a water-resistant resin-coated support, and at least one layer of the water-resistant resin layers between the support and the silver halide emulsion layers is a biaxially oriented polyolefin layer having micropores, and between the polyolefin layer and the silver halide emulsion layers, a polyolefin layer having no micropore is provided, and (c) the reflective support is one prepared by coating onto at least the side of the emulsion-coated surface of the support with a composition having a white pigment mixed and dispersed in a resin containing at least 50 wt % of a polyester synthesized by polycondensation of a dicarboxylic acid with a diol, and wherein the silver halide emulsions in the silver halide emulsion layers each comprise silver halide emulsion grains with a silver chloride content of 95 mol % or more.

(2) The silver halide color photographic light-sensitive material according to the above item (1), wherein the at least three silver halide emulsion layers are at least three kinds of light-sensitive hydrophilic colloidal layers respectively containing any one of yellow-, magenta- and cyan-color-forming couplers, and wherein a non-light-sensitive hydrophilic colloidal layer is provided on the reflective support, and wherein the reflective support is a water-resistant resin-coated support, and at least one layer of the water-resistant resin layers between the support and the silver halide emulsion layers is a biaxially oriented polyolefin layer having micropores, and wherein a pyrazolotriazole-type magenta coupler represented by formula (M):

formula (M)

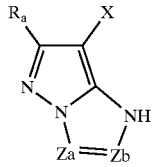

(wherein Za and Zb each represent —C($R_b$)═ or —N═, provided that one of Za and Zb is —C($R_b$)═ and the other is —N═; $R_a$ and $R_b$ each independently represent a hydrogen atom or a substituent; and X represents a hydrogen atom or a group capable of being split-off upon coupling reaction with an oxidized product of a color-developing agent.) and a non-color-forming and oil-soluble organic compound are contained in the magenta-color-forming hydrophilic colloidal layer, in which the ratio by weight of the non-color-forming organic compound/magenta coupler is in the range of 2.0 to 6.0.

(3) The silver halide color photographic light-sensitive material according to the above item (2), which is hardened by using at least one hardening agent represented by the following formula (II):

$$X^1—SO_2—L—SO_2—X^2 \quad \text{formula (II)}$$

wherein, in formula (II), $X^1$ and $X^2$ are —CH═$CH_2$ or —$CH_2CH_2$—Y, in which $X^1$ and $X^2$ may be the same or different, Y represents a group which is substituted by a nucleophilic reagent (a nucleophilic group), or which can be split-off in the form of HY by a base, and L is a divalent linking group which may be further substituted.

(4) The silver halide color photographic light-sensitive material according to the above item (2) or (3), wherein the cyan-color-forming hydrophilic colloidal layer con tains at least one pyrorotriazole cyan coupler represented by the following formula (III):

formula (III)

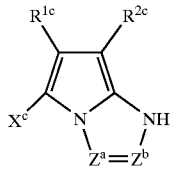

wherein, in formula (III), $Z^a$ and $Z^b$, which may be the same or different, each represent —C($R^{3c}$)= or —N=, provided that one of $Z^a$ and $Z^b$ is —C($R^{3c}$)= and the other is —N=, $R^{1c}$ and $R^{2c}$ each represent an electron-attracting group having a Hammett's substituent constant op value of 0.2 or more, and the total of the $\sigma_p$ values of $R^{1C}$ and $R^{2c}$ is 0.65 or more, $R^{3c}$ represents a hydrogen atom or a substituent, and $X^c$ represents a hydrogen atom or a group capable of being split-off upon reaction with an oxidized product of a color-developing agent.

(5) The silver halide color photographic light-sensitive material according to the above item (1), wherein the support is a water-resistant resin-coated support, and at least one layer of the water-resistant resin-coated layers between the support and the silver halide emulsion layers is a biaxially oriented polyolefin layer having micropores, and wherein when the light-sensitive material is subjected to gradation exposure for an exposure time of $10^{-4}$ second, the maximum gamma in the region where the density after processing is 1.5 to 2.0 is 1.1 or more, but less than 4.2 for yellow, magenta and cyan, and the differences of maximum gamma among yellow, magenta and cyan are within 1.0.

(6) The silver halide color photographic light-sensitive material according to the above item (5), wherein when the light-sensitive material is subjected to gradation exposure for an exposure time of 1/10 second, the maximum gamma in the region where the density after processing is 1.5 to 2.0 is 1.1 or more, but less than 4.0 for yellow, magenta and cyan, and the differences of maximum gamma among yellow, magenta and cyan are within 1.0.

(7) The silver halide color photographic light-sensitive material according to the above item (1), wherein the support is a water-resistant resin-coated support, and at least one layer of the water-resistant resin-coated layers between the support and the silver halide emulsion layers is a biaxially oriented polyolefin layer having micropores, and between the polyolefin layer and the silver halide emulsion layers, a polyolefin layer having no micropore is provided, and wherein when the light-sensitive material is subjected to gradation exposure for an exposure time of $10^{-4}$ second, the maximum gamma in the region where the density after processing is 1.5 to 2.0 is 1.1 or more, but less than 4.2 for yellow, magenta and cyan, and the differences of maximum gamma among yellow, magenta and cyan are within 1.0.

(8) The silver halide color photographic light-sensitive material according to the above item (7), wherein when the light-sensitive material is subjected to gradation exposure for an exposure time of 1/10 second, the maximum gamma in the region where the density after processing is 1.5 to 2.0 is 1.1 or more, but less than 4.0 for yellow, magenta and cyan, and the differences of maximum gamma among yellow, magenta and cyan are within 1.0.

(9) The silver halide color photographic light-sensitive material according to the above item (1), wherein the support is one prepared by coating onto at least the side of the emulsion-coated surface of the support with a composition having a white pigment mixed and dispersed in a resin containing at least 50 wt % of a polyester synthesized by polycondensation of a dicarboxylic acid with a diol, and wherein when the light-sensitive material is subjected to gradation exposure for an exposure time of $10^{-4}$ second, the maximum gamma in the region where the density after processing is 1.5 to 2.0 is 1.1 or more, but less than 4.2 for yellow, magenta and cyan, and the differences of maximum gamma among yellow, magenta and cyan are within 1.0.

(10) The silver halide color photographic light-sensitive material according to the above item (9), wherein the polyester in the reflective support is a polyester which is composed of polyethylene terephthalate as a main component.

(11) The silver halide color photographic light-sensitive material according to the above item (9) or (10), wherein when the light-sensitive material is subjected to gradation exposure for an exposure time of 1/10 second, the maximum gamma in the region where the density after processing is 1.5 to 2.0 is 1.1 or more, but less than 4.0 for yellow, magenta and cyan, and the differences of maximum gamma among yellow, magenta and cyan are within 1.0.

(12) The silver halide color photographic light-sensitive material according to the above item (1), wherein the reflective support is a water-resistant resin-coated support, and at least one layer of the water-resistant resin layers between the support and the silver halide emulsion layers is a biaxially oriented polyolefin layer having micropores, and wherein the silver halide emulsion in at least one layer of the silver halide emulsion layers has a silver chloride content of 95 mol % or more, and is occupied by tabular grains having an average aspect ratio of 2 or more and an average thickness of less than 0.3 $\mu$m, in an amount of 50% or more of the projected area of the total silver halide grains.

(13) The silver halide color photographic light-sensitive material according to the above item (12), wherein the tabular grains have a {100} principal surface.

(14) The silver halide color photographic light-sensitive material according to the above item (12), wherein the tabular grains have a {111} principal surface.

(15) The silver halide color photographic light-sensitive material according to the above item (1), wherein the reflective support is a water-resistant resin-coated support, and at least one layer of the water-resistant resin layers between the support and the silver halide emulsion layers is a biaxially oriented polyolefin layer having micropores, and between the biaxially oriented polyolefin layer and the silver halide emulsion layers, a polyolefin layer having no micropore is provided, and wherein the silver halide emulsion in at least one layer of the silver halide emulsion layers has a silver chloride content of 95 mol % or more, and is occupied by tabular grains having an average aspect ratio of 2 or more and an average thickness of less than 0.3 $\mu$m, in an amount of 50% or more of the projected area of the total silver halide grains.

(16) The silver halide color photographic light-sensitive material according to the above item (15), wherein the tabular grains have a {100} principal surface.

(17) The silver halide color photographic light-sensitive material according to the above item (15), wherein the tabular grains have a {111} principal surface.

(18) The silver halide color photographic light-sensitive material according to the above item (1), wherein the reflective support is one prepared by coating onto at least the side of the emulsion-coated surface of the support with a composition having a white pigment mixed and dispersed in a resin containing at least 50 wt % of a polyester synthesized by polycondensation of a dicarboxylic acid with a diol, and wherein the silver halide emulsion in at least one layer of the silver halide emulsion layers has a silver chloride content of 95 mol % or more, and is occupied by tabular grains having an average aspect ratio of 2 or more and an average thickness of less than 0.3 μm, in an amount of 50% or more of the projected area of the total silver halide grains.

(19) The silver halide color photographic light-sensitive material according to the above item (18), wherein the polyester in the reflective support is a polyester which is composed of polyethylene terephthalate (PET) as a main component (herein, the term "as a main component" means that the content of the PET component in the polyester is 50 wt % or more).

(20) The silver halide color photographic light-sensitive material according to the above item (18) or (19), wherein the tabular grains have a {100} principal surface.

(21) The silver halide color photographic light-sensitive material according to the above item (18) or (19), wherein the tabular grains have a {111} principal surface.

(22) The silver halide color photographic light-sensitive material according to the above item (1), which further comprises at least one non-light-sensitive layer on the reflective support, in which the ratio by weight of the oil-soluble ingredient/hydrophilic binder in at least one layer of the non-light-sensitive layers is 0.50 to 2.00.

(23) The silver halide color photographic light-sensitive material according to the above item (1), wherein the at least three silver halide emulsion layers are a yellow coupler-containing silver halide emulsion layer, a magenta coupler-containing silver halide emulsion layer and a cyan coupler-containing silver halide emulsion layer, and wherein a non-light-sensitive layer is provided on the reflective support, and a matt agent is contained in the outermost layer among the non-light-sensitive layers.

(24) The silver halide photographic light-sensitive material according to the above item (1), which is one used for a reflective-type photographic print, wherein the shape of the four corners of the square or rectangular photographic print is an arc with a radius of 1 mm or more, but 20 mm or less with the center placed in the photographic print and a central angle of 90° or less, and the Taber rigidity of the reflective support is 9.0 g·cm or more.

(25) A method of forming a color image, comprising subjecting a silver halide color photographic light-sensitive material to scanning exposure with a light beam modulated on the basis of image information, and subjecting the resultant silver halide color photographic light-sensitive material to development processing, wherein said silver halide color photographic light-sensitive material is the silver halide color photographic light-sensitive material described in any one of the above items (1) to (24).

(26) A method of forming a color image, comprising processing the silver halide color photographic light-sensitive material described in any one of the above items (1) to (24) with a color-development processing time of 20 seconds or less.

Hereinafter, the silver halide color photographic light-sensitive material of the present invention is described in more detail.

One embodiment of the reflective support which can be used in the silver halide color photographic light-sensitive material according to the present invention is a water-resistant resin-coated reflective support wherein at least one layer of water-resistant resin layers between the support and the silver halide emulsion layer(s) is a biaxially oriented polyolefin layer having micropores.

The method of forming micropores in polyolefin in this reflective support is preferably a method, in which a material forming a core (nucleus) with not-so-high affinity for the polyolefin is added to the polymer, and then the resultant polymer is oriented, to form pores around the core-forming material. This core-forming material for pores is called a pore-inducing material, and use can be made of an inorganic pigment and a polymeric material, and the polymeric material is preferably used.

The polymeric material is preferably a polymer which can be melt-mixed with a polymer for forming the core matrix, and which, upon cooling in the form of a suspension, can form spherical grains dispersed therein. For example, such a material includes polybutylene terephthalate dispersed in polypropylene. The pore-inducing material is used preferably in an amount of 5 to 50 wt % to the core matrix polymer. Grains of the pore-inducing material remaining in the completed sheet core are preferably spherical with a diameter of preferably 0.1 to 10 μm. The size of pores, though depending on the degree of longitudinal and transverse orientation (stretching) is approximately the size of the diameter, in a section, of a particle for opening the pore.

A polyolefin layer containing no micropore can be formed to be adjacent to the polyolefin layer having micropores. The polyolefin layer having micropores are opaque and milky white in itself, and a white pigment, such as titanium dioxide, barium sulfate, alumina and calcium carbonate, can be added to the micropore-containing layer and/or the adjacent polyolefin layer, to increase whiteness. In addition, known pigments, fluorescent brightening agents, and other additives for improving the physical properties of the polyolefin layer can also be added. In particular, when polypropylene is used, titanium oxide or the like can increase packing density and are preferably used from the viewpoint of improvement in whiteness. The density of one or more polyolefin layers is preferably 0.40 to 1.0 g/ml, more preferably 0.50 to 0.70 g/ml.

Preferable embodiments in the present invention include a sandwich-structured unit having a polypropylene surface coating layer containing titanium oxide and containing no micropore, on both sides of a core layer of polypropylene containing no titanium oxide and having micropores. The thickness of the core layer in this sandwich structure is preferably 5 to 150 μm, more preferably 10 to 70 μm, and the thickness of the surface coating layer is preferably 1 to 50 μm, more preferably 3 to 20 μm.

To improve the adhesion between the hydrophilic photographic constitutional layer and the support, a polyolefin layer having no micropore is preferably provided between the polyolefin layer containing micropores and the hydrophilic photographic constitutional layer so that the micropore-free polyolefin layer is adjacent to the hydrophilic photographic constitutional layer. The thickness of the polyolefin layer having no micropore is preferably 0.1 to 5 μm. In a particularly preferable embodiment, the polyolefin layer having micropores is made mainly of polypropylene, and the polyolefin having no micropore is preferably polyethylene. Further, the polyolefin layer having no micropore is subjected more preferably to corona discharge treatment.

It is also preferable that a biaxially oriented polyolefin layer is provided on the support in the side opposite to the emulsion-coated surface, in order to increase the rigidity of the reflective support. The surface of the polyolefin layer on the back surface in this case is preferably a matte-finished polyethylene or polypropylene containing silica. Further, two or more layers of polypropylene can be provided on the back surface, as described in JP-A-11-65024, and the first polyolefin layer can be subjected to printing. The thickness of these polyolefin layers on the back surface is preferably 5 to 100 μm, more preferably 10 to 70 μm.

The support which can be preferably used in the present invention is a polymer support, a synthetic paper support, a cloth support, a woven polymer fiber support, a cellulose fiber paper support, or a laminate thereof. The support is particularly preferably a photographic-grade cellulose fiber paper made of a raw paper with a pH value of 5 to 9, as described in JP-A-6-167771.

To meet consumer's requests, its thickness and rigidity are preferably regulated. For example, for these purposes, a laminate support having a biaxially oriented sheet having a Young's modulus of elasticity of 690 MPa to 5520 MPa in the longitudinal direction and a Young's modulus of elasticity of 690 MPa to 5520 MPa in the transverse direction is made on both sides of a paper support having a Young's modulus of elasticity of 2800 MPa to 13000 MPa in the longitudinal direction and a Young's modulus of elasticity of 1400 MPa to 7000 MPa, thereby a bending rigidity of 150 to 250 mN can be achieved with a thickness of about 0.18 mm to 0.28 mm.

Preferable embodiments of the support in the present invention described above include examples described in JP-A-10-333277, JP-A-10-333278, JP-A-11-52513, JP-A-11-65024, EP-0880065A1, EP-0880066A1, U.S. Pat. No. 5,888,681, U.S. Pat. No. 5,888,714 and U.K. Patent No. 2325749.

Another embodiment of the reflective support which can be used in the silver halide color photographic light-sensitive material according to the present invention is described below.

This reflective support is a reflective support prepared by coating the surface of a substrate (preferably a raw paper) in at least the emulsion-coated side (an image-recording side), with a composition having a white pigment mixed and dispersed in a resin containing at least 50 wt % of a polyester. This polyester is a polyester synthesized by polycondensation of a dicarboxylic acid with a diol. Examples of the preferable dicarboxylic acid include terephthalic acid, isophthalic acid, naphthalene dicarboxylic acid, and the like. Examples of the preferable diol include ethylene glycol, butylene glycol, neopentyl glycol, triethylene glycol, butanediol, hexylene glycol, bisphenol A ethylene oxide adduct (2,2-bis(4-(2-hydroxyethyloxy)phenyl)propane, 1,4-dihydroxymethylcyclohexane, and the like.

In this case, various polyesters obtained by polycondensation between a single dicarboxylic acid or a mixture of dicarboxylic acids and a single diol or a mixture of diols can be used. In particular, at least one of dicarboxylic acids is preferably terephthalic acid. Further, as the dicarboxylic acid component, a mixture of terephthalic acid and isophthalic acid (molar ratio of from 9:1 to 2:8) or a mixture of terephthalic acid and naphthalene dicarboxylic acid (molar ratio of from 9:1 to 2:8) is also preferably used. As the diol, use can be preferably made of a mixture of diols containing ethylene glycol or ethylene glycol. The molecular weight of these polymers is preferably 30,000 to 50,000.

Plural kinds of polyesters with different compositions are preferably mixed and used. Further, a mixture of these polyesters with other resin can be preferably used. The other resin to be mixed is a resin which can be extruded at 270 to 350° C., and can be widely selected, for example, from polyolefins, such as polyethylene and polypropylene, polyethers, such as polyethylene glycol, polyoxymethylene and polyoxypropylene, polyester-series polyurethanes, polyether polyurethanes, polycarbonates, and polystyrenes. These resins to be blended may be used alone or in combination of two or more thereof. For example, 6 wt % of polyethylene and 4 wt % of polypropylene can be mixed with 90 wt % of polyethylene terephthalate. The mixing ratio of the polyester to other resin is varied depending on the type of resin to be mixed, and the ratio by weight for polyolefins is preferably that polyester/other resin is 100/0 to 80/20. A ratio outside this range may cause a rapid reduction in the physical properties of the mixed resin. A resin other than polyolefin can be mixed in such a range that the ratio of polyester/other resin is in the range of 100/0 to 50/50 by weight. If polyester is less than 50% by weight, the effect of the present invention cannot be sufficiently exhibited.

As a white pigment to be mixed and dispersed in polyester in the reflective support for use in the present invention, mention can be made of, for example, inorganic pigments, such as titanium oxide, barium sulfate, lithopone, aluminum oxide, calcium carbonate, silicon oxide, antimony trioxide, titanium phosphate, zinc oxide, white lead and zirconium oxide, and organic fine powder, for example, of polystyrene or styrene/divinyl benzene copolymer. Among these pigments, use of titanium dioxide is particularly effective. Titanium dioxide may be any of rutile and anatase and may be produced by any of a sulfate method and a chloride method. Specific examples of commercially available products include KA-10 and KA-20 (trade names, manufactured by Titan Kogyo K. K.), and A-220 (trade name, manufactured by Ishihara Sangyo Kaisha, Ltd.).

The average particle diameter of the white pigment to be used is preferably 0.1 to 0.8 μm. If it is less than 0.1 μm, the pigment may be hardly mixed and dispersed uniformly in the resin. If it exceeds 0.8 μm, sufficient whiteness may not be obtained, and the coated surface may be protruded to adversely affect image quality. The mixing ratio by weight of the white pigment to the polyester is preferably 98/2 to 30/70 (polyester/white pigment), more preferably 95/5 to 50/50, particularly preferably 90/10 to 60/40. If the white pigment is less than 2% by weight, its contribution to whiteness is not satisfactory, whereas if it exceeds 70% by weight, the smoothness of the surface of the resulting support for photographic printing paper is not satisfactory, and thus a support for photographic printing paper excellent in glossiness may not be obtained. To mix the polyester with the white pigment, they are kneaded into the resin along with a dispersant aid, such as a metal salt of a higher fatty acid, a higher fatty acid ethyl, a higher fatty acid amide, or a higher fatty acid, with a kneader, such as a two-rolls, a three-rolls, a kneader, a Banbury mixer, or the like. An antioxidant can be contained in the resin layer, and its content may be in the range of 50 to 1,000 ppm, to the resin.

In the present invention, the thickness of the polyester/white pigment composition to be coated on the substrate at the side of the emulsion-coated surface, of the reflective support is generally 5 to 100 μm, preferably 5 to 80 μm, and more preferably 10 to 50 μm. If it is thicker than 100 μm, the brittleness of the resin may be emphasized to cause the problem in physical properties such as cracking. A thickness less than 5 μm is not preferable because waterproofness as the original object of the coating is deteriorated, as well as whiteness and surface smoothness cannot be satisfied simultaneously, and the product is physically too soft.

In the respective embodiments described in the item (24) above or items (xviii) to (xx) below, the thickness of the polyester/white pigment composition to be coated on the substrate at the side of the emulsion-coated surface of the reflective support is preferably 25 to 100 μm, more preferably 30 to 80 μm, and further preferably 40 to 75 μm. If it is thicker than 100 μm, the brittleness of the resin may be emphasized to cause the problem in physical properties such as cracking. If the thickness is less than 25 μm, it may become physically too soft.

In the present invention, the thickness of the resin or the resin composition to be coated on the surface of the substrate which is not the side of the emulsion-coated surface is preferably 5 to 100 μm, more preferably 10 to 50 μm. If the thickness is more than this range, the brittleness of the resin may be emphasized to cause the problem of physical properties such as cracking. If the thickness is lower than this range, water-proofing property that is the original object of the coating is deteriorated and the resultant product may become physically too soft. The method of coating a layer on the substrate at the emulsion-coated surface side and on the back surface thereof includes melt-extrusion lamination and the like.

The substrate to be used in the reflective support for use in the present invention is selected from materials generally used in photographic printing paper. That is, mention can be made of materials to be used containing natural pulp selected from needle-leaf trees and broadleaf trees, or synthetic pulp, as the major raw-materials, further containing, if necessary, fillers, such as clay, talc, calcium carbonate and fine grains of urea resin, sizing agents, such as rosin, alkyl ketene dimer, higher fatty acid, epoxylated fatty acid amide, paraffin wax and alkenyl succinic acid, enhancers for paper force, such as starch, polyamide polyamine epichlorohydrin and polyacrylamide, or bonding agents, such as sulfuric acid bond and cationic polymers. In the present invention, the substrate to be used in the reflective support is preferably a raw paper having the natural pulp or synthetic pulp described above as the major raw-materials. The type and thickness of the substrate are not particularly limited, and the weighing amount is preferably 50 to 250 g/m$^2$. For the purpose of imparting smoothness and flatness, the substrate is preferably surface-treated under heating and pressurization by a means, such as a machine calendar and a super calendar.

The above-mentioned "smoothness" is expressed in terms of the surface roughness of the support. The surface roughness of the support in the present invention is described. The surface roughness is expressed in terms of the central-line average surface roughness. The central-line average surface roughness is defined as follows. From the roughness profile (curve), the part of the area SM on the center plane is removed, and rectangular coordinates i.e. X- and Y-axes are placed on the central line in this removed part. When an axis perpendicular to the central line is placed as the Z-axis, the value given by the following equation is defined as the central-line average surface roughness (SRa), which is expressed in the unit of μm.

$$SRa = \frac{1}{SM}\int_0^{Lx}\int_0^{Ly}|f(X, y)|dX \cdot dY$$

The values of the central-line average surface roughness and the height of protrusion from the central line can be determined by measuring an area of 5 mm$^2$, with a cut-off value of 0.8 mm with a diamond needle of 4 μm in diameter at a magnification of ×20 in the horizontal direction and at a magnification of ×2000 in the height direction, by using e.g. a three-dimensional surface roughness meter (SE-30H), produced by Kosaka Laboratory, Ltd. In this case, the feed rate of the measuring needle is preferably about 0.5 mm/sec. The support is preferably one having a value of 0.15 μm or less, more preferably 0.10 μm or less, which value is obtained in this measurement. By use of the support having such surface roughness (smoothness), a color print having a surface excellent in smoothness can be obtained.

For coating the substrate with the above composition of a mixture of polyester/white pigment, the surface of the substrate is preferably subjected to pre-treatment such as corona discharge treatment, flame treatment, or undercoating.

When polyester such as polyethylene terephthalate is used, the adhesion to the photographic emulsion is lower than polyethylene. Accordingly, it is preferable that the polyester is melt-extruded into a laminate on the substrate, and the surface of the polyester is subjected to corona discharge treatment, and then a hydrophilic colloidal layer is coated thereon. Further, it is also preferable to coat an undercoating solution containing a compound represented by the following formula [U] on the surface of thermoplastic resin which is composed of a polyester as a main component.

formula (U)

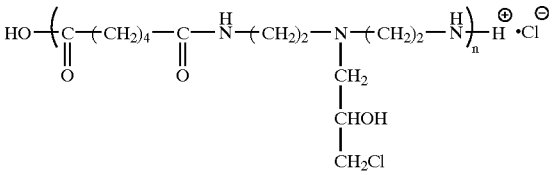

wherein n is an integer of 1 to 7.

The amount of the compound of formula [U] to be coated is preferably 0.1 mg/m$^2$ or more, more preferably 1 mg/m$^2$ or more, and most preferably 3 mg/m$^2$ or more, and a larger amount can lead to higher adhesion, but use thereof in an excess amount is disadvantageous in respect of costs. Further, it is preferable to add an alcohol such as methanol in order to improve coating suitability of the undercoating solution on the surface of the resin. In this case, the proportion of alcohol is preferably 20 wt % or more, more preferably 40 wt % or more, and most preferably 60 wt % or more. Further, in order to further improve the coating suitability, various surface-active agents, such as anionic, cationic, amphoteric, nonionic, fluorocarbon-series and organosilane-series surface-active agents are preferably used.

To obtain a good state of the undercoating surface, a water-soluble polymer such as gelatin is preferably added. In consideration of the stability of the compound of formula [U], the pH of the solution is preferably pH 4 to 11, more preferably pH 5 to 10. Before application of the above undercoating solution, the surface of thermoplastic resin is preferably subjected to surface treatment. As the surface treatment, corona discharge treatment, flame treatment, plasma treatment or the like can be used. The undercoating solution can be coated in a generally widely known coating method by use of, such as a gravure coater, a bar coater, a dip coating, an air knife coating, a curtain coating, a roller coating, a doctor coating and an extrusion coating. The rate of drying of the coating is preferably 30 to 100° C., more preferably 50 to 100° C. and most preferably 70 to 100° C., and the upper limit is determined from the heat resistance of the resin and the lower limit from production efficiency.

In the present invention, the rigidity of the support refers to a value measured in a method described in JIS P-8125 by a Taber rigidity meter, provided that the rigidity of the support is a value measured after removal of the photographic constitutional layer(s) coated, or before coating of the photographic constitutional layer(s). In the present invention, the rigidity is measured in two directions i.e. a paper-making direction and a direction perpendicular to the paper-making direction, and the smaller rigidity is preferably 9.0 g·cm or more. The smaller rigidity is preferably in the range of 9.0 to 30 g·cm, more preferably 11 to 25 g·cm, and most preferably 15 to 20 g·cm. In the present invention, the smaller the ratio of the larger rigidity to the smaller rigidity between the paper-making direction and the direction perpendicular to the paper-making direction is, the more preferable it is; and the ratio is preferably 3 or less, most preferably 2 or less.

The shape of the corners of the silver halide photographic light-sensitive material or photographic print in the present invention is generally rectangular (90°), but this portion may be rounded.

In a preferable embodiment of the present invention, the shape of the photographic print or silver halide photographic light-sensitive material is preferably square or rectangular wherein each of the 4 corners is made an arc with a radius of 1 to 20 mm with the center placed in the rectangular or square shape and a central angle of 90° or less, but it may not be a perfect arc. For example, it may be a part of an ellipse or a part of a polygon similar to the above-described arc, and such shapes are included in the arc in the present invention insofar as their purposes are to substantially round the corner. The radius thereof is preferably in the range of 2 to 15 mm, most preferably 3 to 10 mm.

The shape of the corners may be formed by cutting at any stage just after coating of the light-sensitive material until printing or thereafter.

The cutting means to be used for rounding the shape of the corners preferably uses a cutter whose blade in contact with the corners is in the shape of an arc, but it may be a system where the blade moves in a circular motion.

The couplers which can be used in the present invention are described in e.g. JP-A-62-215272, JP-A-2-33144 and EP355660A. Further, as the cyan coupler, preferably use can be made of diphenylimidazole-series cyan couplers as described in JP-A-2-33144; as well as 3-hydroxypyridine-series cyan couplers (among the specific examples mentioned therein, particularly preferably couplers (6) and (9) or a two-equivalent coupler made from a four-equivalent coupler (42) by making it to have a chorine split-off group) as described in European Patent EP0333185A2; cyclic active-methylene-series cyan couplers (among the specific examples mentioned therein, particularly preferably coupler examples 3, 8 and 34) as described in JP-A-64-32260; pyroropyrazole-type cyan couplers described in European Patent EP0456226A1; pyroroimidazole-type cyan couplers described in European Patent EP0484909; and pyrorotriazole-type cyan couplers described in European Patents EP0488248 and EP0491197A1. Among these, use of the pyrorotriazole-type cyan couplers is particularly preferable.

In addition to the compounds described in the known literatures described above, as the yellow coupler, use can be preferably made of acylacetamide-type yellow couplers having a 3- to 5-membered cyclic structure on an acyl group, as described in European Patent EP0447969A1; malone dianilide-type yellow couplers having a cyclic structure, as described in European Patent EP0482552A1; and acylacetamide-type yellow couplers having a dioxane structure, as described in U.S. Pat. No. 5,118,599. In particular, it is particularly preferable to use the acylacetamide-type yellow couplers wherein the acyl group is a 1-alkylcyclopropane-1-carbonyl group, or the malone dianilide-type yellow couplers wherein one of the anilides constitutes an indoline ring. These couplers can be used alone or in combination.

5-Pyrazone-series magenta couplers or pyrazoloazole-series magenta couplers as described in the known literatures mentioned above are used as the magenta coupler for use in the present invention. Among these, from the viewpoint of hue, image stability and color-forming property, it is preferable to use: a pyrazolotriazole coupler whose secondary or tertiary alkyl group is directly bound to the 2-, 3- or 6-position in the pyrazolotriazole ring, as described in JP-A-61-65245; a pyrazoloazole coupler having a sulfonamide group in the molecule, as described in JP-A-61-65246; a pyrazoloazole coupler having an alkoxyphenylsulfonamido ballasting group, as described in JP-A-61-147254; and a pyrazoloazole coupler having an alkoxy group or an aryloxy group at the 6-position, as described in European Patent Nos. 226,849A and 294,785A.

The cyan coupler represented by formula (III) that is preferably used in the present invention is described.

Herein, the Hammett's substituent constant σp value used in the specification and claims is described to some extent. The Hammett rule is an empirical rule proposed by L. P. Hammett in 1935 to discuss quantitatively the influence of substituents on the reaction or equilibrium of benzene derivatives, and its validity is approved widely nowadays. The substituent constant determined with the Hammett rule includes σp value and σm value, and these values can be found in many general literatures. For example, such values are detailed in e.g. "Lange's Handbook of Chemistry", 12 th edition, 1979, edited by J. A. Dean (McGraw-Hill) and "Kagaku No Ryoiki" (Region of Chemistry), extra edition, No. 122, pp. 96–103, 1979 (Nankodo). In the present invention, each substituent is limited and described in terms of the Hammett substituent constant σp, but this does not mean that the substituent is limited to those having a value known in the literatures, which can be found in the above literatures; it is needless to say that even if the value is unknown in any literature, substituents which can have the value in the range if measured according to the Hammett rule are also included in the present invention. Although the compound represented by formula (III) is not a benzene derivative, but the op value is used as a measure for indicating the electron effect of a substituent on it, regardless of the position of the substituent. In the present invention, the op value is used hereinafter in this meaning. The "lipophilicity" referred to in the present invention indicates 10% or less solubility in water at room temperature.

In the present specification, the aliphatic group may be straight-chain, branched or cyclic, saturated or unsaturated, and represents e.g. alkyl, alkenyl, alkynyl, cycloalkyl or cycloalkenyl, which may further have a substituent. The aromatic group represents aryl which may further have a substituent. The heterocycle (hetero-ring) has a heteroatom in the ring, including aromatic groups, and it may further have a substituent. Unless otherwise specified, the substituent in the present specification and the substituent with which the aliphatic group, aromatic group and heterocyclic group may be further substituted may be any group which can substitute, and examples thereof include an aliphatic group, aromatic group, heterocyclic group, acyl group, acyloxy group, acylamino group, aliphatic oxy group, aromatic oxy group, heterocyclic oxy group, aliphatic oxycarbonyl group, aromatic oxycarbonyl group, heterocyclic oxycarbonyl group, aliphatic carbamoyl group, aromatic carbamoyl group, aliphatic sulfonyl group, aromatic sulfonyl group, aliphatic sulfamoyl group, aromatic sulfamoyl group, aliphatic sulfonamido group, aromatic sulfonamido group, aliphatic amino group, aromatic amino group, aliphatic sulfinyl group, aromatic sulfinyl group, aliphatic thio group, aromatic thio group, mercapto group, hydroxyl group, cyano group, nitro group, hydroxyamino group, halogen atom, and the like.

The cyan coupler represented by the formula (III) that can be used preferably in the present invention is described in detail.

$Z^a$ and $Z^b$ each represent —C($R^{3c}$)= or —N=, provided that one of $Z^a$ and $Z^b$ is —N= and the other is —($R^{3c}$)=.

$R^{3c}$ represents a hydrogen atom or a substituent, and examples of the substituent includes a halogen atom, alkyl group, aryl group, heterocyclic group, cyano group, hydroxyl group, nitro group, carboxy group, sulfo group, amino group, alkoxy group, aryloxy group, acylamino group, alkylamino group, anilino group, ureido group, sulfamoyl amino group, alkyl thio group, aryl thio group, alkoxycarbonyl amino group, sulfonamido group, carbamoyl group, sulfamoyl group, sulfonyl group, alkoxycarbonyl group, heterocyclic oxy group, azo group, acyloxy group, carbamoyloxy group, silyloxy group, aryloxycarbonyl amino group, imido group, heterocyclic thio group, sulfinyl group, phosphonyl group, aryloxycarbonyl group, acyl group, and the like. These groups may be further substituted with a substituent exemplified for $R^{3c}$.

More specifically $R^{3c}$ represents a hydrogen atom, halogen atom (e.g., chlorine atom and bromine atom), alkyl group (e.g., straight-chain or branched alkyl group, aralkyl group, alkenyl group, alkynyl group, cycloalkyl group and cycloalkenyl group having 1 to 32 carbon atoms, specifically such as methyl, ethyl, propyl, isopropyl, t-butyl, tridecyl, 2-methanesulfonylethyl, 3-(3-pentadecylphenoxy)propyl, 3-{4-{2-[4-(4-hydroxyphenylsulfonyl)phenoxy] dodecanamido}phenyl}propyl, 2-ethoxytridecyl, trifluoromethyl, cyclopentyl and 3-(2,4-di-t-amylphenoxy)propyl), aryl group (e.g., phenyl, 4-t-butylphenyl, 2,4-di-t-amylphenyl and 4-tetradecanamidophenyl), heterocyclic group (e.g., imidazolyl, pyrazolyl, triazolyl, 2-furyl, 2-thienyl, 2-pyrimidinyl and 2-benzothiazolyl), cyano group, hydroxyl group, nitro group, carboxy group, amino group, alkoxy group (e.g., methoxy, ethoxy, 2-methoxyethoxy, 2-dodecylethoxy and 2-methanesulfonylethoxy), aryloxy group (e.g., phenoxy, 2-methylphenoxy, 4-t-butylphenoxy, 3-nitrophenoxy, 3-t-butyloxycarbamoylphenoxy and 3 -methoxycarbamoyl), acylamino group (e.g., acetamido, benzamido, tetradecanamido, 2-(2,4-di-t-amylphenoxy)butanamido, 4-(3-t-butyl-4-hydroxyphenoxy)butanamido, 2-{4-(4-hydroxyphenylsulfonyl)phenoxy}decanamido), alkylamino group (e.g., methylamino, butylamino, dodecylamino, diethylamido and methylbutylamido), anilino group (e.g., phenylamino, 2-chloroanilino, 2-chloro-5-tetradecaneaminoanilino, 2-chloro-5-dodecyloxycarbonylanilino, N-acetylanilino and 2-chloro-5{2-(3-t-butyl-4-hydroxyphenoxy)dodecanamido}anilino), ureido group (e.g., phenylureido, methylureido and N,N-dibutylureido), sulfamoyl amino group (e.g., N,N-dipropylsulfamoyl amino and N-methyl-N-decylsulfamoyl amino), alkyl thio group (e.g., methyl thio, octyl thio, tetradecyl thio, 2-phenoxyethyl thio, 3-phenoxypropyl thio and 3-(4-t-butylphenoxy)propylthio), aryl thio group (e.g., phenyl thio, 2-butoxy-5-t-octyl phenyl thio, 3-pentadecyl phenyl thio, 2-carboxyphenyl thio and 4-tetradecanamidophenyl thio), alkoxycarbonyl amino group (e.g., methoxycarbonyl amino and tetradecyloxycarbonyl amino), sulfonamido group (e.g., methanesulfonamido, hexadecanesulfonamido, benzenesulfonamido, p-toluenesulfonamido, octadecanesulfonamido and 2-methoxy-5-t-butylbenzenesulfonamido), carbamoyl group (e.g., N-ethylcarbamoyl, N,N-dibutylcarbamoyl, N-(2-dodecyloxyethyl) carbamoyl, N-methyl-N-dodecylcarbamoyl and N-{3-(2,4-di-t-amylphenoxy) propyl} carbamoyl), sulfamoyl group (e.g., N-ethylsulfamoyl, N,N-dipropylsulfamoyl, N-(2-dodecyloxyethyl) sulfamoyl, N-ethyl-N-dodecylsulfamoyl and N,N-diethylsulfamoyl), sulfonyl group (e.g., methane sulfonyl, octane sulfonyl, benzene sulfonyl and toluene sulfonyl), alkoxycarbonyl group (e.g., methoxycarbonyl, butyloxycarbonyl, dodecyloxycarbonyl and octadecyloxycarbonyl), heterocyclic oxy group (e.g., 1-phenyltetrazole-5-oxy and 2-tetrahydropyranyloxy), azo group (e.g., phenylazo, 4-methoxyphenylazo, 4-pivaloylaminophenylazo and 2-hydroxy-4-propanoylphenylazo), acyloxy group (e.g., acetoxy), carbamoyloxy group (e.g., N-methyl carbamoyloxy and N-phenyl carbamoyloxy), silyloxy group (e.g., trimethyl silyloxy and dibutylmethyl silyloxy), aryloxycarbonyl amino group (e.g., phenoxycarbonyl amino), imido group (e.g., N-succinimido, N-phthalimido and 3-octadecenylsuccinimido), heterocyclic thio group (e.g., 2-benzothioazolylthio, 2,4-di-phenoxy-1,3,5-triazole-6-thio and 2-pyridylthio), sulfinyl group (e.g., dodecane sulfinyl, 3-pentadecyl phenyl sulfinyl and 3-phenoxy propyl sulfinyl), phosphonyl group (e.g., phenoxy phosphonyl, octyloxy phosphonyl and phenyl phosphonyl), aryloxycarbonyl group (e.g., phenoxycarbonyl) and acyl group (e.g., acetyl, 3-phenylpropanoyl, benzoyl and 4-dodecyloxybenzoyl).

Preferable examples of $R^{3c}$ include an alkyl group, aryl group, heterocyclic group, cyano group, nitro group, acylamino group, anilino group, ureido group, sulfamoyl amino group, alkyl thio group, aryl thio group, alkoxycarbonyl amido group, sulfonamido group, carbamoyl group, sulfamoyl group, sulfonyl group, alkoxycarbonyl group, heterocyclic oxy group, acyloxy group, carbamoyloxy group, aryloxycarbonyl amino group, imido group, heterocyclic thio group, sulfinyl group, phosphonyl group, aryloxycarbonyl group and acyl group.

More preferably, $R^{3c}$ is an alkyl group or aryl group. From the viewpoint of cohesiveness, it is preferably an alkyl group or aryl group having at least one substituent, more preferably an alkyl group or aryl group having at least one alkyl group, alkoxy group, sulfonyl group, sulfamoyl group, carbamoyl group, acylamido group or sulfonamido group as a substituent. It is particularly preferably an alkyl group or aryl group having at least one alkyl group, acylamido group or sulfonamido group as a substituent. If the aryl group has any of these substituents, the substituent is positioned preferably at least at the ortho- or para-position(s).

In the cyan coupler for use in the present invention, $R^{1c}$ and $R^{2c}$ each are an electron-attracting group with a Hammett's substituent constant $\nu_p$ value of 0.20 or more, wherein the sum of the σp values of $R^{1c}$ and $R^{2c}$ is 0.65 or more so that the cyan coupler can form a color as a cyan image. The sum of the σp values of $R^{1c}$ and $R^{2c}$ is preferably 0.70 or more, and the upper limit is about 2.0.

$R^{1c}$ and $R^{2c}$ are an electron-attracting group with a Hammett's substituent constant op value of 0.20 or more. Preferably, they are an electron-attracting group with the value of 0.30 or more. They are an electron-attracting group with an upper limit of the value of 1.0 or less.

Specific examples of the electron-attracting group $R^{1c}$ and $R^{2c}$ wherein the op value is 0.20 or more, include an acyl group, acyloxy group, carbamoyl group, alkoxycarbonyl group, aryloxy carbonyl group, cyano group, nitro group, dialkyl phosphono group, diaryl phosphono group, diaryl phosphinyl group, alkyl sulfinyl group, aryl sulfinyl group, alkyl sulfonyl group, aryl sulfonyl group, sulfonyloxy group, acyl thio group, sulfamoyl group, thiocyanate group, thiocarbonyl group, halogenated alkyl group, halogenated alkoxy group, halogenated aryloxy group, halogenated alkylamino group, halogenated alkyl thio group, an aryl group substituted with another electron-attracting group with a op value of 0.20 or more, a heterocyclic group, halogen atom, azo group, and selenocyanate group. Among these substituents, those which can further have a substituent may have the substituent mentioned for $R^{3c}$.

More specifically, the electron-attracting group $R^{1c}$ and $R^{2c}$ wherein the op value is 0.20 or more each represent an acyl group (e.g., acetyl, 3-phenylpropanoyl, benzoyl and 4-dodecyloxybenzoyl), acyloxy group (e.g., acetoxy), carbamoyl group (e.g., carbamoyl, N-ethylcarbamoyl, N-phenylcarbamoyl,N,N-dibutylcarbamoyl, N-(2-dodecyloxyethyl) carbamoyl, N-(4-n-pentadecanamido) phenylcarbamoyl, N-methyl-N-dodecylcarbamoyl and N-{3-(2,4-di-t-amylphenoxy) propyl} carbamoyl), alkoxycarbonyl group (e.g., methoxycarbamoyl, ethoxycarbonyl, iso-propyloxycarbonyl, tert-butyloxycarbonyl, isobutyloxycarbonyl, butyloxycarbonyl, dodecyloxycarbonyl and octadecyloxycarbonyl), aryloxycarbonyl group (e.g., phenoxycarbonyl), cyano group, nitro group, dialkyl phosphono group (e.g., dimethyl phosphono), diaryl phosphono group (e.g., diphenyl phosphono), diaryl phosphinyl group (e.g., diphenyl phosphinyl), alkyl sulfinyl group (e.g., 3-phenoxypropyl sulfinyl), aryl sulfinyl group (e.g., 3-pentadecyl phenyl sulfinyl), alkyl sulfonyl group (e.g., methane sulfonyl and octane sulfonyl), aryl sulfonyl group (e.g., benzene sulfonyl and toluene sulfonyl), sulfonyloxy group (methane sulfonyloxy and toluene sulfonyloxy), acyl thio group (e.g., acetyl thio and benzoyl thio), sulfamoyl group (e.g., N-ethyl sulfamoyl, N,N-dipropyl sulfamoyl, N-(2-dodecyloxyethyl) sulfamoyl, N-ethyl-N-dodecyl sulfamoyl and N,N-diethyl sulfamoyl), thiocyanate group, thiocarbonyl group (e.g., methyl thiocarbonyl and phenyl thiocarbonyl), halogenated alkyl group (e.g., trichloromethane and heptachloropropane), halogenated alkoxy group (e.g., trichloromethyloxy), halogenated aryloxy group (e.g., pentachlorophenyloxy), halogenated alkylamino group (e.g., N,N-di-(trichloromethyl) amino), halogenated alkyl thio group (e.g., dichloromethyl thio and 1,1,2,2-tetrachloroethyl thio), aryl group substituted with another electron-attracting group with a op of 0.2 or more (e.g., 2,4-dinitrophenyl, 2,4,6-trichlorophenyl and pentachlorophenyl), heterocyclic group (e.g., 2-benzoxazolyl, 2-benzothiazolyl, 1-phenyl-2-benzimidazolyl, 5-chloro-1-tetrazolyl and 1-pyrolyl), halogen atom (e.g., chlorine atom and bromine atom), azo group (e.g., phenylazo) or selenocyanate group. Among these substituents, a group which can further have a substituent may further have the substituent mentioned for $R^{3c}$.

Preferable examples of $R^{1c}$ and $R^{2c}$ include an acyl group, acyloxy group, carbamoyl group, alkoxycarbonyl group, aryloxycarbonyl group, cyano group, nitro group, alkyl sulfinyl group, aryl sulfinyl group, alkyl sulfonyl group, aryl sulfonyl group, sulfamoyl group, halogenated alkyl group, halogenated alkyloxy group, halogenated alkyl thio group, halogenated aryloxy group, aryl group substituted with two or more another electron-attracting groups having a op of 0.2 or more, and heterocyclic group. More preferable examples are an alkoxycarbonyl group, nitro group, cyano group aryl sulfonyl group, carbamoyl group and halogenated alkyl group. $R^{1c}$ is most preferably a cyano group. $R^{2c}$ is particularly preferably an alkoxy carbonyl group, most preferably a branched alkoxy carbonyl group (particularly cycloalkoxy carbonyl group).

$X^c$ represents a hydrogen atom or a group capable of being split-off upon coupling reaction with an oxidized product of an aromatic primary amine color-developing agent. Specifically, the group capable of being split-off includes a halogen atom, alkoxy group, aryloxy group, acyloxy group, alkyl- or aryl-sulfonyloxy group, acylamino group, alkyl- or aryl-sulfonamido group, alkoxy carbonyloxy group, aryloxycarbonyloxy group, alkyl-, aryl- or heterocyclic-thio group, carbamoyl amino group, carbamoyloxy group, heterocyclic carbonyloxy group, 5- or 6-membered nitrogen-containing heterocyclic group, imido group and aryl azo group, and these groups may be further substituted with a group allowable as the substituent on $R^{3c}$.

More specific examples include a halogen atom (e.g., fluorine atom, chlorine atom and bromine atom), alkoxy group (e.g., ethoxy, dodecyloxy, methoxyethyl carbamoyl methoxy, carboxypropyloxy, methane sulfonyl ethoxy and ethoxy carbonyl methoxy), aryloxy group (e.g., 4-methylphenoxy, 4-chlorophenoxy, 4-methoxyphenoxy, 4-carboxyphenoxy, 3-ethoxycarbonylphenoxy, 3-acetylaminophenoxy and 2-carboxyphenoxy), acyloxy group (e.g., acetoxy, tetradecanoyloxy and benzoyloxy), alkyl- or aryl-sulfonyloxy group (e.g., methane sulfonyloxy and toluene sulfonyl oxy), acylamino group (e.g., dichloroacetylamino and heptafluorobutyrylamino), alkyl- or aryl-sulfonamido group (e.g., methane sulfonyl amino, trifluoromethane sulfonyl amino and p-toluene sulfonyl amino), alkoxy carbonyloxy group (e.g., ethoxy carbonyloxy and benzyloxy carbonyloxy), aryl oxycarbonyloxy group (e.g., phenoxycarbonyloxy), alkyl-, aryl- or heterocyclic-thio group (e.g., dodecyl thio, 1-carboxydodecyl thio, phenyl thio, 2-butoxy-5-t-octylphenyl thio and tetrazolyl thio), carbamoyl amino group (e.g., N-methyl carbamoyl amino and N-phenyl carbamoyl amino), carbamoyloxy group (e.g., N,N-diethyl carbamoyloxy, N-ethyl carbamoyloxy and N-ethyl-N-phenyl carbamoyloxy), heterocyclic carbonyloxy group (e.g., morpholinocarbonyloxy and piperidinocarbonyloxy), 5- or 6-membered nitrogen-containing heterocyclic group (e.g., imidazolyl, pyradolyl, triazolyl, tetrazolyl and 1,2-dihydro-2-oxo-1-pyridyl), imido group (e.g., succinimido and hydantoinyl) and arylazo group (e.g., phenylazo and 4-methoxyphenylazo). In addition to those described above, $X^c$ may be in the form of a bis-type coupler obtained by condensation of four-equivalent couplers with aldehydes or ketones as a split-off group bound via a carbon atom. Further, $X^c$ may contain a photographically useful group such as a development restrainer or a development accelerator.

Preferable $X^c$ is a halogen atom, alkoxy group, aryloxy group, alkyl- or aryl-thio group, alkyloxy carbonyloxy group, aryloxy carbonyloxy group, carbamoyloxy group, heterocyclic carbonyloxy group, and a 5- or 6-membered nitrogen-containing heterocyclic group binding via a nitrogen atom to a coupling active site. More preferable $X^c$ is a halogen atom, alkyl- or aryl-thio group, alkyloxy carbonyloxy group, aryloxy carbonyloxy group, carbamoyloxy group, heterocyclic carbonyloxy group, among which a carbamoyloxy group and heterocyclic carbonyloxy group are particularly preferable.

In the cyan coupler represented by the formula (III), the group $R^{1c}$, $R^{2c}$, $R^{3c}$ or $X^c$ may be a divalent group, to bind to a polymer which is a dimer or more-higher-mer, or a polymer chain, to form a homopolymer or a copolymer. A typical example of the homopolymer or the copolymer to which a polymer chain is bound is a homopolymer or a copolymer of an addition polymer ethylenically unsaturated compound having a group to give the cyan coupler represented by the formula (III). In this case, one or more kinds of a cyan-color-forming repeating unit having a group to give the cyan coupler represented by the formula (III) may be contained in the polymer, or one or more kinds of a non-color-forming ethylene-type monomer may be contained, as a copolymer component, in the copolymer.

The non-color-forming ethylene-type monomer which does not couple with an oxidized product of an aromatic primary amine developing agent includes acrylic acid, α-chloroacrylic acid, α-alkyl acrylic acid (e.g. methacrylic acid), amides or esters derived from these acrylic acids (e.g., acrylamide, methacrylamide, n-butylacrylamide, t-butylacrylamide, diacetonacrylamide, methyl acrylate, ethyl acrylate, n-propyl acrylate, n-butyl acrylate, t-butyl acrylate, iso-butyl acrylate, 2-ethylhexyl acrylate, n-octyl acrylate, lauryl acrylate, methyl methacrylate, ethyl methacrylate, n-butyl methacrylate and β-hydroxymethacrylate), vinyl esters (e.g., vinyl acetate, vinyl propionate and vinyl laurate), acrylonitrile, methacrylonitrile, aromatic vinyl compounds (e.g., styrene and derivatives thereof, such as vinyl toluene, divinyl benzene, vinyl acetophenone and sulfostyrene), itaconic acid, citraconic acid, crotonic acid, vinylidene chloride, vinyl alkyl ethers (e.g., vinyl ethyl ether), maleates, N-vinyl-2-pyrrolidone, N-vinyl pyridine, 2- and 4-vinyl pyridine, and the like.

In particular, acrylates, methacrylates and maleates are preferable. Two or more kinds of non-color-forming ethylene-type monomers can be used in combination. For example, a combination of methyl acrylate and butyl acrylate, butyl acrylate and styrene, butyl methacrylate and methacrylic acid, or methyl acrylate and diacetone acrylamide can be used.

As well-known in the field of polymer coupler, the ethylenically unsaturated monomer to be copolymerized with a vinylic monomer corresponding to the formula (III) can be selected so as to preferably effect the physical properties and/or chemical properties of the copolymer to be formed, for example, solubility, the compatibility of a binder in a photographic colloid composition with e.g. gelatin, its flexibility and thermostability.

In order that the cyan coupler according to the present invention is contained in the silver halide light-sensitive material, preferably in a red light-sensitive silver halide emulsion layer, it is formed preferably as the so-called built-in-type coupler. For this formation, at least one group of $R^{1c}$, $R^{2c}$, $R^{3c}$ and $X^c$ is preferably a so-called ballasting group (preferably containing 10 or more carbon atoms in total), more preferably the group containing 10 to 50 carbon atoms in total. Preferably, the ballasting group is possessed particularly in $R^{3c}$.

The cyan coupler represented by the formula (III) is more preferably a compound having the structure represented by the formula (IV):

formula (IV)

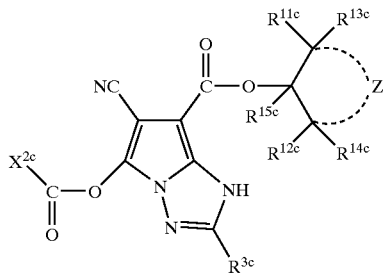

wherein $R^{11c}$, $R^{12c}$, $R^{13c}$, $R^{14c}$ or $R^{14c}$, $R^{15c}$, which may be the same or different, each represent a hydrogen atom or a substituent. The substituent is preferably a substituted or unsubstituted aliphatic group or a substituted or unsubstituted aryl group. More preferable examples are as follows:

$R^{11c}$ and $R^{12c}$ preferably represent an aliphatic group, such as straight-chain, branched or cyclic alkyl group, aralkyl group, alkenyl group, alkynyl group and cycloalkenyl group having 1 to 36 carbon atoms, specifically, for example, methyl, ethyl, propyl, isopropyl, t-butyl, t-amyl, t-octyl, tridecyl, cyclopentyl and cyclohexyl. The number of carbon atoms in the aliphatic group is more preferably 1 to 12. $R^{3c}$, $R^{14c}$ and $R^{15c}$ represent a hydrogen atom or an aliphatic group. The aliphatic group includes the groups mentioned above for $R^{11c}$ and $R^{12c}$, $R^{13c}$, $R^{14c}$ and $R^{15c}$ are particularly preferably a hydrogen atom.

Z represents a group of non-metallic atoms necessary for forming a 5- to 8-membered ring, and this ring may be further substituted, may be a saturated ring or may contain an unsaturated bond. The non-metallic atom is preferably a nitrogen atom, oxygen atom, sulfur atom or carbon atom, more preferably a carbon atom.

The ring formed with Z includes e.g. a cyclopentane ring, cyclohexane ring, cycloheptane ring, cyclooctane ring, cyclohexene ring, piperazine ring, oxane ring, thian ring or the like, and these rings may be further substituted with the above-described substituent represented by $R^{3c}$.

The ring formed with Z is preferably a cyclohexane ring which may be substituted, particularly preferably a cyclohexane ring which is substituted at the 4-position with an alkyl group having 1 to 24 carbon atoms (which may be substituted with a substituent represented by $R^{3c}$ above).

$R^{3c}$ in the formula (IV) has the same meaning as in $R^{3c}$ in the formula (III) and is particularly preferably an alkyl group or aryl group, more preferably a substituted aryl group. The number of carbons is preferably 1 to 36 in the alkyl group and 6 to 36 in the aryl group.

Among the aryl groups, an aryl group which has an alkoxy group substituted at an ortho-position relative to the binding site to the coupler nucleus, is not preferable because the light fastness of the dye derived from the coupler is low.

In this respect, the substituent on the aryl group is preferably a substituted or unsubstituted alkyl group, among which an unsubstituted alkyl group is most preferable. In particular, an unsubstituted alkyl group having 1 to 30 carbon atoms is preferable.

$X^{2c}$ represents a hydrogen atom or a substituent. The substituent is preferably a group accelerating the split-off of the group $X^{2c}$—C(═O)O— at the time of oxidation coupling reaction. $X^{2c}$ is particularly preferably a heterocyclic group, a substituted or unsubstituted amino group or an aryl group. The heterocyclic group is preferably a 5- to 8-membered ring having 1 to 36 carbon atoms and containing a nitrogen atom, an oxygen atom or a sulfur atom. More preferably, it is a 5- or 6-membered ring bound via a nitrogen atom, among which the 6-membered ring is particularly preferable. These rings may form a condensed ring with a benzene ring or heterocycle. Specific examples include imidazole, pyrazole, triazole, lactam compounds, piperidine, pyrrolidine, pyrrole, morpholine, pyrazolidine, thiazolidine, pyrazoline or the like, among which morpholine and piperidine are preferable, and morpholine is particularly preferable.

The substituent on the substituted amino group includes an aliphatic group, aryl group or heterocyclic group. The aliphatic group includes the above-mentioned substituent on $R^{3c}$, and further it may be substituted with a cyano group, alkoxy group (e.g. methoxy), alkoxycarbonyl group (e.g. ethoxycarbonyl), chlorine atom, hydroxyl group and carboxyl group. The substituted amino group is substituted more preferably with two substituents than one substituent. The substituent is preferably an alkyl group.

The aryl group is preferably a group having 6 to 36 carbon atoms, more preferably a monocycle. Specific examples include phenyl, 4-t-butylphenyl, 2-methylphenyl, 2,4,6-trimethylphenyl, 2-methoxyphenyl, 4-methoxyphenyl, 2,6-dichlorophenyl, 2-chlorophenyl and 2,4-dichlorophenyl.

The cyan coupler represented by the formula (IV) that can be preferably used in the present invention preferably has, in its molecule, a group rendering the coupler soluble in oil, and the coupler is easily soluble in a high-boiling organic solvent. This coupler itself, as well as a dye to be formed by oxidation coupling of this coupler with a color-forming reducing agent (a developing agent), are preferably undiffusible in a hydrophilic colloidal layer.

In the coupler represented by the formula (IV), $R^{3c}$ may contain a group to give the coupler represented by the formula (IV), to form a dimer or a more-higher polymer, or $R^{3c}$ may contain a polymer chain, to form a homopolymer or a copolymer. A typical example of the homopolymer or copolymer containing a polymer chain is a homopolymer or copolymer of an addition polymer ethylene-type unsaturated compound having a group to give the coupler represented by the formula (IV). In this case, one or more kinds of a cyan-color-forming repeating unit having a group to give the coupler represented by the formula (IV) may be contained in the polymer, or one or more kinds of a non-color-forming ethylene-type monomer that does not couple with an oxidized product of an aromatic primary amine developing agent, such as an acrylate, methacrylate or maleate, as a copolymer component may be contained in the copolymer.

Hereinafter, specific examples of the cyan coupler defined in the present invention are shown below, but these are not intended to limit the present invention.

(1)

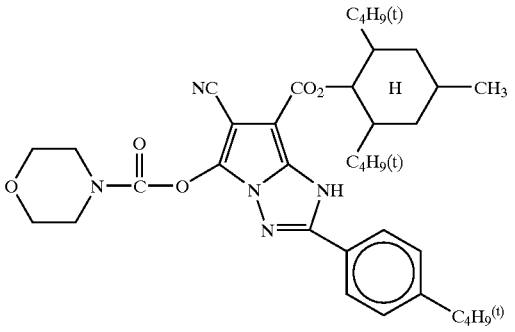

pKa 7.14

(2)

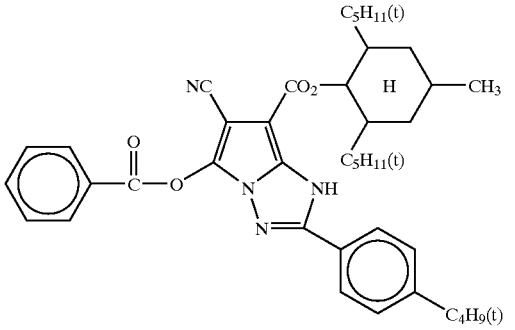

pKa 7.90

-continued
(3)
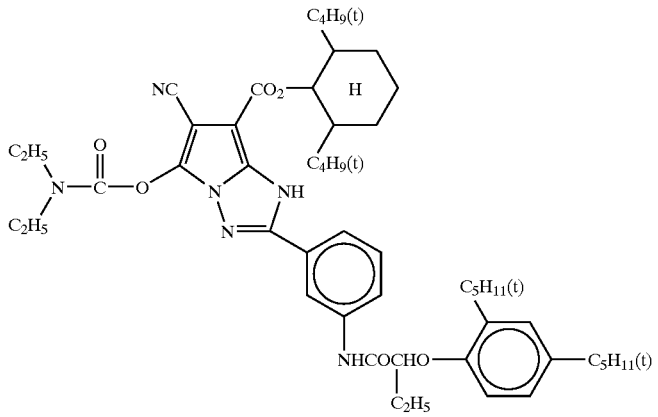
(4)
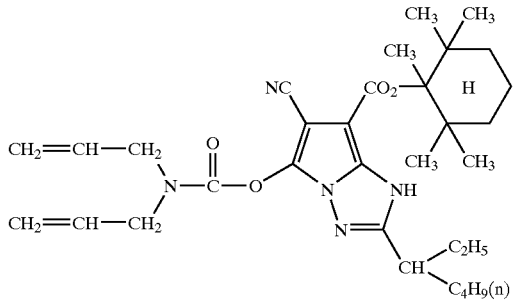
(5)
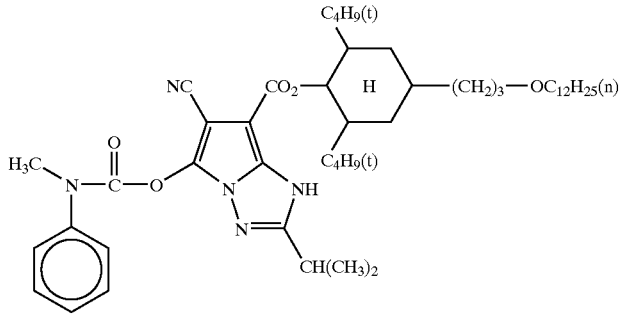
(6)
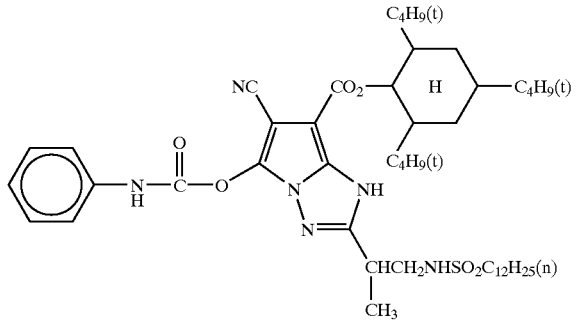

-continued
(7)
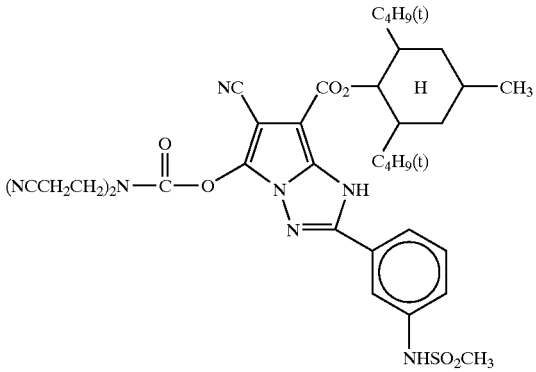
(8)
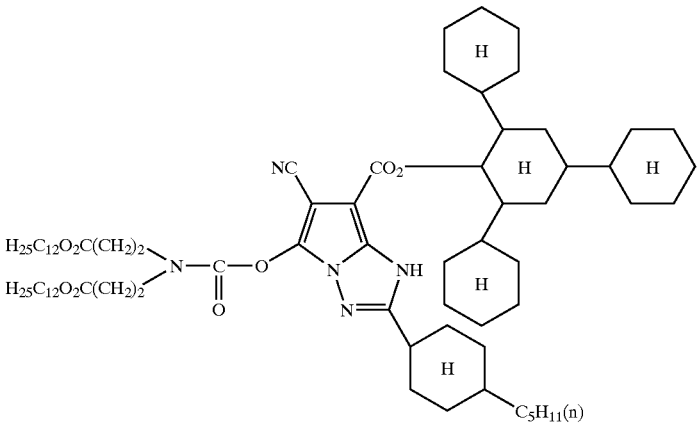
(9)
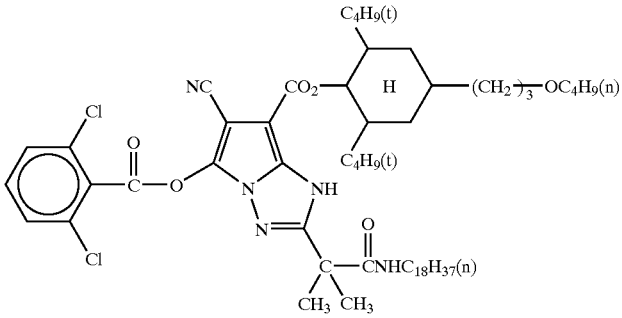
(10)
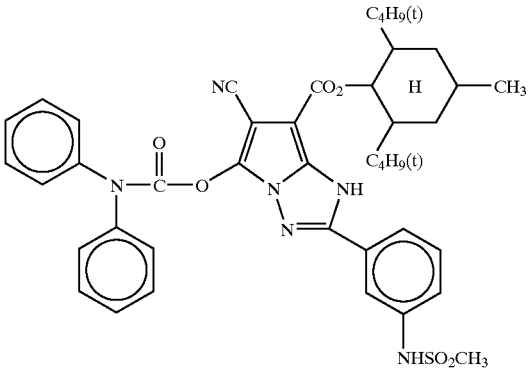

-continued
(11)
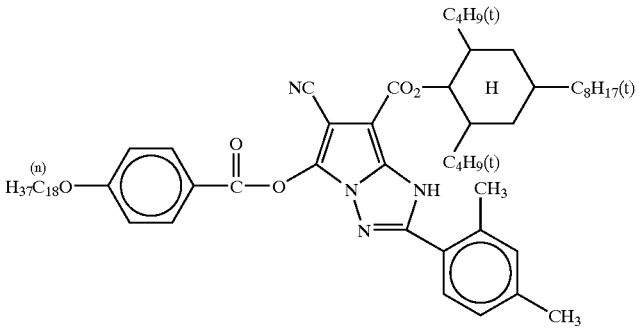
(12)
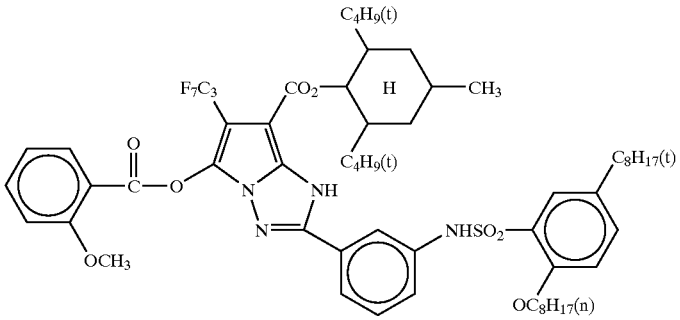
(13)
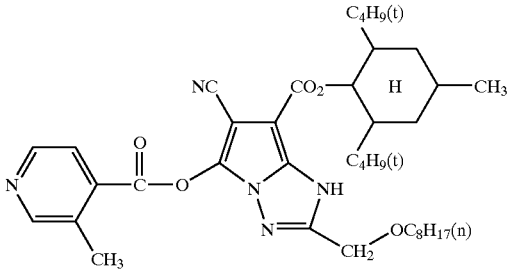
(14)
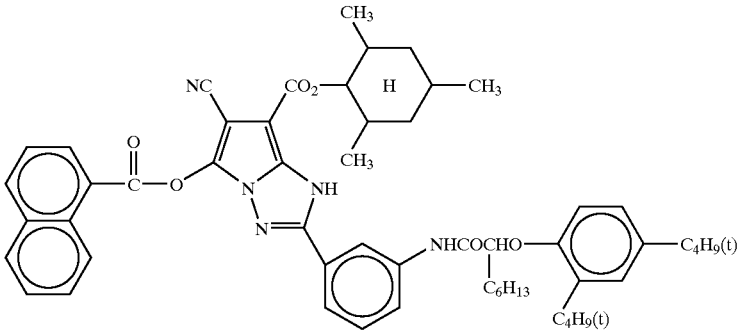
(15)
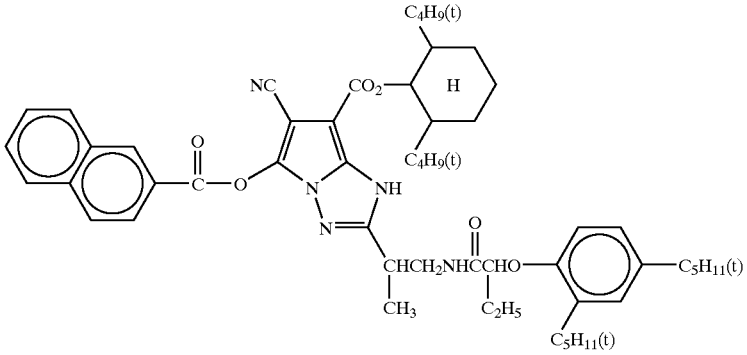

-continued
(16)
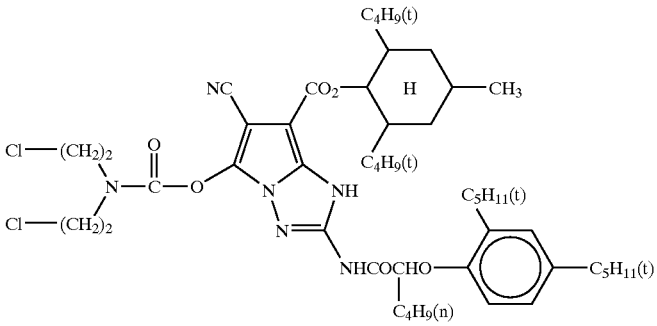
(17)
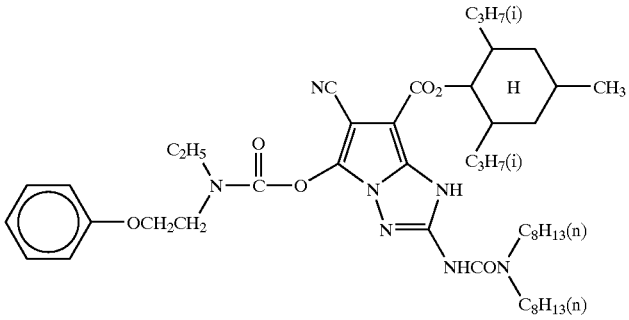
(18)
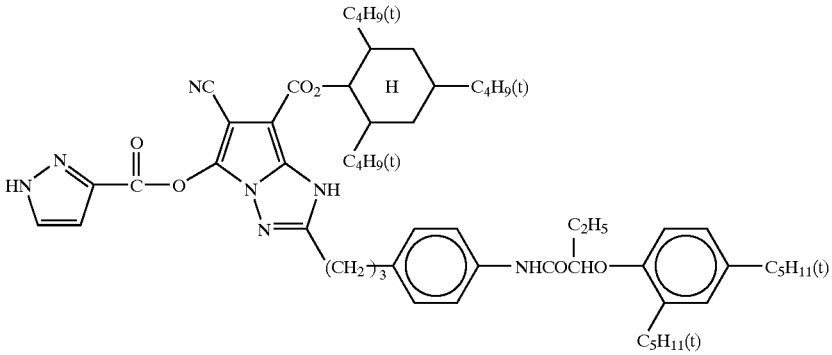
(19)
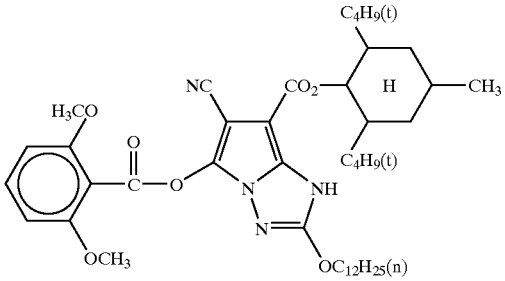
(20)
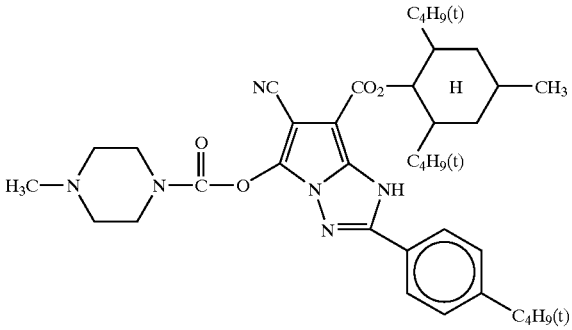

-continued
(21)
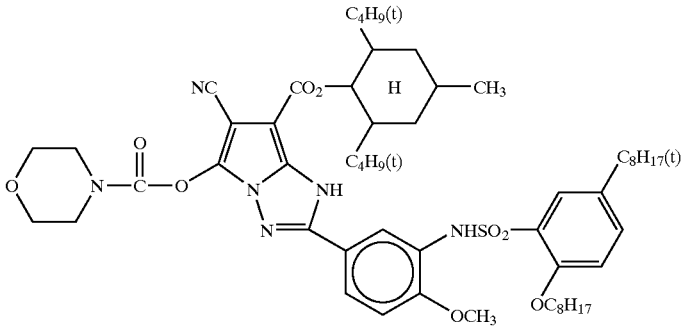
pKa 7.70
(22)
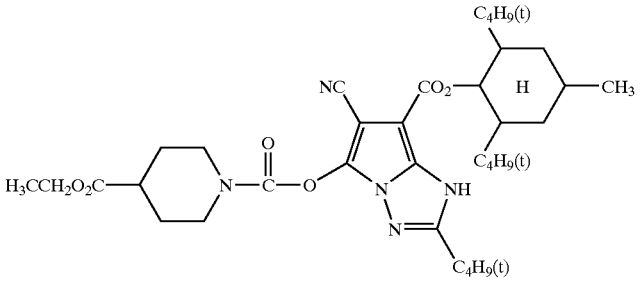
pKa 8.30
(23)
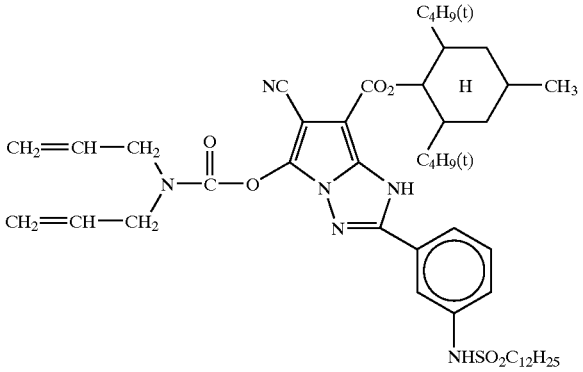
(24)
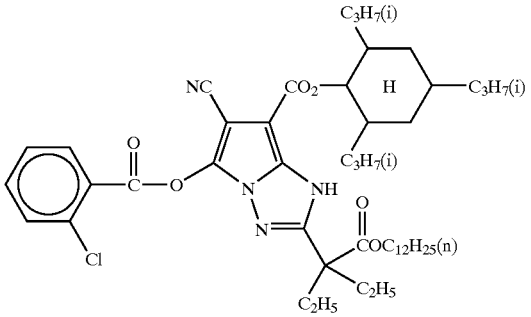

-continued
(25)
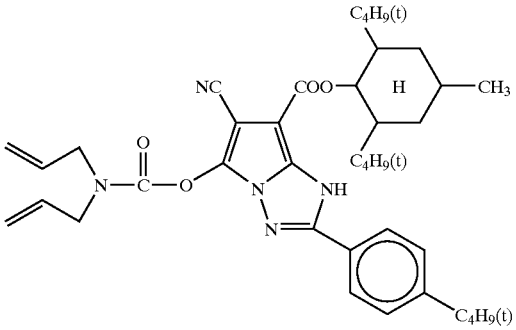
pKa 7.47
(26)
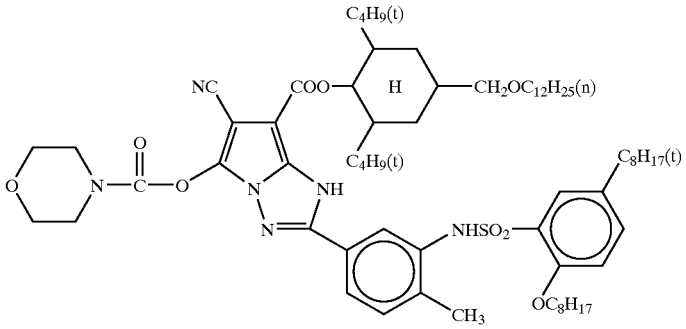
pKa 7.38
(27)
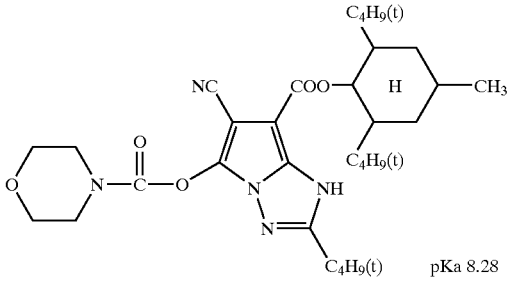
pKa 8.28
(28)
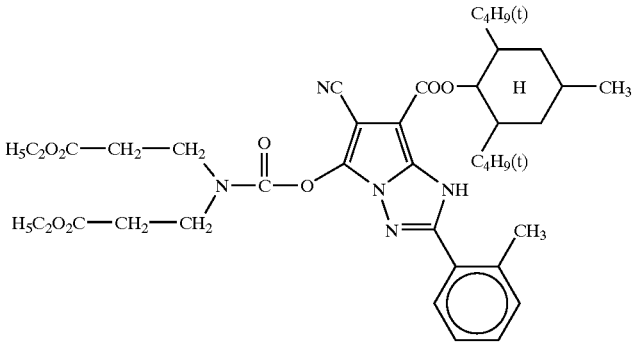

-continued
(29)
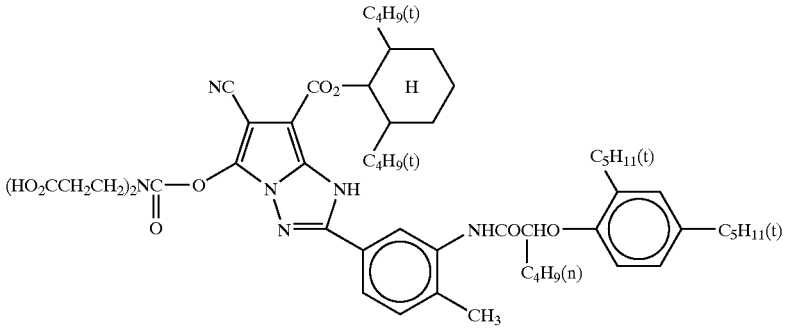
(30)
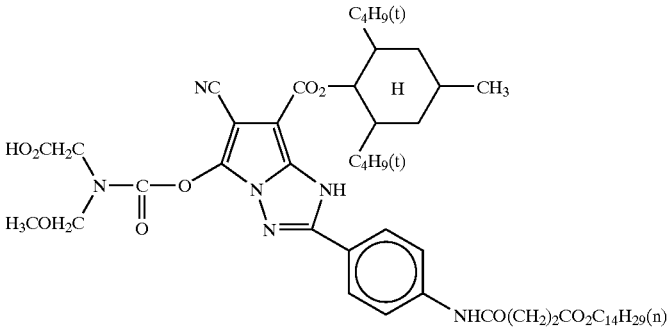
(31)
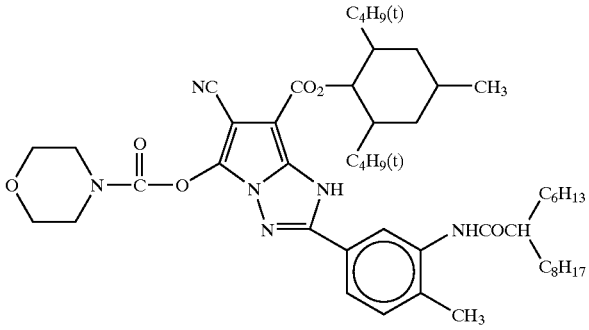
(32)
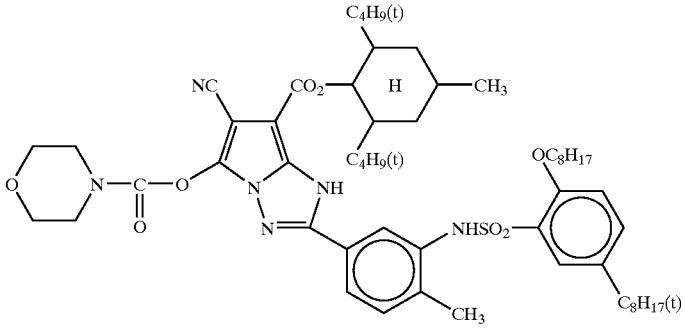
pKa 7.38

-continued
(33)
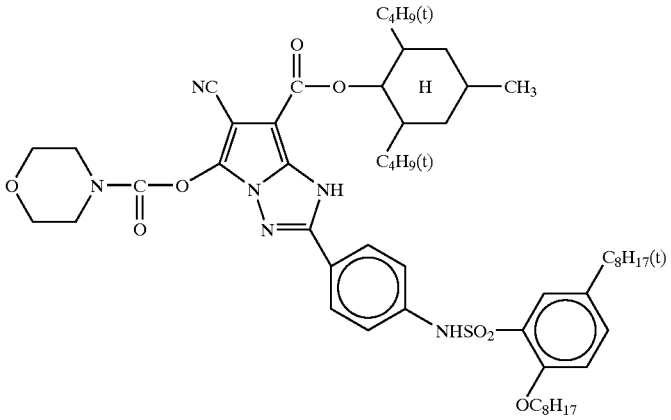
(34)
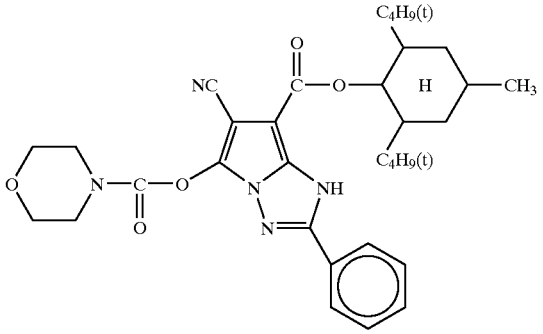
(35)
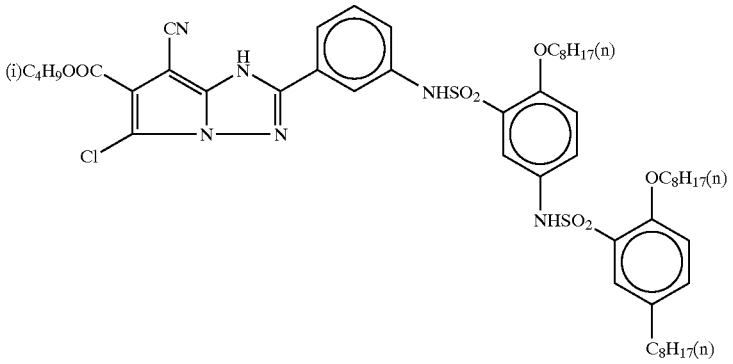
(36)
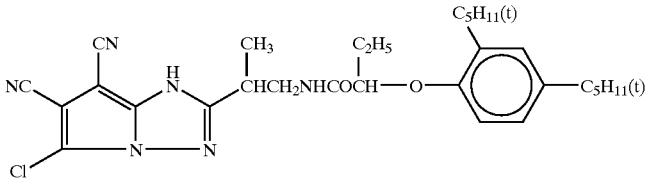

-continued
(37)
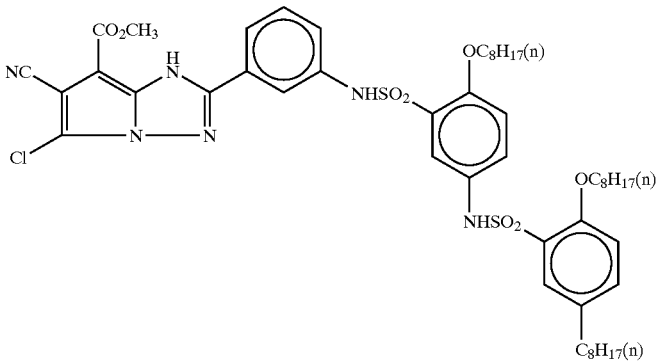
(38)
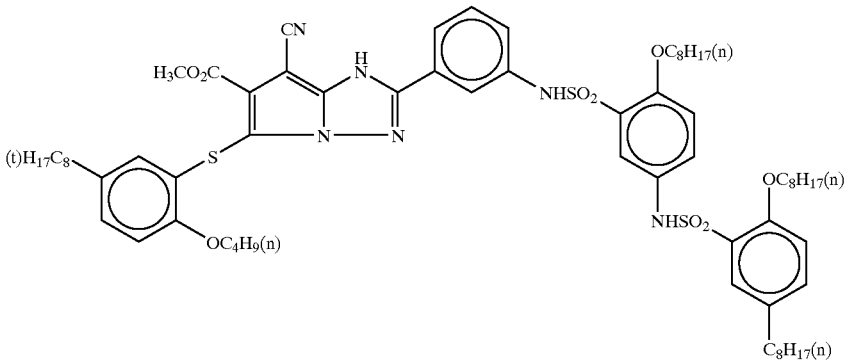
(39)
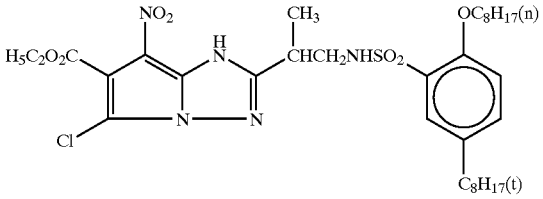
(40)
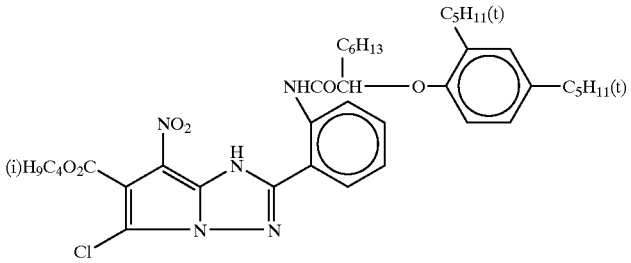
(41)
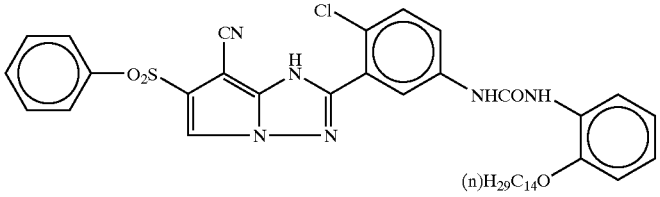
(42)
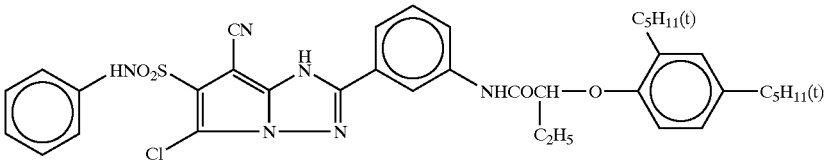

-continued
(43)
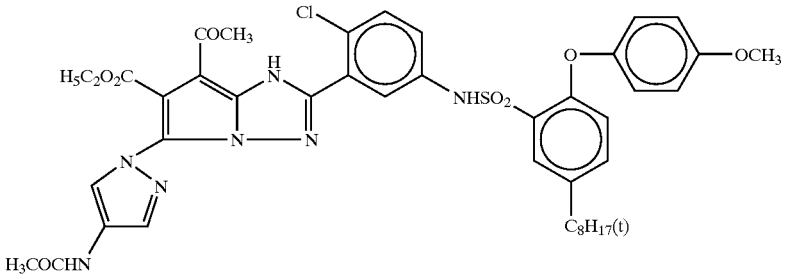
(44)
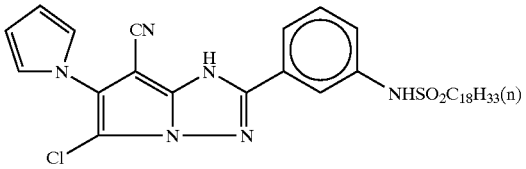
(45)
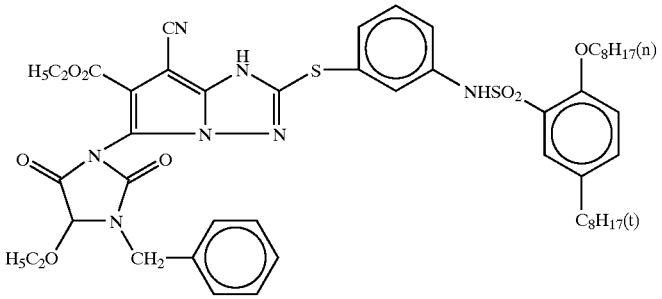
(46)
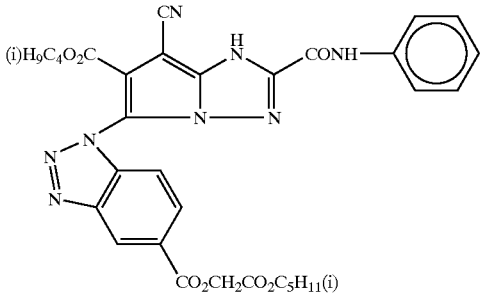
(47)
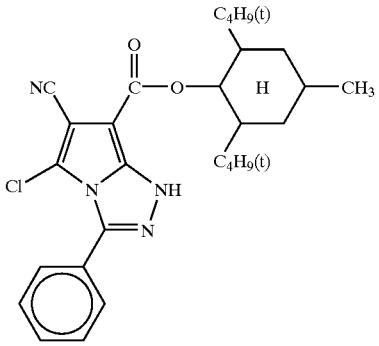

The compounds represented by the formula (III) can be synthesized in known methods such as methods described in JP-A-5-255333, JP-A-5-202004, JP-A-7-48376 and JP-A-8-110623.

Although the amount of the cyan coupler coated is varied depending on the molar absorption coefficient, it is preferably in the range of 0.01 to 1 g/m$^2$, more preferably 0.05 to 0.5 g/m$^2$.

If the cyan coupler to be used is a coupler represented by the formula (IV), its amount is preferably in the range of 0.01 to 0.6 g/m$^2$, further preferably 0.05 to 0.4 g/m$^2$, most preferably 0.1 to 0.3 g/m$^2$.

The ratio in amount of the cyan coupler to the silver halide used is varied depending on the equivalency of the coupler, and when a two-equivalent coupler is used, the Ag/coupler ratio is preferably in the range of 1.5 to 8, and when a four-equivalent coupler is used, the ratio is preferably 3 to 16. In the present invention, the two-equivalent coupler with a low value of pKa is preferable in the present invention, and in this case, the Ag/coupler ratio is preferably in the range of 1.5 to 8, more preferably 2 to 6, further preferably 2.5 to 5.

The cyan coupler represented by the formula (III) is preferably used in combination with a conventionally used phenol-type cyan coupler such as 2-acylamino-5-alkyl-4,6-dichlorophenol-type cyan coupler. In this case, the ratio of the cyan coupler represented by the formula (III) to the total cyan couplers in amount to be used is preferably in the range of 5 to 90 mol %. It is more preferably in the range of 5 to 70 mol %, more preferably 5 to 50 mol %. Further, it is most preferably in the range of 5 to 30 mol %.

Hereinafter, the pyrazolotriazole-type coupler represented by the formula (M) that can be preferably used in the present invention is described in detail.

Za and Zb each represent —C($R_b$)= or —N= provided that one of Za and Zb is —C($R_b$)= and the other is —N=.

$R_a$ and $R_b$ represent a hydrogen atom or a substituent. The substituent includes a halogen atom, aliphatic group, aryl group, heterocyclic group, cyano group, hydroxy group, nitro group, carboxy group, sulfo group, amino group, alkoxy group, aryloxy group, acylamino group, alkylamino group, anilino group, ureido group, sulfamoyl amino group, alkyl thio group, aryl thio group, alkoxycarbonylamino group, sulfonamide group, carbamoyl group, sulfamoyl group, sulfonyl group, alkoxycarbonyl group, heterocyclic oxy group, azo group, acyloxy group, carbamoyloxy group, silyloxy group, aryloxycarbonyl amino group, imido group, heterocyclic thio group, sulfinyl group, phosphonyl group, aryloxycarbonyl group, acyl group and azolyl group, among which those groups which can further have substituents may be substituted with the substituents described above.

More specific examples include a halogen atom (e.g., chlorine atom and bromine atom), aliphatic group (e.g., straight-chain or branched alkyl group, aralkyl group, alkenyl group, alkynyl group, cycloalkyl group and cycloalkenyl group, having 1 to 32 carbon atoms, specifically e.g. methyl, ethyl, propyl, isopropyl, tert-butyl, tridecyl, 2-methane sulfonyl ethyl, 3-(3-pentadecylphenoxy) propyl, 3-{4-{2-[4-(4-hydroxyphenylsulfonyl) phenoxy] dodecanamide} phenyl} propyl, 2-ethoxytridecyl, trifluoromethyl, cyclopentyl and 3-(2,4-di-tert-amylphenoxy) propyl), aryl group (e.g., phenyl, 4-tert-butyl phenyl, 2,4-di-tert-amylphenyl, 2,4,6-trimethyl phenyl, 3-tridecanamide-2,4,6-trimethyl phenyl, 4-tetradecanamide phenyl and tetrafluorophenyl), heterocyclic group (e.g., 2-furyl, 2-thienyl, 2-pyrimidinyl and 2-benzothiazolyl), cyano group, hydroxy group, nitro group, carboxy group, sulfo group, amino group, alkoxy group (e.g., methoxy, ethoxy, 2-methoxyethoxy, 2-dodecylethoxy and 2-methanesulfonylethoxy), aryloxy group (e.g., phenoxy, 2-methyl phenoxy, 4-tert-butyl phenoxy, 3-nitrophenoxy, 3-tert-butoxycarbamoyl phenoxy and 3-methoxycarbamoyl phenoxy), acylamino group (e.g., acetamide, benzamide, tetradecanamide, 2-(2,4-di-tert-amylphenoxy) butanamide, 4-(3-tert-butyl-4-hydroxyphenoxy) butanamide and 2-[4-(4-hydroxyphenylsulfonyl) phenoxy] decanamide), alkylamino group (e.g., methyl amino, butyl amino, dodecyl amino, diethyl amino and methyl butyl amino), anilino group (e.g., phenyl amino, 2-chloroanilino, 2-chloro-5-tetradecane aminoanilino, 2-chloro-5-dodecyloxy carbonyl anilino, N-acetyl anilino and 2-chloro-5-[2-(3-tert-butyl-4-hydroxyphenoxy) dodecanamide] anilino), carbamoyl amino group (e.g., N-phenyl carbamoyl amino, N-methyl carbamoyl amino and N,N-dibutyl carbamoyl amino), sulfamoyl amino group (e.g., N,N-dipropyl sulfamoyl amino and N-methyl-N-decyl sulfamoyl amino), alkyl thio group (e.g., methyl thio, octyl thio, tetradecyl thio, 2-phenoxyethyl thio, 3-phenoxypropyl thio and 3-(4-tert-butylphenoxy) propyl thio), aryl thio group (e.g., phenyl thio, 2-butoxy-5-tert-octyl phenyl thio, 3-pentadecyl phenyl thio, 2-carboxy phenyl thio and 4-tetradecanamide phenyl thio), alkoxycarbonyl amino group (e.g., methoxycarbonyl amino and tetradecyloxycarbonyl amino), sulfonamide group (e.g., methane sulfonamide, hexadecane sulfonamide, benzene sulfonamide, p-toluene sulfonamide, octadecane sulfonamide and 2-methoxy-5-tert-butylbenzene sulfonamide), carbamoyl group (e.g., N-ethyl carbamoyl, N,N-dibutyl carbamoyl, N-(2-dodecyloxyethyl) carbamoyl, N-methyl-N-dodecyl carbamoyl and N-[3-(2,4-di-tert-aminophenoxy) propyl] carbamoyl), sulfamoyl group (e.g., N-ethyl sulfamoyl, N,N-dipropyl sulfamoyl, N-(2-dodecyloxyethyl) sulfamoyl), N-ethyl-N-dodecyl sulfamoyl and N,N-diethyl sulfamoyl), sulfonyl group (e.g., methane sulfonyl, octane sulfonyl, benzene sulfonyl and toluene sulfonyl), alkoxycarbonyl group (e.g., methoxycarbonyl, butoxycarbonyl, dodecyloxycarbonyl and octadecyloxycarbonyl), heterocyclic oxy group (e.g., 1-phenyltetrazole-5-oxy and 2-tetrahydropyranyloxy), azo group (e.g., phenylazo, 4-methoxyphenylazo, 4-pivaloyl aminophenylazo and 2-hydroxy-4-propanoylphenylazo), acyloxy group (e.g., acetoxy), carbamoyloxy group (e.g., N-methyl carbamoyloxy and N-phenyl carbamoyloxy), silyloxy group (e.g., trimethyl silyloxy and dibutylmethyl silyloxy), aryloxy carbonyl amino group (e.g., phenoxycarbonyl amino), imide group (e.g., N-succinimide, N-phthalimide, 3-octadecenyl succinimide), heterocyclic thio group (e.g., 2-benzothiazolyl thio, 2,4-di-phenoxy-1,3,5-triazole-6-thio and 2-pyridyl thio), sulfinyl group (e.g., dodecane sulfinyl, 3-pentadecyl phenyl sulfinyl and 3-phenoxy propyl sulfinyl), phosphonyl group (e.g., phenoxy phosphonyl, octyl phosphonyl and phenyl phosphonyl), aryloxycarbonyl group (e.g., phenoxycarbonyl), acyl group (e.g., acetyl, 3-phenyl propanoyl, benzoyl and 4 -dodecyloxy benzoyl) and azolyl group (e.g., imidazolyl, pyrazolyl, 3-chloro-pyrazole-1-yl and triazolyl).

Among these substituents, preferable substituents include an alkyl group, cycloalkyl group, aryl group, alkoxy group, aryloxy group, alkyl thio group, aryl thio group, carbamoyl amino group, aryloxy carbonyl amino group, alkoxy carbonyl amino group, alkyl acyl amino group, aryl acyl amino group or the like. Among these, $R_a$ is preferably an alkyl group, cycloalkyl group, alkoxy group, aryloxy group, alkyl thio group, and aryl thio group, among which an alkyl group, cycloalkyl group, alkoxy group and aryloxy group are more preferable. $R_b$ is preferably an alkyl group and aryl group.

X represents a hydrogen atom or a group capable of being split-off upon reaction with an oxidized product of an aromatic primary amine color-developing agent, and specifically the group capable of being split-off includes a halogen atom, alkoxy group, aryloxy group, acyloxy group, alkyl or aryl sulfonyloxy group, acyl amino group, alkyl or aryl sulfonamide group, alkoxy carbonyloxy group, aryloxy carbonyloxy group, alkyl-, aryl- or heterocyclic-thio group, carbamoyl amino group, 5- or 6-membered nitrogen-containing heterocyclic group, imide group, aryl azo group or the like, and these groups may be further substituted with groups allowable as substituents on $R_a$ or $R_b$.

More specific examples include a halogen atom (e.g., fluorine atom, chlorine atom and bromine atom), alkoxy group (e.g., ethoxy, dodecyloxy, methoxyethyl carbamoyl methoxy, carboxy propyloxy, methyl sulfonyl ethoxy and ethoxy carbonyl methoxy), aryloxy group (e.g., 4-methylphenoxy, 4-chlorophenoxy, 4-methoxyphenoxy, 4-carboxyphenoxy, 3-ethoxycarboxyphenoxy, 4-methoxycarbonylphenoxy, 3-acetylaminophenoxy and 2-carboxyphenoxy), acyloxy group (e.g., acetoxy, tetradecanoyloxy and benzoyloxy), alkyl or aryl sulfonyloxy group (e.g., methane sulfonyloxy and toluene sulfonyloxy), acylamino group (e.g., dichloracetylamide and heptafluorobutyrylamino), alkyl or aryl sulfonamide group (e.g., methane sulfonamino, trifluoromethane sulfonamino and p-toluene sulfonylamino), alkoxycarbonyloxy group (e.g., ethoxycarbonyloxy and benzyloxycarbonyloxy), aryl oxycarbonyloxy group (e.g., phenoxycarbonyloxy), alkyl, aryl or heterocyclic thio group (e.g., dodecyl thio, 1-carboxydodecyl thio, phenyl thio, 2-butoxy-5-tert-octyl phenyl thio, 2-benzyloxycarbonyl aminophenyl thio and tetrazolyl thio), carbamoyl amino group (e.g., N-methyl carbamoyl amino and N-phenyl carbamoyl amino), 5- or 6-membered nitrogen-containing heterocyclic group (e.g., 1-imidazolyl, 1 -pyrazolyl, 1,2,4-triazole-1-yl, tetrazolyl, 3,5-dimethyl-1-pyrazolyl, 4-cyano-1-pyrazolyl, 4-methoxycarbonyl-1-pyrazolyl, 4-acetylamino-1-pyrazolyl and 1,2-dihydro-2-oxo-1-pyridyl), imido group (e.g., succinimide and hydantoinyl) and arylazo group (e.g., phenylazo and 4-methoxyphenylazo). X is preferably a halogen atom, alkoxy group, aryloxy group, alkyl- or aryl-thio group, and 5- or 6-membered nitrogen-containing heterocyclic group which binds via nitrogen atom to the coupling active site, particularly preferably a halogen atom, substituted aryloxy group, substituted aryl thio group or substituted 1-pyrazolyl group.

The magenta couplers represented by the formula (M) are more preferably those represented by formula (M-I) or (M-II):

formula (M-I)

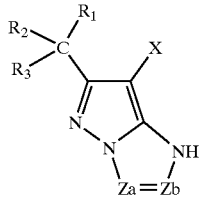

formula (M-II)

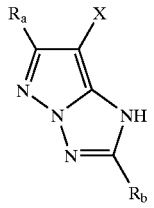

wherein $Z_a$, $Z_b$, X, $R_a$ and $R_b$ have the same meanings as defined in the formula (M), and $R_1$ to $R_3$ each independently have the same meanings as $R_a$.

The couplers represented by the formula (M-I) or (M-II) are particularly preferably those represented by formula (M-A):

formula (M-A)

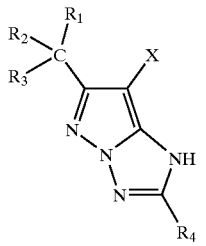

wherein $R_1$ to $R_3$ and X have the same meanings as defined in the formula (M-I), and $R_4$ has the same meanings as $R_b$.

In the formula (M-A), preferable substituents are as follows. Preferable groups of X include a halogen atom, alkoxy group and aryloxy group, among which a chlorine atom is preferable. Preferable substituent groups of $R_1$ to $R_4$ include an alkyl group, aryl group, anilino group, alkoxy group, aryloxy group or the like, among which an alkyl group or aryl group is preferable, and it is particularly preferable that $R_1$, $R_2$ and $R_3$ are methyl groups and $R_4$ is an alkyl group or aryl group (these are preferably substituted). $R_4$ is most preferably an aryl group. The magenta coupler for use in the present invention is used preferably in the range of 0.001 to 1 mol, more preferably 0.003 to 0.3 mol, per mol of the light-sensitive silver halide in the same layer. The molecular weight of the coupler is preferably 800 or less, more preferably 600 or less.

Examples of the magenta couplers represented by the formula (M) are shown below, but these are not intended to limit the present invention.

(M-1)
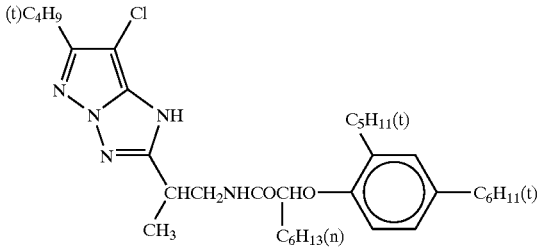
(M-2)
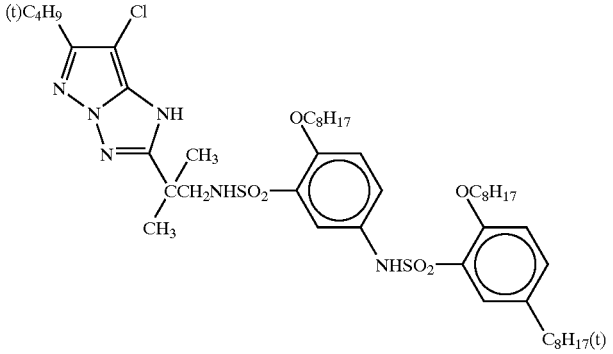
(M-3)
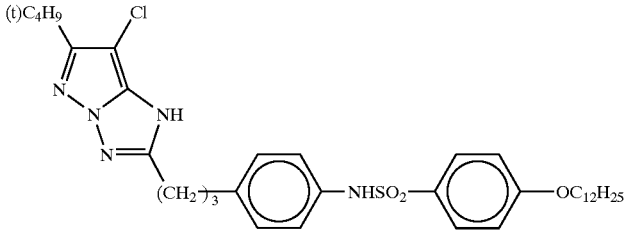
(M-4)
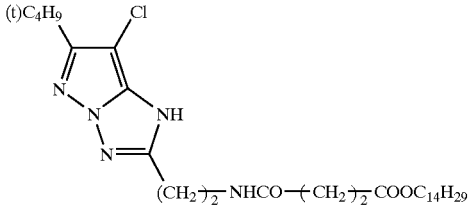
(M-5)
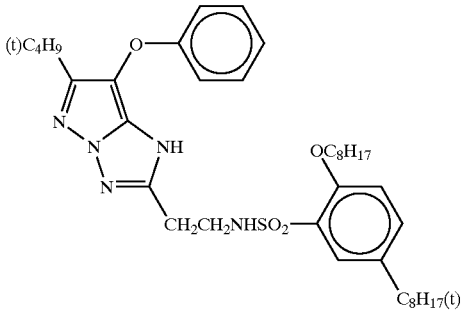

-continued
(M-6)
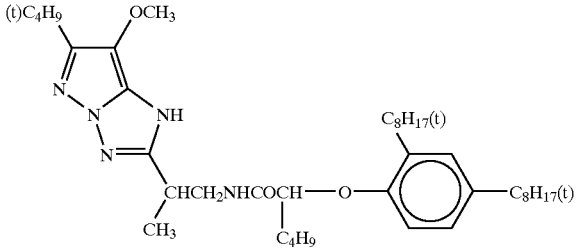
(M-7)
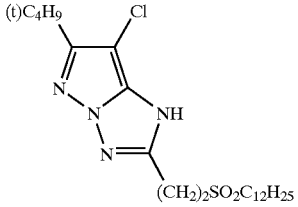
(M-8)
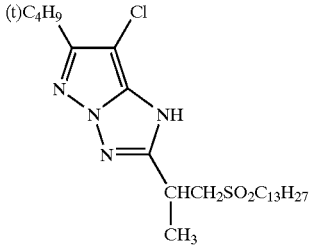
(M-9)
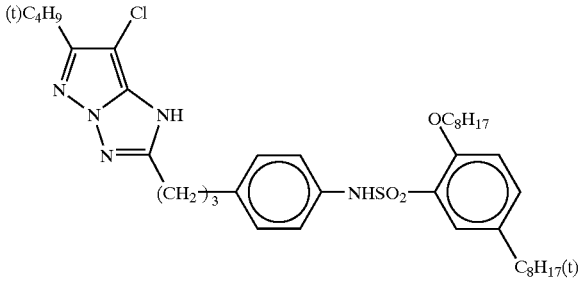
(M-10)
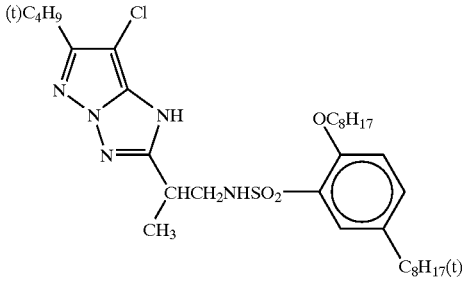
(M-11)
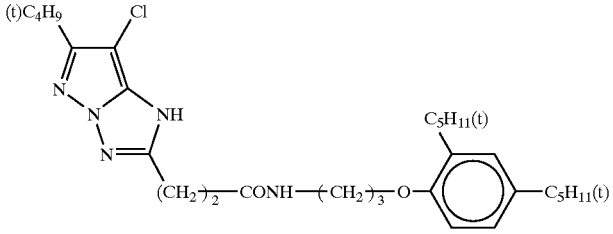

-continued
(M-12)
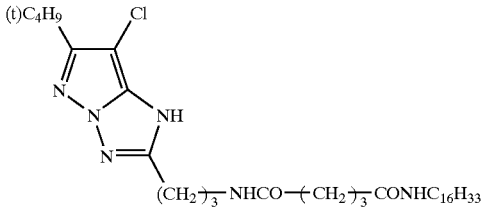
(M-13)
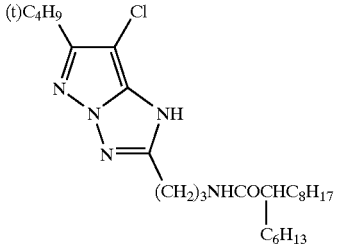
(M-14)
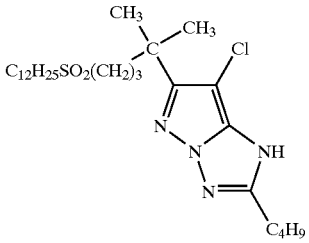
(M-15)
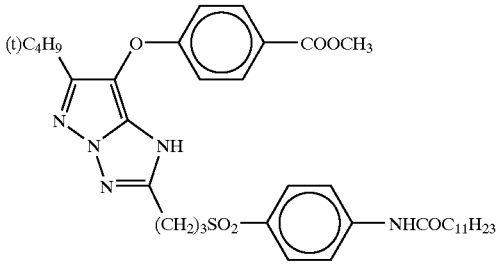
(M-16)
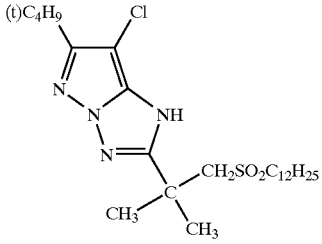

-continued
(M-17)
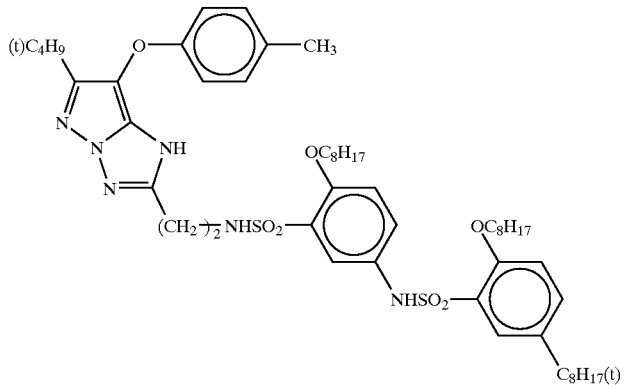
(M-18)
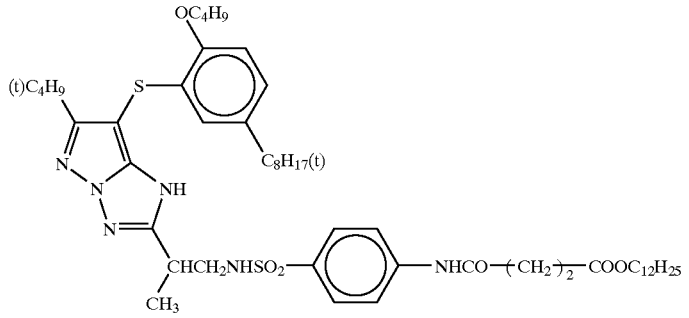
(M-19)
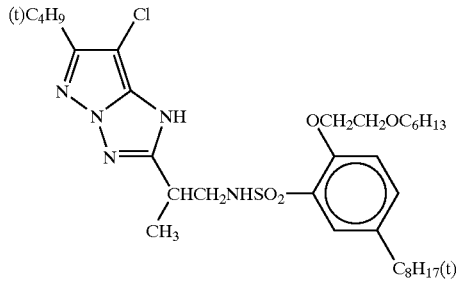
(M-20)
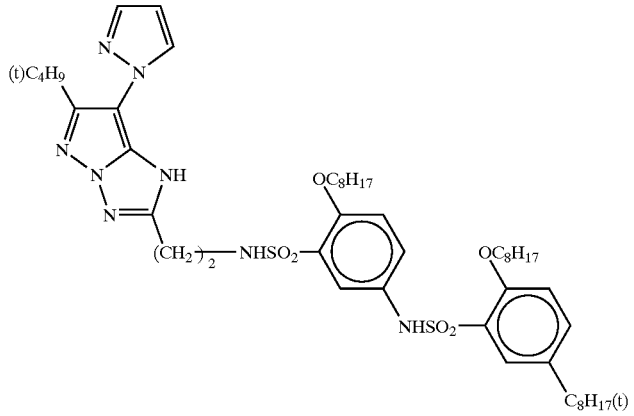

-continued
(M-21)
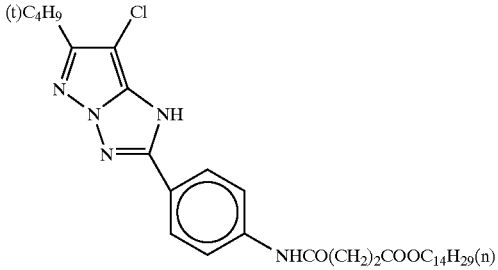
(M-22)
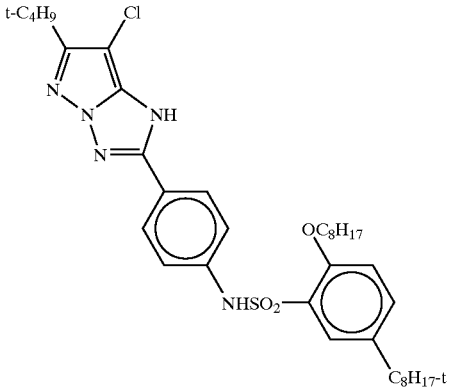
(M-23)
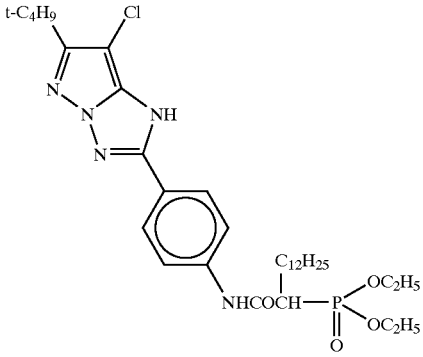
(M-24)
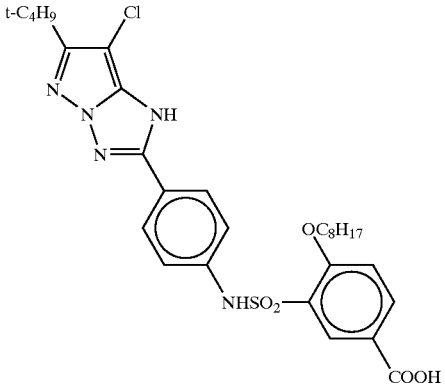

-continued
(M-25)
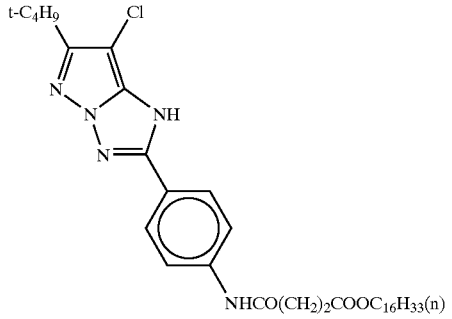
(M-26)
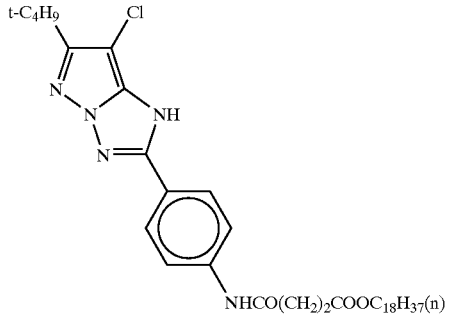
(M-27)
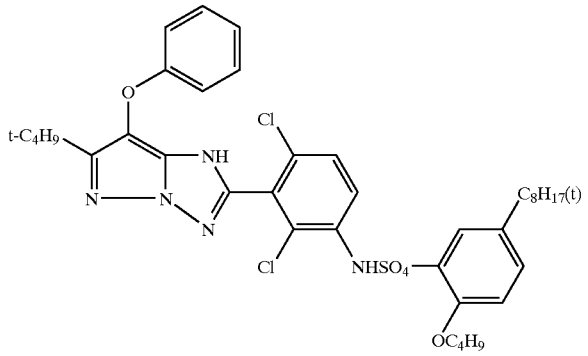
(M-28)
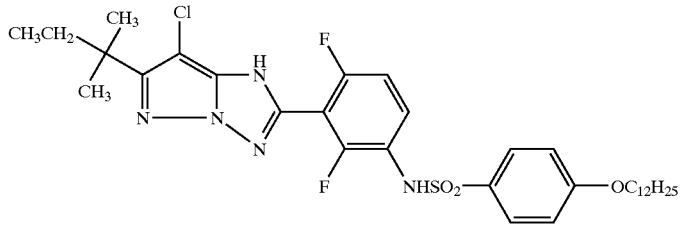
(M-29)
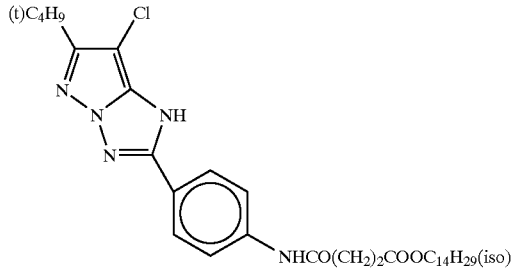

-continued
(M-30)
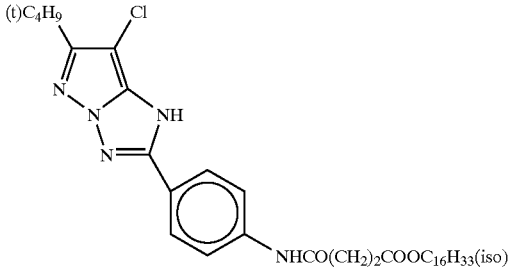
(M-31)
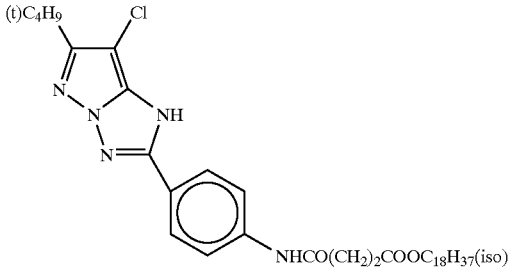
(M-32)
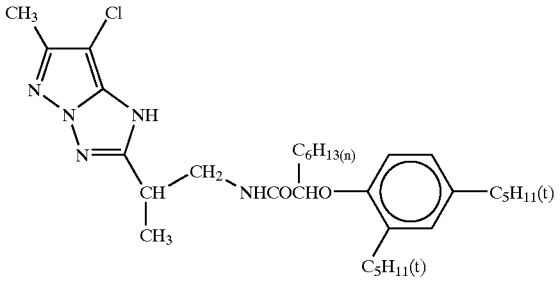
(M-33)
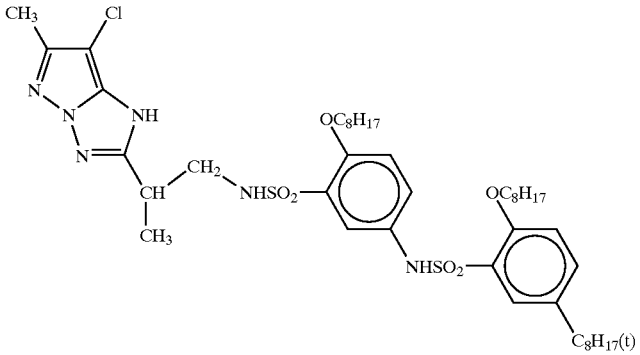
(M-34)
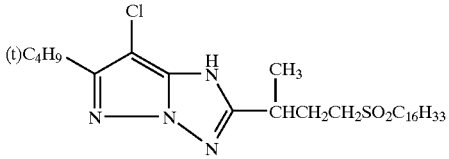
(M-35)
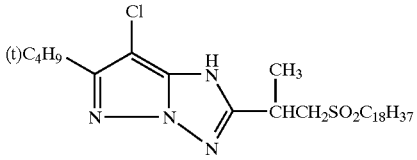

-continued
(M-36)
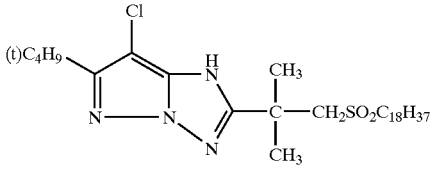
(M-37)
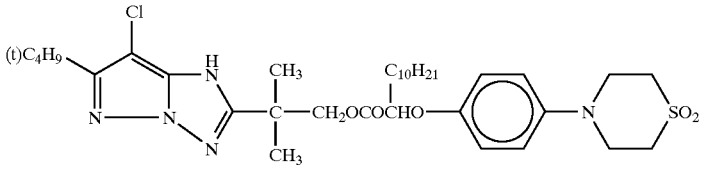
(M-38)
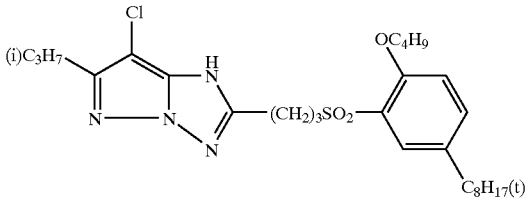
(M-39)
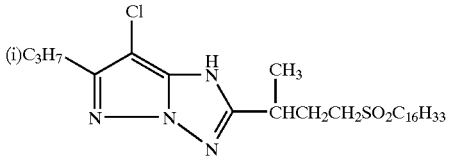
(M-40)
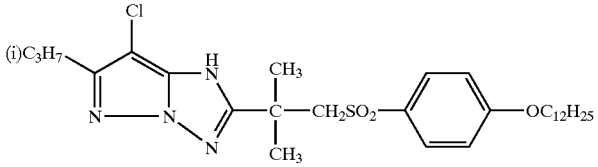
(M-41)
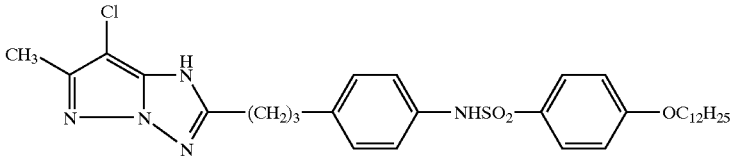
(M-42)
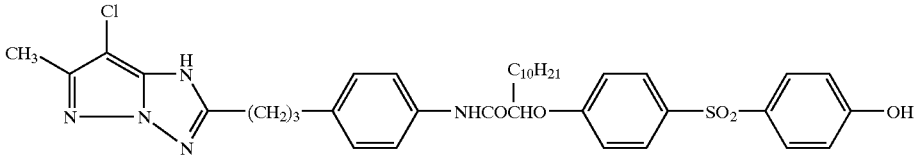
(M-43)
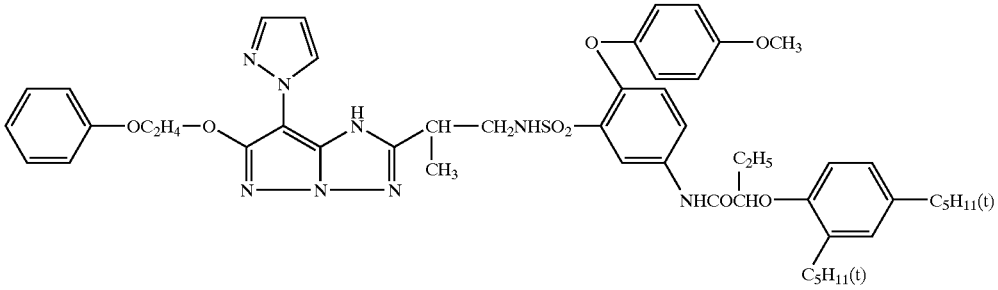

-continued
(M-44)
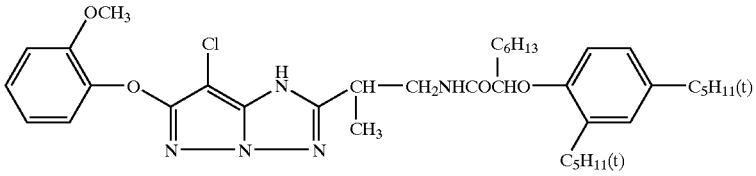
(M-45)
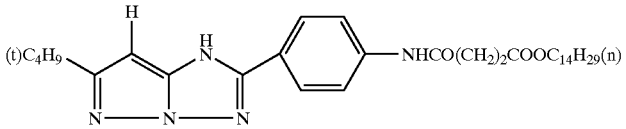
(M-46)
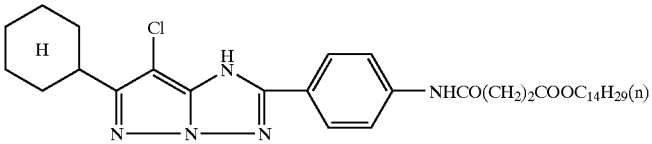
(M-47)
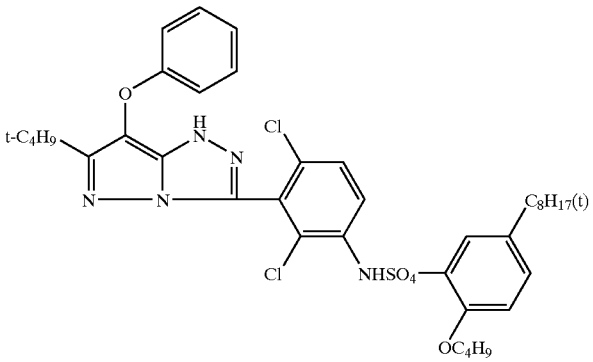
(M-48)
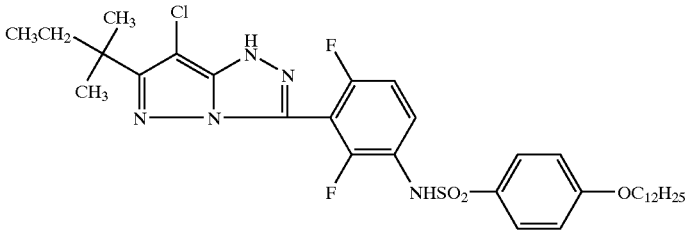
(M-49)
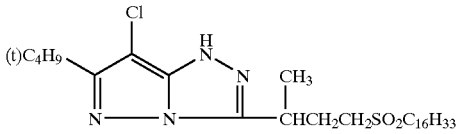
(M-50)
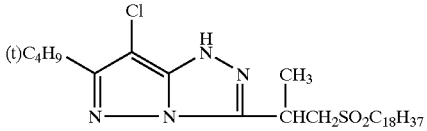
(M-51)
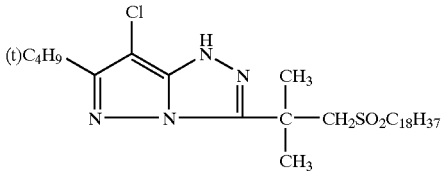

-continued
(M-52)
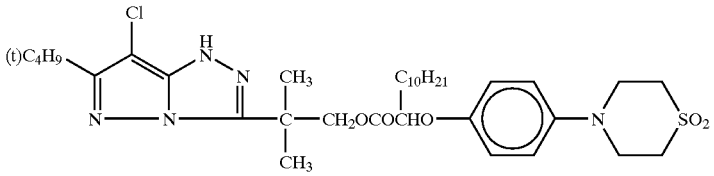
(M-53)
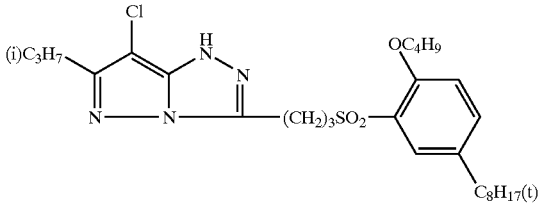
(M-54)
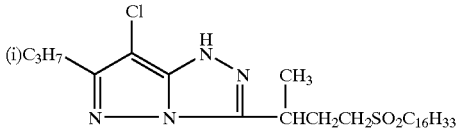
(M-55)
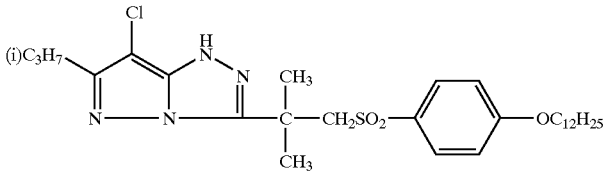
(M-56)
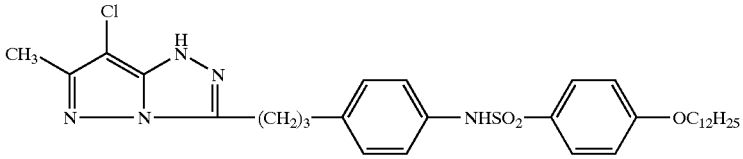
(M-57)
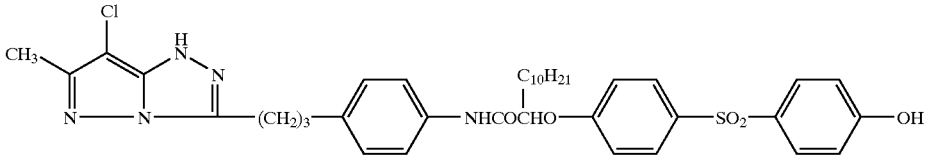
(M-58)
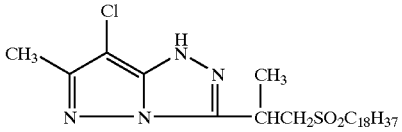
(M-59)
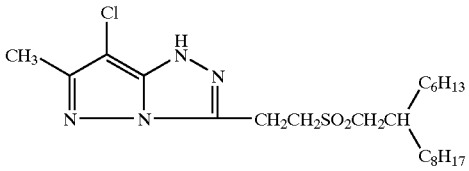
(M-60)
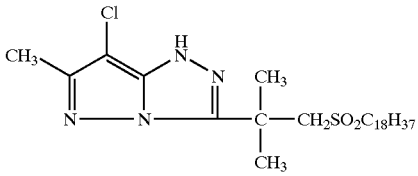

-continued (M-61)

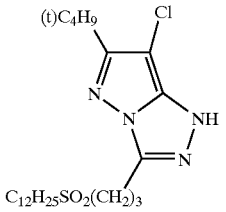

Although the amount of the magenta coupler for use in the present invention to be coated is varied depending on the molar absorption coefficient of the magenta coupler, it is preferably in the range of 0.01 to 1 g/m$^2$, more preferably 0.02 to 0.6 g/m$^2$, most preferably 0.05 to 0.5 g/m$^2$.

The ratio in amount of the magenta coupler to the silver halide to be used is varied depending on the equivalency of the coupler, and when a two-equivalent coupler is used, the Ag/coupler ratio is preferably in the range of 1.5 to 8, and when a four-equivalent coupler is used, the ratio is preferably 3 to 16.

In the light-sensitive material according to the present invention, for the purpose of improving the sharpness or the like of images, dyes (particularly oxonol-type dyes), which can be decolored by processing described on pages 27 to 76 in European Patent Application No. 337,490A2, are preferably added to the hydrophilic colloidal layer such that the optical reflection density of the light-sensitive material at 680 nm becomes 0.70 or more, or 12 wt % or more (more preferably 14 wt % or more) of titanium oxide which is surface-treated with di- to tetra-hydric alcohols (e.g. trimethylol ethane) is preferably contained in a water-resistant resin layer of a support.

In the silver halide color photographic light-sensitive material according to the present invention, gelatin can be used as the hydrophilic binder, but hydrophilic colloids of other gelatin derivatives, graft polymers between gelatin and other polymers, proteins other than gelatin, sugar derivatives, cellulose derivatives and synthetic hydrophilic polymeric materials such as homopolymers or copolymers can also be used in combination with gelatin, if necessary.

Gelatin to be used in the silver halide color photographic light-sensitive material according to the present invention may be either lime-treated or acid-treated gelatin or may be gelatin produced from any of cow bone, cowhide, pig skin, or the like, as the raw material, preferably lime-treated gelatin produced from cow bone or pig skin as the raw material.

In the present invention, the total amount of the hydrophilic binder contained in the light-sensitive silver halide emulsion layer(s) and the non-light-sensitive hydrophilic colloidal layer(s) that are layers between the support and the hydrophilic colloidal layer furthest from the support at the side coated with the silver halide emulsion layer, is preferably 7.4 to 3.0 g/m$^2$, more preferably 6.0 to 3.5 g/m$^2$, most preferably 5.5 to 4.0 g/m$^2$, from the viewpoint of rapid processing. When tabular grains are used in the emulsion, the amount thereof is preferably 6.5 g/m$^2$ or less, most preferably 5.5 g/m$^2$ or less but 4.0 g/m$^2$ or more. A lower content of the hydrophilic binder is effective for enhancing the speed in the steps of color development and washing with water.

In the present invention, the silver halide emulsion layer furthest from the support refers to a layer containing a silver halide emulsion that can substantially contribute to dye-forming upon reaction of the coupler, via the development of the silver halide emulsion contained in the layer. Accordingly, the silver halide emulsion layer does not include a coupler-free layer only containing a fine-grain emulsion or colloidal silver which is substantially not sensitive.

In the present invention, the ratio of [amount of hydrophilic binder/thickness of silver halide] in every silver halide emulsion layer is preferably 1.5 to 15. In the present invention, this ratio is hereinafter referred to as [B/AgX] ratio.

As used herein, the amount of hydrophilic binder refers to the amount of hydrophilic binder (g/m$^2$) per m$^2$ of the silver halide emulsion layer. Since the amount of the hydrophilic binder is divided by the specific gravidity to represent thickness, the amount of the hydrophilic binder in the present invention can be seen to be an amount proportional to thickness.

On the other hand, the thickness of the silver halide emulsion refers to a thickness ($\mu$m) occupied by silver halide emulsion grains in a direction perpendicular to the support in the silver halide emulsion layer. Assuming that the silver halide emulsion layer is ideally coated, the thickness of the halide silver emulsion in the present invention is the side length ($\mu$m) of a cube in the case of cubic grains, or is the thickness ($\mu$m) in a perpendicular direction to a major plane in the case of tabular grains. When silver halide grains having different sizes are used in combination, the weight-average value of the thickness of the respective grains is assumed to be the thickness of the silver halide emulsion. For example, the silver halide emulsion thickness (AgX) when silver halide grains are used in combination is defined as:

$$AgX=A\cdot Xa/(Xa+Xb+Xc+\ldots)+B\cdot Xb/(Xa+Xb+Xc+\ldots)+C\cdot Xc\ (Xa+Xb+Xc+\ldots)+\ldots$$

wherein the weight of coated silver halide emulsion grains with thickness A ($\mu$m) is Xa (g/m$^2$), the weight of coated silver halide emulsion grains with thickness B ($\mu$m) is Xb (g/m$^2$), the weight of coated silver halide emulsion grains with thickness C ($\mu$m) is Xc, and so on.

As is clear from the following definition, the thickness of the emulsion in the emulsion layer is relatively decreased as the [B/AgX] ratio in the present invention is increased. From the viewpoint of restricting pressure marks (streaks) and reducing processing color-mixing in the present invention, the [B/AgX] ratio is preferably 1.5 to 15, more preferably 2.0 to 12, most preferably 5.0 to 10. When tabular grains are used in the emulsion, the ratio is preferably 1.50 or more, more preferably 1.70 or more, further preferably 1.90 or more, most preferably 6.0 or more.

The color light-sensitive material of the present invention can be constituted by coating a support having a reflection layer with at least one each of a yellow-color-forming silver halide emulsion layer, a magenta-color-forming silver halide emulsion layer and a cyan-color-forming silver halide emulsion layer. In the general color photographic paper, color reproduction according to subtractive color processes can be made by containing a color coupler which forms a dye having a complementary color to a light to which the silver halide emulsion is sensitive. In the general color photographic paper, silver halide emulsion grains can spectrally be sensitized with blue-, green- and red-sensitive spectral sensitizing dye in the order of the above-described color-forming layers, and the light-sensitive layer may be constituted by coating the support with layers containing the silver halide emulsion particles in the above-described order. However, a different order from the above order may also be used. That is, from the viewpoint of rapid processing, there is the case where a light-sensitive layer containing silver halide grains having the largest average particle size is preferably the uppermost layer, or from the viewpoint of storability under irradiation, there is also the case where the magenta-color-forming light-sensitive layer is preferably the lowermost layer.

In addition, the light-sensitive layer and the resultant hue may have a relationship different from the above, and at least one infrared-sensitive silver halide emulsion layer can also be used.

In the present invention, the silver halide emulsion layer containing a yellow coupler may be arranged in any position on the support. For example, when tabular grains are used in the emulsion, the layer containing a yellow coupler is coated preferably in a position more apart from the support than the magenta coupler-containing silver halide emulsion layer and/or the cyan coupler-containing silver halide emulsion layer. Further, from the viewpoint of acceleration of color development, acceleration of silver removal and reduction of a residual color by a sensitizing dye, the yellow coupler-containing silver halide emulsion layer is coated preferably in the most apart position from the support than the other silver halide emulsion layers. Further, from the viewpoint of a reduction in Blix discoloration, the cyan coupler-containing silver halide emulsion layer is preferably a middle layer between the other silver halide emulsion layers, and from the viewpoint of a reduction in light discoloration, the cyan coupler-containing silver halide emulsion layer is preferably the lowermost layer. Further, each color-forming layer of yellow, magenta or cyan may be composed of 2 or 3 layers. For example, a coupler layer not containing a silver halide emulsion is arranged to be adjacent to the silver halide emulsion layer to form a color-forming layer, as described in JP-A-4-75055, JP-A-9-114035, JP-A-10-246940, U.S. Pat. No. 5,576,159, etc.

For example, when tabular grains are used in the emulsion, the yellow coupler-containing silver halide emulsion layer is preferably coated most apart from the support than the other silver halide emulsion layers. In the yellow coupler-containing silver halide emulsion layer, the amount of the hydrophilic binder is preferably 1.35 g/m$^2$ or less, more preferably 1.25 g/m$^2$ or less, most preferably 1.20 g/m$^2$ or less but 0.60 g/m$^2$ or more. Further, with respect to the thickness of the silver halide emulsion, the side length in the case where cubic grains are used is preferably 0.80 $\mu$m or less, more preferably 0.75 $\mu$m or less, most preferably 0.70 $\mu$m or less but 0.30 $\mu$m or more, and the side length in the case where tabular grains are used (a length of a side in terms of a length of the side of a cubic having the same volume as the grain) is preferably 0.40 $\mu$m or less but 0.02 $\mu$m or more, more preferably 0.30 $\mu$m or less, more preferably 0.20 $\mu$m or less, most preferably 0.15 $\mu$m or less but 0.05 $\mu$m or more. A mixture of silver halide emulsions having different sizes and shapes is preferably used to control sensitivity, gradation and other photographic performance.

In the present invention, the amount of the silver halide emulsion to be coated is preferably 0.60 to 0.10 g/m$^2$, more preferably 0.55 to 0.20 g/m$^2$ or more, most preferably 0.50 to 0.25 g/m$^2$.

When silver halide emulsion grains are used in the cyan-color-forming layer and the magenta-color-forming layer, the side length thereof is preferably 0.50 $\mu$m or less, more preferably 0.40 $\mu$m or less but 0.10 $\mu$m or more.

In the present invention, the film thickness in the constitution of the photographic layer means the thickness, before processing, in the constitution of the photographic layer which is a layer over the support. Specifically, the film thickness can be obtained in any one of the following methods. In the first method, the film thickness can be obtained by cutting the silver halide color photographic light-sensitive material in a direction perpendicular to the support, and observing its cut surface under a microscope. The second method is a method of calculating the film thickness from the coating amount (g/m$^2$) and specific gravity of each component in the constitution of the photographic layer.

For example, the specific gravity of typical gelatin for use in photography is 1.34 g/ml, and the specific gravity of silver halide is 5.59 g/ml, and other lipophilic additives are previously measured before coating, whereby the film thickness can be calculated in the second method.

In the present invention, the film thickness in the photographic layer constitution is preferably 9.0 $\mu$m or less, more preferably 8.0 $\mu$m or less, most preferably 7.0 $\mu$m or less but 3.5 $\mu$m or more.

In the present invention, the hydrophobic photographic material is an oil-soluble ingredient excluding the dye-forming coupler, and the oil-soluble ingredient is a lipophilic component remaining in the light-sensitive material after processing. Specific examples of the oil-soluble ingredient include the dye-forming coupler, a high-boiling organic solvent, a color-mixing inhibitor, an ultraviolet absorber, lipophilic additives, a lipophilic polymer or polymer latex, a matt agent, a slip (sliding) agent or the like, which are usually added as lipophilic fine grains to the photograph-constituting layer. Accordingly, a water-soluble dye, a hardening agent, water-soluble additives and silver halide emulsions are not included in the oil-soluble ingredient. Further, a surfactant is usually employed in preparing lipophilic fine grains, and the surfactant is not regarded as the oil-soluble ingredient in the present invention.

The total amount of the oil-soluble ingredient in the present invention is preferably 4.5 g/m$^2$ or less, further preferably 4.0 g/m$^2$ or less, most preferably 3.8 g/m$^2$ or less but 3.0 g/m$^2$ or more. In the present invention, the value obtained by dividing the weight (g/m$^2$) of the hydrophobic photographic material contained in the dye-forming coupler-containing layer by the weight (g/m$^2$) of said dye-forming coupler, is preferably 4.5 or less, more preferably 3.5 or less, most preferably 3.0 or less.

In the present invention, the ratio of the oil-soluble ingredient in the photographic layer constitution to the hydrophilic binder can be arbitrarily selected. The ratio thereof by weight in the photographic layer constitution other than the protective layer is preferably 0.05 to 1.50, more preferably 0.10 to 1.40, most preferably 0.20 to 1.30. By optimizing the ratio of each layer, the film strength, abrasion resistance and curl characteristics can be regulated.

In the present invention, the non-light-sensitive layer refers to all layers other than the light-sensitive silver halide emulsion layer and examples thereof include a protective layer, a color mixing-preventing layer or the like. In at least one of non-light-sensitive layers, the ratio by weight of the oil-soluble ingredient to the amount of the hydrophilic binder is preferably 0.50 to 2.00, more preferably 0.70 to 1.80, further preferably 0.90 to 1.60.

In the present invention, the amount of the hydrophilic binder to be coated in at least one non-light-sensitive layer can be arbitrarily selected, but preferably it is 0.2 to 2.0 $g/m^2$, more preferably 0.6 to 1.3 $g/m^2$.

The non-light-sensitive layer having the oil-soluble ingredient/hydrophilic binder ratio in the present invention may be coated in any position, and it is preferably coated more outside than the silver halide emulsion layer most apart from the support and is most preferably coated more outside than but adjacent to the silver halide emulsion layer most apart from the support. The "outside" refers to a direction apart from the support.

A fluorescent brightening agent is preferably used in the light-sensitive material in the present invention. The fluorescent brightener is contained preferably in the water-resistant resin layer such as polyethylene, polypropylene or polyester layer, of the support described above. Further, the fluorescent brightener may be dispersed in the hydrophilic colloidal layer of the light-sensitive material. The fluorescent brightener may preferably use benzoxazole-series, coumarin-series or pyrazoline-series, and more preferably benzoxazolyl naphthalene-series and benzoxazolyl stilbene-series fluorescent brightener. Although the amount thereof is not particularly limited, it is preferably 1 to 100 $mg/m^2$. When mixed in a water-resistant resin, the mixing ratio thereof to the water-resistant resin is preferably 0.0005 to 3% by weight, more preferably 0.001 to 0.5% by weight.

As the silver halide emulsion, heterogeneous metal ion species which can be doped in silver halide grains, storage stabilizers or antifoggant for the silver halide emulsion, chemical sensitization methods (sensitizer), spectral sensitization methods (spectral sensitizer), cyan couplers, magenta or yellow couplers, which can be used in combination, and the emulsification and dispersion methods of the couplers, color image-storability improvers (stain inhibitor and anti-fading agents), dyes (colored layer), gelatin species, the layer constitution of the light-sensitive material, and the pH of a coating of the light-sensitive material, are preferably those described in the patent applications in Tables 1 and 2.

TABLE 1

| Element | JP-A-7-104448 | JP-A-7-77775 | JP-A-7-301895 |
|---|---|---|---|
| Reflective-type bases | Column 7, line 12 to Column 12, line 19 | Column 35, line 43 to Column 44, line 1 | Column 5, line 40 to Column 9, line 26 |
| Silver halide emulsions | Column 72, line 29 to Column 74, line 18 | Column 44, line 36 to Column 46, line 29 | Column 77, line 48 to Column 80, line 28 |
| Different metal ion species | Column 74, lines 19 to 44 | Column 46, line 30 to Column 47, line 5 | Column 80, line 29 to Column 81, line 6 |
| Storage stabilizers or antifoggants | Column 75, lines 9 to 18 | Column 47, lines 20 to 29 | Column 18, line 11 to Column 31, line 37 (Especially, mercaptohetero-cyclic compounds) |

TABLE 1-continued

| Element | JP-A-7-104448 | JP-A-7-77775 | JP-A-7-301895 |
|---|---|---|---|
| Chemical sensitizing methods (Chemical sensitizers) | Column 74, line 45 to Column 75, line 6 | Column 47, lines 7 to 17 | Column 81, lines 9 to 17 |
| Spectrally sensitizing methods (Spectral sensitizers) | Column 75, line 19 to Column 76, line 45 | Column 47, line 30 to Column 49, line 6 | Column 81, line 21 to Column 82, line 48 |
| Cyan couplers | Column 12, line 20 to Column 39, line 49 | Column 62, lines 50 to 16 | Column 88, line 49 to Column 89, line 16 |
| Yellow couplers | Column 87, line 40 to Column 88, line 3 | Column 63, lines 17 to 30 | Column 89, lines 17 to 30 |
| Magenta couplers | Column 88, lines 4 to 18 | Column 63, line 3 to Column 64, line 11 | Column 31, line 34 to Column 77, line 44 and column 88, lines 32 to 46 |
| Emulsifying and dispersing methods of couplers | Column 71, line 3 to Column 72, line 11 | Column 61, lines 36 to 49 | Column 87, lines 35 to 48 |

TABLE 2

| Element | JP-A-7-104448 | JP-A-7-77775 | JP-A-7-301895 |
|---|---|---|---|
| Dye-image-storability improving agents (anti-stain Agents) | Column 39, line 50 to Column 70, line 9 | Column 61, line 50 to Column 62, line 49 | Column 87, line 49 to Column 88, line 48 |
| Anti-fading agents | Column 70, line 10 to Column 71, line 2 | | |
| Dyes (colored layers) | Column 77, line 42 to Column 78, line 41 | Column 7, line 14 to Column 19, line 42, and Column 50, line 3 to Column 51, line 14 | Column 9, line 27 to Column 18, line 10 |
| Gelatins | Column 78, lines 42 to 48 | Column 51, lines 15 to 20 | Column 83, lines 13 to 19 |
| Layer construction of light-sensitive materials | Column 39, lines 11 to 26 | Column 44, lines 2 to 35 | Column 31, line 38 to Column 32, line 33 |
| pH of coatings of light-sensitive material | Column 72, lines 12 to 28 | | |
| Scanning exposure | Column 76, line 6 to Column 77, line 41 | Column 49, line 7 to Column 50, line 2 | Column 82, line 49 to Column 83, line 12 |
| Preservatives in developing solution | Column 88, line 19 to Column 89, line 22 | | |

Other known photographic materials and additives can be used in the silver halide photographic light-sensitive material of the present invention.

The cyan, magenta and yellow couplers, which can be used alone or in combination in the present invention, include those described in Table 1 above, and further the following couplers are useful: the couplers described on page 91, upper right column, line 4 to page 121, upper left column, line 6 in JP-A-62-215272; page 3, upper right column, line 14 to page 18, upper left column, bottom line, and page 30, upper right column, line 6 to page 35, lower right column, line 11 in JP-A-2-33144; page 4, lines 15 to 27, page 5, line 30 to page 28, bottom line, page 45, lines 29 to 31, and page 47, line 23 to page 63, line 50 in EP0355, 660A2; JP-A-8-122984; JP-A-9-222704; and the like.

In the present invention, it is preferable to contain 1) at least one kind of compounds selected from lipophilic compounds which chemically bond with an aromatic primary amine color-developing agent under the condition of pH 8 or less, to form a substantially colorless product; and/or 2) at least one kind of compounds selected from lipophilic compounds which chemically bond with an oxidized product of an aromatic primary amine color-developing agent under the condition of pH 8 or less, to form a substantially colorless product. Combined use of the compound defined in 1) and the compound defined in 2) is particularly preferable.

As the compounds defined in 1) and 2), compounds represented by formulae and exemplified compounds in JP-A62-143048, JP-A-62-17665, JP-A-62-283338, JP-A-62-229145, JP-A-63-115855, JP-A-63-115866, JP-A-63-158545, JP-A-64-86139, JP-A-1-271748, European Patent Application Laid-Open No. 255722, and Published Technical Report No. 90-9416 from Hatsumei Kyokai (Japan Institute of Invention and Innovation), can preferably be applied.

The amount of these compounds to be used (alone or in total) is preferably $0.5\times10^{-6}$ to $2\times10^{-3}$ mol/m$^2$, more preferably $1\times10^{-6}$ to $5\times10^{-4}$ mol/m$^2$, most preferably $2\times10^{-6}$ to $3\times10^{-4}$ mol/m$^2$. When these compounds and the coupler are used in the same layer, the amount thereof (alone or in total) is preferably in the range of 0.5 to 300 mol %, preferably 1 to 200 mol %, most preferably 5 to 150 mol %, per mol of said coupler. These compounds may be used in the non-light-sensitive layer and these are preferably used after co-emulsified with the coupler. Combined use of these compounds and a pyrazolotriazole coupler, a pyrorotriazole coupler, or an acylacetamide-type yellow coupler whose acyl group is 1-alkylcyclopropane-1-carbonyl group is particularly preferable.

Typical examples of anti-fading agents include hindered phenols which mainly include hydroquinones, 6-hydroxy chromans, 5-hydroxy coumaranes, spirochromans, p-alkoxyphenols and bisphenols, gallate derivatives, methylene dioxybenzenes, aminophenols, hindered amines, ultraviolet absorbers, and ether or ester derivatives of these compounds whose phenolic hydroxyl group is silylated or alkylated. Further, metal complexes, which typically include (bis-salicylic aldoxymato) nickel complex and (bis-N,N-dialkyl dithiocarbamato) nickel complex, can also be used.

These are preferably used in combination with the compounds defined in 1) and 2) above.

The non-color-forming oil-soluble organic compound in the present invention is described.

In the present invention, the term "non-color-forming" means non-color-forming by development processing, and the non-color-forming oil-soluble organic compound does not include color-forming couplers. Further, the oil-soluble organic compound is preferably a lipophilic component remaining in the light-sensitive material after processing. Specifically, the non-color-forming oil-soluble organic compound includes a high-boiling organic solvent, lipophilic additives (anti-fading agent, stain inhibitors, ultraviolet absorbers, color mixing inhibitors or the like), lipophilic polymer latex, matt agents, slip (sliding) agents or the like, which are usually added as lipophilic fine grains to the photographic constituent layer. Accordingly, the water-soluble dye, the hardening agent, water-soluble additives, the silver halide emulsion and the like do not include the non-color-forming oil-soluble organic compound. A surfactant can usually be employed in preparing lipophilic fine grains, and the surfactant is not regarded as the non-color-forming oil-soluble organic compound in the present invention.

It is preferable that the magenta coupler for use in the present invention, preferably the magenta coupler represented by the formula (M), further preferably the formula (M-I) or (M-II), particularly preferably the formula (M-II), is used together with the non-color-forming oil-soluble organic compound in the magenta-color-forming layer such that the ratio of the whole non-color-forming oil-soluble organic compound/magenta coupler is preferably in the range of 2.0 to 6.0. The ratio is more preferably in the range of 2.5 to 5.5, most preferably 2.8 to 5.0. In the case using a conventional support, the change in sensitivity after storage due to the change in the amount of the oil-soluble ingredient was not so significant, but in the case using the support for use in the present invention, the change in sensitivity after storage is sensitively influenced by the amount of the oil-soluble ingredient, therefore the characteristic of high sensitivity can particularly be demonstrated in the above preferable range of the whole non-color-forming oil-soluble organic compound/magenta coupler in the present invention.

A hardening agent is preferably used in the present invention. The hardening agent includes e.g. aldehyde-series compounds such as formaldehyde and glutaraldehyde; ketone compounds such as diacetyl and cylopentane dione; bis(2-chloroethyl urea); 2-hydroxy-4,6-dichloro-1,3,5-triazine; compounds having reactive halogen described in U.S. Pat. Nos. 3,288,775 and 2,732,303 and U.K. Patent Nos. 974,723 and 1,167,207 and the like; 5-acetyl-1,3-diacryloyl-hexahydro-1,3,5-triazine; compounds having reactive olefin described in U.S. Pat. Nos. 3,635,718 and 3,232,763 and U.K. Patent No. 994,869 and the like; N-hydroxymethyl phthalimide; N-methylol compounds described in U.S. Pat. Nos. 2,732,316 and 2,586,168 and the like; isocyanates described in U.S. Pat. No. 3,103,437 and the like; aziridine compounds described in U.S. Pat. Nos. 3,017,280 and 2,983,611 and the like; acid derivatives described in U.S. Pat. Nos. 2,725,294 and 2,725,295 and the like; epoxy compounds described in U.S. Pat. No. 3,091,537 and the like; and halogen carboxy aldehydes such as mucochloric acid.

The inorganic hardening agent includes chrome alum, zirconium sulfate or the like. Further, mention is made of those in the form of precursors thereof in place of the compounds described above, for example, alkali metal bisulfite aldehyde adducts, hydantoin methylol derivatives, primary aliphatic nitroalcohol, mesyloxy ethyl sulfonyl-series compounds, chloroethyl sulfonyl-series compounds.

The gelatin to which the hardening agent for use in present invention is applied, may be any of the so-called alkali-treated (lime-treated) gelatin immersed in an alkali bath before gelatin extraction in the production process, acid-treated gelatin immersed in an acid bath, and double-immersed gelatin via both the treatments, and enzyme-treated gelatin. Further, this hardening agent can also be applied to low-molecular-weight gelatin which is partially hydrolyzed by heating the gelatin or allowing a proteinase to act thereon, in a water bath.

Among these, particularly, the hardening agents represented by the formula (II) and (H-I) are preferable. The hardening agent represented by the formula (II) is particularly preferable.

Hereinafter, the hardening agent represented by the formula (II) is described.

In the formula, $X^1$ and $X^2$ are $—CH{=}CH_2$ or $—CH_2CH_2—Y$, and $X^1$ and $X^2$ may be the same or different. Y represents a group which can be substituted with a nucleophilic reagent (nucleophilic group) or split-off in the form of HY by a base. L is a divalent linking group which may be further substituted.

Preferable examples thereof include:

$—CH{=}CH_2$, $—CH_2CH_2—Cl$, $—CH_2CH_2—Br$, $—CH_2CH_2—OSO_2CH_3$, $—CH_2CH_2—OSO_2C_6H_5$, $—CH_2CH_2—OSO_2C_6H_4—CH_3$, $—CH_2CH_2—OSO_3Na$, $—CH_2CH_2—OSO_3K$, $—CH_2CH_2—OCOCH_3$, $—CH_2CH_2—OCOCF_3$, $—CH_2CH_2—OCOCHCl_2$,

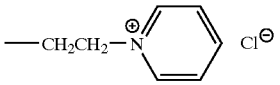

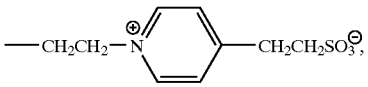

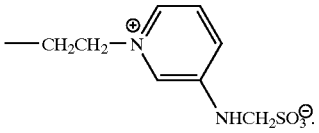

Among these, those groups having the following structures are preferable, and $—CH{=}CH_2$ is the most preferable.

$—CH{=}CH_2$, $—CH_2CH_2—Cl$, $—CH_2CH_2—Br$, $—CH_2CH_2—OSO_2CH_3$, $—CH_2CH_2—OSO_3Na$,

-continued $—CH_2CH_2—OSO_3K$,

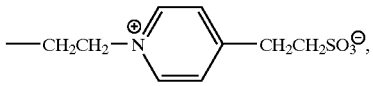

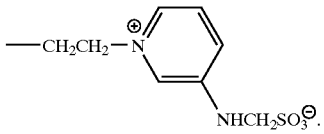

The divalent linking group L is an alkylene group (including a cycloalkylene group), arylene group (including a divalent aromatic heterocyclic group), or a divalent group formed by combining such a group with one or more linkages represented by —O—, $—NR^{11}—$, $—SO_2—$, $—SO_3—$, —S—, —SO—, $—SONR^{11}—$, —CO—, —COO—, $—CONR^{11}—$, $—NR^{11}COO—$ and $—NR^{11}CONR^{11}—$. $R^{11}$ represents a hydrogen atom or an alkyl having 1 to 15 carbon atoms, aryl and aralkyl group. When it contains two or more linkages represented by $—NR^{11}—$, $—SONR^{11}—$, $—CONR^{11}—$, $—NR^{11}COO—$ and $—NR^{11}CONR^{11}—$, these $R^{11}$ groups may bond to each other to form a ring. Further, the alkylene group and arylene group described above may have substituents, and the substituents include e.g. a hydroxy group, alkoxy group, carbamoyl group, sulfamoyl group, sulfo group or salts thereof, carboxyl group or salts thereof, halogen atom, alkyl group, aralkyl group and aryl group. The substituents may be further substituted with one or more groups represented by $X^3—SO_2—$, and $X^3$ has the same meanings as defined in $X^1$ and $X^2$ above.

Typical examples of L can include the following. In the following examples, each of "a" to "k" represents an integer of 1 to 6. The "e" only may be 0, preferably 2 or 3. The "a" to "k" except for "e" are preferably 1 or 2, particularly preferably 1. In the formula, $R^{11}$ is preferably a hydrogen atom and an alkyl group having 1 to 6 carbon atoms, particularly preferably a hydrogen atom, methyl and ethyl.

$—(CH_2)_a—$, $—(CH_2)_b—O—(CH_2)_c—$, $—(CH_2)_d—CONR^{11}—(CH_2)_e—NR^{11}CO—(CH_2)_f—$, $—(CH_2)_g—SO_2—(CH_2)_h—$,

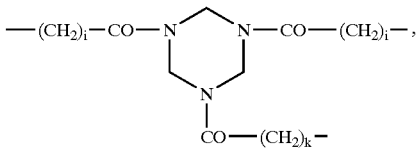

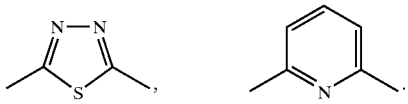

Hereinafter, typical examples of the hardening agent for use in the present invention are described, but are not intended to limit the present invention.

G-1.
$CH_2{=}CHSO_2CH_2SO_2CH{=}CH_2$
G-2.
$CH_2{=}CHSO_2CH_2OCH_2SO_2CH{=}CH_2$
G-3.
$CH_2{=}CHSO_2CH_2CH_2CH_2SO_2CH{=}CH_2$
G-4.
$CH_2{=}CHSO_2CH_2CH(OH)CH_2SO_2CH{=}CH_2$
G-5.
$CH_2{=}CHSO_2CH_2CONHCH_2CH_2NHCOCH_2SO_2CH{=}CH_2$
G-6.
$CH_2{=}CHSO_2CH_2CONHCH_2CH_2CH_2NHCOCH_2SO_2CH{=}CH_2$
G-7.
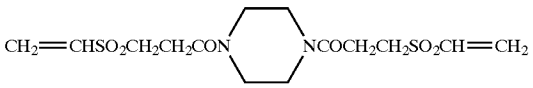
G-8.
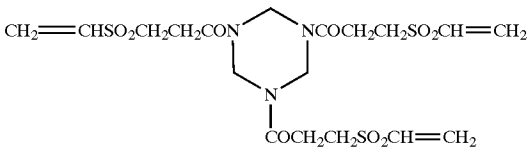
G-9.
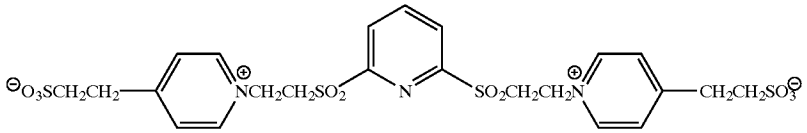
G-10.
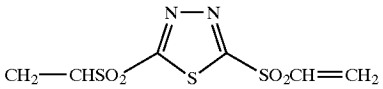
G-11.
$(CH_2{=}CHSO_2CH_2)_3CCH_2SO_2CH_2CH_2NHCH_2CH_2SO_3Na$
G-12.
$(CH_2{=}CHSO_2)_2CHCH_2CH_2{-}C_6H_4{-}SO_3Na$ Methods for synthesizing these hardening agents for use in the present invention are described in detail in e.g. JP-B-47-2429 ("JP-B" means examined Japanese patent publication), JP-B-50-35807, JP-A-49-24435, JP-A-53-41221 and JP-A-59-18944.

The amount of the hardening agent to be added in the present invention is preferably 0.01 to 20% by weight, particularly preferably 0.1 to 10% by weight, to the total dried gelatin to be used in the light-sensitive material. In the present invention, the hardening agent may be previously added to a coating solution, or may be mixed with a coating solution just before coating.

Now, the hardening agent represented by the formula (H-I) is described.

formula (H-I)

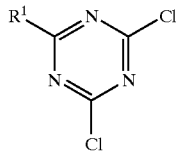

wherein $R^1$ represents a hydroxyl group, —OM group (M is a monovalent metal atom), alkyl group, the group:

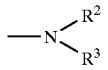

(wherein $R^2$ and $R^3$ represent an alkyl group and aryl group respectively), —$NHCOR^4$ (wherein $R^4$ represents a hydrogen atom, alkyl group, aryl group, alkyl thio group and aryl thio group), or alkoxy group.

In the formula (H-I), the alkyl group represented by $R^1$ is preferably e.g. a methyl group, ethyl group, butyl group or the like, and the alkoxy group represented by $R^1$ is preferably a methoxy group, ethoxy group, butoxy group or the like. Further, specific examples of the group:

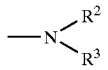

include —$NH_2$, —$NHCH_3$, —$NHC_2H_5$ etc., and specific examples of the —$NHCOR^4$ group include —$NHCOCH_3$, —$NHCOC_6H_5$ etc. Further, M in the —OM group represented by $R^1$ is particularly preferably e.g. a sodium atom, potassium atom or the like.

The cyanuric chloride-series hardening agents shown in the formula (H-I) above are described in detail in JP-B 47-6151, JP-B-47-33380, JP-B-54-25411 and JP-A-56-130740. Further, compounds having structures similar to those of the compounds represented by formula (H-I) are described in JP-B-53-2726, JP-A-50-61219, JP-A-56-27135, JP-A-56-60430 and JP-A-57-40244, and these compounds are also useful in the present invention.

Specific examples of compounds for use in the present invention are classified and shown below, but these compounds are not intended to limit the present invention.

a. Compounds Represented by Formula (H-I)

H-1

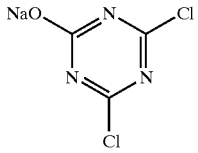

H-2

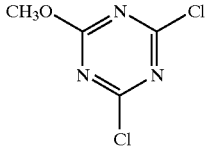

H-3

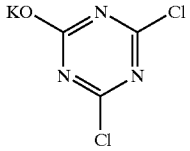

H-4

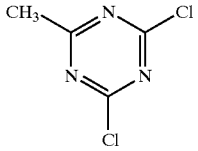

H-5

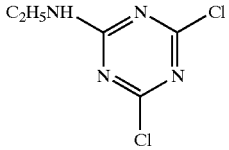

These hardening agents may be used alone or in combination thereof, and the hardening agent to be used in combination includes the hardening agent mentioned above.

The photographic layer to which the hardening agents represented by the formula (II) or (H-I) in the present invention are added, is not particularly limited, and the hardening agents can be used in any gelatin-containing photographic layers such as, not only the silver halide emulsion layer but also the non-light-sensitive layer, for example, undercoat, backing layer, filter layer, interlayer and overcoat layer.

The matt agent in the present invention is described. The matt agent is defined as discontinuous solid grains of an inorganic or organic material dispersible in a hydrophilic organic colloidal binder.

The matt agent for use in the present invention is not particularly limited as far as it is solid grains that do not adversely affect photographic properties. The inorganic matt agent includes silicon dioxide, titanium oxide, aluminum oxide, zinc carbonate, calcium carbonate, barium sulfate, calcium sulfate, calcium silicate and aluminum silicate, and the organic matt agent includes matt agents of organic polymers such as cellulose esters, polymethyl methacrylate, polystyrene or polydivinyl benzene and copolymers thereof.

In the present invention, the following matt agents are preferably used: porous matt agents described on page 2, lower left column, line 8 to page 3, upper right column, line 4 in JP-A-3-109542, matt agents whose surface is treated with an alkali described on page 3, upper right column, line 7 to page 5, lower right column, line 4 in JP-A-4-127142, and matt agents of organic polymers described on page 2, right column, line 25 to page 8, right column, line 39 in JP-A-6-118542.

Further, these matt agents may be used in combination thereof. For example, combined use of an inorganic matt agent and an organic matt agent, combined use of a porous matt agent and a non-porous matt agent, combined use of an amorphous matt agent and a spherical matt agent, combined use of matt agents having different average particle diameters (for example, combined use of a matt agent having an average particle diameter of 1.5 μm or more and a matt agent having an average particle diameter of 1 μm or less described in JP-A-6-118542).

The amount of the matt agent to be coated in the present invention is preferably 5 to 1000 mg/m$^2$, particularly 10 to 200 mg/m$^2$. The average particle diameter of the matt agent is preferably in the range of 20 μm or less, particularly preferably 0.4 to 10 μm.

The latex may be any generally known polymer latex, and the polymers preferably used include homopolymers of alkyl acrylate, copolymers thereof with acrylic acid or styrene, styrene-butadiene copolymers, and polymers or copolymers, comprising monomer units having an active methylene group, a water-soluble group, or a crosslinking group with gelatin. In particular, the copolymers with monomer units having a water-soluble group or a crosslinking group with gelatin, but mainly containing hydrophobic monomer components from such as alkyl acrylate and styrene, are used most preferably, in order to increase affinity for gelatin as the binder.

Preferable examples of monomers having a water-soluble group include acrylic acid, methacrylic acid, maleic acid, 2-acrylamide-2-methyl propane sulfonic acid, styrene sulfonic acid, and preferable examples of monomers having a crosslinking group with gelatin include glycidyl acrylate, glycidyl methacrylate and N-methylol acrylamide, or the like.

The polymer latex and the method of synthesizing thereof are described in detail in JP-A-2-41, U.S. Pat. Nos. 2,852,386, 2,853,457, 3,411,911, 3,411,912 and 4,197,127, JP-B-45-5331, JP-A-60-18540 etc., and for example, there is a method in which a polymer obtained by emulsion polymerization or solution polymerization is dispersed again. By way of example, in the case of the emulsion polymerization the polymer is obtained by polymerization at about 30 to 100° C., preferably 60 to 90° C. for 3 to 8 hours under stirring in water as dispersion medium wherein a monomer is used in an amount of 10 to 50 wt % per water, and a polymerization initiator is used in an amount of 0.05 to 5 wt % and a dispersant in an amount of 0.1 to 20 wt % per the monomer.

The polymerization initiator includes water-soluble peroxides, water-soluble azo compounds or the like. The dispersant includes anionic surface active agents, nonionic surface active agents, cationic surface active agents and amphoteric surface active agents, in addition to the water-soluble polymer, and these may be used alone or in combination.

Specific examples of the polymer latex for use in the present invention are shown below, but the present invention is not limited to the following examples:

LA-1

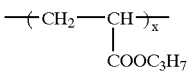

-continued

LA-2

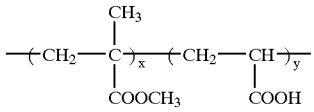

x:y = 96:4

LA-3

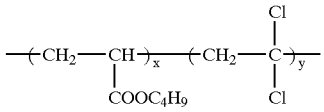

x:y = 97:3

LA-4

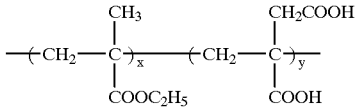

x:y = 98:2

LA-5

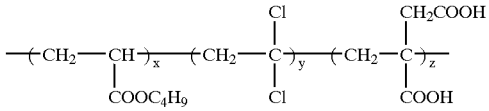

x:y:z = 80:16:4

LA-6

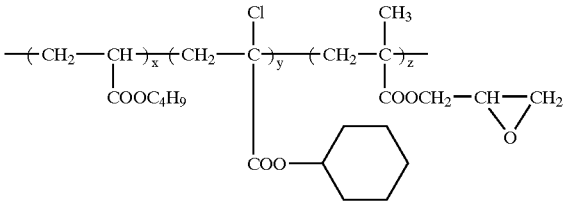

x:y:z = 60:30:10

LA-7

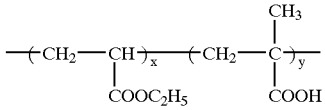

x:y = 95:5

The Tg (glass transition temperature) of the polymer for forming the polymer latex for use in the present invention is preferably 40° C. or less. The Tg of the polymer can be examined by Polymer Handbook (Wiley & Sons, 1966) and the Tg (° K.) of the copolymer is expressed as in:

$$Tg\ (\text{copolymer}) = v_1 Tg_1 + v_2 Tg_2 + \ldots + v_w Tg_w$$

wherein $v_1$, $V_2 \ldots V_w$ represent the percentage by weight of each monomer in the copolymer, and $Tg_1$, $Tg_2 \ldots Tg_w$ represent the Tg (° K.) of a homopolymer of each monomer in the copolymer. The Tg calculated according to this equation has a precision within ±5° C.

In the present invention, any polymer latex having an average particle diameter of 0.5 to 300 nm can be preferably used. The average particle diameter of the polymer latex can be measured by electron microphotography, soap titration, light scattering or centrifugation sedimentation which are described in "Chemistry of Polymer Latex" (published in 1973 by Kobunshi Kankokai), among which light scattering is preferably used.

The molecular weight of the polymer is not particularly specified, but the total molecular weight is preferably 1,000 to 1,000,000.

The amount of the latex to be coated in the present invention is preferably 40 mg/m$^2$ or more but 10 mg/m$^2$ or less, more preferably 50 mg/m$^2$ or more but 5 mg/m$^2$ or less.

In the present invention, a hydrophobic polymer having a melting point of 55 to 200° C. is contained in the layer containing a matt agent or in a layer thereon, and after formation of images, the polymer grains can be fused to form a protective layer. The hydrophobic polymer is preferably compounds described on page 3, lines 24 to 30, in EP 0 893 733 A1. The average particle diameter of the hydrophobic polymer is preferably in the range of 0.01 to 1 $\mu$m, particularly preferably 0.01 to 0.5 $\mu$m. The content of the hydrophobic polymer in the coated layer is preferably 30 to 95 wt %, and 5 to 70 wt % gelatin is preferably contained therein. Further, 5 to 45 wt % water-soluble polymer may be contained therein. Preferable examples of the water-soluble polymer are compounds described on page 4, lines 6 to 10, in EP 0 893 733 A1. Although the step of fusing the polymer grains after formation of images is not particularly limited, pressing involving pressurization under heating is preferable.

In the present invention, an aqueous coating substance consisting of 0.1 to 50 $\mu$m polymer and 1 to 3 wt % polymer latex binder is further coated on the matt agent-containing layer, and after formation of images, the polymer grains can be fused to form a protective layer. The polymer is preferably compounds described on page 3, lines 14 to 29, in EP 0 893 735 A1. The polymer latex is preferably compounds described on page 3, lines 48 to 50, in EP 0 893 735 A1. The average particle diameter of the polymer is preferably in the range of 0.01 to 50 $\mu$m, particularly preferably 0.01 to 15 $\mu$m. The content of the polymer is preferably 5 to 50 wt %. Although the step of fusing the polymer grains after formation of images is not particularly limited, pressing involving pressurization under heating is preferable.

The method of fusing the polymer in the matt agent-containing layer or in a layer thereon to form a protective layer in the present invention may use methods described in EP 0915372A1, EP 0915373A1, and EP 0915377A1.

In the present invention, known dispersion methods such as oil-in-water dispersion method or latex dispersion method using a high-boiling organic solvent, can be used in order to introduce photographic materials such as coupler, anti-fading agent and stain inhibitor into the silver halide light-sensitive material.

In the oil-in-water dispersion method, a coupler or other photographically useful compounds are dissolved in a high-boiling organic solvent, and can be emulsified and dispersed along with a dispersant, such as surfactant, in a hydrophilic colloid, preferably in an aqueous solution of gelatin by known apparatus such as sonicator, colloid mil, homogenizer, mantongorin (phonetic) and high-speed dissolver.

Further, an auxiliary solvent can be used for dissolving a coupler or photographically useful materials. The auxiliary solvent referred to here is an organic solvent useful at the time of emulsification and dispersion, and is removed substantially from the light-sensitive material after a drying step at the time of coating. Examples of such auxiliary solvents include e.g. lower alcohol acetates such as ethyl acetate and butyl acetate, as well as ethyl propionate, sec-butyl alcohol, methyl ethyl ketone, methyl isobutyl ketone, β-ethoxy ethyl acetate, methyl cellosolve acetate, methyl carbitol acetate, methyl carbitol propionate and cyclohexane.

As necessary, an organic solvent completely miscible with water, for example, methyl alcohol, ethyl alcohol, acetone, tetrahydrofuran and dimethyl formamide and the like can be partially used in combination. These organic solvents can also be used in combination thereof.

From the viewpoint of improvement of stability with the lapse of time in an emulsified dispersion during storage, restriction of a change in photographic performance in the form of a final coating composition mixed with an emulsion, and improvement thereof in stability with the lapse of time, all or a part of the auxiliary solvent can be removed as necessary from the emulsified dispersion by a method such as distillation under reduced pressure, noodle water washing or ultrafiltration.

The average particle size of the lipophilic fine grain dispersion thus obtained is preferably 0.04 to 0.50 $\mu$, more preferably 0.05 to 0.30 $\mu$, most preferably 0.08 to 0.20 $\mu$. The average particle size can be measured by use of e.g. a Coulter submicron particle analyzer model N4 (Coulter Electronics Ltd.).

From the viewpoint of rapid washing, a smaller amount of the high-boiling organic solvent and other photographically useful compounds to be used is preferable, and the ratio by weight of the total thereof to the coupler is preferably 0.05 or more but 8.0 or less, more preferably 0.1 or more but 3.0 or less, most preferably 0.1 or more but 2.5 or less. Further, a highly active coupler can also be used without using the high-boiling organic solvent.

In the present invention, examples of high-boiling organic solvents which can be preferably used are described in U.S. Pat. No. 2,322,027 and JP-A-10-221825. Specific examples of high-boiling organic solvents which are preferable from the viewpoint of color-forming property, color reproduction and image fastness are shown below.

1

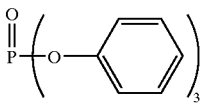

2

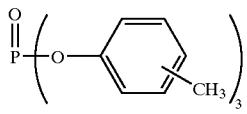

3

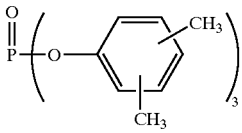

4

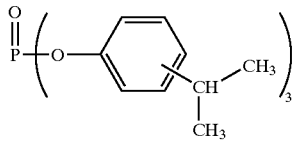

-continued
5
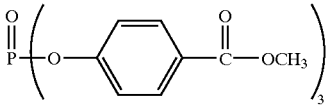
6
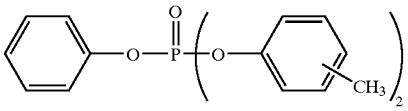
7
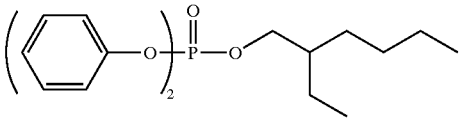
8
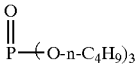
9
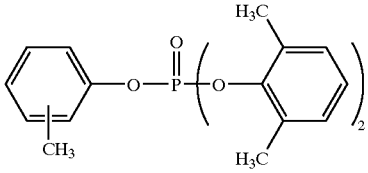
10
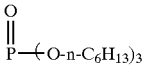
11
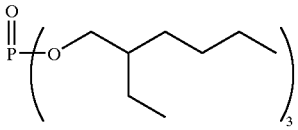
12
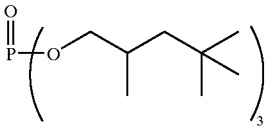
13
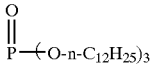
14
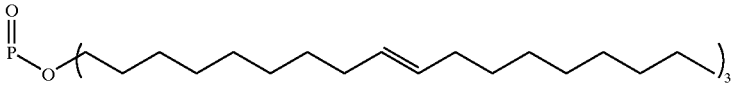
15
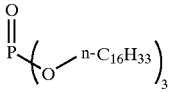
16
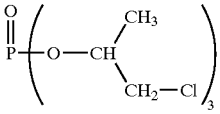
17
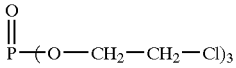
18
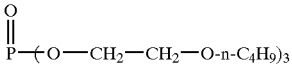
19
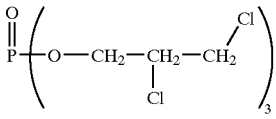
20
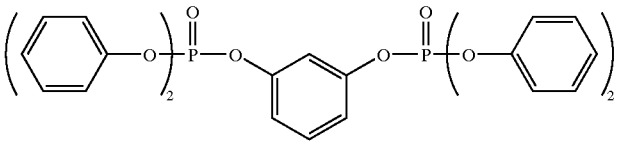
21
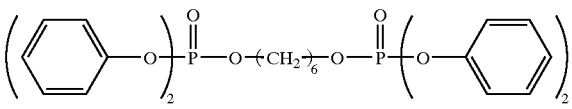
22
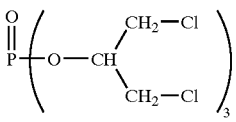
23
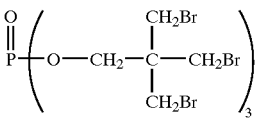
24
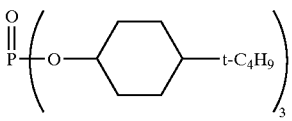
25
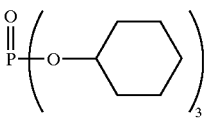

-continued
26
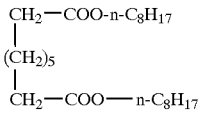
27
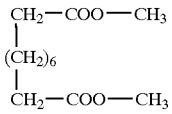
28
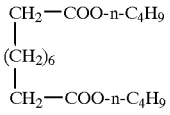
29
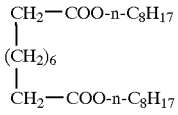
30
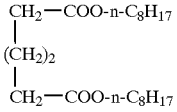
31
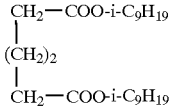
32
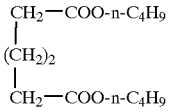
33
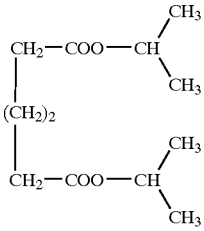
34
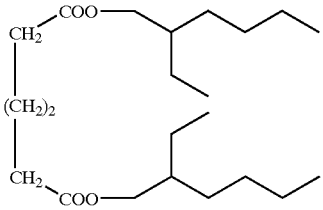
35
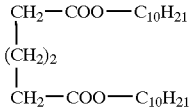
36
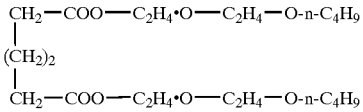
37
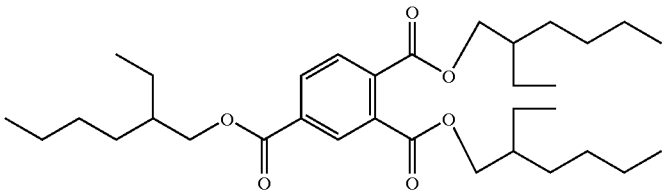
38
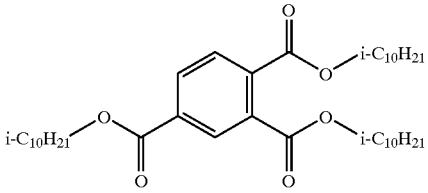
39
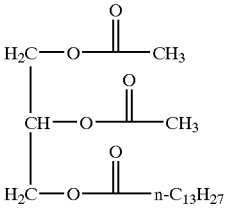
40
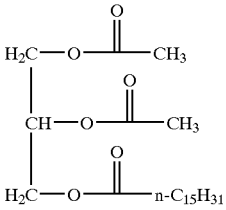
41
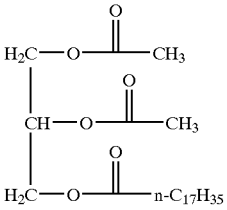

-continued
42
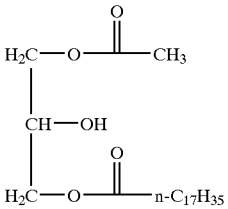
43
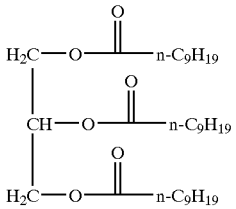
44
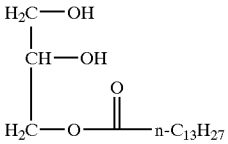
45
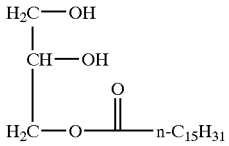
46
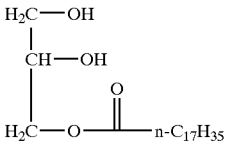
47
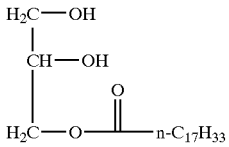
(oleyl)
48
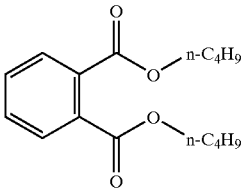
49
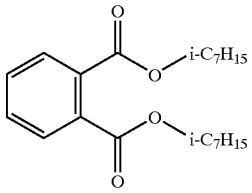
50
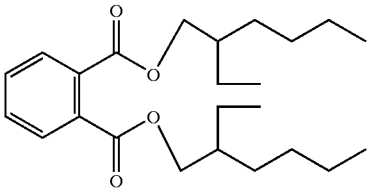
51
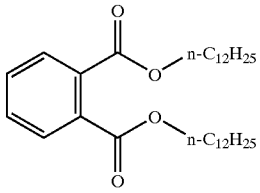
52
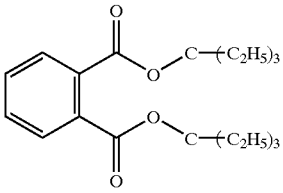
53
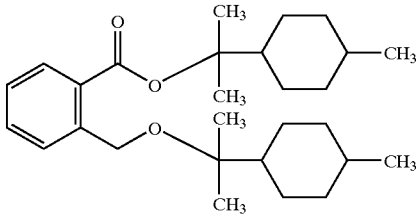
54
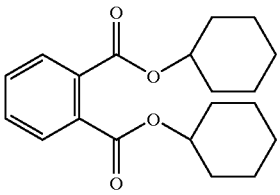
55
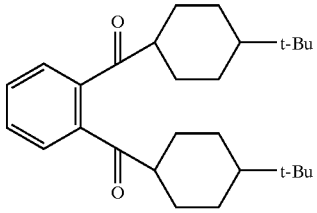
56
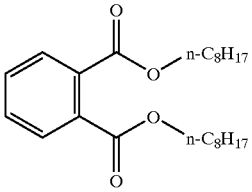
57
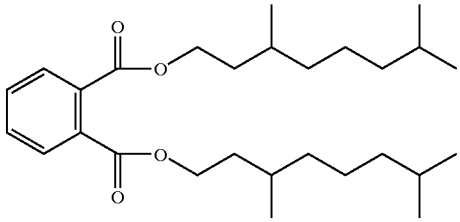

-continued
58
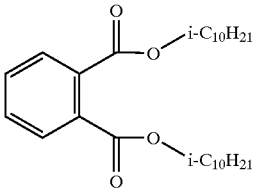
59
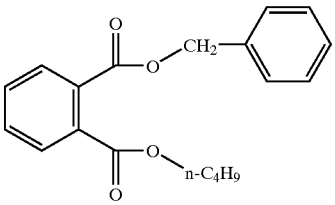
60
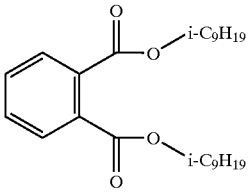
61
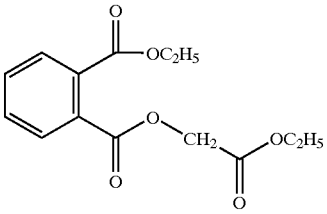
62
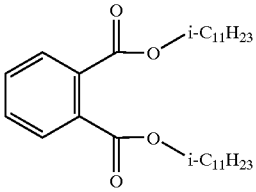
63
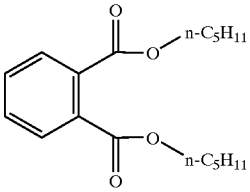
64
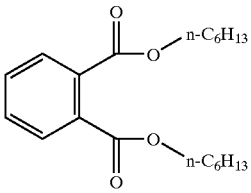
65
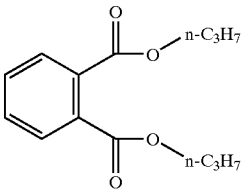
66
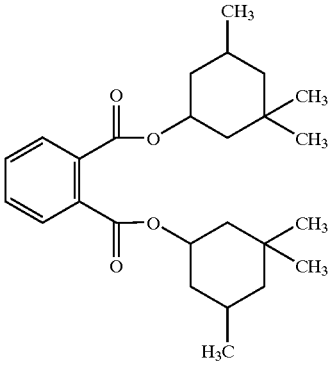
67
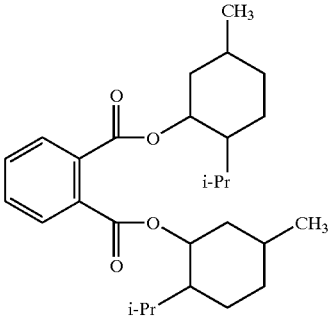
68
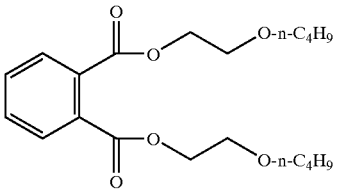
69
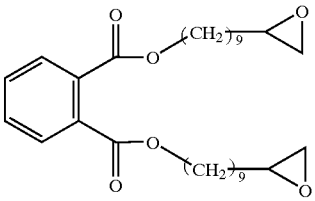
70
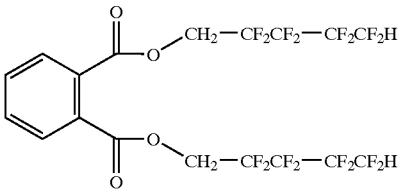
71
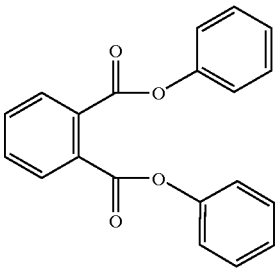

-continued
72
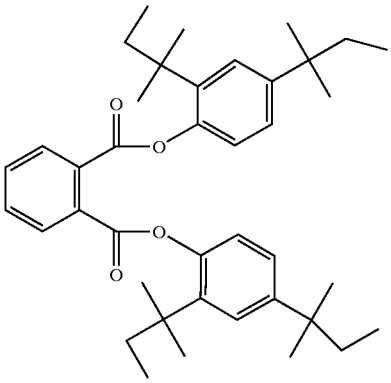
73
$n\text{-}C_{17}H_{33}$—COO-n-$C_4H_9$
74
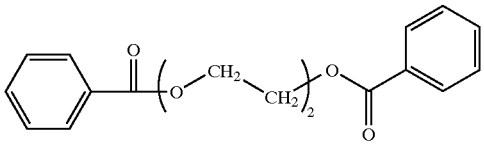
75
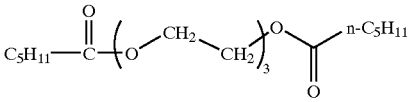
76
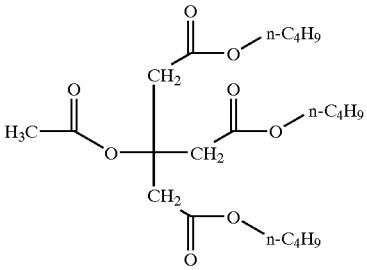
77
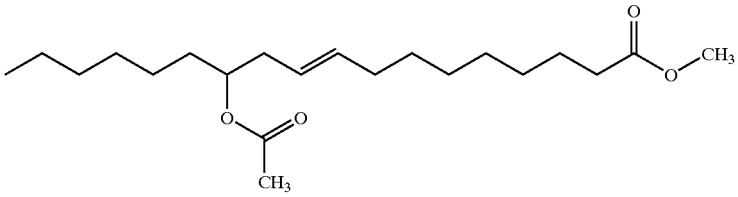
78
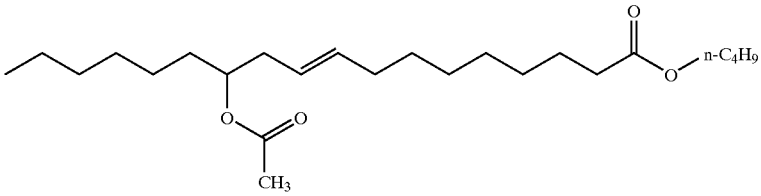
79
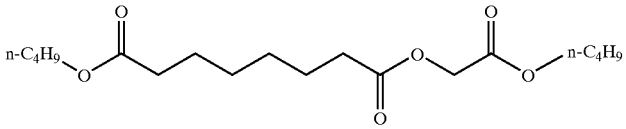
80
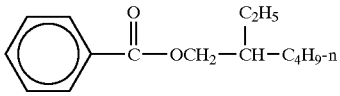
81
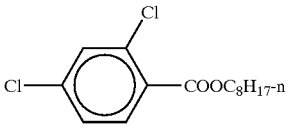
82
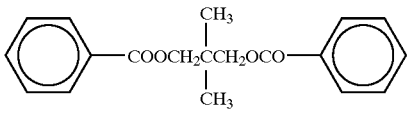
83
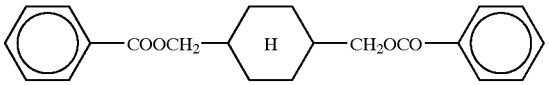

-continued
84
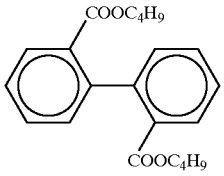
85
$n\text{-}C_{15}H_{31}COOC_{16}H_{33}\text{-}n$
86
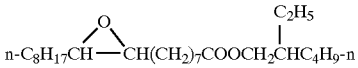
87
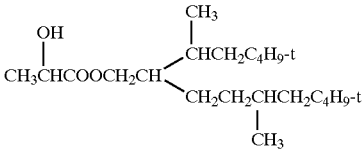
88
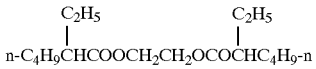
89
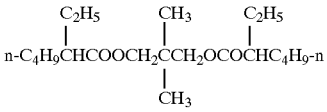
90
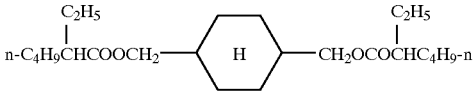
91
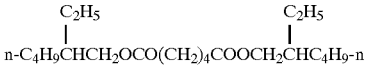
92
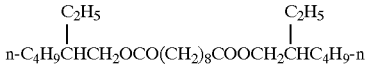
93
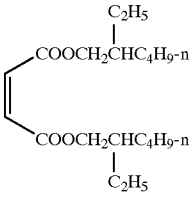
94
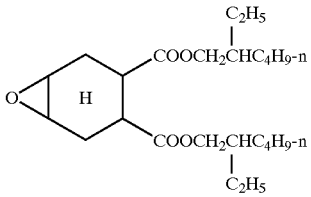
95
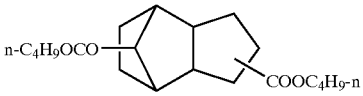
96
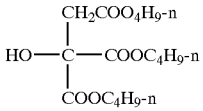
97
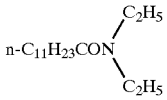
98
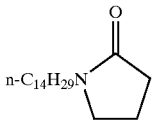
99
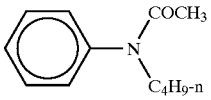
100
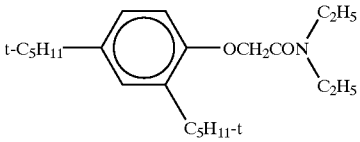
101
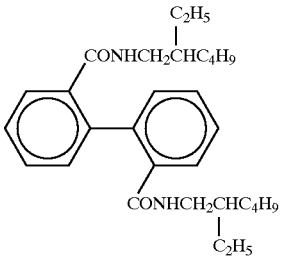
102
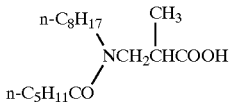
103
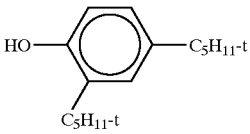

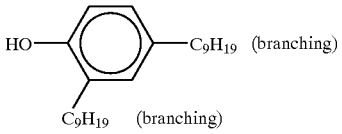
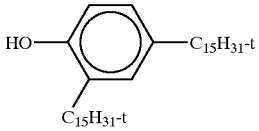
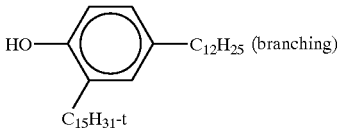
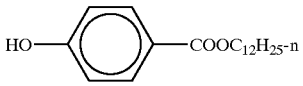
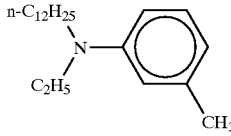
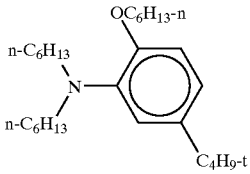
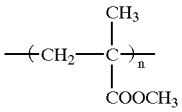
(average molecular weight 20,000)
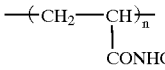
(average molecular weight 60,000)
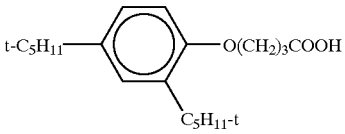
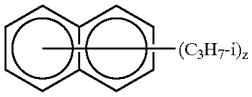
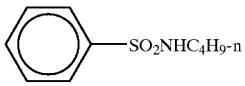
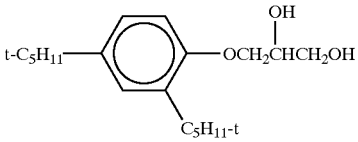
-continued
104
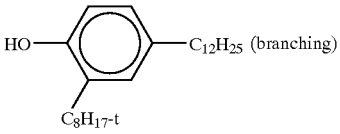
105
106
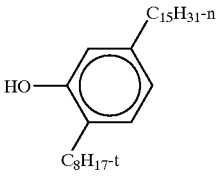
107
108
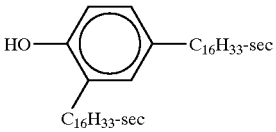
109
110
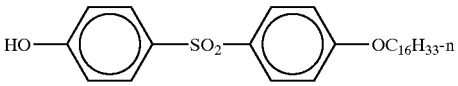
111
112
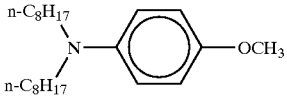
113
114
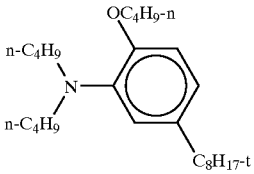
115
116
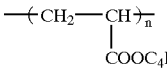
(average molecular weight 50,000)
117
118
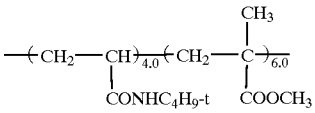
(average molecular weight 40,000)
119
120
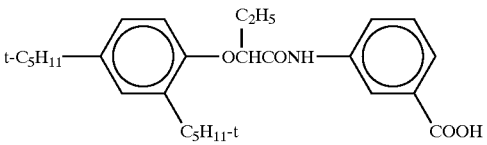
121
122
$C_nH_{2n+z}$ (A mixture of normal paraffins of n = 14, 15)
123
124
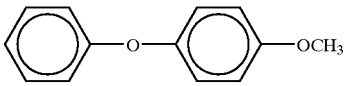
125
126
Chlorinated paraffin
(average composition $C_{14}H_{24}Cl_6$)
127

-continued

128 Chlorinated paraffin (average composition $C_{12}H_{18}Cl_8$)

129 Poly(chlorotrifluoroethylene (average molecular weight 900)

130

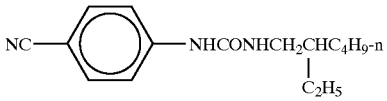

131

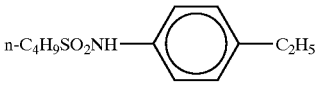

132

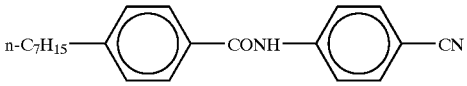

133

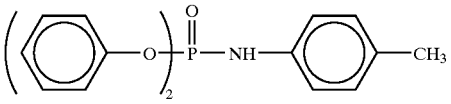

In the present invention, a known color-mixing prevention agent may be used. Among these, those described in the patent publications exemplified in the following are preferable.

For example, high-molecular-weight redox compounds described in JP-A-5-333501, phenidone- or hydrazine-series compounds described in Japanese patent application No. 9-140719 and U.S. Pat. No. 4,923,787, and white couplers described in JP-A-5-249637, JP-A-10-282615 and German Patent No. 19629142A1 may be used. Particularly in the case of intending to increase the pH of a developer and to accelerate development processing, redox compounds described in German Patent No. 19618786A1, European Patent No. 839623A1, European Patent No. 842975A1, German Patent No. 19806846A1 and French Patent No. 276046A1 are preferably used.

In the present invention, preferably compounds containing a triazine skeleton having high molar extinction coefficient are used as a ultraviolet light absorber. For example, compounds described in the following patent publications may be used.

These compounds are described, for example, in JP-A-46-3335, JP-A-55-152776, JP-A-5-197074, JP-A-5-232630, JP-A-5-307232, JP-A-6-211813, JP-A-8-53427, JP-A-8-234364, JP-A-8-239368, JP-A-9-31067, JP-A-10-115898, JP-A-10 -147577, JP-A-10-182621, German Patent No. 19739797A, European Patent No. 711804A, and JP-T-8-501291 ("JP-T" means published searched patent publication).

As the antiseptic and mildew-proofing agent that can be used in the present invention, those described in JP-A-63-271247 are useful. As the hydrophilic colloid used for the photographic layer constituting the light-sensitive material, gelatin is preferable, in which, particularly, heavy metals, such as iron, copper, zinc and manganese, which are contained as impurities, are preferably 5 ppm or less, and more preferably 3 ppm or less.

The amount of calcium contained in the light-sensitive material is preferably 20 mg/m$^2$ or less, more preferably 10 mg/m$^2$ or less and most preferably 5 mg/m$^2$ or less. As the protective layer used in the present invention, those described in U.S. Pat. No. 5,856,051 and No. 5,853,926 are preferably used, though any material may be used as far as it protects its under-layer.

The light-sensitive material of the present invention is suitable to a scanning exposure system using a cathode ray tube (CRT), besides the case where it is used as the usual printing system using a negative printer.

An exposure apparatus using a cathode ray tube is simpler, more compact and lower in cost than apparatuses using a laser. Also, the regulations of the light axis and color are easy.

As the cathode ray tube used for image exposure, various emitters (light-emittable substances) which emit in a spectrum range are used, according to necessity. For instance, any one of a red-light emitter, a green-light emitter and a blue-light emitter or combinations of two or more of these emitters are used. The spectrum range is not limited to the aforementioned red, green or blue, and fluorescent substances which emit in a yellow, orange, violet or infrared range may also be used. Especially, cathode ray tubes which combine these emitters with each other to emit white-light are often used.

When the light-sensitive material has plural light-sensitive layers with different distributions of spectral sensitivity, and the cathode ray tube also has a fluorescent substance(s) which emits in plural spectrum ranges, plural colors may be exposed to light simultaneously, specifically, image signals of plural colors may be input to the cathode ray tube to emit light from the tube surface. A method (exposure performed alternately side by side) may be adopted in which the image signals of each color are input alternately to emit each color alternately and exposure is carried out through a film which cuts colors except for the target color. In general, the exposure performed alternately side by side is preferable to obtain a high quality image because it can use a cathode ray tube with high resolution.

The light-sensitive material of the present invention is preferably used in a digital scanning exposure system using monochromatic high density light, such as a gas laser, light-emitting diode, semiconductor laser, and second harmonic-generating light-source (SHG) obtained by combining a semiconductor laser or a solid laser using a semiconductor laser as an exciting light source with a non-linear optical crystal. It is preferable to use a semiconductor laser or a second harmonic-generating light-source (SHG) obtained by combining a semiconductor laser or a solid laser with a non-linear optical crystal, to make the system compact and inexpensive. In order to design an apparatus which is compact and inexpensive and further has a long life and high stability in particular, the use of a semiconductor laser is preferable, and it is preferable to use a semiconductor laser in at least one of the light sources used for exposure.

When such a light source for scanning exposure is used, the maximum wavelength of spectral sensitivity of the light sensitive material according to the present invention may be optionally designed according to the wavelength of the light source for scanning exposure to be used. In the SHG light source obtained by combining a solid laser using a semiconductor laser as an exciting light source or a semiconductor laser with a non-linear optical crystal, blue light and green light can be obtained since the oscillation wavelength of a laser can be halved. It is possible to allow the light-sensitive material to have the maximum wavelength of spectral sensitivity in usual three wavelength ranges of blue, green and red accordingly.

The exposure time required for such a scanning exposure is preferably $10^{-4}$ sec or less and more preferably $10^{-6}$ sec or less, on the premise that it is defined as the time required for exposing a pixel size in the case where the density of a pixel is assumed to be 400 dpi.

In the present invention, the light-sensitive material may be provided with a latent image with a micro dot pattern, for the purpose of preventing unlicensed copying of the light-sensitive material which has been processed. This method is described in JP-A-9-226227.

Preferable scanning exposure systems which can be applied to the present invention are described in detail in the patents listed in the aforementioned table.

When the light-sensitive material of the present invention is processed, processing materials and processing methods described in JP-A-2-207250, page 26, right lower column, first line to page 34, right upper column, line 9, and JP-A-4-97355, page 5, left upper column, line 17 to page 18, right lower column, line 20, are preferably used. Also, as the preservative used for the developer, the compounds described in the patents listed in the aforementioned table are preferably used.

In the present invention, in order to improve the expression of an image, represented by, for instance, the depiction of high image quality, especially, metallic texture, in which densities in micro areas vary greatly, and to be able to correspond with a wide range of exposure time, it is preferable to impart the following photographic characteristics to the light-sensitive material.

In the present invention, the maximum gamma in a range where, when gradation exposure is performed in a time period of $10^{-4}$ sec, the density after processing would be 1.5 to 2.0, is 1.1 or more and less than 4.2, and preferably 2.2 to 3.2, with regard to all of yellow, magenta and cyan. The meaning of such a definition that the maximum gamma is 1.1 or more and less than 4.2 is as follows. Specifically, the gradation exposure of each developed color is carried out through an optical wedge in a strobo-type exposure apparatus, in which the emission time is controlled to $10^{-4}$ sec, or in an exposure apparatus, in which the shutter speed is set to $10^{-4}$ sec so that the light from the light source is irradiated just for $10^{-4}$ sec, and after color-development processing, then sensitometry is performed to obtain a characteristic curve; in such a manner the maximum gamma in the range where the density in the characteristic curve would be 1.5 to 2.0 is 1.1 or more and less than 4.2 with regard to yellow, magenta and cyan. Here, the above maximum gamma is defined based on the density after processing when the gradation exposure is performed for $10^{-4}$ sec. However, this does not mean that the silver halide color photographic light-sensitive material of the present invention is limited to those exposed at high intensity for $10^{-4}$ sec.

In the present invention, each difference in the maximum gamma is within 1.0, preferably within 0.5 and most preferably within 0.3.

Also, besides the photographic characteristic in the above gradation exposure performed with an exposure time of $10^{-4}$ sec, more preferably the maximum gamma in a range where, when gradation exposure is performed for an exposure time of 1/10 sec, the density after processing would be 1.5 to 2.0, is 1.1 or more and less than 4.0, and preferably 2.2 to 3.2, with regard to all of yellow, magenta and cyan; and each difference in the above maximum gamma is within 1.0, preferably within 0.5 and most preferably within 0.3.

The "characteristic curve" referred to in the specification is a so-called D-log E curve made by plotting D (density) as the parameter of the ordinate against Log E (E is an exposure amount) as the parameter of the abscissa. It is explained in detail, for example, in "The Theory of the Photographic Process" edited by T. H. James, the fourth edition, pp. 501–509.

In the present invention, the "density" is a value including a fog (generally about 0.1).

Also, the "gamma" represents a differential value at an optional point on the characteristic curve and is a so-called "point gamma," which is defined in ibid., page 502.

The high-silver-chloride emulsion used in the present invention is generally poor in intrinsic sensitivity of emulsion particles to blue light with a wavelength of 400 to 500 nm. It is therefore desirable to improve insufficient saturation (chroma) caused by poor sensitivity of emulsion particles to blue light, particularly insufficient tone-reproduction of color shading in the red-color high-density portions, by conventionally known techniques. For instance, a method in which a green-sensitive spectral sensitizing dye is added to a cyan coupler-containing red-sensitive emulsion layer, as described in European Patent No. 304,297A2, or a method in which a blue-sensitive and/or a green-sensitive spectral sensitizing dye are added to a cyan coupler-containing red-sensitive high-silver-chloride emulsion layer, as described, for example, in JP-A-2-129628, JP-A-4-134336 and JP-A-8-87089, is preferably used. As to each color-sensitive sensitizing dye in the present invention, preferably the wavelength of a peak of spectral sensitivity when the dye is absorbed onto a silver chloride emulsion, is in a range between about 590 and 720 nm in the case of a red-sensitive sensitizing dye, in a range between about 510 and 590 nm in the case of a green-sensitive sensitizing dye, and in a range of about 390 and 510 nm in the case of a blue-sensitive sensitizing dye.

As measures to improve the whiteness of the support, a fluorescent whitening agent may be contained in a water-resistant resin layer of the support used in the present invention. As a preferable fluorescent whitening agent, the compounds described in JP-A-9-203984, JP-A-9-204001, JP-A-6-123949, JP-A-2-188573, JP-A-3-91740, JP-A-3-65948, JP-A-2-254440, JP-A-2-71256, JP-A-2-168249, JP-A-1-262538, JP-A-50-66234 and U.S. Pat. No. 4,794,071 and No. 3,501,298 may be used.

As the silver halide particles contained in the silver halide emulsion that can be used in the present invention, cubic or tetradecahedron crystal particles substantially having a {100} plane (these crystal particles may have a round particle top and high-order planes), octahedron crystal particles, or tabular particles in which 50% or more of all the projected areas thereof consists of a {100} or {111} plane and have an aspect ratio of 2 or more, are preferable. The aspect ratio is a value obtained by dividing the diameter of a circle equivalent to the projected area by the thickness of the particle. In the present invention, cubic particles, tabular particles having a {100} plane as its principal plane or tabular particle having a {111} plane as its principal plane are preferably adopted. Moreover, among {100} tabular particles, those having a neighboring side ratio of 10 or less are preferred. This neighboring side ratio means a value obtained by dividing a longer side among neighboring two sides by a smaller side. As the neighboring side ratio is closer to 1, the principal plane is closer to a square.

The silver halide emulsion used in the present invention is silver chloride, silver chlorobromide, silver chloroiodide or silver chlorobromoiodide, each having a silver chloride content of 95 mol % or more. The content of silver chloride is preferably 95 to 99.9 mol % and more preferably 98 to 99.9 mol %. The content of silver iodide is preferably 0.01 to 1 mol % and more preferably 0.1 to 0.5 mol %. The content of silver bromide is preferably 0.05 to 5 mol % and more preferably 0.1 to 2 mol %.

Here, the tabular silver halide particles which are preferably used in the present invention will be explained in detail.

In the present invention, the tabular particles are those having an aspect ratio of 1.2 or more, and the average aspect ratio means an average of aspect ratios of all the tabular particles in the emulsion. The greater the aspect ratio is, the thinner the thickness of the particle is, and hence the flatter the particle is. The thickness indicates the distance between two principal planes of the tabular particle and the average thickness means an average of the thickness of all tabular particles. The projected diameter of the tabular particle indicates the diameter of a circle having the area equivalent to the projected area when the principal plane is placed in parallel to the substrate surface and it is viewed from above the direction perpendicular to the substrate surface. In the present invention, a "circle equivalent diameter" or a "projected area equivalent diameter" is used in the same meaning as the "projected diameter". Preferably the circle equivalent diameter of the silver halide tabular particle for use in the present invention is 0.2 to 1.0 $\mu$m.

A preferable {111} tabular particle and {100} tabular particle in the present invention will be hereinafter explained. A pair of parallel surfaces perpendicular to the direction of the thickness of a tabular particle are called principal planes.

The {111} tabular particle is a tabular particle having a {111} plane as its principal plane.

Methods are known in which an additive (a crystal phase control agent) is added at the time of particle formation, to form a particle having a {111} plane as its outer surface. These methods are shown below.

| Patent No. | Crystal phase control agent | Inventor |
|---|---|---|
| U.S. Pat. No. 4,400,463 | Azaindenes + thioether peptizer | Mascaski |
| U.S. Pat. No. 4,783,398 | 2-4-dithiazolidinone | Mifune, et al. |
| U.S. Pat. No. 4,713,323 | Aminopyrazolopyrimidine | Mascaski |
| U.S. Pat. No. 4,983,508 | Bispyridinium salt | Ishiguro, et al. |
| U.S. Pat. No. 5,185,239 | Triaminopyrimidine | Mascaski |
| U.S. Pat. No. 5,178,997 | 7-azaindole-series compound | Mascaski |
| U.S. Pat. No. 5,178,998 | Xanthine | Mascaski |
| JP-A-64-70741 | Dye | Nishikawa, et al. |
| JP-A-3-212639 | Aminothioether | Ishiguro |
| JP-A-4-283742 | Thiourea derivatives | Ishiguro |
| JP-A-4-335632 | Triazolium salt | Ishiguro |
| JP-A-2-32 | Bispyridinium salt | Ishiguro, et al. |
| JP-A-8-227117 | Monopyridinium salt | Ohzeki, et al. |

As aforementioned, methods using various crystal phase control agents are disclosed. The compounds (compound examples 1 to 42) described in JP-A-2-32 are preferable and crystal phase control agents 1–29 described in JP-A-8-227117 are particularly preferable. However, the present invention is not limited to these compounds.

The {111} tabular particle can be obtained by forming two parallel twin planes. The formation of the twin plane depends upon temperature, a dispersion medium (gelatin), the concentration of a halogen and the like. It is therefore necessary to determine proper conditions concerning these parameters. In the case where the crystal phase control agent is allowed to exist when the core (nucleus) is formed, the concentration of gelatin is preferably 0.1% to 10%. The concentration of chloride is preferably 0.01 mol/l or more and more preferably 0.03 mol/l or more.

It is disclosed in JP-A-8-184931 that preferably the crystal phase control agent is not used in the formation of the core to form a monodispersion of particles. When the crystal phase control agent is not used in the formation of the core, the concentration of gelatin is preferably 0.03% to 10% and more preferably 0.05% to 1.0%. The concentration of chloride is preferably 0.001 mol/l to 1 mol/l and more preferably 0.003 mol/l to 0.1 mol/l. Although the core formation temperature may be optionally selected in a range between 2° C. to 90° C., it is preferably 5° C. to 80° C. and particularly preferably 5° C. to 40° C.

The core of a tabular particle is formed in the first stage of core formation and many cores other than those of tabular particles are included in a reaction container just after the core is formed. This is why a technique is required to carry out ripening after the core is formed, to allow only tabular particle to remain and to make other particles become extinct. If the usual Ostwald ripening is performed, the core of a tabular particle is also dissolved and becomes extinct, and hence all cores of tabular particles decrease with the result that the resulting tabular particles are increased in size. In order to prevent this, the crystal phase control agent is added. In particular, a phthalated gelatin is additionally used, to enhance the effect of the crystal phase control agent to thereby prevent the dissolution of tabular particles. The pAg during ripening is of particular importance and is preferably 60 to 130 mV to a silver/silver chloride electrode.

Then, the formed core is grown, in the presence of the crystal phase control agent, by physical ripening and by addition of a silver salt and a halide. In this case, the concentration of the chloride is preferably 5 mol/l or less and more preferably 0.05 to 1 mol/l. The temperature during the growth of particles may be selected in a range between 10° C. and 90° C., and it is preferably in a range between 30° C. and 80° C.

The total amount of the crystal phase control agent to be used is preferably $6\times10^{-5}$ mol or more and particularly preferably $3\times10^{-4}$ mol to $6\times10^{-2}$ mol, based on 1 mol of silver halide in the finished emulsion. The crystal phase control agent may be added at any time during core formation, physical ripening and particle growth process for silver halide particles. After the addition, the formation of {111} planes starts. The crystal phase control agent may be added in a reaction container in advance. When tabular particles with a small size are formed, it is preferable that the crystal phase control agent be added in the reaction container along with the growth of particles and be increased in its concentration.

If the amount of the dispersion medium used in the formation of a core is insufficient for the growth, the dispersion medium must be added to compensate. It is preferable for the growth that the gelatin be present in an amount of 10 g/l to 100 g/l. As the gelatin to be added to compensate, phthalated gelatin or trimellitate gelatin is preferable.

The pH during the formation of particles is optional, and it is preferably in the range from a neutral zone to an acidic zone.

The {100} tabular particle will be explained. The {100} tabular particle is a tabular particle having a {100} plane as its principal plane. Examples of the shape of the principal plane include a rectangle shape, a triangle, tetragon or pentagon shape that is formed from said rectangle by deleting one corner thereof (the deleted shape means a right triangle section which is formed from a vertex of the corner and sides forming the corner), and a tetragon, pentagon, hexagon, heptagon or octagon shape that is formed from said rectangle having 2 to 4 deleted shapes as mentioned in the above.

A rectangle formed by supplementing the deleted sections is defined as a supplemented tetragon. The neighboring side ratio (the length of the long side/the length of the short side) of the rectangle and the supplemented tetragon is preferably 1 to 6, more preferably 1 to 4 and still more preferably 1 to 2.

The tabular silver halide emulsion particles having a {100} principal plane are formed, by adding an aqueous silver salt solution and an aqueous halide solution to a dispersion medium, such as an aqueous gelatin solution, while stirring, and mixing these. The method adopted at this time is disclosed in, for example, JP-A-6-301129, JP-A-6-347929, JP-A-9-34045 and JP-A-9-96881. In this method, silver iodide or a iodide ion, or alternatively silver bromide or a bromide ion is made to exist, and a strain in the core is caused by difference in the size of a crystal lattice between the above silver halide or halide ion and silver chloride, to introduce a crystal defect which imparts anisotropic growth characteristics, such as screw dislocation. When the screw location is introduced, the formation of a two-dimensional core on the plane is not a rate-determining step in a lower supersaturated condition. Thus crystallization on this plane proceeds, to form tabular particles by introducing the screw dislocation. Here, the lower supersaturated condition indicates a condition obtained by adding in an amount preferably 35% or less and more preferably 2 to 20% of that added in critical condition. It is not confirmed that the crystal defect is screw dislocation. However, this crystal defect is considered to be highly possibly a screw dislocation, when account is taken of the direction in which the dislocation is introduced, or of the fact that anisotropic growth characteristics are imparted to the particles. In order for the tabular particle to be thinner, it is preferable to maintain the introduced dislocation as disclosed in JP-A-8-122954 and JP-A-9-189977.

JP-A-6-347928 discloses a method using imidazoles or 3,5-diaminotriazoles and JP-A-8-339044 discloses a method using polyvinyl alcohols: by adding these compounds as a {100} plane-forming accelerator, the {100} tabular particle is formed. Moreover, the {100} tabular particle may be prepared by each method disclosed, for example, in U.S. Pat. No. 5,320,935, No. 5,264,337, No. 5,292,632, No. 5,314,798 and No. 5,413,904 and WO94/22051. However, the present invention is not limited to these methods.

Preferably the particle for use in the present invention has a so-called core/shell structure comprising a core section and a shell section enclosing the core section. Preferably the core section contains silver chloride in an amount of 90 mol % or more. The core section may comprise two or more sections with different halogen compositions. The shell section occupy preferably 50% or less, and particularly preferably 20% or less, of the total volume of the particle. The shell section is preferably made of silver chloroiodide or silver chlorobromoiodide. The shell section contains iodine in an amount of preferably 0.5 mol % to 13 mol % and particularly preferably 1 mbl % to 13 mol %. The content of silver iodide in the whole particle is preferably 5 mol % or less and particularly preferably 1 mol % or less.

Preferably the content of silver bromide is also higher in the shell section than in the core section. The content of silver bromide is preferably 20 mol % or less and particularly preferably 5 mol % or less.

In the silver halide emulsion for use in the present invention, the principal plane of the particles, which occupy preferably 50 to 100%, more preferably 80 to 100%, still more preferably 90 to 100% and particularly preferably 95 to 100% of the sum of the projected area of total silver halide particles, is a {100} plane or {111} plane and has an average thickness preferably less than 0.3 μm, more preferably 0.01 to 0.30 μm, still more preferably 0.02 to 0.20 μm and particularly preferably 0.05 to 0.15 μm and an average aspect ratio of preferably 2.0 to 100, more preferably 2.0 to 50, still more preferably 4.0 to 50 and particularly preferably 6.0 to 50. An average aspect ratio of 2 to 20 is particularly preferred. The coefficient of variation in projected area or thickness (the standard deviation of distribution/average-projected diameter or average thickness) is preferably 0 to 0.4, more preferably 0 to 0.3 and further preferably 0.01 to 0.2.

The tabular high-silver-chloride emulsion particles having a {100} or {111} plane as its principal plane may be prepared in more detail by each of the methods disclosed, for example, in JP-A-6-138619, U.S. Pat. No. 4,399,215, No. 5,061,617, No. 5,320,938, No. 5,264,337, No. 5,292,632, No. 5,314,798 and No. 5,413,904 and WO94/22051.

The silver halide tabular particles for use in the present invention may be used in any of emulsion layers, such as a silver halide emulsion layer containing a yellow dye-forming coupler, a silver halide emulsion layer containing a magenta dye-forming coupler, and a silver halide emulsion layer containing a cyan dye-forming coupler. It is used preferably in at least one of a silver halide emulsion layer containing a yellow dye-forming coupler and a silver halide emulsion layer containing a magenta dye-forming coupler, and most preferably in a silver halide emulsion layer containing a yellow dye-forming coupler.

Among the silver halide particles, such as cubic, tetradecahedron or octahedron crystal particles having a {100} plane, which are not tabular particles, according to the present invention, cubic particles having a {100} plane are preferred.

The average particle diameter of these silver halide particles is preferably 0.2 μm to 2 μm. Its distribution state is a monodispersion more preferably. The monodispersion emulsion is an emulsion having the distribution of particles in which the coefficient of variation (S/average r) with regard to the particle diameter of the silver halide particles is preferably 0.25 or less and more preferably 0.15 or less. Here, the average r is an average particle diameter and S is a standard deviation as regards the particle diameter. Specifically, when the particle diameter of individual emulsion particle is ri and the number of the particles is ni, the average particle diameter r is defined by the following equation:

$$r = \frac{\sum ni \cdot ri}{\sum ni}$$

and the standard deviation S is defined by the following equation:

$$s = \sqrt{\frac{\sum (\bar{r} - ri)^2 \cdot ni}{\sum ni}}$$

Here, the diameter of an individual particle has the same meaning as the aforementioned "projected diameter", "circle equivalent diameter" and "projected area equivalent diameter.".

It is preferable that the average particle diameter of silver halide emulsion particles contained in each one of the silver halide emulsion layer used in the present invention does not become larger, according to the distance of each layer from the support. Specifically, the average particle diameter of particles contained in one emulsion layer is preferably the same as or lower than that of particles contained in the closest emulsion layer which is inside portion (at the support side). The term "the same as" referred to herein means that the ratio of the above two average particle diameters is 0.95 to 1.05 (within ±5%) and more preferably within ±2%.

As the aforementioned silver halide particle, similar to the tabular particles as mentioned in the above, any one of the following particles may be selected optionally and used. Examples of these particles include particles having a so-called uniform-type structure in which any portion in a silver halide particle has the same composition with regard to the distribution of halogen composition inside of the silver halide emulsion particle, particles having a so-called laminate (layered)-type structure in which the core and the shell (one or plural layers) enclosing said core in the silver halide particle are different from each other in the halogen composition, and particles having a structure in which portions having different halogen compositions are present non-layer-wise in the inside or surface of the particle (a structure in which portions with different compositions are joined with each other on the edge, corner or surface of the particle in the case where these portions are present in the surface of the particle). The use of either one of the latter two types of particle is more advantageous than the use of the uniform-type structure particle, in order to obtain high sensitivity, and it is also preferable in the viewpoint of resistance to pressure. When the silver halide particles have the above structure, the boundary portion between portions having different halogen compositions may be a clear boundary, or an unclear boundary in which a mixed crystal is formed due to a difference in composition, or those allowed positively to have a continuously varied structure.

Among these, phases containing a specific halogen component in a high content, such as a silver iodide-rich phase and a silver bromide-rich phase are given. As described in JP-A-3-84545, there is the case where as the former, high-silver-chloride particles containing 0.01 to 3 mol % of silver iodide on the emulsion particle surface are preferably used, but it is preferable that the particles are preferably provided with a silver bromide-rich phase.

The silver bromide-rich phase may be formed in the vicinity of a vertex of the particle through the following process. Firstly, bromine ions or silver bromide fine particles are supplied to host silver halide particles, to precipitate a new silver halide phase richer in silver bromide on the surface of the host silver halide particles. This process using, for example, bromine ions is run through a process so-called "halogen conversion" by an exchange reaction between the bromine ions and halogen ions on the surface of the host silver halide particles. On the other hand, the process using silver bromide fine particles is run by a reaction so-called "recrystallization" aiming at the preparation of more stable composition of crystals between the host silver halide particles and the silver bromide fine particles, which reaction has contents considered to be distinguished from the conversion reaction. In such a reaction for recrystallization, the driving force of the reaction is an increase in entropy, showing that this reaction is quite different from that of the Ostwald ripening. There are descriptions concerning this fact, for example, by H. C. Yutzy in "Journal of American Chemical Society" page 59916 (1937). It is surprising that the vicinity of a vertex of the host particle is selected as the position at which a new phase richer in silver bromide is formed in both of these reactions, despite that these two reactions differ utterly from each other. However, this is a widely known phenomenon.

The silver halide composition of the aforementioned silver bromide-rich phase is those having a silver bromide content of preferably at least 10 mol % and more preferably exceeding 20 mol %.

Further explanations will be continued with regard to the silver halide emulsion containing silver halide particles having a tabular, cubic or the like form which is preferably used in the present invention.

Various polyvalent metal ion impurities may be introduced into the silver halide emulsion used in the present invention in a process of forming emulsion particles or in a physical ripening step. Examples of the compounds of the metal to be used include salts or complex salts of metal of group VIII in the periodic table such as iron, iridium, ruthenium, osmium, rhenium, rhodium, cadmium, zinc, lead, copper and thallium, which may be used in combination. In the present invention, compounds of metal such as iron, ruthenium, osmium or rhenium which have at least four cyano ligands further improve the sensitivity at high intensity and also restrain latent image-sensitization and are hence particularly desirable. The amount of these compounds to be used is preferably $10^{-9}$ to $10^{-2}$ mol per one mol of silver halide, though its range is widespreading according to the purpose. These metal ions will be explained in more detail, which are not limiting of the present invention.

The iridium ion-containing compounds are trivalent or tetravalent salts or complex salts with the complex salts being preferable. For example, complex salts of halogens, amines, or oxalato, such as iridous (III) chloride, iridous (III) bromide, iridium (IV) chloride, sodium hexachloroiridate (III), potassium hexachloroiridate (IV), hexammineirridium (IV) salts, trioxalatoiridium (III) salts and trioxalatoiridium (IV) salts, are preferable. The platinum ion-containing compounds are divalent or tetravalent salts or complex salts with complex salts being preferable. For instance, platinum (IV) chloride, potassium hexachloroplatinate (IV), tetrachloroplatinic (II) acid, tetrabromoplatinic (II) acid, sodium tetraxis(thiocyanato)platinate (IV) and hexammineplatinum (IV) chloride are used.

The palladium ion-containing compounds are generally divalent or tetravalent salts or complex salts with complex salts being particularly preferable. For instance, sodium tetrachloropalladate (II), sodium tetrachloropalladate (IV), potassium hexachloropalladate (IV), tetramminepalladium (II) chloride and potassium tetracyanopalladate (II) are used. As the nickel ion-containing compounds, for example, nickel chloride, nickel bromide, potassium tetrachloronickelate (II), hexamminenickel (II) chloride and sodium tetracyanonickelate (II) are used.

As the rhodium ion-containing compounds, trivalent salts or complex salts are generally preferable. For example, potassium hexachlororhodate, sodium hexabromorhodate and ammonium hexachlororhodate are used. The iron-containing compounds are compounds containing a divalent or trivalent iron ion, preferably iron salts or iron complex salts, which are soluble in water in the range of concentration to be preferably used and particularly preferably iron complex salts that are easily contained in silver halide particles. Examples of the iron complex salts include ferrous chloride, ferric chloride, ferrous hydroxide, ferric hydroxide, ferrous thiocyanide, ferric thiocyanide, hexacyanoiron (II) complex salts, hexacyanoiron (III) complex salts, ferrous thiocyanate complex salts and ferric thiocyanate complex salts. Six-coordinate metal complexes having at least 4 cyan ligands as described in European Patent No. 336,426A are also preferably used.

The aforementioned metal ion-providing compound may be contained in the silver halide particles for use in the present invention by the following measures. For example, the metal ion-providing compound is added, at the time of forming the silver halide particles, in a dispersion medium, such as an aqueous gelatin solution, aqueous halide solution, aqueous silver salt solution or aqueous solution of other compounds, or in the form of a silver halide fine particles made to contain the metal ion in advance, and the fine particles are then dissolved. Also, the metal ion used in the present invention is made to be contained in the particles either before or during or just after the formation of particles. This timing may be changed depending on which position of the particle to select as the place where the metal ion is to be contained.

The process of preparing the silver halide emulsion in the present invention, as is widely known in general, involves a step of forming silver halide particles by a reaction between a water-soluble silver salt and a water-soluble halide, a desalting step and a chemical ripening step.

The silver halide emulsion used in the present invention is generally subjected to chemical sensitization. As to the chemical sensitization method, sulfur sensitization typified by the addition of an unstable sulfur compound, noble metal sensitization typified by gold sensitization, and reduction sensitization may be used independently or in combination. As compounds used for the chemical sensitization, those described in JP-A-62-215272, page 18, right lower column to page 22, right upper column are preferably used.

The silver halide emulsion used in the present invention is preferably subjected to gold sensitization as is known in this industrial field. This is because the gold sensitization can further decrease a variation in the photographic properties when scanning exposure is performed using laser light or the like. To carry out chemical sensitization, a compound such as chloroauric acid or its salt, or gold thiocyanates or gold thiosulfates may be used. The amount of each of these compounds to be added is preferably $5\times10^{-7}$ to $5\times10^{-3}$ mol and more preferably $1\times10^{-6}$ to $1\times10^{-4}$ mol per one mol of silver halide, though it may be changed in a wide range according to the case.

In the present invention, gold sensitization may be used in combination with other sensitizing method, for example, sulfur sensitization, selenium sensitization, tellurium sensitization, reduction sensitization, or noble metal sensitization using a noble metal other than a gold compound.

The silver halide emulsion used in the present invention may contain various compounds for the purpose of preventing fogs during the production step, storage and photographic processing of the emulsion or the light-sensitive material, or for the purpose of stabilizing the photographic properties. Namely, many compounds known as the anti-foggant or stabilizer may be added. Examples of these compounds include azoles, e.g., benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiaidiazoles, aminotriazoles, benzotriazoles, nitrobenzotriazoles, mercaptotetrazoles (particularly, 1-phenyl-5-mercaptotetrazole and the like), mercaptopyrimidines, mercaptotriazines; thioketo compounds, e.g., oxadoline thion; azaindenes, e.g., triazaindenes, tetrazaindenes (particularly, 4-hydroxy substituted (1,3,3a, 7)tetrazaindene), pentazaindenes; benzenethiosulfonic acid, benzenesulfinic acid, benzenesulfonic acid amide. Particularly preferable compounds are mercaptotetrazoles. These mercaptotetrazoles are preferable since they have the ability of more increasing sensitivity at high intensity, in addition to the aforementioned abilities of preventing fogging and improving the stability.

In the present invention, the color-development time means the time which elapses since the light-sensitive material is introduced into a color-developer until it is introduced in a bleach-fixing solution in the subsequent processing step. For instance, when the light-sensitive material is processed in, for example, an automatic developing machine, the color-development time means the sum of both the time (a so-called time-in-solution) during which the light-sensitive material is immersed in a color-developer and the time (a so-called time-in-air) during which the light-sensitive material is taken out of the color-developer and conveyed in air towards a bleach-fixing bath in the subsequent step. Likely, the bleach-fixing time means the time which elapses since the light-sensitive material is introduced into a bleach-fixing solution until it is introduced into a washing or stabilizing bath in the subsequent step. Also, the washing or stabilizing time means the time (a so-called time-in-solution) during which the light sensitive material is held in a solution since it is introduced into a washing or stabilizing solution until it is taken out toward a drying step.

In a rapid processing at which the present invention aims, the color-development time is preferably 30 sec or less, more preferably 20 sec or less, and most preferably 15 sec or less and 6 sec or more. Likely the bleach-fixing time is preferably 30 sec or less, more preferably 20 sec or less, and most preferably 15 sec or less and 6 sec or more. Also, the washing or stabilizing time is preferably 40 sec or less, more preferably 30 sec or less, and most preferably 20 sec or less and 6 sec or more.

As a drying method according to the present invention, any one of the methods which are conventionally known to dry color photographic light-sensitive materials rapidly may be adopted. From the object of the present invention, it is preferable to dry a color photographic light-sensitive material preferably within 20 sec, more preferably within 15 sec, and most preferably in 5 sec to 10 sec.

As the drying system, any one of a contact heating system and a hot air-blowing system may be used, and a structure of a combination of the contact heating system and the hot air-blowing system makes it possible to carry out drying more rapidly than the above independent system, and the combination is hence preferable. In a more preferred embodiment concerning the drying method according to the present invention, the light-sensitive material is contact-heated using a heat-roller and then blow-dried using hot air blown toward the light-sensitive material from a perforated panel or nozzles. It is preferable that, in the blow-drying section, the mass velocity of the hot air blown per heatreceiving unit area of the light-sensitive material be 1000 $kg/m^2 \cdot hr$ or more. The diffuser (outlet of blown air) has preferably a shape reduced in pressure loss and examples of the shape are given in FIG. 7 to FIG. 15 described in JP-A-9-33998.

The developer and the developer replenisher contain a color-developing agent. Preferable examples of the color-developing agent include known aromatic primary amine color-developing agents, particularly p-phenylenediamine derivatives. Typical examples are shown hereinbelow, but the present invention is not limited to these examples. Among recent black-white light-sensitive materials, there are those in which a coupler is added so as to develop a black color to form a black-white image by using a common color developer. The color developer used in the present invention may be applied to the processing of light-sensitive materials of this type.

1) N,N-diethyl-p-phenylenediamine
2) 4-amino-N,N-diethyl-3-methylaniline
3) 4-amino-N-(β-hydroxyethyl)-N-methylaniline
4) 4-amino-N-ethyl-N-(β-hydroxyethyl)aniline
5) 4-amino-N-ethyl-N-(1-hydroxyethyl)-3-methylaniline
6) 4-amino-N-ethyl-N-(3-hydroxypropyl)-3-methylaniline
7) 4-amino-N-ethyl-N-(4-hydroxybutyl)-3-methylaniline
8) 4-amino-N-ethyl-N-(β-methanesulfonamidoethyl)-3-methylaniline
9) 4-amino-N,N-diethyl-3-(β-hydroxyethyl)aniline
10) 4-amino-N-ethyl-N-(β-methoxyethyl)-3-methylaniline
11) 4-amino-N-(β-ethoxyethyl)-N-ethyl-3-methylaniline
12) 4-amino-N-(3-carbamoylpropyl-N-n-propyl-3-methylaniline
13) 4-amino-N-(4-carbamoylbutyl-N-n-propyl-3-methylaniline
15) N-(4-amino-3-methylphenyl)-3-hydroxypyrrolidine
16) N-(4-amino-3-methylphenyl)-3-(hydroxymethyl)pyrrolidine
17) N-(4-amino-3-methylphenyl)-3-pyrrolidinecarboxyamide Among the aforementioned p-phenylenediamine derivatives, the exemplified compounds 5), 6), 7), 8) and 12) are particularly preferable and among these compounds, the compounds 5) and 8) are most preferable. These p-phenylenediamine derivatives are generally in the form of a salt, such as a sulfate, hydrochloride, sulfite, naphthalene disulfonate and p-toluene sulfonate, in the state of a solid material. The concentration of the aromatic primary amine developing agent in a developer or a replenisher is preferably 2 mmol to 200 mmol, more preferably 12 mmol to 200 mmol and further preferably 12 mmol to 150 mmol per 11 of the developer. The replenisher is designed to have a concentration larger by a consumed amount during development than the developer. Specifically, the concentration of the replenisher is determined so that the amount to be supplied to a developing vessel by replenishment is balanced with the amount to be consumed by a reaction and the lost amount including that carried over to the next vessel and that of overflow, to keep the concentration in the developing vessel constant. Therefore, in the case of a low replenishment processing in a preferred embodiment of the present invention, the concentration of the developing agent is designed to be high to secure necessary amount to be supplied by a small replenisher amount.

When the present invention is practiced, it is preferable to use a developer which does not substantially contain benzyl alcohol. Here the term "does not substantially contain" means that benzyl alcohol is contained only in an amount of concentration preferably 2 ml/l or less and more preferably 0.5 ml/l or less. Most preferably the developer contains no benzyl alcohol at all.

It is more preferable that the developer used in the present invention does not substantially contain any sulfite ion. The sulfite ion has a function as preservatives for the developing agent and, at the same time, an action of dissolving a silver halide and an action of decreasing a dye-forming efficiency by the reaction with an oxidized product of the developing agent. It is estimated that these actions are one of the causes of an increased variation in the photographic characteristics along with continuous processing. Here the term "does not substantially contain" means that the concentration of the sulfite ion is preferably $3.0\times10^{-3}$ mol/l or less. Most preferably the developer contains no sulfite ion at all. However, in the present invention, a very small amount of sulfite ion is neglected which is used as an antioxidant for a processing agent kit, in which the developing agent is concentrated, before the developing agent is prepared as a solution directly subjected to use.

Preferably the developer used in the present invention does not substantially contain any sulfite ion, and more preferably it also does not substantially contain hydroxylamine. This is because hydroxylamine has a function as preservatives for the developer but itself has silver-developing activity, and it is thought that a variation in the concentration of hydroxylamine largely affects the photographic characteristics. Here the term "does not substantially contain hydroxylamine" means that the concentration of hydroxylamine is preferably $5.0\times10^{-3}$ mol/l or less. Most preferably the developer contains no hydroxylamine at all.

It is more preferably that the developer used in the present invention contains an organic preservative in place of the aforementioned hydroxylamine and sulfite ions.

Here, the organic preservative means whole the organic compounds which decrease the deterioration rate of aromatic primary amine color-developing agents when it is added to a processing solution of a light-sensitive material. Namely, the preservative is an organic compound having the ability of preventing the oxidation of a color-developing agent caused by oxygen and the like. Among these organic compounds, particularly effective organic preservatives are hydroxylamine derivatives (excluding hydroxylamine, the same as follows), hydroxam acids, hydrazines, hydrazides, phenols, α-hydroxyketones, α-aminoketones, saccharides, monoamines, diamines, polyamines, quaternary ammonium salts, nitroxy radicals, alcohols, oximes, diamide compounds and alicyclic amines. These compounds are disclosed in each publication or specification of JP-A-63-4235, JP-A-63-30845, JP-A-63-21647, JP-A-63-44655, JP-A-63-53551, JP-A-63-43140, JP-A-63-56654, JP-A-63-58346, JP-A-63-43138, JP-A-63-146041, JP-A-63-44657, JP-A-63-44656, U.S. Pat. No. 3,615,503 and No. 2,494,903, JP-A-52-143020 and JP-B-48-30496.

As the preservative, those described in JP-A-11-119400, the paragraph No. 0155 are preferred.

A chloride ion may be added in the developer if necessary. Many color developers (especially, developers for color print materials) usually contain a chloride ion in an amount of $3.5\times10^{-2}$ to $1.5\times10^{-1}$ mol/l. However, since a chloride ion is usually released as a byproduct in development and supplied to the developer, there are also many cases where no chloride ion is required to add to a replenisher. The amount of a chloride ion in the replenisher is designed such that the concentration of a chloride ion in a developing vessel when it reaches the running equilibrium composition falls in the above defined concentration range. When the concentration of a chloride ion is too high, this gives rise to the problem that the developing is delayed and also the rapidness and color density are impaired. Therefore a too high concentration is not preferable. Also, a too-low chloride ion concentration is not preferable in many cases as far as the prevention of fogging is concerned.

With regard to the containing of a bromide ion, it is the same as the case of a chloride ion. Preferably a bromide ion in the color developer is of the order of 1 to $5\times10^{-3}$ mol/l in the processing of materials for photographing, and it is preferably $1.0\times10^{-3}$ mol/l or less in the processing of print materials. There is the case where a bromide ion is added in the developer replenisher as required so that the concentration of a bromide ion falls in the above range.

When these ions are contained in the developer and the replenisher as required, examples of the chloride ion-supplying material include sodium chloride, potassium chloride, ammonium chloride, lithium chloride, nickel chloride, magnesium chloride, manganese chloride and calcium chloride. Among these compounds, sodium chloride and potassium chloride are preferable.

Examples of the bromide ion-supplying material include sodium bromide, potassium bromide, ammonium bromide, lithium bromide, calcium bromide, magnesium bromide, manganese bromide, nickel bromide, cerium bromide and thallium bromide. Among these compounds, potassium bromide and sodium bromide are preferred.

When the light-sensitive material to be development-processed is a color print paper, it is important characteristics of the image quality that the white background of an image has high whiteness. It is important to make a background with an apparently white finish by using a fluorescent whitening agent. The fluorescent whitening agent is contained in the light-sensitive material according to its property. There is also the case where the fluorescent whitening agent is allowed to penetrate into the light-sensitive material from a processing solution in a development process. In this case, an appropriate processing solution to which the fluorescent whitening agent is to be added is selected according to the property of the fluorescent whitening agent so as to obtain a high whiteness-enhancing effect. The fluorescent whitening agent is therefore possibly added to a color developer with a high pH. Also, there is the case where the fluorescent whitening agent is added to a bleach-fixing solution or a stabilizing bath so that it is not washed out in the process but contained in a large amount in the developed print. In general, stilbene-series fluorescent whitening agents are frequently used. Among these, fluorescent whitening agents of di(triazylamino)stilbene-series represented by the following formula or 4,4'-diamino-2,2'-disulfostilbene-series are preferred.

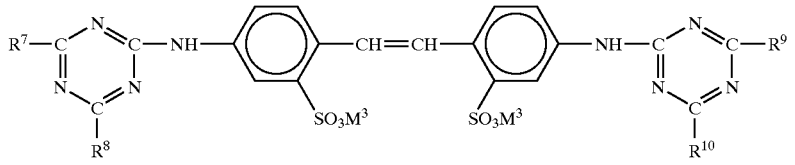

In the above formula, $R^7$ and $R^9$ respectively represent a hydrogen atom, an alkyl group having 1 or 2 carbon atoms, an alkoxy group having 1 or 2 carbon atoms or a hydroxyalkyl group having 1 or 2 carbon atoms, $R^8$ and $R^{10}$ respectively represent a substituted or unsubstituted amino group or an alkoxy group having 2 or less carbon atoms, wherein when the amino group is substituted, the substituent is an alkyl group having two or less carbon atoms, a hydroxyalkyl group having two or less carbon atoms, a sulfoalkyl group having two or less carbon atoms or a phenyl group, and $M^3$ represents a hydrogen atom, a sodium atom or a potassium atom.

These compounds are all known and are easily available or are readily synthesized using a known method. This stilbene-series fluorescent whitening agent may be added to any of the color developer, the processing agent composition for a desilvering solution, or the light-sensitive material. When the stilbene-series fluorescent whitening agent is contained in the processing solution, the concentration is preferably $1\times10^{-4}$ to $5\times10^{-2}$ mol/l and more preferably $2\times10^{-4}$ to $1\times10^{-2}$ mol/l. The amount of the processing agent composition according to the present invention is determined such that the developer which is being used contains the fluorescent whitening agent in a concentration kept at the above level.

The color developer or the replenisher is used at a pH ranging between preferably 9.5 to 13.0 and more preferably 9.8 and 12.5. To keep this pH, various buffers are preferably used. As the buffer, besides the aforementioned potassium carbonate and sodium carbonate, other carbonates, phosphates, borates, tetraborates, hydroxybenzoates, glycyl salts, N,N-dimethylglycyl salts, leucine salts, norleucine salts, guanine salts, 3,4-dihydroxyphenylalanine salts, alanine salts, aminobutyrate, 2-amino-2-methyl-1,3-propanediol salts, valine salts, proline salts, trishydroxyaminomethane salts, lysine salts and the like may be used. Particularly, carbonates, phosphates, tetraborates and hydroxybenzoates have the advantages that they have high buffering ability at a pH as high as 9.0 or more, do not adversely affect the photographic properties (e.g., fogging) even if they are added to the color developer and are inexpensive. It is therefore particularly preferable to use these buffers.

Specific examples of these buffers include, besides sodium carbonate and potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate) and potassium 5-sulfo-2-hydroxybenzoate (potassium 5-sulfosalicylate). However, the present invention is not limited to these compounds.

As to the amount of the aforementioned buffers, the concentration of these buffers in the color-developer replenisher is preferably 0.04 to 2.0 mol/l and particularly preferably 0.1 mol/l to 0.4 mol/l in terms of the sum of each amount of these buffers.

An optional developing accelerator may be added as required to the developer and the replenisher.

Examples of the developing accelerator which may be added as required, include thioether-series compounds revealed in each publication or specification of JP-B-37-16088, JP-B-37-5987, JP-B-38-7826, JP-B-44-12380, JP-B-45-9019 and U.S. Pat. No. 3,813,247, p-phenylenediamine-series compounds revealed in each publication of JP-A-52-49829 and JP-A-50-15554, quaternary ammonium salts revealed in each publication of JP-A-50-137726, JP-B-44-30074, JP-A-56-156826 and JP-A-52-43429, amine-series compounds described in each publication or specification of U.S. Pat. No. 2,494,903, No. 3,128,182, No. 4,230,796 and No. 3,253,919, JP-B-41-11431, U.S. Pat. No. 2,482,546, No. 2,596,926 and No. 3,582,346, polyalkylene oxides shown in each publication or specification of JP-B-37-16088, JP-B-42-25201, U.S. Pat. No. 3,128,183, JP-B-41-11431, JP-B-42-23883 and U.S. Pat. No. 3,532,501, as well as 1-phenyl-3-pyrazolidones and imidazoles.

Other color developer components, for example, various chelating agents which are agents for preventing the precipitation of calcium and magnesium or agents for improving the stability of a color developer, may be added to the color developer for use in the present invention. Moreover, an optional antifoggant and a surfactant may also be added as required. These additives are described in JP-A-11-119400, the paragraphs No. 0159 and No. 0161 which are preferably used in the present invention.

Explanations concerning the color developer replenisher or developer used in the present invention were made as above.

The color-development processing temperature in the present invention is preferably 30 to 55° C., more preferably 35 to 55° C. and particularly preferably 38 to 45° C. when the light-sensitive material to be processed is a color print material. The development processing time is preferably 5 to 90 sec and more preferably 8 to 60 sec. The present invention is particularly suitable to extremely rapid development processing performed in as fast as 10 to 30 sec mentioned in the above. The replenishing amount, though the smaller it is, the better it is, may be generally 20 to 600 ml, preferably 30 to 120 ml and particularly preferably 15 to 60 ml, per $m^2$ of the light-sensitive material.

When the present invention is put into practice, the developing step using the color developer is followed by a desilvering step in which treatment using a bleaching solution and a bleach-fixing solution is carried out. Thereafter, washing and/or stabilizing processings are generally performed. These processings are also preferable in the present invention.

With regard to these steps in succession to the developing step using the color developer, the methods described in JP-A-11-119400, the paragraphs No. 0164 to No. 0176 are preferably applied to the present invention and each of these paragraphs No. 0164 to No. 0176 of this patent publication is preferably incorporated as it is into the specification by reference.

The light-sensitive material of the present invention is preferably processed using an automatic processor (developing machine).

The details concerning the automatic developing machine and the processing using said automatic developing machine are described in JP-A-11-125885 and are preferably applied to the present invention. The paragraphs No. 0180 to No. 0189 in JP-A-11-125885 are preferably incorporated into the specification by reference.

As the method of developing the light-sensitive material of the present invention after exposure, the following systems may be used. These systems include a wet system, such as a method of developing using a developer containing a conventional alkali agent and a developing agent, and a method in which a developing agent is included in the light-sensitive material and an activator solution such as an alkali solution containing no developing agent is used to develop; and a thermal developing system using no processing solution. In the method using an activator solution in particular, the developing agent is not contained in the processing solution and hence the processing solution is easily controlled and handled. This method is also less in the burden of waste water treatment, showing that it is also a preferable method in view of environmental protection.

In the method using an activator solution, as the developing agent or its precursor to be included in the light-sensitive material, for example, hydrazine-type compounds described in JP-A-8-234388, JP-A-9-152686, JP-A-9-152693, JP-A-9-211814 and JP-A-9-160193 are preferable.

In addition, developing methods in which the amount of silver to be applied in a light-sensitive material is decreased and image-amplifying treatment (intensifying treatment) using hydrogen peroxide is performed are preferably used. It is particularly preferable to use this method in the method using an activator solution. Specifically, an image-forming method using an activator solution containing hydrogen peroxide as disclosed in JP-A-8-297354 and JP-A-9-152695 is preferably used.

In the method using an activator solution, the light-sensitive material is generally subjected to desilvering treatment after it is treated using an activator solution. In the image-amplifying treatment method using a light-sensitive material with a lower silver amount, the desilvering treatment may be omitted and a simple method such as washing or stabilizing treatment may be used instead. In the system in which image information is read from a light sensitive material by using a scanner or the like, a processing method requiring no desilvering process may be adopted even when a light-sensitive material, e.g., a light-sensitive material for photographing, having high silver content is used.

As the activator solution, a desilvering solution (bleaching/fixing solution), and processing materials for a washing or stabilizing solution, and the washing or stabilizing method, known materials and methods may be used in the present invention. Preferably those described in Research Disclosure Item 36544 (September, 1994) pp. 536–541 and in JP-A-8-234388 may be used.

The present invention can provide a silver halide color photographic light-sensitive material having rapid processing suitability and an image-forming method using the light-sensitive material. The present invention can also provide a silver halide color photographic light-sensitive material which is less in variation in the photographic property of the light-sensitive material when the light-sensitive material which is unexposed is stored and its storage condition is changed, and an image-forming method using the light-sensitive material.

The silver halide color photographic light-sensitive material of the present invention has high sensitivity and is greatly improved in sharpness, whiteness, curling properties, surface smoothness and color reproduction. The silver halide color photographic light-sensitive material of the present invention also has such a good storage stability that it is less in variations in the photographic characteristics, such as sensitivity and gradation, with the lapse of time, when the light-sensitive material is stored for a long term in an unexposed state. The silver halide color photographic light-sensitive material of the present invention also has such an excellent effect that the stability of an image after processing is high.

Moreover, the light-sensitive material of the present invention has excellent reproducibility of, for example, metallic texture, and hence can reproduce wide range types of image of high image-quality. This effect is expressed even in scanning exposure made in a short exposure time and in the conventional exposure using an enlarger, showing that the light-sensitive material of the present invention is a remarkably useful and convenient silver halide color photographic light-sensitive material.

The silver halide color photographic light-sensitive material of the present invention has excellent surface smoothness and gloss, and it is less in desensitization caused when pressure is applied to the light-sensitive material or the light-sensitive material is bent, thereby exhibiting excellent handling characteristics. The silver halide color photographic light-sensitive material of the present invention makes it possible to attain a photographic image-forming system and a super-rapid processing system with high-intensity and short-time exposure, while maintaining the above characteristics.

Further, the silver halide color photographic light-sensitive material of the present invention has excellent surface smoothness and glossiness, and it is less in fogging when pressure, particularly such a force as to cause abrasion, is applied to the light-sensitive material, thereby exhibiting excellent handling characteristics. The silver halide color photographic light-sensitive material of the present invention makes it possible to attain a photographic image-forming system and an ultra-rapid processing system with high-intensity and short-time exposure, while maintaining the above characteristics.

According to the present invention, a silver halide color photographic light-sensitive material can be obtained which is resistant to abrasion to the processed sample, has excellent resistance to curling and is less in variation in photographic properties when the light-sensitive material which is unexposed is stored and its storage condition is changed.

The photographic print and the silver halide photographic light-sensitive material of the present invention have high tolerance to deformation and bending and is less in curling so that it can be piled up vertically over tens to hundreds of sheets even if they are printed in a large number of sheets by continuous printing, thereby showing excellent piling-up characteristic and operability. Also, the present invention exhibits an excellent effect of producing the photographic print excellent in piling-up characteristics, mechanical strength and the like, even by rapid processing with scanning exposure.

Besides, preferable embodiments of the present invention include the followings:

(i) The silver halide color photographic light-sensitive material according to the above item (1), wherein the reflective support is prepared by coating at least the emulsion-coated surface-side of the support with a composition having a white pigment mixed and dispersed in a resin containing at least 50 wt % of a polyester synthesized by polycondensation of a dicarboxylic acid with a diol, and the polyester in the reflective support is a polyester whose major component is polyethylene terephthalate.

(ii) The silver halide color photographic light-sensitive material according to the above item (1) or (i), wherein at least one layer of the silver halide emulsion layers contains a cyan dye-forming coupler represented by formula (III):

formula (III)

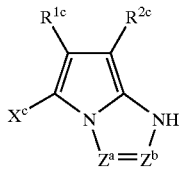

wherein, in formula (III), $Z^a$ and $Z^b$, which may be the same or different, each represent —C($R^{3c}$)= or —N=, provided that one of $Z^a$ and $Z^b$ is —C($R^{3c}$)= and the other is —N=; $R^{1c}$ and $R^{2c}$ each represent an electron-attracting group having a Hammett's substituent constant $\sigma_p$ value of 0.2 or more, and the total of the $\sigma_p$ values of $R^{1c}$ and $R^{2c}$ is 0.65 or more; $R^{3c}$ represents a hydrogen atom or a substituent, and $X^c$ represents a hydrogen atom or a group capable of being split-off upon reaction with an oxidized product of a color-developing agent; and the group $R^{1c}$, $R^{2c}$, $R^{3c}$ or $X^c$ may be a divalent group, to bind to a polymer which is a dimer or a more-higher polymer, or to a polymer chain, to form a homopolymer or a copolymer.

(iii) The silver halide color photographic light-sensitive material according to the above item (1), (i) or (ii), wherein at least one layer of the silver halide emulsion layers contains a magenta dye-forming coupler represented by formula (M):

formula (M)

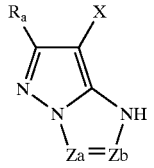

wherein Za and Zb each represent —C($R_b$)= or —N=, provided that one of Za and Zb is —C($R_b$)= and the other is —N=; $R_a$ and $R_b$ each independently represent a hydrogen atom or a substituent, and X represents a hydrogen atom or a group capable of being split-off upon coupling reaction with an oxidized product of a color-developing agent.

(iv) A method of forming a color image, which comprises subjecting a silver halide color photographic light-sensitive material to scanning exposure to a light beam modulated on the basis of image information, and processing the silver halide color photographic light-sensitive material to development, wherein said silver halide color photographic light-sensitive material is the silver halide color photographic light-sensitive material described in any one of the above items (1) or (i) to (iii).

(v) A method of forming a color image, which comprises processing said silver halide color photographic light-sensitive material described in any one of the above item (1) or (i) to (iii) for a color-development processing time of 20 seconds or less.

(vi) The silver halide color photographic light-sensitive material according to the above item (22), wherein at least one layer of the non-light-sensitive layers is more outside than the emulsion layer most apart from the support.

(vii) The silver halide color photographic light-sensitive material according to the above item (22) or (vi), wherein the amount of the hydrophilic binder to be coated in at least one layer of the non-light-sensitive layers is 0.2 to 2.0 g/m$^2$.

(viii) The silver halide color photographic light-sensitive material according to the above item (22), (vi) or (vii), wherein the average grain diameter of the silver halide grains in one of the emulsion layers is not to be larger than the grain diameter in the layer more apart from the support.

(ix) The silver halide color photographic light-sensitive material according to any one of the above items (22), or (vi) to (viii), wherein the polyester in the reflective support is a polyester which is composed of polyethylene terephthalate as a main component.

(x) A method of forming a color image, which comprises subjecting a silver halide color photographic light-sensitive material to scanning exposure to a light beam modulated on the basis of image information, and processing the silver halide color photographic light-sensitive material to development, wherein said silver halide color photographic light-sensitive material is the silver halide color photographic light-sensitive material described in any one of the above item (22), or (vi) to (ix).

(xi) A method of forming a color image, which comprises processing said silver halide color photographic light-sensitive material described in any one of the above items (22), or (vi) to (ix) for a color-development processing time of 20 seconds or less.

(xii) The silver halide color photographic light-sensitive material according to the above item (23), wherein the polyester in the reflective support is a polyester which is composed of polyethylene terephthalate as a main component.

(xiii) The silver halide color photographic light-sensitive material according to the above item (23) or (xii), which contains a matt agent in an amount of 10 mg or more per m$^2$.

(xiv) The silver halide color photographic light-sensitive material according to the above item (23), (xii) or (xiii), which contains a latex in an amount of 40 mg or more per m$^2$ in the outermost layer among the non-light-sensitive layers.

(xv) The silver halide color photographic light-sensitive material according to any one of the above item (23), or (xii) to (xiv), which has a protective layer formed by coating, onto the silver halide light-sensitive emulsion layers, with at least one layer of a coating consisting of 30 to 95 wt % of hydrophobic polymer grains having an average particle size of 0.01 to 1 $\mu$m and a melting point of 55 to 200° C. and 5 to 70 wt % of gelatin, followed by fusion of the polymer grains.

(xvi) The silver halide color photographic light-sensitive material according to any one of the above items (23), or (xii) to (xv), which has a protective layer formed by coating, onto the silver halide light-sensitive emulsion layers, with at least one layer of an aqueous coating comprising 5 to 50 wt % of polymer grains having an average particle size of 0.01 to 50 $\mu$m and 1 to 3 wt % of a polymer latex binder, followed by fusion of the polymer grains.

(xvii) The silver halide color photographic light-sensitive material according to any one of the above items (23), or (xii) to (xvi), wherein the gelatin hardening agent is a compound represented by the following formula (H-I):

formula (H-I)

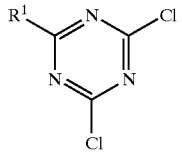

wherein, in formula (H-I), $R^1$ represents a hydroxyl group, —OM group (in which M represents a monovalent metal atom), alkyl group, —N($R^2$)($R^3$) group (in which $R^2$ and $R^3$ each independently represent an alkyl group or aryl group), —NHCO$R^4$ group (in which $R^4$ represents a hydrogen atom, alkyl group, aryl group, alkyl thio group or aryl thio group), or alkoxy group.

(xviii) A reflective-type photographic print, wherein the shape of four corners of the square or rectangular photographic print is an arc with a radius of 1 mm or more but 20 mm or less with the center placed in the photographic print and a central angle of 90° or less, wherein the reflective support is prepared by coating at least the image-recording side of the support with a composition having a white pigment mixed and dispersed in a resin containing at least 50 wt % of a polyester synthesized by polycondensation of a dicarboxylic acid with a diol, and wherein the Taber rigidity of the reflective support is 9.0 g·cm or more.

(xix) A reflective-type photographic print, wherein the shape of four corners of the square or rectangular photographic print is an arc with a radius of 1 mm or more but 20 mm or less with the center placed in the photographic print and a central angle of 90° or less, wherein the reflective support has at least one layer of a biaxially oriented polyolefin layer having micropores, and wherein the Taber rigidity of the reflective support is 9.0 g·cm or more.

(xx) A method of forming an image, which comprises subjecting a silver halide photographic light-sensitive material to scanning exposure, for $10^{-4}$ second or less per picture element, to a light beam modulated on the basis of image information, and processing the silver halide light-sensitive material to development, wherein said silver halide photographic light-sensitive material is the light-sensitive material described in the above item (24).

(xxi) A method of forming a color image, which comprises subjecting a silver halide color photographic light-sensitive material to scanning exposure to a light beam modulated on the basis of image information, and processing the silver halide color photographic light-sensitive material to development, wherein said silver halide color photographic light-sensitive material is the silver halide color photographic light-sensitive material described in any one of the above items (i) to (xvii).

(xxii) A method of forming a color image, which comprises processing said silver halide color photographic light-sensitive material described in any one of the above items (i) to (xvii) for a color-development processing time of 20 seconds or less.

The present invention will be explained in more detail based on the following examples, which are not intended to be limiting of the present invention.

EXAMPLES

Production of a Cellulose Paper Support

A pulp finished-paper material consisting of 50% of a bleached hardwood kraft, 25% of bleached hardwood sulfite, and a bleached softwood sulfite, was refined to 200 ml Canadian Standard Freeness by using a double disk refiner and then a Jordan conical refiner, to make a photographic paper support. To the resulted pulp finished-paper material were added 0.2% of an alkylketene dimer, 1.0% of a cationic cornstarch, 0.5% of polyamide epichlorohydrin, 0.26% of an anionic polyacrylamide, and 5.0% of $TiO_2$ on dry amount basis. A paper base obtained by pressing the resulted material until Scheffield porosity became 160 scheffield unit and an apparent density became 0.70 g/ml, was surface-sized with a cornstarch solution, which was hydroxyethylated by 10%, by using a vertical size press, thereby achieved the starch filling amount of 3.3 wt %. This surface-sized support was calendered until the apparent density became 1.04 g/ml, to obtain a cellulose paper support having a thickness of 145 μm. On the paper support, polymer layers having the following composition were formed and corona discharge treatment was carried out on the emulsion surface side, followed by undercoating to manufacture a reflective support. Further, the polymer layer on the emulsion surface side was made to contain 10 mg/m$^2$ of 4,4'-bis(5-methylbenzooxazolyl)stilbene and ultramarine.

Reflective Support A (a Comparative Support)

Polymer composition for the emulsion surface side:
- Polyethylene layer (35 μm) containing 20 wt % of titanium oxide Polymer composition for the back surface side:
- Polyethylene layer (30 μm)

Reflective Support B (a Support According to the Present Invention)

Polymer composition for the emulsion surface side:
- Polyethylene terephthalate layer (35 μm) containing 20 wt % of titanium oxide Polymer composition for the back surface side:
- Polyethylene layer (30 μm)

Reflective Cupport C (a Support According to the Present Invention)

Polymer composition for the emulsion surface side:
- From the emulsion surface side;
- Polyethylene layer (1 μm) having no micropore
- Polypropylene outer layer (4 μm) containing titanium oxide but having no micropores
- Polypropylene core layer (22 μm) having micropores
- Polypropylene outer layer (4 μm) containing titanium oxide but having no micropores
- Polyethylene layer (4 μm) containing titanium oxide but having no micropores Polymer composition for the back surface:
- Polyethylene layer (30 μm)

Reflective Support D (a Support According to the Present Invention)

Polymer composition for the emulsion surface:
- From the emulsion surface side;
- Polyethylene layer (3 μm) having no micropores
- Polypropylene layer (7 μm) containing titanium oxide and having micropores
- Polypropylene layer (9 μm) having no micropores
- Polypropylene layer (7 μm) containing titanium oxide and having micropores
- Polyethylene layer (4 μm) containing titanium oxide but having no micropores Polymer composition for the back surface:
- A polyethylene layer (30 μm)

Reflective Support B2 (a Support According to the Present Invention)

Polymer composition for the emulsion surface:
- The same as that of the reflective support B Polymer composition for the back surface:
- From the support side;
- Polyethylene layer (28 μm)
- Silica-containing polyethylene layer (2 μm)

Reflective Support C2 (a Support According to the Present Invention)

Polymer composition for the emulsion surface:
- The same as that of the reflective support C Polymer composition for the back surface:
- From the support side;
- Polyethylene layer (9 μm)
- Polypropylene layer (24 μm)
- Silica-containing polyolefin layer (3 μm)

Reflective Support D2 (a Support According to the Present Invention)

Polymer composition for the emulsion surface:
- The same as that of the reflective support D Polymer composition on the back surface:
- Polyethylene layer (6 μm)
- Polypropylene layer (27 μm)
- Silica-containing polyolefin layer (3 μm)

Further, a cellulose paper support that differed from the above in the amount of the alkylketene dimer being altered to 0.4% on dry amount basis in the production of the above cellulose paper support, was produced, and in the same manner as in the productions of the above reflective supports A to D2, reflective supports A' to D2' corresponding to these supports A to D2 were produced.

Example 1-1

Photographic constitutional layers of the first layer to seventh layer were coated successively on the above reflective support A, to prepare a sample A001A of a silver halide color photographic light-sensitive material having the layer constitution shown below. A coating solution for each photographic constitutional layer was prepared as below.

Preparation of Fifth Layer Coating Solution 50 g of a cyan coupler (ExC-1), 220 g of a cyan coupler (ExC-2), 220 g of a color-image stabilizer (Cpd-1), 10 g of a color-image stabilizer (Cpd-9), 10 g of a color-image stabilizer (Cpd-10), 20 g of a color-image stabilizer (Cpd-12), 140 g of an ultraviolet absorbing agent (UV-1), 30 g of an ultraviolet absorbing agent (UV-3), and 60 g of an ultraviolet absorbing agent (UV-4) were dissolved in 200 g of a solvent (Solv-6) and 350 ml of ethyl acetate, and the resulting solution was emulsified and dispersed in 6500 g of a 10% aqueous gelatin solution containing 200 ml of 10% sodium dodecylbenzene sulfonate, to prepare an emulsified dispersion C.

On the other hand, a silver chlorobromide emulsion C (cubes; a 1:4 mixture of a large-size emulsion C having an average grain size of 0.50 μm, and a small-size emulsion C having an average grain size of 0.41 μm (in terms of mol of silver). The deviation coefficients of the grain size distributions were 0.09 and 0.11, respectively. Each size emulsion had 0.5 mol % of silver bromide locally contained in part of the grain surface whose substrate was made up of silver chloride) was prepared. To the large-size emulsion C of this emulsion, had been added $6.0\times10^{-5}$ mol, per mol of silver, of each of red-sensitive sensitizing dyes G and H shown below, and to the small-size emulsion C of this emulsion, had been added $9.0\times10^{-5}$ mol, per mol of silver, of each of red-sensitive sensitizing dyes G and H shown below. Further, the chemical ripening of this emulsion was carried out optimally with a sulfur sensitizer and a gold sensitizer being added.

The above emulsified dispersion C and this silver chlorobromide emulsion C were mixed and dissolved, and a fifth-layer coating solution was prepared so that it would have the composition shown below. The coating amount of the emulsion is in terms of silver.

The coating solutions for the first layer to the fourth layer and for the sixth layer to the seventh layer were prepared in the similar manner as that for the fifth-layer coating solution. As the gelatin hardener for each layer, 1-oxy-3,5-dichloro-s-triazine sodium salt (H-1) was used.

Further, to each layer, were added Ab-1, Ab-2, Ab-3, and Ab-4, so that the total amounts would be 15.0 mg/m$^2$, 60.0 mg/m$^2$, 5.0 mg/m$^2$, and 10.0 mg/m$^2$, respectively.

(H-1) Hardener

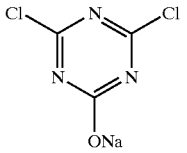

(used 1.4 weight % per gelatin)

(H-2) Hardener (HA-25)

$CH_2{=}CHSO_2CH_2CONH{-}CH_2$ $CH_2{=}CHSO_2CH_2CONH{-}CH_2$ (H-3) Hardener $CH_2{=}CHSO_2CH_2CONH{-}CH_2$ $CH_2$ $CH_2{=}CHSO_2CH_2CONH{-}CH_2$ (H-4)

$CH_2{=}CHSO_2CH_2SO_2CH{=}CH_2$ (Ab-1) Antiseptic

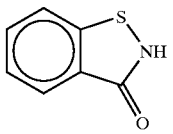

(Ab-2) Antiseptic

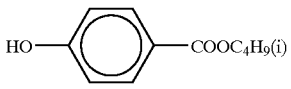

(Ab-3) Antiseptic

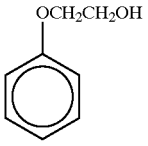

-continued (Ab-4) Antiseptic

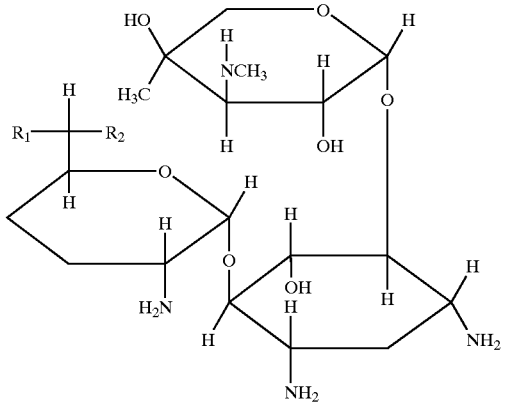

| | $R_1$ | $R_2$ |
|---|---|---|
| a | —$CH_3$ | —$NHCH_3$ |
| b | —$CH_3$ | —$NH_2$ |
| c | —H | —$NH_2$ |
| d | —H | —$NHCH_3$ |

A mixture in 1:1:1:1 (molar ratio) of a, b, c, and d

For the silver chlorobromide emulsion of the respective photosensitive emulsion layer, the following spectral sensitizing dyes were used.

Blue-Sensitive Emulsion Layer (Sensitizing dye A)

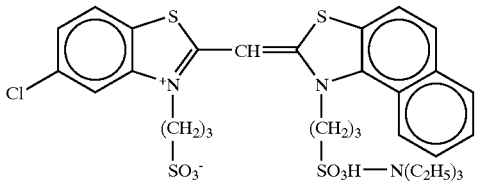

(Sensitizing dye B)

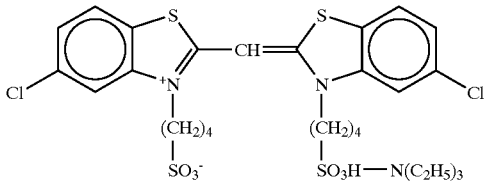

(Sensitizing dye C)

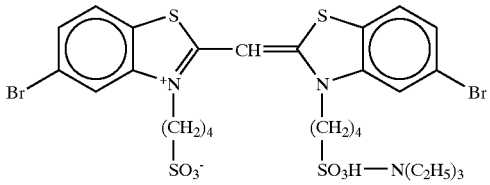

(The sensitizing dyes A, B, and C were added to the large-size emulsion in an amount of $1.4\times10^{-4}$ mol, per mol of silver halide, and to the small-size emulsion in an amount of $1.7\times10^{-4}$ mol, per mol of silver halide.)

Green-Sensitive Emulsion Layer (Sensitizing dye D)

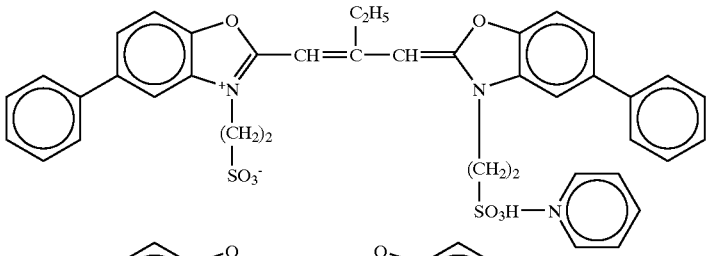

(Sensitizing dye E)

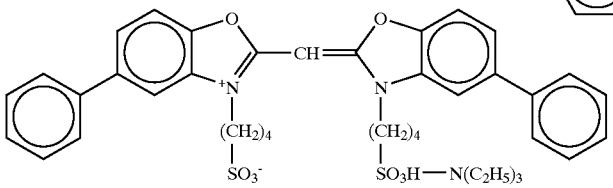

(Sensitizing dye F)

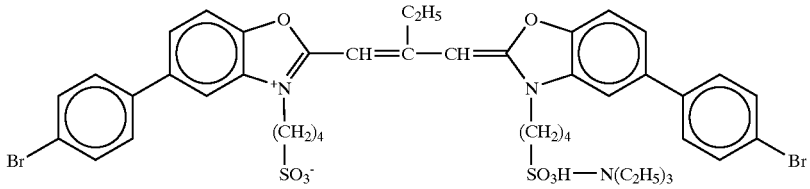

(The sensitizing dye D was added to the large-size emulsion in an amount of 3.0×10 mol, and to the small-size emulsion in an amount of $3.6\times10^{-4}$ mol, per mol of the silver halide; the sensitizing dye E was added to the large-size emulsion in an amount of 4.0×10 mol, and to the small-size emulsion in an amount of $7.0\times10^{-5}$ mol, per mol of the silver halide; and the sensitizing dye F was added to the large-size emulsion in an amount of $2.0\times10^{-4}$ mol, and to the small-size emulsion in an amount of $2.8\times10^{-4}$ mol, per mol of the silver halide.)

Red-Sensitive Emulsion Layer (Sensitizing dye G)

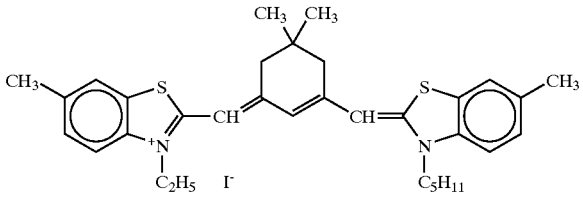

(Sensitizing dye H)

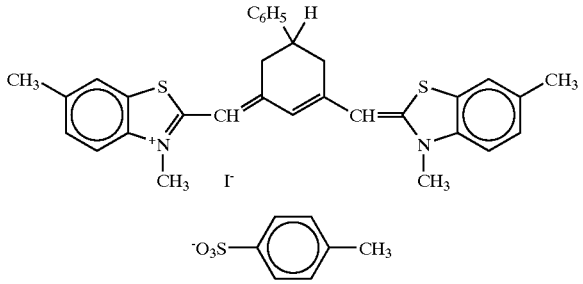

(The sensitizing dyes G and H were used as mentioned in the above.)

Further, the following compound I was added to the red-sensitive emulsion layer in an amount of $2.6\times10^{-3}$ mol per mol of the silver halide.)

(Compound I)

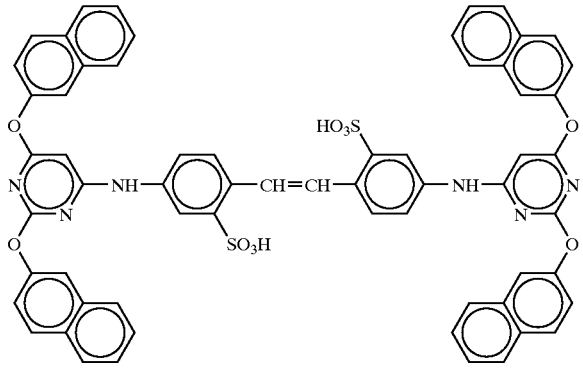

Further, to the blue-sensitive emulsion layer, the green-sensitive emulsion layer, and the red-sensitive emulsion layer, was added 1-(3-methylureidophenyl)-5-mercaptotetrazole in amounts of $3.3\times10^{-4}$ mol, $1.0\times10^{-3}$ mol, and $5.9\times10^{-4}$ mol, respectively, per mol of the silver halide.

Further, the compound was also added to the second layer, the forth layer, the sixth layer, and the seventh layer, in amounts of 0.2 mg/m$^2$, 0.2 mg/m$^2$, 0.6 mg/m$^2$, and 0.1 mg/m$^2$, respectively.

Further, to the blue-sensitive emulsion layer and the green-sensitive emulsion layer, were added 4-hydroxy-6-methyl-1,3,3a, 7-tetrazaindene in amounts of $1\times10^{-4}$ mol and $2\times10^{-4}$ mol, respectively, per mol of the silver halide.

Further, to the red-sensitive emulsion layer, was added a copolymer of methacrylic acid and butyl acrylate (1:1 in weight ratio; average molecular weight, 200,000 to 400,000) in an amount of 0.05 g/m$^2$.

Further, to the second layer, the fourth layer, and the sixth layer, was added disodium catechol-3,5-disulfonate in amounts of 6 mg/m$^2$, 6 mg/m$^2$, and 18 mg/m$^2$, respectively.

Further, in order to prevent irradiation, the following dyes (coating amounts are shown in parentheses) were added to the emulsion layers.

Dye-1

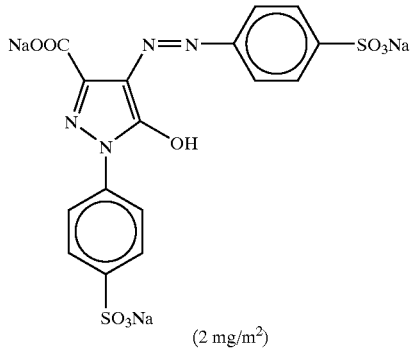

(2 mg/m$^2$)

Dye-2

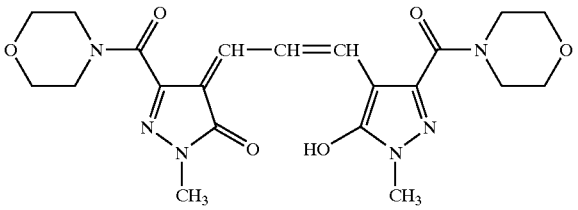

(5 mg/m$^2$)

Dye-3

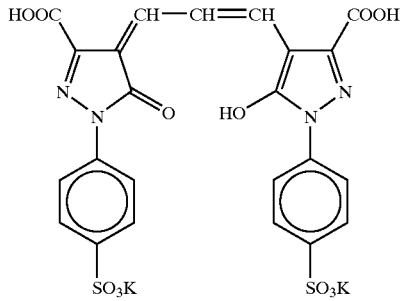

(1 mg/m$^2$)

Dye-4

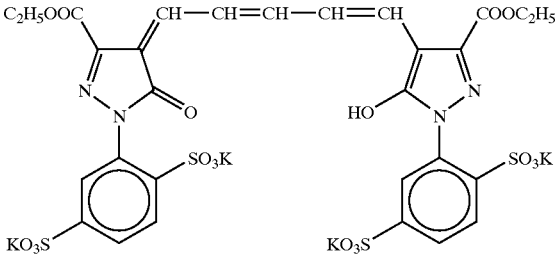

(10 mg/m$^2$)

Dye-5

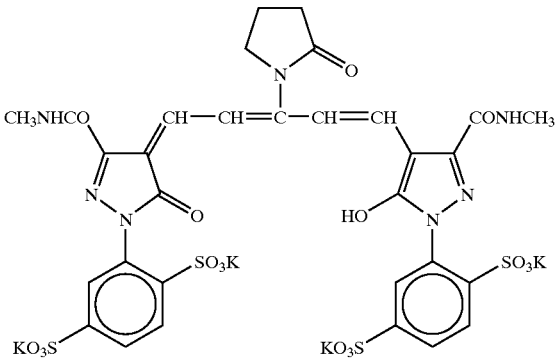

(10 mg/m$^2$)

(Layer Constitution)

The composition of each layer is shown below. The numbers show coating amounts (g/m$^2$). In the case of the silver halide emulsion, the coating amount is in terms of silver.

| | |
|---|---|
| First Layer (Blue-Sensitive Emulsion Layer) | |
| A silver chlorobromide emulsion A (cubes, a 3:7 mixture of a large-size emulsion A having an average grain size of 0.72 μm, and a small-size emulsion A having an average grain size of 0.60 μm (in terms of mol of silver). The deviation coefficients of the grain size distributions were 0.08 and 0.10, respectively. Each emulsion had 0.3 mol % of silver bromide contained locally in part of the grain surface whose substrate was made up of silver chloride) | 0.25 |
| Gelatin | 1.35 |
| Yellow coupler (ExY-1) | 0.41 |
| Yellow coupler (ExY-2) | 0.21 |
| Color-image stabilizer (Cpd-1) | 0.08 |
| Color-image stabilizer (Cpd-2) | 0.04 |
| Color-image stabilizer (Cpd-3) | 0.08 |
| Color-image stabilizer (Cpd-8) | 0.04 |
| Solvent (Solv-1) | 0.23 |
| Second Layer (Color-Mixing Inhibiting Layer) | |
| Gelatin | 1.00 |
| Color-mixing inhibitor (Cpd-4) | 0.05 |
| Color-mixing inhibitor (Cpd-5) | 0.07 |
| Color-image stabilizer (Cpd-6) | 0.007 |
| Color-image stabilizer (Cpd-7) | 0.14 |
| Color-image stabilizer (Cpd-13) | 0.006 |
| Solvent (Solv-1) | 0.06 |
| Solvent (Solv-2) | 0.22 |
| Third Layer (Green-Sensitive Emulsion Layer) | |
| A silver chlorobromide emulsion B (cubes, a 1:3 mixture of a large-size emulsion B having an average grain size of 0.45 μm, and a small-size emulsion B having an average grain size of 0.35 μm (in terms of mol of silver). The deviation coefficients of the grain size distributions were 0.10 and 0.08, respectively. Each emulsion had 0.4 mol % of silver bromide contained locally in part of the grain surface whose substrate was made up of silver chloride) | 0.12 |
| Gelatin | 1.20 |
| Magenta coupler (ExM-1) | 0.10 |
| Magenta coupler (ExM-2) | 0.05 |
| Ultraviolet absorbing agent (UV-1) | 0.05 |
| Ultraviolet absorbing agent (UV-2) | 0.02 |
| Ultraviolet absorbing agent (UV-3) | 0.02 |
| Ultraviolet absorbing agent (UV-4) | 0.03 |
| Color-image stabilizer (Cpd-2) | 0.01 |
| Color-image stabilizer (Cpd-4) | 0.002 |
| Color-image stabilizer (Cpd-7) | 0.08 |
| Color-image stabilizer (Cpd-8) | 0.01 |
| Color-image stabilizer (Cpd-9) | 0.03 |
| Color-image stabilizer (Cpd-10) | 0.01 |
| Color-image stabilizer (Cpd-11) | 0.000: |
| Color-image stabilizer (Cpd-13) | 0.004 |
| Solvent (Solv-3) | 0.10 |
| Solvent (Solv-4) | 0.19 |
| Solvent (Solv-5) | 0.17 |
| Fourth Layer (Color-Mixing Inhibiting Layer) | |
| Gelatin | 0.71 |
| Color-mixing inhibitor (Cpd-4) | 0.04 |
| Color-mixing inhibitor (Cpd-5) | 0.05 |
| Color-image stabilizer (Cpd-6) | 0.005 |
| Color-image stabilizer (Cpd-7) | 0.10 |
| Color-image stabilizer (Cpd-13) | 0.004 |
| Solvent (Solv-1) | 0.04 |
| Solvent (Solv-2) | 0.16 |
| Fifth Layer (Red-Sensitive Emulsion Layer) | |
| The above-described silver chlorobromide emulsion C | 0.17 |
| Gelatin | 0.98 |

-continued

| | |
|---|---|
| Cyan coupler (ExC-1) | 0.05 |
| Cyan coupler (ExC-2) | 0.22 |
| Ultraviolet absorbing agent (UV-1) | 0.14 |
| Ultraviolet absorbing agent (UV-3) | 0.03 |
| Ultraviolet absorbing agent (UV-4) | 0.06 |
| Color-image stabilizer (Cpd-1) | 0.22 |
| Color-image stabilizer (Cpd-9) | 0.01 |
| Color-image stabilizer (Cpd-10) | 0.01 |
| Color-image stabilizer (Cpd-12) | 0.02 |
| Solvent (Solv-6) | 0.20 |
| Sixth Layer (Ultraviolet Absorbing Layer) | |
| Gelatin | 0.46 |
| Ultraviolet absorbing agent (UV-1) | 0.14 |
| Ultraviolet absorbing agent (UV-2) | 0.05 |

-continued

| | |
|---|---|
| Ultraviolet absorbing agent (UV-3) | 0.05 |
| Ultraviolet absorbing agent (UV-4) | 0.04 |
| Ultraviolet absorbing agent (UV-5) | 0.03 |
| Ultraviolet absorbing agent (UV-6) | 0.04 |
| Solvent (Solv-7) | 0.18 |
| Seventh Layer (Protective Layer) | |
| Gelatin | 1.00 |
| Acryl-modified copolymer of polyvinyl alcohol (modification degree: 17%) | 0.04 |
| Liquid paraffin | 0.02 |
| Surface-active agent (Cpd-14) | 0.01 |
| Surface-active agent (Cpd-15) | 0.01 |

(ExY-1) Yellow coupler

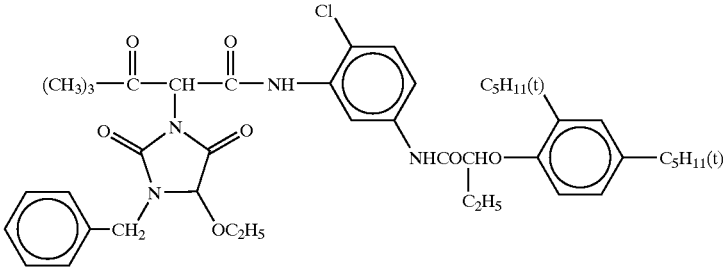

(ExY-2) Yellow coupler

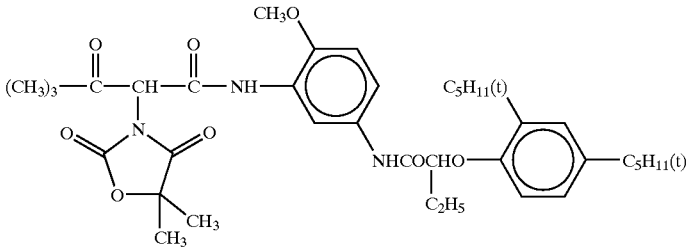

(ExY-3) Yellow coupler
A mixture in 70:30 (molar ratio) of

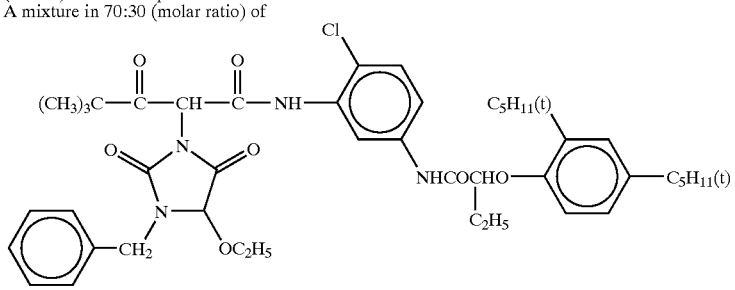

and

-continued
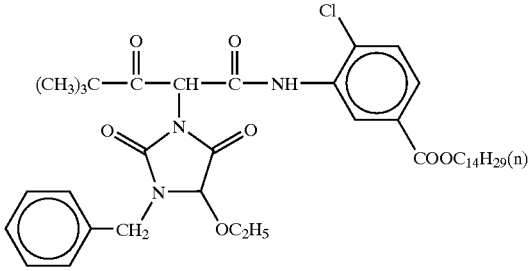
(ExM-1) Magenta coupler
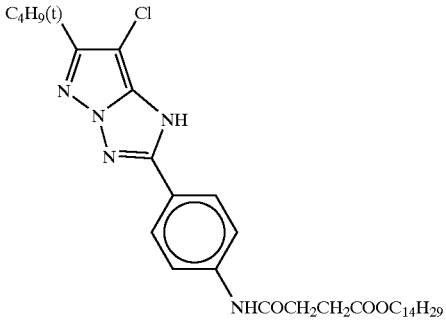
(ExM-2) Magenta coupler
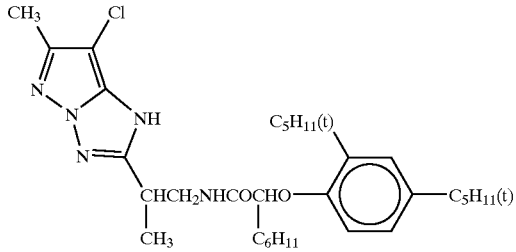
(ExM-3) Magenta coupler
A mixture in 40:40:20 (molar ratio) of
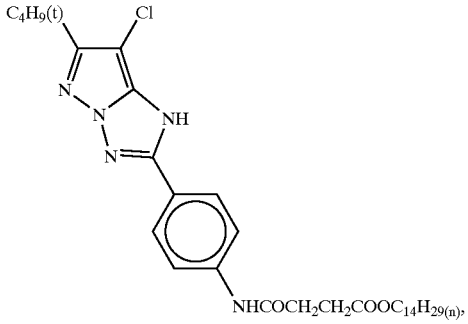
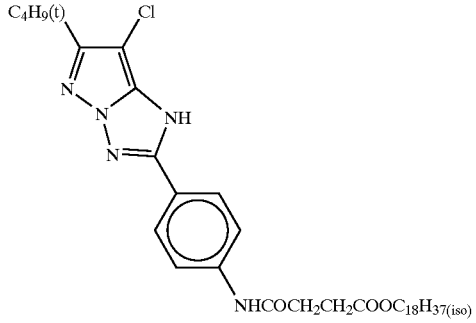
and
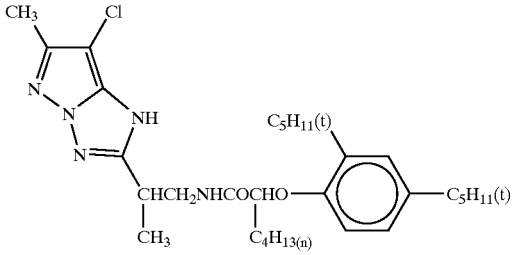
(ExM-4) Comparative magenta coupler
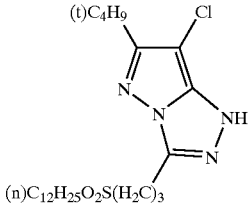
(ExC-1) Cyan coupler
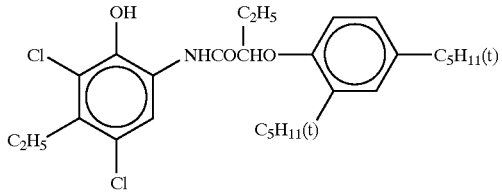

-continued
(ExC-2) Cyan coupler
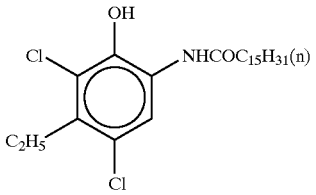
(ExC-3) Cyan coupler
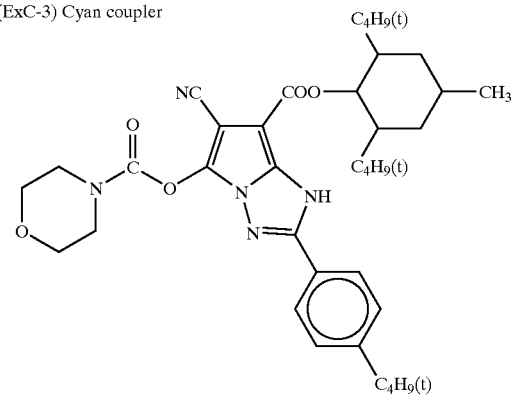
(ExC-4) Cyan coupler
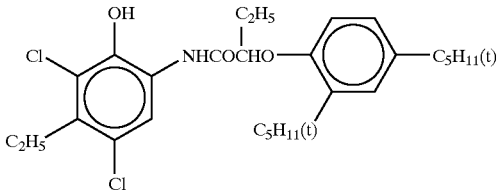
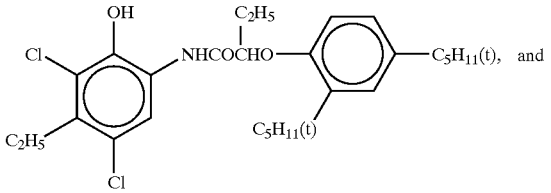
(ExC-5) Cyan coupler
A mixture in 50:25:25 (molar ratio) of
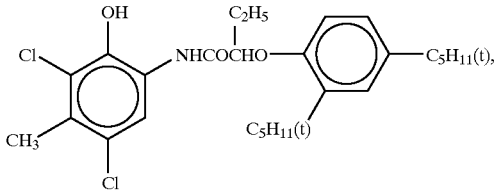
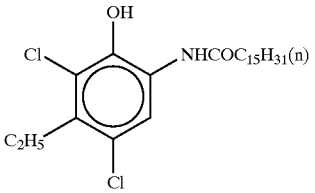
(Cpd-1) Color-image stabilizer
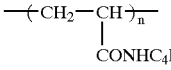
number-average
molecular weight 60,000
(Cpd-2) Color-image stabilizer
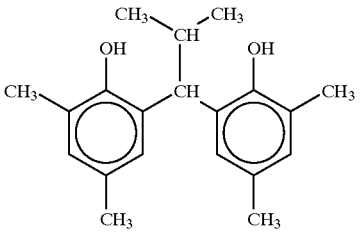
(Cpd-3) Color-image stabilizer
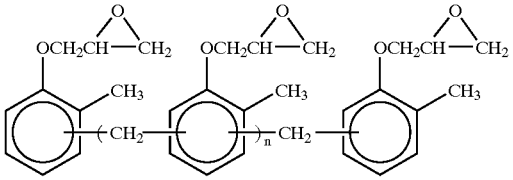
n = 7~8 (average value)
(Cpd-4) Color-mixing inhibitor
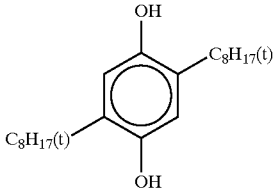
(Cpd-5) Color-mixing inhibitor
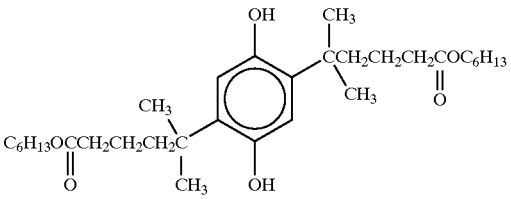
(Cpd-6) Auxiliary color-mixing inhibitor
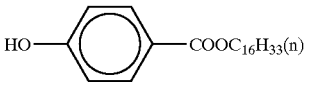

-continued
(Cpd-7) Stabilizer
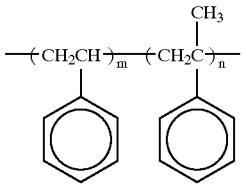
number-average molecular weight 600
m/n = 10/90
(Cpd-8) Color-image stabilizer
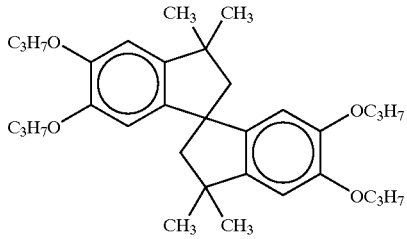
(Cpd-9) Color-image stabilizer
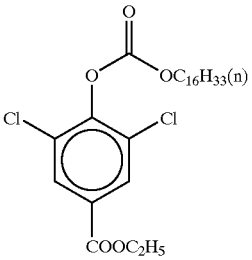
(Cpd-10) Color-image stabilizer
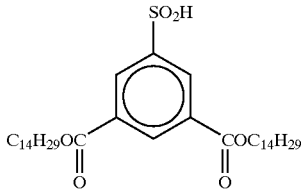
(Cpd-11)
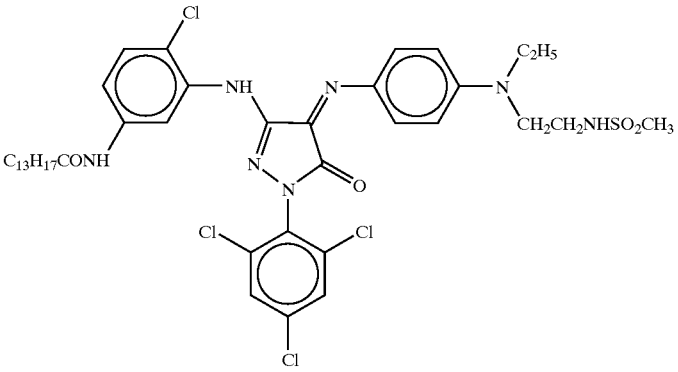
(Cpd-12) Color-image stabilizer
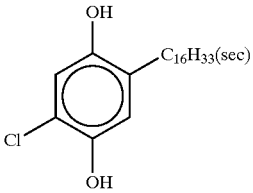
(Cpd-13) Color-image stabilizer
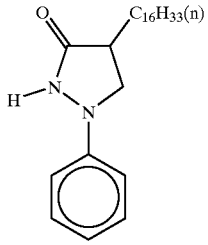
(Cpd-14) Surfactant
A mixture in 7:3 (weight ratio) of
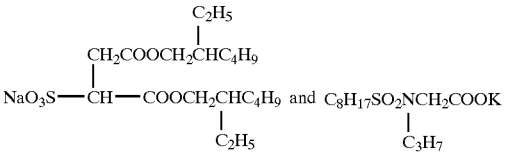
(Cpd-15) Surfactant
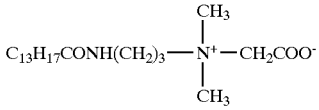

-continued
(Cpd-16)
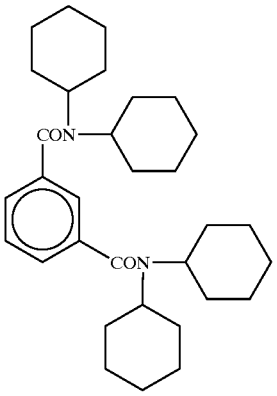
(Cpd-17)
A mixture in 1:1 of
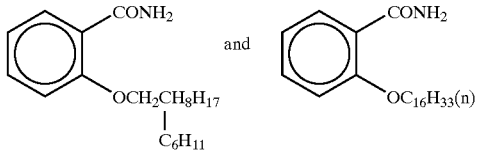
(Cpd-18)
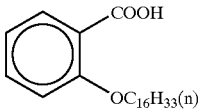
(Cpd-19)
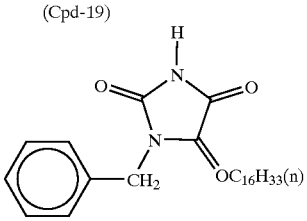
(Cpd-20)
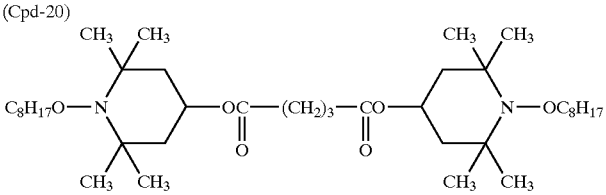
(Cpd-21) Color-image stabilizer
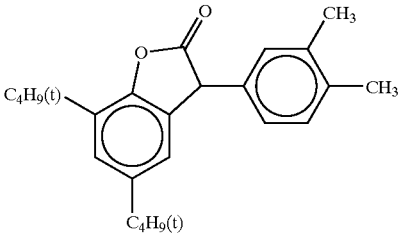
(Cpd-22) Surfactant
A mixture in 7:3 (molar ratio) of
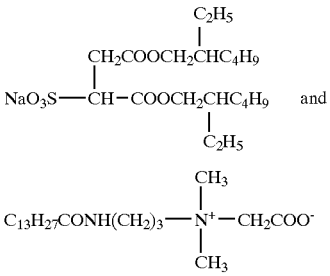
(Cpd-23)
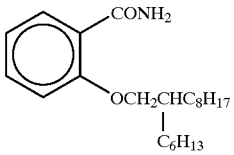
(Cpd-24) Surfactant
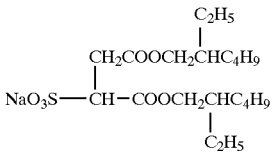
(UV-1) Ultraviolet absorbing agent
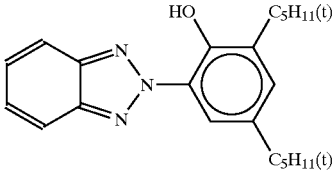
(UV-2) Ultraviolet absorbing agent
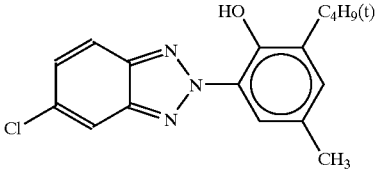

-continued (UV-3) Ultraviolet absorbing agent

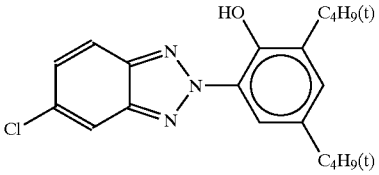

(UV-4) Ultraviolet absorbing agent

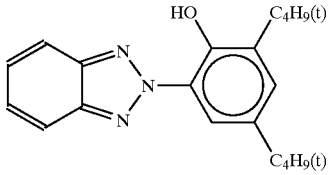

(UV-5) Ultraviolet absorbing agent

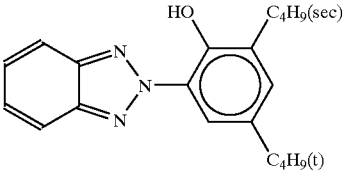

(UV-6) Ultraviolet absorbing agent

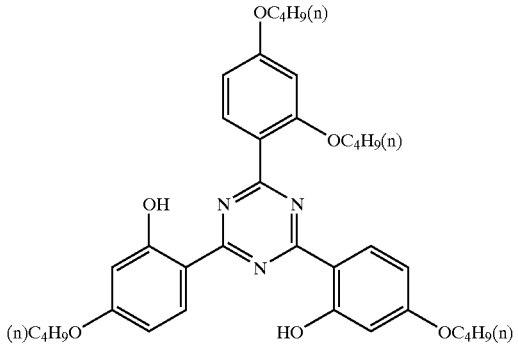

(UV-7) Ultraviolet absorbing agent

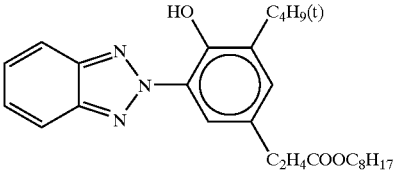

UV-A: A mixture in 4/2/2/3 (weight ratio) of UV-1/UV-2/UV-3/UV-4

UV-B: A mixture in 9/3/3/4/5/3 (weight ratio) of UV-1/UV-2/UV-3/UV-4/UV-5/UV-7

UV-C: A mixture in 1/1/1/2 (weight ratio) of UV-2/UV-3/UV-7/UV-6

(Solv-1)

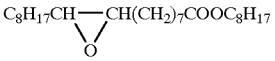

(Solv-2)

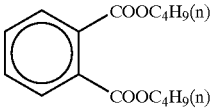

(Solv-3)

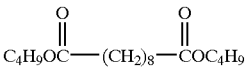

(Solv-4)

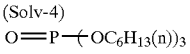

(Solv-5)

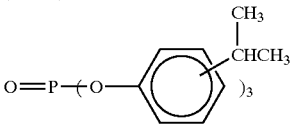

(Solv-6)

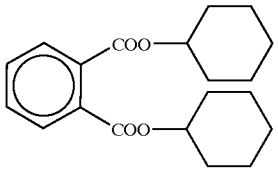

(Solv-7)

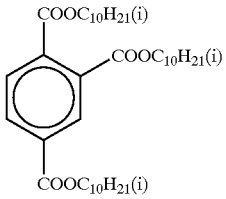

(Solv-8)

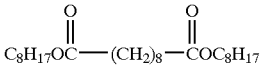

(Solv-9)

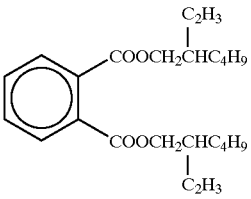

(S1-4)

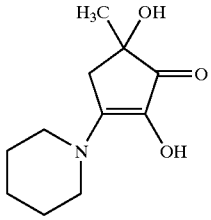

| Fifth layer (red-sensitive emulsion layer) | |
|---|---|
| Silver chlorobromide emulsion C1 (this emulsion was different from the silver chloride emulsion C only in the point that the content of silver bromide, which was contained locally in a part of the particle surface, was 0.8 mol %) | 0.11 |
| Gelatin | 1.13 |
| Cyan coupler (ExC-2) | 0.05 |
| Cyan coupler (ExC-3) | 0.10 |
| Cyan coupler (ExC-4) | 0.01 |
| Color-image stabilizer (Cpd-7) | 0.06 |
| Color-image stabilizer (Cpd-9) | 0.04 |
| Color-image stabilizer (Cpd-13) | 0.01 |
| Color-image stabilizer (Cpd-16) | 0.01 |
| Color-image stabilizer (Cpd-17) | 0.12 |
| Color-image stabilizer (Cpd-18) | 0.04 |
| Color-image stabilizer (Cpd-19) | 0.07 |
| Color-image stabilizer (Cpd-20) | 0.07 |
| Solvent (Solv-5) | 0.14 |

Further, in the silver halide color photographic

| Fifth layer (red-sensitive emulsion layer) | |
|---|---|
| The aforementioned silver chlorobromide emulsion C1 | 0.16 |
| Gelatin | 1.00 |
| Cyan coupler (ExC-1) | 0.05 |
| Cyan coupler (ExC-2) | 0.18 |
| Cyan coupler (ExC-3) | 0.024 |
| Ultraviolet absorber (UV-1) | 0.04 |
| Ultraviolet absorber (UV-3) | 0.01 |
| Ultraviolet absorber (UV-4) | 0.01 |
| Color-image stabilizer (Cpd-1) | 0.23 |
| Color-image stabilizer (Cpd-9) | 0.01 |
| Color-image stabilizer (Cpd-12) | 0.01 |
| Color-image stabilizer (Cpd-13) | 0.01 |
| Solvent (Solv-6) | 0.23 |

In the sample A001A, A101A and A201A manufactured in the above manner, the type of cyan coupler in the fifth layer and the support were altered to produce samples A1001 to A1021. (Each fifth layer of the samples A1001 to A1004 was the same as that of the sample A201A, and in each fifth layer of the samples A1005 to A1010, the cyan couplers were replaced by a comparative coupler such that the amount of the comparative coupler became equivalent by mol to the total amount of the cyan coupler of the sample A201A. Each fifth layer of the samples A1011 to A1014 was the same as that of the sample A001A. Each fifth layer of the samples A1015 to A1018 was the same as that of the sample A110A, and each fifth layer of the samples A1019 to A1021 was made by altering the cyan coupler (1) in the sample A101A to the coupler (2) with equimolar amount.) As to the number of the basic composition of the emulsion layer in Table 3, samples having the same compositions as the samples A001A, A101A or A201A except for the cyan coupler of the fifth layer were designated as A001, A101 or A201, respectively. These samples were evaluated in the following tests a and b.

Evaluation Test a (Increase in Dmin After the Sample was Stored at High Temperatures):

Each sample was stored in the two conditions of 25° C.-55% RH, 10 days, and 40° C.-55% RH, 10 days, and thereafter processed in the processing step A described later. Dmin of the unexposed part after the processing was measured. The Dmin measured after the storage in the condition of 25° C.-55% RH, 10 days was subtracted from the Dmin measured after the storage in the condition of 40° C.-55% RH, 10 days, to calculate an increase in fog (ΔDmin). Evaluation test b (variation in sensitivity after the sample was stored at high temperatures):

Each sample was stored in the same conditions as in the above test a. Thereafter the sample was exposed to light at 200 CMS for 0.1 sec by using a sensitometer through a three-color separation wedge, and processed in the processing step A described later. The exposure value required to give a color-developing density of 0.5 was measured, to calculate a logarithmic value (log E) of the measured exposure value. The log E after the storage in the condition of 25° C.-55% RH, 10 days, was subtracted from the log E after the storage in the condition of 40° C.-55% RH, 10 days, to calculate a variation in sensitivity (Δlog E).

The processing step will be hereinafter explained.

Processing A

The aforementioned light-sensitive material A201A was made into rolls with a width of 127 mm; they were exposed to light imagewise, using a mini-lab printer processor PP1258AR manufactured by Fuji Photo Film Co., Ltd.; and then, they were continuously processed (running test) in the following processing steps, until the replenishment reached to be equal to twice the color development tank volume. The process using thus-obtained running solution was designated processing A.

| Processing step | Temperature | Time | Replenishment rate* |
|---|---|---|---|
| Color developing | 38.5° C. | 45 sec | 45 ml |
| Bleach-fixing | 38.0° C. | 45 sec | 35 ml |
| Rinse (1) | 38.0° C. | 20 sec | — |
| Rinse (2) | 38.0° C. | 20 sec | — |
| Rinse (3) | **38.0° C. | 20 sec | — |
| Rinse (4) | **38.0° C. | 30 sec | 121 ml |

*Replenishment rate per $m^2$ of the light-sensitive material.

**A rinse cleaning system RC50D, manufactured by Fuji Photo Film Co., Ltd., was installed in the rinse (3) and the rinse solution was taken out from the rinse (3) and sent to a reverse osmosis membrane module (RC50D) by using a pump. The permeated water obtained in that tank was supplied to the rinse (4), and the concentrated water was returned to the rinse (3). Pump pressure was controlled such that the water to bepermeated in the reverse osmosis module would be maintained in an amount of 50 to 300 ml/min, and the rinse solution was circulated under controlled temperature for 10 hours a day.

(The rinse was made in a tank counter-current system from (1) to (4).)

The composition of each processing solution was as follows.

| [Color developer] | [Tank solution] | [Replenisher] |
|---|---|---|
| Water | 800 ml | 800 ml |
| Dimethylpolysiloxane-series surfactant (Silicone KF351A/ Shin-Etsu Chemical Co., Ltd.) | 0.1 g | 0.1 g |
| Tri(isopropanol)amine | 8.8 g | 8.8 g |
| Ethylenediamine tetraacetic acid | 4.0 g | 4.0 g |
| Polyethylene glycol (molecular weight: 300) | 10.0 g | 10.0 g |
| Sodium 4,5-dihydroxybenzene-1,3-disulfonate | 0.5 g | 0.5 g |
| Potassium chloride | 10.0 g | — |
| Potassium bromide | 0.040 g | 0.010 g |

-continued

| [Color developer] | [Tank solution] | [Replenisher] |
|---|---|---|
| Triazinylaminostilbene-series fluorescent whitening agent (Hakkol FWA-SF/Showa Chemical Industry Co., Ltd.) | 2.5 g | 5.0 g |
| Sodium sulfite | 0.1 g | 0.1 g |
| Disodium-N,N-bis(sulfonatoethyl) hydroxylamine | 8.5 g | 11.1 g |
| N-ethyl-N-(β-methanesulfonamidoethyl)-3-methyl-4-amino-4-aminoaniline 3/2 sulfuric acid · 1 hydrate | 5.0 g | 15.7 g |
| Potassium carbonate | 26.3 g | 26.3 g |
| Water to make | 1000 ml | 1000 ml |
| pH (25° C./adjusted using potassium hydroxide and sulfuric acid) | 10.15 | 12.50 |

| [Bleach-fixing solution] | [Tank solution] | [Replenisher] |
|---|---|---|
| Water | 700 ml | 600 ml |
| Ethylenediaminetetraacetic acid iron (III) ammonium | 47.0 g | 94.0 g |
| Ethylenediamine tetraacetic acid | 1.4 g | 2.8 g |
| m-Carboxybenzenefulfinic acid | 8.3 g | 16.5 g |
| Nitric acid (67%) | 16.5 g | 33.0 g |
| Imidazole | 14.6 g | 29.2 g |
| Ammonium thiosulfate (750 g/l) | 107.0 ml | 214.0 ml |
| Ammonium sulfite | 16.0 g | 32.0 g |
| Ammonium bisulfite | 23.1 g | 46.2 g |
| Water to make | 1000 ml | 1000 ml |
| pH (25° C./adjusted using acetic acid and ammonia) | 6.0 | 6.0 |

| [Rinse solution] | [Tank solution] | [Replenisher] |
|---|---|---|
| Sodium chlorinated-isocyanurate | 0.02 g | 0.02 g |
| Deionized water (conductivity: 5 μmS/cm or less) | 1000 ml | 1000 ml |
| pH | 6.5 | 6.5 |

Processing B

Running solutions were made in the same manner as in the processing A, except that the aforementioned light-sensitive material A201A was continuously processed using a mini-lab printer processor PP1258AR, which was manufactured by Fuji Photo Film Co., Ltd. and remodeled so that the conveyer speed could be enhanced in order to shorten the time of the processing steps. The process using this running solution was designated Processing B.

| Processing step | Temperature | Time | Replenishment rate* |
|---|---|---|---|
| Color developing | 45.0° C. | 15 sec | 45 ml |
| Bleach-fixing | 40.0° C. | 15 sec | 35 ml |
| Rinse (1) | 40.0° C. | 7 sec | — |
| Rinse (2) | 40.0° C. | 7 sec | — |
| Rinse (3) | **40.0° C. | 7 sec | — |
| Rinse (4) | **40.0° C. | 7 sec | 121 ml |

*and**are the same as in the processing A.

The composition of each processing solution was different from that in the processing A, only in the following point (the amount of the compounds and pH).

| [Color developer] | [Tank solution] | [Replenisher] |
|---|---|---|
| N-ethyl-N-(β-methanesulfonamidoethyl)-3-methyl-4-amino-4-aminoaniline · 3/2 sulfuric acid · 1 hydrate | 10.0 g | 22.0 g |

| [Bleach-fixing solution] | [Tank solution] | [Replenisher] |
|---|---|---|
| Ethylenediaminetetraacetic acid iron (III) ammonium | 75.0 g | 150.0 g |
| pH | 5.5 | 5.5 |

| [Rinse solution] | [Tank solution) | [Replenisher] |
|---|---|---|
| pH | 5.5 | 5.5 |

TABLE 3

| Sample No. | Type of support | Basic composition of emulsion layer (Type of cyan coupler in fifth layer) | ΔDmin (RL) | Remarks |
|---|---|---|---|---|
| A1001 | A | A201((1), Comparative cyan coupler C1, C2) | 0.020 | Comparative example |
| A1002 | B | A201((1), Comparative cyan coupler C1, C2) | 0.003 | This invention |
| A1003 | C | A201((1), Comparative cyan coupler C1, C2) | 0.003 | This invention |
| A1004 | D | A201((1), Comparative cyan coupler C1, C2) | 0.003 | This invention |
| A1005 | A | A201(Comparative coupler C1) | 0.020 | Comparative example |
| A1006 | B | A201(Comparative coupler C1) | 0.010 | This invention |
| A1007 | C | A201(Comparative coupler C1) | 0.010 | This invention |
| A1008 | A | A201(Comparative coupler C2) | 0.020 | Comparative example |
| A1009 | B | A201(Comparative coupler C2) | 0.010 | This invention |
| A1010 | C | A201(Comparative coupler C2) | 0.010 | This invention |
| A1011 | A | A001(Comparative coupler C1, C2) | 0.020 | Comparative example |
| A1012 | B | A001(Comparative coupler C1, C2) | 0.010 | This invention |
| A1013 | C | A001(Comparative coupler C1, C2) | 0.010 | This invention |
| A1014 | D | A001(Comparative coupler C1, C2) | 0.010 | This invention |
| A1015 | A | A101((1), Comparative coupler C2, C3) | 0.020 | Comparative example |
| A1016 | B | A101((1), Comparative coupler C2, C3) | 0.003 | This invention |
| A1017 | C | A101((1), Comparative coupler C2, C3) | 0.003 | This invention |
| A1018 | D | A101((1), Comparative coupler C2, C3) | 0.003 | This invention |
| A1019 | A | A101((2), Comparative coupler C2, C3) | 0.020 | Comparative example |
| A1020 | B | A101((2), Comparative coupler C2, C3) | 0.002 | This invention |
| A1021 | C | A101((2), Comparative coupler C2, C3) | 0.002 | This invention |

Comparative cyan coupler C1

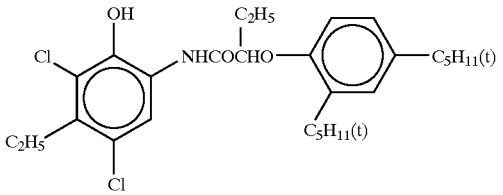

Comparative cyan coupler C2

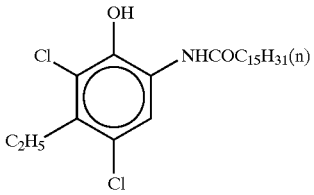

Comparative cyan coupler C3

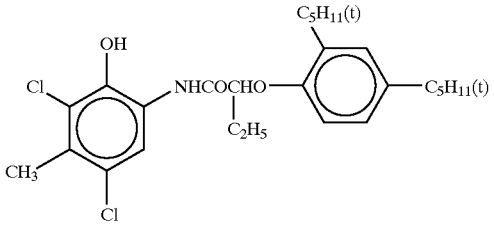

From Table 3, it is found that the light-sensitive materials of the present invention, each of which was formed by applying a silver halide emulsion having the silver chloride content of 95 mol % or more to the support according to the present invention, were reduced in an increase of fog when they were stored at high temperature. Also, when a cyan coupler preferable in the present invention was used, the increase of fog was further suppressed to be small.

Example 1-2

The samples in Example 1-1 were processed using the processing step B, with the color development time being 20 sec or less, and increase of fog was evaluated according to Example 1-1. As a consequence, the same results as in Example 1-1 were obtained.

Example 1-3

The type of magenta coupler in the third layer and the support were altered in the sample A201A, to make samples A2001 to A2016. In changing the type of magenta couplers, they were replaced so as to be equal in mol. Using these samples, the evaluation b was made. The results are shown in Table 4.

TABLE 4

| Sample No. | Type of support | Type of magenta coupler | Δlog E | Remarks |
|---|---|---|---|---|
| A2001 | A | M-21/M-32* | 0.08 | Comparative example |
| A2002 | B | M-21/M-32* | 0.02 | This invention |
| A2003 | C | M-21/M-32* | 0.02 | This invention |
| A2004 | D | M-21/M-32* | 0.02 | This invention |

TABLE 4-continued

| Sample No. | Type of support | Type of magenta coupler | Δlog E | Remarks |
|---|---|---|---|---|
| A2005 | A | M-21 | 0.08 | Comparative example |
| A2006 | B | M-21 | 0.02 | This invention |
| A2007 | C | M-21 | 0.02 | This invention |
| A2008 | A | M-61 | 0.09 | Comparative example |
| A2009 | B | M-61 | 0.02 | This invention |
| A2010 | C | M-61 | 0.02 | This invention |
| A2011 | A | Comparative coupler M1 | 0.09 | Comparative example |
| A2012 | B | Comparative coupler M1 | 0.04 | This invention |
| A2013 | C | Comparative coupler M1 | 0.04 | This invention |
| A2014 | A | Comparative coupler M2 | 0.09 | Comparative example |
| A2015 | B | Comparative coupler M2 | 0.04 | This invention |
| A2016 | C | Comparative coupler M2 | 0.04 | This invention |

*M-21/M-32 were used with the weight ratio of 2:1.

Comparative magenta coupler M1

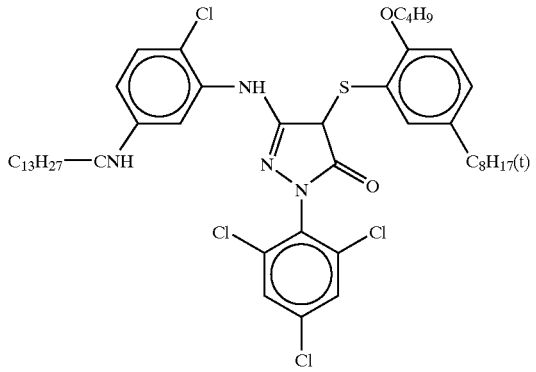

Comparative magenta coupler M2

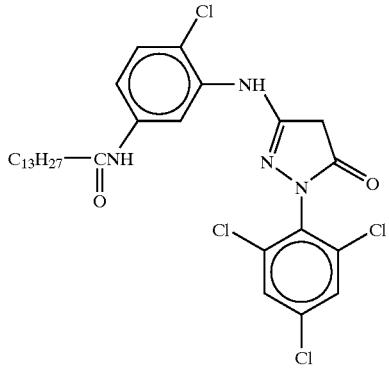

From Table 4, it is found that the light-sensitive materials of the present invention, each of which was formed by applying a silver halide emulsion having the silver chloride content of 95 mol % or more to the support according to the present invention, were reduced in variation of sensitivity when they were stored at high temperature. Also, when a cyan coupler preferable in the present invention was used, the variation of sensitivity was further suppressed to be small.

Example 1-4

Each sample in Example 1-3 was subjected to the processing according to the evaluation b, except that the exposure time was altered to $10^{-4}$ sec. As a consequence, almost the same effects as in Example 1-3 were obtained.

Example 1-5

Samples were prepared by altering the support B to the support B2, the support C to the support C2, and the support D to the support D2, in Examples 1-1 to 1-3, respectively, and they were subjected to evaluations. As a result, it was found that variations in fog and in sensitivity due to the change of the storage condition of the light-sensitive material, could be decreased according to the present invention.

Example 1-6

The following compound was added to the fifth layer in an amount of $1.0\times10^{-5}$ mol per mol of the silver halide in Example 1-1, and the resulting sample was evaluated in the same manner as in Example 1-1. As a result, almost the same effects were obtained.

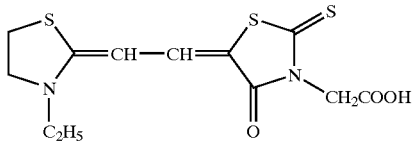

Example 1-7

A running process was carried out using the light-sensitive material A201A in the same manner as in the processing A, except that the bleach-fixing solution was altered to one having the following composition.

| [Bleach-fixing solution] | [Tank solution] | [Replenisher] |
|---|---|---|
| Water | 800 ml | 800 ml |
| Ammonium thiosulfate (750 g/l) | 107.0 ml | 214.0 ml |
| m-Carboxymethylbenzene-sulfinic acid | 8.3 g | 16.5 g |
| Ethylenediaminesuccinic acid (SS-isomer) | 42 g | 84 g |
| Ferric nitrate nonahydrate | 48.5 g | 97 g |
| 90% Acetic acid | 6.7 g | 13.4 g |
| Nitric acid | 0.18 mol | 0.36 mol |
| Imidazole | 14.6 g | 29.2 g |
| Ammonium sulfite | 16.0 g | 32.0 g |
| Potassium methabisulfite | 23.1 g | 46.2 g |
| Water to make | 1000 ml | 1000 ml |
| pH (25 ° C./adjusted using acetic acid and ammonium) | 6.5 | 6.5 |

(Note)
*: The chelating agent-1 and the chelating agent-2 are the aminocarboxylic acid component in the bleaching agent-1 and bleaching agent-2, respectively; and the amounts of these agents are 10 mol% of the bleaching agent-1 and bleaching agent-2, respectively.
**: The total amount of the bleaching agent-1 and the bleaching agent-2 is 120 mmol for the tank solution and 240 mmol for the replenisher.

In Examples 1-1 and 1-3, the bleach-fixing solution of the processing A was altered to the above solution, to evaluate variations in fog and sensitivity. The same results were obtained.

Example 2-1

A paper base both surfaces of which had been coated with a polyethylene resin, was subjected to surface corona discharge treatment; then it was provided with a gelatin undercoat layer containing sodium dodecylbenzensulfonate, and it was successively coated with the first to seventh photographic constitutional layers, to prepare Sample B001 of a silver halide color photographic light-sensitive material having the layer constitution shown below. The coating solutions for each photographic constitutional layer were prepared as follows.

Preparation of Fifth Layer Coating Solution

An emulsified dispersion C and a silver chlorobromide emulsion C, which were used for the fifth layer in Example 1-1, were prepared.

The emulsified dispersion C and the silver chlorobromide emulsion C were mixed and dissolved to prepare a fifth layer coating solution such that the coating solution had the following composition. The coating amount of the emulsion is an amount converted in terms of silver.

Each coating solution for the first layer to the fourth layer, and the sixth layer to the seventh layer was prepared in the same manner as the fifth layer coating solution. As the gelatin hardener for each layer, 1-oxy-3,5-dichloro-s-triazine sodium salt (H-1) was used.

The constitution other than the above is the same as that of the sample A001A in Example 1-1, unless otherwise noted.

(Layer Constitution)

The constitution of each layer is shown below. The numerals indicate the applied amount (g/m$^2$). The coating amount of the silver halide emulsion is an amount converted in terms of coating amount of silver.

Support

Polyethylene Resin Laminated Paper

[The polyethylene resin on the first layer side contained a white pigment ($TiO_2$; content of 16 wt %, ZnO; content of 4 wt %), a fluorescent whitening agent (a mixture of 4,4'-bis(benzoxazolyl)stilbene and 4,4'-bis(5-methylbenzoxazolyl)stilbene mixed in a ratio of 8/2; content of 0.05 wt %) and a bluish dye (ultramarine)]

Second Layer and Fourth Layer (Color-Mixing Inhibiting Layers)

The following compound was added to the corresponding layers of the sample A001A in Example 1-1.

| | |
|---|---|
| Color-image stabilizer (Cpd-21) | 0.01 |

Third Layer (Green-Sensitive Emulsion Layer)

This layer was different from the corresponding layer of the sample A001A in Example 1-1 only in the point that no magenta coupler (ExM-2) was used and the amount of the magenta coupler (ExM-1) was changed to 0.13 g/m$^2$.

Seventh Layer (Protective Layer)

This layer was different from the corresponding layer of the sample A001A in Example 1-1 only in the point that the surfactant (Cpd-14) was replaced with the surfactant (Cpd-24) equal in amount.

As the reflective support, the aforementioned A and C were used.

Samples B002 to B003 were prepared in the same manner as Comparative Example B001 produced in the above, except that the oil-soluble components excluding the coupler in the third layer were regulated such that the ratio of oil-soluble ingredient/coupler became the value described in Table 5 keeping the same proportion of contents.

Further, samples B004 to B006 were prepared in the same manner as samples B001 to B003, except that the support A was changed to the support C according to the present invention.

The sensitivity and color density of the magenta color-forming layer of each sample were measured. The results are shown in Table 5. Table 5 shows the sensitivity at the density of 0.5 (S0.5) (relative sensitivity using the sample B001 as a standard) and color density (Dmax) of each sample stored in a refrigerator. Further, as to the samples stored at 30° C.-70% humidity, a difference (ΔS0.5) in sensitivity from a corresponding sample stored in a refrigerator, and a difference in color density at the exposure amount at which the density of the sample stored in a refrigerator became 1.5 (ΔD1.5) are shown.

TABLE 5

| Sample | Support | Magenta coupler | Ratio of oil-soluble content/coupler | Hardener | S0.5 | Dmax | ΔS0.5 | ΔD1.5 |
|---|---|---|---|---|---|---|---|---|
| B001 | A | (M-21) | 5.4 | H-1 | ±0.00 | 2.20 | +0.02 | −0.05 |
| B002 | A | (M-21) | 4.5 | H-1 | ±0.00 | 2.19 | +0.01 | −0.06 |
| B003 | A | (M-21) | 2.5 | H-1 | ±0.00 | 2.17 | +0.01 | −0.08 |
| B004 | C | (M-21) | 5.4 | H-1 | +0.05 | 2.20 | +0.03 | −0.04 |
| B005 | C | (M-21) | 4.5 | H-1 | +0.04 | 2.20 | +0.02 | −0.05 |
| B006 | C | (M-21) | 2.5 | H-1 | +0.04 | 2.18 | +0.02 | −0.07 |
| B007 | A | ExM-4 | 5.4 | H-1 | −0.06 | 1.82 | +0.01 | −0.05 |
| B008 | A | ExM-4 | 4.5 | H-1 | −0.07 | 1.76 | −0.01 | −0.07 |
| B009 | A | ExM-4 | 2.5 | H-1 | −0.09 | 1.62 | −0.03 | −0.10 |
| B010 | C | ExM-4 | 5.4 | H-1 | −0.06 | 1.84 | ±0.00 | −0.06 |
| B011 | C | ExM-4 | 4.5 | H-1 | −0.08 | 1.77 | −0.02 | −0.09 |
| B012 | C | ExM-4 | 2.5 | H-1 | −0.10 | 1.58 | −0.03 | −0.11 |
| B013 | A | (M-21) | 5.4 | H-4 | +0.02 | 2.21 | +0.04 | −0.05 |
| B014 | A | (M-21) | 4.5 | H-4 | +0.01 | 2.20 | +0.04 | −0.06 |
| B015 | A | (M-21) | 2.5 | H-4 | +0.01 | 2.17 | +0.03 | −0.08 |
| B016 | C | (M-21) | 5.4 | H-4 | +0.09 | 2.21 | +0.01 | −0.02 |
| B017 | C | (M-21) | 4.5 | H-4 | +0.08 | 2.19 | ±0.00 | −0.02 |
| B018 | C | (M-21) | 2.5 | H-4 | +0.08 | 2.19 | ±0.00 | −0.03 |
| B019 | A | ExM-4 | 5.4 | H-4 | −0.04 | 1.81 | +0.02 | −0.07 |
| B020 | A | ExM-4 | 4.5 | H-4 | −0.05 | 1.75 | ±0.00 | −0.08 |
| B021 | A | ExM-4 | 2.5 | H-4 | −0.07 | 1.59 | −0.02 | −0.11 |
| B022 | C | ExM-4 | 5.4 | H-4 | −0.04 | 1.82 | −0.01 | −0.07 |
| B023 | C | ExM-4 | 4.5 | H-4 | −0.07 | 1.79 | −0.04 | −0.10 |
| B024 | C | ExM-4 | 2.5 | H-4 | −0.09 | 1.60 | −0.05 | −0.13 |

Samples B007 to B012 were prepared in the same manner as samples B001 to B006 except that the magenta coupler ExM-1 was changed to the comparative magenta coupler ExM-4.

Samples B013 to B024 were produced in the same manner as samples B001 to B012, except that the hardener H-1 was changed to the hardener H-4, which was a preferable hardener for use in the present invention.

The aforementioned samples B001 to B024 were subjected to gray gradation exposure, and running processing using the following processing solutions was conducted so as to be in a running condition, until the replenishing amount reached three times the volume of the mother solution.

The Processing Steps are Shown Below.

Processing A1

A processing A1 was structured in the same manner as the processing A, except that the following points were different from the processing A.

As the light-sensitive material for making the running solution, the above light-sensitive material B005 was used.

To examine the storage stability of the light-sensitive material, a sample was stored at 5° C. in a refrigerator, and the other was stored in the condition of 30° C.-70% for one month, and they were then subjected to gray gradation exposure for 1/10 sec, followed by processing using the above running process solution.

As is apparent from Table 5, the preferable coupler in the present invention, when it was used in combination with the support according to the present invention, could give remarkably high sensitivity in comparison with the case where the comparative support was used. In addition, by allowing the ratio of oil-soluble ingredient/coupler ratio to be in the preferable range of the present invention, high sensitivity could be attained without adversely affecting a variation in sensitivity when the light-sensitive material was stored for a long term.

In the case of the comparative coupler ExM-4, it originally imparted low sensitivity and color density. With respect to the change in sensitivity after the storage, different from the case of the preferable coupler for use in the present invention, no difference was observed between the supports in behavior of variation in sensitivity with the lapse of time when the coupler was used. Therefore, the present invention is newly found from these results, and is never expected from the conventional teachings.

It is also apparent from Table 5, that the use of the hardener preferably used in the present invention made it possible to further improve the sensitivity and to decrease a variation in sensitivity with the lapse of time.

As to the behavior of a variation in sensitivity due to a combination with a hardener, there was also a difference between the coupler preferably used in the present invention and the comparative coupler. Concerning this, the conventional teachings suggest nothing.

One-half of the coupler ExM-1 for use in the present invention was replaced by the coupler ExM-2 to prepare samples B025 to B042, which were then evaluated like the above. In this case, light-sensitive materials which had high sensitivity and a suppressed variation in sensitivity with lapse of time could be produced as far as the support according to the present invention and the oil-soluble ingredient amount accorded to the preferable scope of the present invention. Also, by combining a hardener according to the present invention, a further improvement was effected.

In addition, the samples of the present invention were all extremely superior in sharpness, curling characteristics, surface smoothness and whiteness.

Example 2-2

Each fifth layer of the samples B001 to B024 prepared in Examples 2-1 was replaced by the fifth layer of the sample A101A prepared in Example 1-1 to produce samples B101 to B124, and then they were evaluated in the same manner.

In this case, also enhancement in sensitivity and an improvement in the storage stability were found as far as a magenta coupler and oil-soluble ingredient accorded to the preferable scope of the present invention, and the same effects as in Example 2-1 were obtained. In this example, it was found that a variation in the sensitivity of the cyan color-forming layer was also improved. This example is superior in the color reproducibility of blue and green, and is among the preferable embodiments of the present invention, which enable the reproducibility of a vivid color.

Example 2-3

Each fifth layer of the samples B001 to B024 prepared in Examples 2-1 was replaced by the fifth layer of the sample A201A prepared in Example 1-1 to produce samples B201 to B224, which were then evaluated in the same manner.

In this case, also enhancement in sensitivity and an improvement in the storage stability were found and the same effects as in Example 2-1 were obtained as far as a preferable magenta coupler and oil-soluble ingredient accorded to the scope of the present invention. In this example, it was found that a variation in the sensitivity of the cyan color-forming layer was also improved. This example is among the preferable embodiments of the present invention, which have excellent image storability and are highly economical.

Example 2-4

The exposure time was altered to $10^{-4}$ sec in the productions of the samples B201 to B240 in Example 2-3, and the resulted samples were subjected to the processing step shown by the following processing step B1.

The samples were evaluated according to the method of Example 2-1, and as a consequence, almost the same results were obtained. Particularly, a variation in sensitivity with the lapse of time was improved more significantly than in the case of Example 2-3.

Processing B1

A processing B1 differed from the processing B only in the points that the above light-sensitive material B205 was used to make the running solution, and the pH of the rinse solution both in the tank solution and in the replenisher was changed to 6.5.

Example 3-1

(Preparation of Sample C101)

On the aforementioned reflective support A, photographic structural layers of the fist layer to seventh layer were coated successively, to produce a sample C101 of a silver halide color photographic light-sensitive material having the layer constitution shown below. The coating solution for each photographic constitutional layer was prepared as follows.

Preparation of Fifth Layer Coating Solution 50 g of a cyan coupler (ExC-1), 170 g of a cyan coupler (ExC-2), 30 g of a cyan coupler (ExC-3), 220 g of a color-image stabilizer (Cpd-1), 12 g of a color-image stabilizer (Cpd-9), 10 g of a color-image stabilizer (Cpd-12), 11 g of a color-image stabilizer (Cpd-13), 40 q of an ultraviolet absorber (UV-1), 10 g of an ultraviolet absorber (UV-3), and 10 g of an ultraviolet absorber (UV-4) were dissolved in 210 g of a solvent (Solv-6) and 350 ml of ethyl acetate. This resulted solution was emulsified and dispersed in 6500 g of an aqueous 10% gelatin solution containing 200 ml of 10% sodium dodecylbenzenesulfonate, to prepare an emulsified dispersion C1.

Using the above emulsified dispersion C1 and the aforementioned silver chlorobromide emulsion C (in which, silver bromide fine particles with an average sphere equivalent diameter of 0.03 $\mu$m that were prepared in advance were used, to contain silver bromide locally), a fifth layer coating solution was prepared in the same manner as in the production of the sample A001A in Example 1-1.

Also, a sample C101 was prepared in the same manner as in the production of the sample A001A in Example 1-1, unless otherwise noted.

(Layer Structure)

The structure of each layer is shown below. The numerals represent applied amounts (g/m$^2$). The coating amount of the silver halide emulsion is shown in terms of silver.

First Layer (Blue-Sensitive Emulsion Layer)

This layer was different from the corresponding layer of the sample A001A in Example 1-1 in the point that only the amounts (unit: g/m$^2$) of the following compounds were changed.

Silver chlorobromide emulsion A (in which, to contain silver bromide locally, silver bromide fine particles with an average sphere equivalent diameter of 0.03 $\mu$m that were prepared in advance were used): 0.27, gelatin: 1.36, yellow coupler (ExY-1): 0.43, and solvent (Solv-1): 0.25.

Second Layer and Fourth Layer (Color-Mixing Inhibiting Layers)

These layers were the same as the corresponding layers of the sample A001A in Example 1-1.

Third Layer (Green-Sensitive Emulsion Layer)

This layer was different from the corresponding layer of the sample A001A in Example 1-1 in the point that only the amounts (unit: g/m$^2$) of the following compounds were changed.

Silver chlorobromide emulsion B (in which, to contain silver bromide locally, silver bromide fine particles with an average sphere equivalent diameter of 0.03 $\mu$m that were prepared in advance were used): 0.14, gelatin: 1.32, magenta coupler (ExM-2): 0.08, color-image stabilizer (Cpd-2): 0.02, solvent (Solv-3): 0.10, and solvent (Solv-5): 0.17.

Fifth Layer (Red-Sensitive Emulsion Layer)

This layer was different from the fifth layer of the sample A201A in Example 1-1 in the point that the silver chloride emulsion C1 was changed to 0.17 g/m$^2$ of the aforementioned silver chlorobromide emulsion C (in which, to contain silver bromide locally, silver bromide fine particles with an average sphere equivalent diameter of 0.03 $\mu$m that were prepared in advance were used), solvent (Solv-5) was replaced by 0.21 g/m$^2$ of solvent (Solv-6), and each amount (unit: g/m$^2$) of the following compounds was changed as follows.

Cyan coupler (ExC-2): 0.17, cyan coupler (ExC-3): 0.03, and color-image stabilizer (Cpd-1): 0.22.

Sixth layer (ultraviolet absorbing layer) and Seventh layer (protective layer) were the same as the corresponding layers of the sample A201A in Example 1-1.

(Preparation of Samples C102 to C112)

Next, samples C102 to C112 were prepared by changing the support and regulating the gradation as shown in Table 6 from those in the sample C101. The gradation was regulated by controlling each amount of the yellow prussiate of potash used in the preparation of the silver chloride substrate, and potassium hexachloroiridate (IV) contained in the silver bromide fine particles that were used to make silver bromide locally contained in the surface of the particle. In this preparation, other characteristic values such as the average particle size, the coefficient of variation in the particle size of distribution, the content of silver bromide, the addition amount of a sensitizing dye, and the mixing ratio of large- and small-sized emulsions were designed to be the same as those of the corresponding emulsion used in the sample C101.

(Exposure of the Sample)

The samples C101 to C112 were exposed to light using the following exposure apparatus, spectral filter, and optical wedge, to see the gradation when the exposure time was $10^{-4}$ sec.

Exposure apparatus: Sensitometer MARK VII manufactured by EG & G Ltd.

Filter: band pass filters for light of 480 nm (blue), 550 nm (green), and 680 nm (red), respectively.

In addition, the following two types of image were formed by exposure using a laser scanning exposure apparatus described in JP-A-10-20547, for the purpose of evaluating the obtained image.

Image A: a white dish and tableware made of silver placed on a black felted cloth (the photograph of these articles was taken using a reversal film Velvia produced by Fuji Photo Film Co., Ltd., and then the image was taken in by means of a film scanner to obtain digital data).

Image B: transparent spheres lined up like a right-octahedron-form, which appeared on a black ground (This is a CG image which was shadowed by Phong shading and rendered by a radiocity method, on the premise that the spheres had transparent bodies with a refractive index of 2.42, and the illumination was of a parallel light source).

A processing that was the same as the processing A, except that the sample C101 was used to make the running solution, was designated as processing A2. Each light-sensitive material after being exposed was developed.

(Evaluation)

The measurement of the gradation was made using an HPD-5 model densitometer manufactured by Fuji Photo Film Co., Ltd.

On the other hand, the evaluation of the image was made by sensorial evaluation by 10 examinees. In the evaluation method, 10 examinees evaluated each quality (blurring, depth of black, three-dimensional depth, and texture, or the like) of the images A and B produced using each sample. The result of the evaluation were classified into three grades: the image was satisfactory or was seen to be natural (○), the image was not satisfactory but acceptable as a picture (Δ), and the picture was seen to be unnatural and not acceptable (X). With regard to each sample, a grade selected by the most examinees was determined as the evaluated grade. Among the course of these evaluations, the most popular image qualities, based on which the examinees made their judgement, were three dimensional depth and texture. The results of the evaluation are shown in Table 6, together with the result of Example 3-2 described later.

TABLE 6

| | | Maximum gamma when the exposure time was $10^{-4}$ (Density 1.5 to 2.0) | | | Maximum gamma when the exposure time was 1/10 sec (Density 1.5 to 2.0) | | | Evaluation of image | | | | |
|---|---|---|---|---|---|---|---|---|---|---|---|---|
| Sample | Support | Yellow | Magenta | Cyan | Yellow | Magenta | Cyan | Image A | Image B | Image C | Image D | Remarks |
| C101 | A | 1.4 | 1.2 | 0.8 | 3.2 | 2.8 | 3.4 | X | X | X | Δ | Comparative example |
| C102 | A | 3.3 | 2.9 | 3.8 | 3.3 | 3.2 | 3.9 | X | Δ | Δ | Δ | Comparative example |
| C103 | A | 3.5 | 3.4 | 4.1 | 4.2 | 3.9 | 4.2 | Δ | Δ | Δ | X | Comparative example |
| C104 | B | 3.3 | 2.9 | 3.8 | 3.3 | 3.2 | 3.9 | ○ | ○ | ○ | ○ | This invention |
| C105 | B | 3.5 | 3.4 | 4.1 | 4.2 | 3.9 | 4.2 | ○ | ○ | ○ | Δ | This invention |
| C106 | C | 3.3 | 2.9 | 3.8 | 3.3 | 3.2 | 3.9 | ○ | Δ | ○ | ○ | This invention |
| C107 | D | 3.3 | 2.9 | 3.8 | 3.3 | 3.2 | 3.9 | ○ | Δ | ○ | ○ | This invention |
| C108 | D | 3.5 | 3.4 | 4.1 | 4.2 | 3.9 | 4.2 | ○ | ○ | ○ | Δ | This invention |
| C109 | B2 | 3.3 | 2.9 | 3.8 | 3.3 | 3.2 | 3.9 | ○ | ○ | ○ | ○ | This invention |
| C110 | B2 | 3.5 | 3.4 | 4.1 | 4.2 | 3.9 | 4.2 | ○ | ○ | ○ | Δ | This invention |

TABLE 6-continued

| | | Maximum gamma when the exposure time was $10^{-4}$ (Density 1.5 to 2.0) | | | Maximum gamma when the exposure time was 1/10 sec (Density 1.5 to 2.0) | | | Evaluation of image | | | | |
|---|---|---|---|---|---|---|---|---|---|---|---|---|
| Sample | Support | Yellow | Magenta | Cyan | Yellow | Magenta | Cyan | Image A | Image B | Image C | Image D | Remarks |
| C111 | C2 | 3.3 | 2.9 | 3.8 | 3.3 | 3.2 | 3.9 | ○ | Δ | ○ | ○ | This invention |
| C112 | D2 | 3.3 | 2.9 | 3.8 | 3.3 | 3.2 | 3.9 | ○ | Δ | ○ | ○ | This invention |

It is understood from Table 6 that image qualities were improved by allowing the gradation to be in the preferable range of the present invention. This, however, did not suffice the requirements. It is found that a natural image with less congruity could be obtained in combination with the support according to the present invention.

Example 3-2

The samples C101 to C112 were subjected to gradation exposure using the following exposure apparatus, to see the gradation when the exposure time was 1/10 sec.

Exposure apparatus: FWJ Model Sensitometer produced by Fuji Photo Film Co., Ltd.

As filters and an optical wedge, the same ones as in Example 3-1 were used.

Next, the following two types of image were formed by exposure using an AF4500 Model Enlarger produced by Fuji Photo Film Co., Ltd., with an exposure time range between ⅕ to 1/20 sec.

Image C: the image A in Example 3-1 (an internegative for exposure was produced from the image of the reversal film taken).

Image D: an image of ice-water placed in a glass (which was taken using a color negative film, Fuji Color SUPER 400 produced by Fuji Photo Film Co., Ltd.).

The exposed sample was subjected to processing in the same manner as in Example 3-1, and then subjected to sensorial evaluation performed in the same method. The results are shown in Table 6 together with the results in Example 3-1.

It is found from Table 6 that the image quality of the sample, in which the gradation was in the preferable range of the present invention, was evaluated as a preferable one. When this result was examined together with the results of Example 3-1, it is found that the samples according to the present invention were evaluated as a preferable one regardless of a difference in the exposure means.

Example 3-3

The samples C101 to C112 were subjected to the same tests as in Examples 3-1 and 3-2, except that the processing method was altered to the following method.

(Processing B2)

A processing B2 was the same as the processing B, except that the sample C101 was used to make the running solution and the color developing time was changed to 25 sec.

These samples were subjected to sensorial evaluation performed in the same method as in Examples 3-1 and 3-2. The same results were obtained.

Example 4-1

(Preparation of Emulsion BLA)

3.5 g of sodium chloride was added to an aqueous 3% solution of lime-processed gelatin, and further 1.0 ml of N,N'-dimethylimidazolidine-2-thion (aqueous 1% solution) was added to the mixture. To the resulted solution, an aqueous solution (Ag-1) containing 0.8 mol of silver nitrate, and an aqueous solution (X-1) containing 0.8 mol of sodium chloride, were added and mixed with vigorous stirring at 57° C. Then, an aqueous solution (Ag-2) containing 0.20 mol of silver nitrate, and an aqueous solution (X-2) containing 0.20 mol of sodium chloride were added and mixed with vigorous stirring at 57° C. At this time, $1\times10^{-5}$ mol of yellow prussiate of potash was added to the aqueous solution (X-2). In succession, the resulting mixture was subjected to sedimentation washing at 40° C. to perform desalting. 80.0 g of lime-processed gelatin was added, and then the emulsion was adjusted to pH 6.2 and pAg 7.0. Each of blue-sensitive spectral sensitizing dyes A1 and B1 was added to the emulsion in an amount of $1.6\times10^{-4}$ mol. Thereafter, an emulsion of silver chlorobromide fine particles (Br/Cl=6/4) having a cubic form with a side length of 0.05 μm was added in an amount of 0.4 g as the amount of silver. Potassium hexachloroiridate (IV) had been contained in advance in this emulsion of fine particles in an amount of $3\times10^{-5}$ mol per mol of silver. Then, sodium benzenethiosulfonate and a gold-sensitizer (chloroauric acid) were added to the emulsion to carryout chemical sensitization at 60° C. in a most preferable manner. In succession, 1-(5-methylureidophenyl)-5-mercaptotetrazole was added in an amount of $3.0\times10^{-4}$ mol per mol of silver. It was found from the electron microphotograph that the shape of the particle was cubic, the size of the particle was 0.72 μm, and the coefficient of variation was 0.08. The size of the particle was represented by an average of diameters of circles equivalent to the projected area of the particle, and as the distribution of particle size, a value obtained by dividing the standard deviation of particle size by an average particle size, was adopted.

(Sensitizing dye A1)

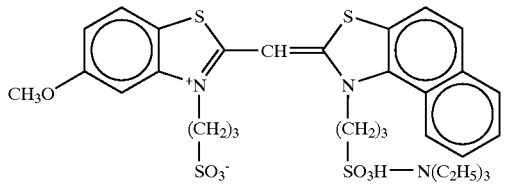

-continued (Sensitizing dye B1)

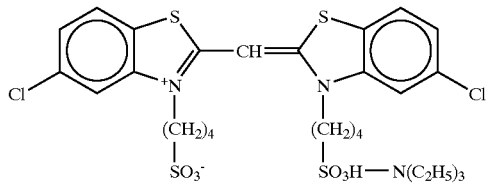

(Preparation of Emulsion BLB)

1.0 g of sodium chloride was added to an aqueous 2% solution of a lime-processed gelatin, and the mixture was adjusted to pH 4.5 by addition of an acid. To the aqueous solution, an aqueous solution (Ag-11) containing 0.05 mol of silver nitrate, and an aqueous solution (X-11) containing sodium chloride and potassium bromide in an amount of 0.05 mol in total, were added and mixed at 40° C. with vigorous stirring. In succession, an aqueous solution (X-12) containing 0.005 mol of potassium bromide was added, and then an aqueous solution (Ag-13) containing 0.13 mol of silver nitrate, and an aqueous solution (X-13) containing 0.13 mol of sodium chloride were added. The temperature of the reaction mixture was raised to 75° C., and an aqueous solution (Ag-14) containing 0.9 mol of silver nitrate, and an aqueous solution (X-14) containing 0.9 mol of sodium chloride were added and mixed while the pAg of the reaction mixture was kept at 7.0. After five minutes, an aqueous solution (Ag-15) containing 0.1 mol of silver nitrate, and an aqueous solution (X-15) containing 0.1 mol of sodium chloride were added and mixed. At the same time, an iodide ion was added in an amount equivalent to 0.4 mol % of total silver by using an aqueous K1 solution. After the mixture was allowed to stand for 40 minutes, it was subjected to sedimentation washing at 40° C. to carry out desalting. 100 g of a lime-processed gelatin was added to the desalted mixture, and the resulting mixture, was adjusted to pH 6.2 and pAg 7.0.

It was found from the electron microphotograph that the particle was a tabular particle having principal plane of {100} plane, and the particle had projected area-equivalent diameter of 0.82 $\mu$m, average thickness of 0.13 $\mu$m, average aspect ratio of 6, converted value equivalent to the side length of a cubic of 0.41 $\mu$m, and coefficient of variation of 0.20. (the content of iodine: 0.4 mol %). Blue-sensitive spectral sensitizing dyes A1 and B1 were added in an amount of $3.1\times10^{-4}$ mol/mol Ag, and in an amount of $4.6\times10^{-4}$ mol/mol Ag, respectively, so as to accord with the dye coating ratio of the emulsion (BLA).

Then, the emulsion was subjected to chemical sensitization optimally, by employing sodium benzenethiosulfonate and a gold-sensitizer (chloroauric acid), at 60° C. In succession, 1-(5-methylureidophenyl)-5-mercaptotetrazole was added in an amount of $7.2\times10^{-4}$ mol/mol Ag.

(Preparation of Emulsion BLC)

To 1.21 of water, 2.0 g of sodium chloride and 2.8 g of an inert gelatin were added, and the container was kept at 33° C. To the container, 60 ml of silver nitrate aqueous solution (silver nitrate 9 g) and 60 ml of sodium chloride solution (sodium chloride 3.2 g) were added with stirring over one minute according to a double jet method. 1 mmol of a crystal habit controlling agent 1 was added to the mixture, one minute after the completion of the addition. After one minute, 3.0 g of sodium chloride was further added. The temperature of the reaction container was elevated to 60° C. in the subsequent 25 minutes. After a ripening of 16 minutes at 60° C., 290 g of an aqueous solution of 10% phthalated gelatin solution, and 0.8 mmol of the crystal habit controlling agent 1 were added to the mixture. Thereafter, 754 ml (113 g) of a silver nitrate aqueous solution and 768 ml of a sodium chloride aqueous solution (sodium chloride: 41.3 g) were added to the resulting mixture at an accelerated flow rate over 28 minutes. During this 28 minutes, at the period of 21 to 28 minutes, 30 ml of a 0.25M sodium chloride aqueous solution containing 0.48 g of potassium iodide, 11 mg of yellow prussiate of potash, and $1\times10^{-8}$ mol of potassium hexachloroiridate (IV), was further added.

Crystal Habit Controlling Agent 1

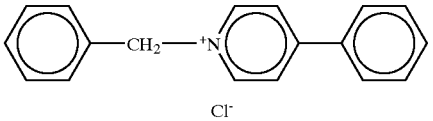

The resulted mixture was subjected to sedimentation washing at 40° C. to carry out desalting. 100 g of a lime-processed gelatin was added, and the resulting mixture was adjusted to pH 6.2 and pAg 7.0.

It was found from the electron microphotograph that the particle shape was a tabular particle having principal plane of a {111} plane, and the particle had, projected area-equivalent diameter of 0.82 $\mu$m, average thickness of 0.13 $\mu$m, average aspect ratio of 6, converted value equivalent to the side length of a cubic of 0.41 $\mu$m, and coefficient of variation of 0.25. Thus, a {111} tabular particle having almost the same size as the emulsion BLB was obtained. (the content of iodine: 0.4 mol %). This emulsion was subjected to spectral sensitization and to chemical sensitization in the same manner as in Emulsion BLB, to obtain an emulsion BLC.

Corona discharge treatment was performed on the surface of the aforementioned reflective support A. Then, a gelatin undercoat layer containing sodium dodecylbenzene sulfonate was provided on the support, and photographic structural layers of the first layer to the seventh layer were successively coated on the undercoat, to prepare Sample D110 of a silver halide color photographic light-sensitive material having the following layer structure. The coating solutions for each photographic structural layer were prepared as follows.

Preparation of First Layer Coating Solution 57 g of a yellow coupler (ExY-3), 7 g of a color-image stabilizer (Cpd-1), 4 g of a color-image stabilizer (Cpd-2), 7 g of a color-image stabilizer (Cpd-3), and 2 g of a color-image stabilizer (Cpd-8) were dissolved in 21 g of a solvent (Solv-1) and 80 ml of ethyl acetate. This solution was emulsified and dispersed in 220 g of a 23.5 wt % aqueous solution of gelatin, containing 4 g of sodium dodecylbenzene sulfonate, by using a high speed stirring emulsifier (a dissolver), and then water was added to the emulsion to prepare 900 g of an emulsified dispersion A1.

While, the above emulsified dispersion A1 and the emulsion BLA were mixed and dissolved, to prepare a first layer coating solution so as to have the following composition. The coating amount of the emulsion shows the amount converted to that of silver.

Each coating solution for the second layer to the seventh layer was prepared in the same manner as in the preparation of the first layer coating solution. As the gelatin hardener used in each layer, the hardeners H-1, H-2, and H-3 were used. Also, Ab-1 to Ab-4 were added to each layer in the same amount as in the sample A001A in Example 1-1.

The spectral sensitizing dye of the silver chlorobromide emulsion for the green-sensitive emulsion layer was the same that was used for the silver chlorobromide emulsion B in Example 1-1. The sensitizing dyes G and H were added to the silver chlorobromide emulsion C for the red-sensitive emulsion layer, in an amount of $8.0\times10^{-5}$ mol per mol of silver halide for a large-size emulsion, and $10.7\times10^{-5}$ mol per mol of silver halide for a small-size emulsion. Further, the compound I was added to the red-sensitive emulsion layer in an amount of $3.0\times10^{-3}$ mol per mol of silver halide.

Also, 1-(3-methylureidophenyl)-5-mercaptotetrazole was added to each of the green-sensitive emulsion layer, red-sensitive emulsion layer, second layer, fourth layer, sixth layer, and seventh layer in the same amount as in the sample A001A in Example 1-1.

In addition, 4-hydroxy-6-methyl-1,3,3a, 7-tetrazindene, a copolymer latex of methacrylic acid and butylacrylate (weight ratio: 1:1, average molecular weight: 200000 to 400000), and disodium catechol-3,5-disulfonate, were used in the same layer and in the same amount as in the sample A001A in Example 1-1.

Further, Dye-1, Dye-2, Dye-4 and Dye-5 were added in amounts of 2 mg/m$^2$, 2 mg/m$^2$, 3 mg/m$^2$, and 7 mg/m$^2$, respectively.

(Layer Constitution)

The composition of each layer is shown below. The numbers show coating amounts (g/m$^2$). In the case of the silver halide emulsion, the coating amount is in terms of silver.

Support

Polyethylene Resin Laminated Paper

[The polyethylene resin on the first layer side contained a white pigment ($TiO_2$; content of 16 wt %, ZnO; content of 4 wt %), a fluorescent whitening agent (4,4'-bis(5-methylbenzoxazolyl)stilbene; content of 0.03 wt %) and a bluish dye (ultramarine)]

| | |
|---|---|
| First Layer (Blue-Sensitive Emulsion Layer) | |
| Emulsion BLA | 0.24 |
| Gelatin | 1.25 |
| Yellow coupler (ExY-3) | 0.57 |
| Color-image stabilizer (Cpd-1) | 0.07 |
| Color-image stabilizer (Cpd-2) | 0.04 |
| Color-image stabilizer (Cpd-3) | 0.07 |
| Color-image stabilizer (Cpd-8) | 0.02 |
| Solvent (Solv-1) | 0.21 |
| Second Layer (Color-Mixing Inhibiting Layer) | |
| Gelatin | 0.99 |
| Color-mixing inhibitor (Cpd-5) | 0.09 |
| Color-image stabilizer (Cpd-6) | 0.018 |
| Color-image stabilizer (Cpd-7) | 0.13 |
| Color-image stabilizer (Cpd-13) | 0.01 |
| Solvent (Solv-1) | 0.06 |
| Solvent (Solv-2) | 0.22 |
| Third Layer (Green-Sensitive Emulsion Layer) | |
| Silver chlorobromide emulsion B | 0.14 |
| Gelatin | 1.36 |
| Magenta coupler (ExM-3) | 0.15 |
| Ultraviolet absorbing agent (UV-A) | 0.14 |
| Color-image stabilizer (Cpd-2) | 0.02 |
| Color-image stabilizer (Cpd-5) | 0.002 |

-continued

| | |
|---|---|
| Color-image stabilizer (Cpd-7) | 0.09 |
| Color-image stabilizer (Cpd-8) | 0.02 |
| Color-image stabilizer (Cpd-9) | 0.03 |
| Color-image stabilizer (Cpd-10) | 0.01 |
| Color-image stabilizer (Cpd-11) | 0.0001 |
| Solvent (Solv-3) | 0.11 |
| Solvent (Solv-4) | 0.22 |
| Solvent (Solv-5) | 0.20 |
| Fourth Layer (Color-Mixing Inhibiting Layer) | |
| Gelatin | 0.71 |
| Color-mixing inhibiting layer (Cpd-5) | 0.06 |
| Color-image stabilizer (Cpd-6) | 0.013 |
| Color-image stabilizer (Cpd-7) | 0.10 |
| Color-image stabilizer (Cpd-13) | 0.007 |
| Solvent (Solv-1) | 0.04 |
| Solvent (Solv-2) | 0.16 |
| Fifth Layer (Red-Sensitive Emulsion Layer) | |
| Silver chlorobromide emulsion C2 (cubes, a 5:5 mixture of a large-size emulsion C2 having an average grain size of 0.40 μm, and a small-size emulsion C2 having an average grain size of 0.30 μm (in terms of mol of silver). The deviation coefficients of the grain size distributions were 0.09 and 0.11, respectively. Each emulsion had 0.8 mol % of silver bromide contained locally in part of the grain surface whose substrate was made up of silver chloride) | 0.12 |
| Gelatin | 1.11 |
| Cyan coupler (ExC-3) | 0.13 |
| Cyan coupler (ExC-5) | 0.03 |
| Color-image stabilizer (Cpd-1) | 0.05 |
| Color-image stabilizer (Cpd-7) | 0.06 |
| Color-image stabilizer (Cpd-9) | 0.04 |
| Color-image stabilizer (Cpd-10) | 0.01 |
| Color-image stabilizer (Cpd-13) | 0.02 |
| Color-image stabilizer (Cpd-16) | 0.01 |
| Color-image stabilizer (Cpd-18) | 0.03 |
| Color-image stabilizer (Cpd-19) | 0.09 |
| Color-image stabilizer (Cpd-20) | 0.07 |
| Color-image stabilizer (Cpd-23) | 0.12 |
| Solvent (Solv-5) | 0.15 |
| Solvent (Solv-8) | 0.05 |
| Sixth Layer (Ultraviolet Absorbing Layer) | |
| Gelatin | 0.46 |
| Ultraviolet absorbing agent (UV-B) | 0.45 |
| Compound (S1-4) | 0.0015 |
| Solvent (Solv-7) | 0.25 |
| Seventh layer (protective layer) | |
| The surfactant of the seventh layer in the sample A001A in Example 1-1 was altered to the following compound. | |
| Surfactant (Cpd-22) | 0.01 |

In the same manner, coated samples D120 and D130 were prepared, wherein the emulsion BLA of the sample D110 was altered to the emulsions BLB and BLC, respectively.

The reflective support of the sample D110 was altered to the reflective supports B, B2, C, C2, D, and D2 to prepare coating samples D111 to D116, respectively. The reflective support of the sample D120 was altered to the reflective supports B, B2, C, C2, D, and D2 to prepare coating samples D121 to D126, respectively. The reflective support of the sample D130 was altered to the reflective supports B, B2, C, C2, D, and D2 to prepare coating samples D131 to D136, respectively. The details are shown in Table 7.

TABLE 7

| Sample | Emulsion | Support |
|---|---|---|
| D110 | BLA | A |
| D120 | BLB | A |

TABLE 7-continued

| Sample | Emulsion | Support |
|---|---|---|
| D130 | BLC | A |
| D111 | BLA | B |
| D112 | BLA | B2 |
| D113 | BLA | C |
| D114 | BLA | C2 |
| D115 | BLA | D |
| D116 | BLA | D2 |
| D121 | BLB | B |
| D122 | BLB | B2 |
| D123 | BLB | C |
| D124 | BLB | C2 |
| D125 | BLB | D |
| D126 | BLB | D2 |
| D131 | BLC | B |
| D132 | BLC | B2 |
| D133 | BLC | C |
| D134 | BLC | C2 |
| D135 | BLC | D |
| D136 | BLC | D2 |

The following experiment was conducted to investigate the pressure characteristics of these coating samples.

Experiment

The sample was bent around a 2-mm-diameter round bar made of stainless steel, over one sec, so as to form an angle of 40°. Each coated sample was subjected to gradation exposure for sensitometry by using a sensitometer (FWH Model, produced by Fuji Photo Film Co., Ltd.). In this exposure, an SC-40 filter was fitted to carry out exposure at low illumination intensity (5 lux) for 10 sec. In succession to the exposure, a color-development processing A3 as shown below was carried out. A micro-densitometer was used to read the density of the bent section of the treated sample, which bent section was exposed to light of the exposure amount that obtain a density of 2.0 at the unbent section, thereby measuring a density reduction AD caused by bending. When ΔD is a negative value, this shows pressure-induced desensitization is occurred. The larger the absolute value of the ΔD, the greater the pressure-induced desensitization is caused.

[Processing A3]

A processing A3 was the same as the processing A, except that the aforementioned light sensitive material D120 was used to make the running solution.

The results of the above are shown in Table 8.

TABLE 8

| Sample | Emulsion | Support | Pressure-induced desensitization (ΔD) |
|---|---|---|---|
| D110 | BLA | A | −1.80 |
| D120 | BLB | A | −1.10 |
| D130 | BLC | A | −1.00 |
| D111 | BLA | B | −0.70 |
| D112 | BLA | B2 | −0.60 |
| D113 | BLA | C | −0.80 |
| D114 | BLA | C2 | −0.70 |
| D115 | BLA | D | −0.70 |
| D116 | BLA | D2 | −0.60 |
| D121 | BLB | B | −0.20 |
| D122 | BLB | B2 | −0.10 |
| D123 | BLB | C | −0.20 |
| D124 | BLB | C2 | −0.15 |
| D125 | BLB | D | −0.20 |
| D126 | BLB | D2 | −0.15 |
| D131 | BLC | B | −0.10 |
| D132 | BLC | B2 | −0.10 |

TABLE 8-continued

| Sample | Emulsion | Support | Pressure-induced desensitization (ΔD) |
|---|---|---|---|
| D133 | BLC | C | −0.20 |
| D134 | BLC | C2 | −0.10 |
| D135 | BLC | D | −0.20 |
| D136 | BLC | D2 | −0.10 |

As is apparent from Table 8, the samples comprising the support for use in the present invention and the tabular particles preferably used in the present invention were low in a pressure-induced desensitization, showing that the pressure characteristics were remarkably improved. It is also confirmed that the samples comprising the tabular particles preferably used in the present invention were all superior in surface smoothness and glossiness.

Example 4-2

Although the particulars to be investigated were quite the same as those in Example 4-1, the layer structure of the coated sample was changed as follows to make the coated sample reduced in thickness, and the quite same experiment was conducted.

As a typical example, the sample D210 is shown, and the content of each sample is shown in Table 9.

Preparation of Sample D210

| | |
|---|---|
| Second layer (color-mixing inhibiting layer) | |
| Gelatin | 0.60 |
| Color-mixing inhibitor (Cpd-4) | 0.09 |
| Color-image stabilizer (Cpd-6) | 0.007 |
| Color-image stabilizer (Cpd-13) | 0.007 |
| Ultraviolet absorber (UV-C) | 0.05 |
| Solvent (Solv-5) | 0.11 |
| Third layer (green-sensitive emulsion layer) | |
| Silver chlorobromide emulsion B (the same emulsion as in the sample D110) | 0.14 |
| Gelatin | 0.73 |
| Magenta coupler (ExM-3) | 0.15 |
| Ultraviolet absorber (UV-A) | 0.05 |
| Color-image stabilizer (Cpd-2) | 0.02 |
| Color-image stabilizer (Cpd-8) | 0.07 |
| Color-image stabilizer (Cpd-9) | 0.03 |
| Color-image stabilizer (Cpd-10) | 0.009 |
| Color-image stabilizer (Cpd-11) | 0.0001 |
| Color-image stabilizer (Cpd-13) | 0.008 |
| Solvent (Solv-3) | 0.06 |
| Solvent (Solv-4) | 0.11 |
| Solvent (Solv-5) | 0.06 |
| Fourth layer (color-mixing inhibiting layer) | |
| Gelatin | 0.48 |
| Color-mixing inhibitor (Cpd-5) | 0.07 |
| Color-image stabilizer (Cpd-6) | 0.006 |
| Color-image stabilizer (Cpd-13) | 0.006 |
| Ultraviolet absorber (UV-C) | 0.04 |
| Solvent (Solv-5) | 0.09 |
| Fifth layer (red-sensitive emulsion layer) | |
| Silver chlorobromide emulsion C2 (the same emulsion as in the sample D110) | 0.12 |
| Gelatin | 0.59 |
| Cyan coupler (ExC-2) | 0.13 |
| Cyan coupler (ExC-3) | 0.03 |
| Color-image stabilizer (Cpd-7) | 0.01 |
| Color-image stabilizer (Cpd-9) | 0.04 |
| Color-image stabilizer (Cpd-15) | 0.19 |
| Color-image stabilizer (Cpd-18) | 0.04 |

-continued

| | |
|---|---|
| Ultraviolet absorber (UV-7) | 0.02 |
| Solvent (Solv-5) | 0.09 |
| Sixth layer (ultraviolet absorbing layer) | |
| Gelatin | 0.32 |
| Ultraviolet absorber (UV-C) | 0.42 |
| Solvent (Solv-7) | 0.08 |
| Seventh layer (protective layer) | |
| Gelatin | 0.70 |
| Acryl-modified copolymer of polyvinyl alcohol (the degree of modification: 17%) | 0.04 |
| Liquid paraffin | 0.01 |
| Surfactant (Cpd-22) | 0.01 |
| Polydimethylsiloxane | 0.01 |
| Silicon dioxide | 0.003 |

TABLE 9

| Sample | Emulsion | Support |
|---|---|---|
| D210 | BLA | A |
| D220 | BLB | A |
| D230 | BLC | A |
| D211 | BLA | B |
| D212 | BLA | B2 |
| D213 | BLA | C |
| D214 | BLA | C2 |
| D215 | BLA | D |
| D216 | BLA | D2 |
| D221 | BLB | B |
| D222 | BLB | B2 |
| D223 | BLB | C |
| D224 | BLB | C2 |
| D225 | BLB | D |
| D226 | BLB | D2 |
| D231 | BLC | B |
| D232 | BLC | B2 |
| D233 | BLC | C |
| D234 | BLC | C2 |
| D235 | BLC | D |
| D236 | BLC | D2 |

Each of the produced coated samples was bent around a 2-mm-diameter round bar made of stainless steel, so as to form an angle of 40° in the same manner as in Experiment 1 in Example 4-1. As to the subsequent development processing, ultra-rapid processing was carried out according to a development processing B3.

[Processing B3]

The processing B3 was structured in the same manner as in the processing B, except for the following points and except that the light-sensitive material D220 was used to make the running solution in the following processing steps.

The color-developing time was changed to 12 sec, and each rinsing time of the rinse (1) to the rinse (4) was changed to 4 sec, and except for these changes, the processing temperature, the replenisher amount, the composition of the each processing solutions, and the like were the same as those in the processing B.

The results are shown in Table 10.

TABLE 10

| Sample | Emulsion | Support | Pressure-induced desensitization (ΔD) |
|---|---|---|---|
| D210 | BLA | A | −2.10 |
| D220 | BLB | A | −1.40 |

TABLE 10-continued

| Sample | Emulsion | Support | Pressure-induced desensitization (ΔD) |
|---|---|---|---|
| D230 | BLC | A | −1.30 |
| D211 | BLA | B | −0.90 |
| D212 | BLA | B2 | −0.80 |
| D213 | BLA | C | −0.90 |
| D214 | BLA | C2 | −0.75 |
| D215 | BLA | D | −0.80 |
| D216 | BLA | D2 | −0.80 |
| D221 | BLB | B | −0.15 |
| D222 | BLB | B2 | −0.05 |
| D223 | BLB | C | −0.15 |
| D224 | BLB | C2 | −0.10 |
| D225 | BLB | D | −0.15 |
| D226 | BLB | D2 | −0.10 |
| D231 | BLC | B | −0.05 |
| D232 | BLC | B2 | −0.05 |
| D233 | BLC | C | −0.10 |
| D234 | BLC | C2 | −0.05 |
| D235 | BLC | D | −0.10 |
| D236 | BLC | D2 | −0.05 |

As is clear from Table 10, a significant pressure-induced desensitization was observed in the ultra-rapid processing of the thinned-layer samples, whereas the samples comprising the support for use in the present invention and tabular particles preferably used in the present invention were low in pressure-induced desensitization, that is, these samples were greatly improved in the pressure characteristics, and effect was also confirmed when ultra-rapid processing of the thinned layer sample was carried out. It is also found that the samples containing preferable tabular particles for use in the present invention were all superior in surface smoothness and glossiness.

Example 4-3

Using the samples D110 to D116, D120 to D126, D130 to D136, D210 to D216, D220 to D226, and D230 to D236, images were formed by laser-scanning exposure.

As the laser light source, a light source of 473 nm taken out from a YAG solid laser (oscillation wavelength: 946 nm), which used a semiconductor laser GaAlAs (oscillation wavelength: 808.5 nm) as an exciting light source, by wavelength conversion using an SHG crystal of $LiNbO_3$ with a reversal domain structure; a light source of 532 nm taken out from a $YVO_4$ solid laser (oscillation wavelength: 1064 nm), which used a semiconductor laser GaAlAs (oscillation wavelength: 808.7 nm) as an exciting light source, by wavelength conversion using an SHG crystal of $LiNbO_3$ with a reversal domain structure; and AlGaInP (oscillation wavelength: about 680 nm, Type No. $LN9R^{20}$, produced by Matsushita Electric Industrial Co., Ltd.) were used. Each laser light of three colors was arranged so that it moved in the direction perpendicular to the scanning direction by a polygon mirror, to perform scanning exposure sequentially on the sample. A variation in the quantity of light, which could be caused due to the temperature of the semiconductor laser, was restrained by making use of Peltier elements to keep the temperature constant. The effective beam diameter was 80 μm, the scanning pitch was 42.3 μm (600 dpi), and the average exposure time per one pixel was $1.7\times10^{-7}$ sec.

After the exposure, the samples D110 to D116, D120 to D126, and D130 to D136 were subjected to the color-development processing A3, and the samples D210 to D216, D220 to D226, and D230 to D236 were subjected to the color-development processing B3. The same evaluation as in Examples 4-1 and 4-2 were made, and it was found that a pressure-induced desensitization was rather small in the case of laser scanning exposure, and the light-sensitive material of the present invention had a larger effect as the illumination intensity of the exposure was higher.

Example 5-1

Corona discharge treatment was performed on the surface of the reflective support A, a gelatin undercoat layer containing sodium dodecylbenzene sulfonate was then provided on the support, and further a first layer to a seventh layer as photographic structural layers were coated successively, to manufacture a sample E111 of a silver halide color photographic light-sensitive material having the layer structure shown below. The coating solution for each photographic structural layer was prepared as follows.

Preparation of First Layer Coating Solution

The emulsified dispersion A1 prepared in Example 4-1 was used.

While, a silver chlorobromoiodide emulsion AH ({111} tabular particles, average particle size: 0.40 $\mu$m. The coefficient of variation in the distribution of particle size was 0.20. The aforementioned {111} plane crystal habit controlling agent 1 was used. The content of silver iodide was 0.4 mol %, and 0.5 mol % of silver bromide was locally contained in the vicinity of the vertex of a substrate particle) was prepared.

To this emulsion were added the aforementioned blue-sensitive sensitizing dyes A and C respectively in an amount of $2\times10^{-4}$ mol per mol of a silver halide, and the sensitizing dye B in an amount of $2\times10^{-4}$ mol per mol of a silver halide. Also, this emulsion was chemically ripened most appropriately by adding a sulfur sensitizer and a gold sensitizer.

The above emulsified dispersion A1 and silver chlorobromoiodide emulsion AH were mixed and dissolved, to prepare the first layer coating solution in a manner that the coating solution had the following composition.

Each coating solution for the second layer to the seventh layer was prepared in the same manner as in the preparation of the first layer coating solution.

A sample E111 was prepared in the same manner as in the preparation of the light-sensitive material D110 in Example 4-1; except that the silver chlorobromoiodide emulsion AH was used as the silver halide emulsion of the first layer, and H-1, H-2, and H-3 were used as the gelatin hardener of each layer.

Like the above, the reflective support A of the sample E111 was changed to the reflective support B, B2, C, C2, D, or D2, to produce the coated samples E112, E113, E114, E115, E116, or E117, respectively.

TABLE 11

| Sample | Support | Second layer Ratio of oil-soluble ingredient/ hydrophilic binder | Fourth layer Ratio of oil-soluble ingredient/ hydrophilic binder | Sixth layer Ratio of oil-soluble ingredient/ hydrophilic binder | Remarks |
|---|---|---|---|---|---|
| E111 | A | 0.53 | 0.54 | 1.53 | Comparative example |
| E112 | B | 0.53 | 0.54 | 1.53 | This invention |
| E113 | B2 | 0.53 | 0.54 | 1.53 | This invention |
| E114 | C | 0.53 | 0.54 | 1.53 | This invention |
| E115 | C2 | 0.53 | 0.54 | 1.53 | This invention |
| E116 | D | 0.53 | 0.54 | 1.53 | This invention |
| E117 | D2 | 0.53 | 0.54 | 1.53 | This invention |

The following experiment was made to examine abrasion resistance of these coated samples.

Experiment

The sample was secured to a flat plane. A Scotch-Brite nylon scrubbing brush (produced by Sumitomo 3M Ltd.) was loaded with a weight weighing 100 g per $cm^2$, and the brush was brought into contact with the sample to scratch the sample at a rate of 8 cm per sec. Then, each sample was subjected to gradation exposure for sensitometry by using a sensitometer (FWH Model, produced by Fuji Photo Film Co., Ltd.). In this treatment, Y-, M- and C-filter were fitted to carry out gray exposure at an illuminance of 3000 CMS for 10 sec. After the exposure, a color-development processing A4 (the same processing as the processing A, except that the above light-sensitive material E112 was used to make the running solution) was carried out.

The degree of fogs produced on a white background of the developed sample as a result of the scratching of the nylon scrubbing brush was evaluated to obtain the results as shown in Table 12.

TABLE 12

| Sample | Support | Resistance to abrasion | Remarks |
|---|---|---|---|
| E111 | A | Δ | Comparative example |
| E112 | B | ○ | This invention |
| E113 | B2 | ○ | This invention |
| E114 | C | ○ | This invention |
| E115 | C2 | ○ | This invention |
| E116 | D | ○ | This invention |
| E117 | D2 | ○ | This invention |

○: A level without problem
Δ: Fogs were slightly produced
X: Fogs were produced (especially developed color on the upper portion)
XX: Considerable fogs were produced, and developed color was observed from the upper layer to the lower layer As is apparent from Table 12, the samples having the support of the present invention and the ratio of oil-soluble ingredient/hydrophilic binder within the preferable range in the present invention, exhibited high abrasion resistance. It is also found that the samples according to the present invention were all remarkably excellent in surface smoothness and glossiness.

Example 5-2

Although matters to be investigated were quite the same as those in Example 5-1, the layer structure of the coated sample was changed as shown below, to make the thickness of the coated sample thin, and the quite same experiment was conducted.

As a typical example, the sample E211 is shown, and the content of each sample is shown in Table 13.

TABLE 13

| Sample | Support | Second layer Ratio of oil-soluble ingredient/ hydrophilic binder | Fourth layer Ratio of oil-soluble ingredient/ hydrophilic binder | Sixth layer Ratio of oil-soluble ingredient/ hydrophilic binder | Remarks |
|---|---|---|---|---|---|
| E211 | A | 0.44 | 0.44 | 1.56 | Comparative example |
| E212 | B | 0.44 | 0.44 | 1.56 | This invention |
| E213 | B2 | 0.44 | 0.44 | 1.56 | This invention |
| E214 | C | 0.44 | 0.44 | 1.56 | This invention |
| E215 | C2 | 0.44 | 0.44 | 1.56 | This invention |
| E216 | D | 0.44 | 0.44 | 1.56 | This invention |
| E217 | D2 | 0.44 | 0.44 | 1.56 | This invention |

Preparation of Sample E211

The second, fourth, sixth, and seventh layers were the same as the corresponding layers of the sample D110 in Example 4-1.

First layer (blue-sensitive emulsion layer: the same as that of the sample E111.

Third layer (green-sensitive emulsion layer)

The same as the third layer of the sample D110 in Example 4-1, except that the silver chlorobromide emulsion B (the same emulsion as that of the sample E111) was used in the same amount.

Fifth layer (red-sensitive emulsion layer) The same as the fifth layer of the sample D110 in Example 4-1, except that the silver chlorobromide emulsion C2 (the same emulsion as that of the sample E111) was used in the same amount.

Each produced coated sample was scratched and exposed in the same manner as in the experiment in Example 5-1. As to the subsequent development processing, ultra-rapid processing was carried out according to the following development processing B4.

As a consequence, the ratios of oil-soluble ingredient/hydrophilic binder of the sixth layer all fell in the preferable range of the present invention, despite the fact that the film thickness of the sample was thinned. Like the results in Example 5-1, the samples E212 to E217 according to the present invention could keep a level at which no problem concerning the abrasion resistance arose. This was also confirmed when thinned sample was subjected to ultra-rapid processing. However, the sample E211 produced fogs in evaluation of the abrasion resistance.

[Processing B4]

The processing B4 was structured in the same manner as in the processing B, except for the following points and except that the light-sensitive material E212 was used to make the running solution in the following processing steps.

Both the color-developing time and the bleach-fixing time were changed to 12 sec, and each rinsing time of the rinse (1) to the rinse (4) was changed to 4 sec, and except for these changes, the processing temperature, the replenisher amount, each composition of the processing solutions, and the like, were the same as those in the processing B.

Example 5-3

In the sample E212, the average particle size of the emulsion AH in the first layer was changed to 0.50 $\mu$m, each average particle size of two types of particle of the emulsion B in the third layer was changed to 0.40 $\mu$m, and each average particle size of two types of particle of the emulsion C2 in the fifth layer was changed to 0.34 $\mu$m, to thereby decrease the size of the particle of the emulsion layer located in the upper layer (apart from the support). The modified sample was subjected to the same evaluation as in Example 5-2 to find that the resistance to abrasion was improved.

Example 5-4

Using each of the samples E111 to E117 and E211 to E217, an image was formed by laser scanning exposure.

The laser scanning exposure was conducted in the same manner as in Example 4-3.

After the exposure, the samples E111 to E117 were subjected to the color development processing A4, and the samples E211 to E217 were subjected to the color development processing B4. The same evaluations as in Examples 5-1 and 5-2 were made to find that that fogs arose rather gently in the case of laser scanning exposure, and the light-sensitive material of the present invention had a larger effect as the illumination intensity of the exposure became higher.

Example 6-1

A light-sensitive material was prepared in the same manner as sample A201A in Example 1-1, except that 0.01 g/m$^2$ of a color-image stabilizer (Cpd-21) was further added to the fifth layer of the sample A201A.

The sample obtained in this manner on the reflective support A was designated as a sample F101. Next, the composition of the seventh layer and the support were changed as shown in Table 6 to prepare samples F102 to F111.

These samples were subjected to the following evaluation tests a, b, c and d.

Evaluation Test a (Increase in Dmin after High Temperature Storage)

Each samples was stored with 20 sheets of which being overlapped on each other, in the following two conditions: 25° C.-55% RH, 10 days and 40° C.-55% RH, 10 days. 10 th sheet sample was processed in the processing step A5 described later. After the processing, the Dmin of the unexposed area was measured (using HPD-18 Model Densitometer, produced by Fuji Photo Film Co., Ltd.). A stain increase (ΔDmin) was calculated by subtracting the Dmin measured after being stored at 25° C.-55% RH for 10 days from the Dmin measured after being stored at 40° C.-55% RH for 10 days.

Evaluation Test b (a Variation in Sensitivity after High Temperature Storage):

Each sample, after it was stored in the same condition as in the above evaluation test a, was exposed to light at 200 CMS for 0.1 sec by using a sensitometer (FWH Model, produced by Fuji Photo Film Co. Ltd.; color temperature of a light source, 3200° K.) through a three color separation wedge, and then the sample was processed in a processing step A5 explained later. An exposure amount required to provide a color density of 0.5 was measured to calculate a logarithm (log E) of the exposure amount (an HPD-18 Model Densitometer, produced by Fuji Photo Film Co., Ltd., was used). A variation in sensitivity (Δlog E) was calculated by subtracting the value of log E calculated after the sample was stored at 25° C.-55% RH for 10 days from the value of log E calculated after the sample was stored at 40° C.-55% RH for 10 days.

Evaluation Test c (Curling at High Humidity):

The sample which had been treated was cut down to a size of 10 cm×10 cm, and allowed to stand under a constant temperature and humidity condition of 30° C.-80% RH for 24 hours. The degree of curling was determined by calculating the reciprocal of the curvature radius under constant temperature and humidity of 30° C.-80% RH. The larger the (+) numeral is, the stronger and the more unacceptable the (+) curling is (i.e. locating the sample with its image face upward, the sample was warped upward).

Curling=1/Radius of curvature (m)

Evaluation Test d (Scratch Resistance Test of the Processed Sample):

The sample was exposed to white light, and the treated sample with a black background was cut down to a wedge size, and measured by the following method. The sample was placed in a continuous loading type scratch strength tester (Heidon) 18 Model (produced by Shinto Scientific Co., Ltd.) according to a predetermined method. A continuous load of 0 to 100 g was applied to measure a load (g), that was applied when a scratch started to appear on the sample surface, by a predetermined method, thereby evaluating the raw sample for the scratch resistance. The greater the value, the higher the scratch resistance is. As a needle, a 0.1 mm diamond needle was used.

Processing step A5

Using a paper processor, continuous processing was carried out in the following processing steps using processing solutions having the following compositions, thereby a processing condition at a running equilibrium condition was produced.

| Processing step | Temperature | Time | Replenisher* | Tank volume |
|---|---|---|---|---|
| Color developing | 35° C. | 45 sec | 100 ml | 5 l |
| Bleach-fixing | 30–35° C. | 45 sec | 215 ml | 5 l |
| Rinsing | 30° C. | 90 sec | 350 ml | 5 l |
| Drying | 70–80° C. | 60 sec | | |

*Replenisher amount per 1 $m^2$ of the light-sensitive material.

The composition of each process solution was as follows.

| Color developer | Tank solution | Replenisher |
|---|---|---|
| Water | 800 ml | 800 ml |
| Ethylenediamine-N,N,N',N'-tetramethylenephosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-ethyl-N-(β-methane sulfonamideethyl)-3-methyl-4-aminoaniline sulfate | 5.0 g | 7.0 g |
| N,N-bis(carboxymethyl) hydrazine | 4.0 g | 5.0 g |
| N,N-di(sulfoethyl)hydroxyl amine.1Na | 4.0 g | 5.0 g |
| Fluorescent whitening agent (WHITEX 4B, produced by Sumitomo Chemical CO., Ltd.) | 1.0 g | 2.0 g |
| Water to make | 1000 ml | 1000 ml |
| pH (25° C.) | 10.05 | 10.45 |

| Bleach-fixing solution (a tank solution is the same as a replenishing solution) | |
|---|---|
| Water | 400 ml |
| Ammonium thiosulfate (700 g/l) | 100 ml |
| Sodium sulfite | 17 g |
| Ethylenediamine tetraacetate Iron (III) ammonium | 55 g |
| Disodium ethylenediamine tetraacetic acid | 5 g |
| Ammonium bromide | 40 g |
| Water to make | 1000 ml |
| pH (25° C.) | 6.0 |

Rinsing solution (a tank solution is the same as a replenishing solution)

Deionized water (each amount of calcium and magnesium is 3 ppm or less).

The obtained results are collectively shown in Table

TABLE 14

| Sample No. | Support | Matting agent Composition | Average particle diameter (μm) | Micropore diameter (Å) | Surface area (mg/m²) | Coating amount (mg/m²) | Evaluation method a ΔDmin (BL) | Evaluation method b ΔlogE (BL) | Evaluation method c Curling at high humidity | Evaluation method d Scratch resistance |
|---|---|---|---|---|---|---|---|---|---|---|
| F101 | A | — | — | — | — | — | 0.020 | 0.050 | 3.5 | 52 |
| F102 | A | Polymemethyl methacrylate | 3.5 | no micropore | — | 100 | 0.025 | 0.040 | 3.0 | 45 |
| F103 | A | Polymemethyl methacrylate | 3.5 | no micropore | — | 450 | 0.027 | 0.022 | 2.7 | 35 |
| F104 | A | Silicon dioxide | 3.5 | 50 | 550 | 100 | 0.024 | 0.025 | 3.1 | 45 |
| F105 | A | Silicon dioxide | 5 | 210 | 300 | 50 | 0.025 | 0.022 | 2.8 | 40 |
| F106 | B | Polymemethyl methacrylate | 3.5 | no micropore | — | 100 | 0.002 | 0.015 | 1.8 | 78 |
| F107 | B | Polymemethyl methacrylate | 3.5 | no micropore | — | 450 | 0.002 | 0.018 | 1.9 | 69 |
| F108 | B | Silicon dioxide | 3.5 | 50 | 550 | 100 | 0.003 | 0.015 | 1.8 | 75 |
| F109 | C | Polymemethyl methacrylate | 3.5 | no micropore | — | 50 | 0.004 | 0.017 | 1.8 | 70 |
| F110 | D | Polymemethyl methacrylate | 3.5 | no micropore | — | 50 | 0.004 | 0.017 | 1.8 | 78 |
| F111 | C | Silicon dioxide | 5 | 210 | 300 | 50 | 0.003 | 0.019 | 1.8 | 75 |

From the results shown in Table 14, it is understood that the combination of the support and a matt agent according to the present invention improved the each characteristics.

Example 6-2

In the sample F101, the composition of the seventh layer was changed as shown in Table 15 to make samples F201 to F205. These samples were evaluated in the test c in Example 6-1 and in a test e shown below.

Evaluation Test e (Curling at Low Moistures)

The sample was evaluated in the same test as the evaluation test c, except that the constant temperature and moisture conditions in which the sample was allowed to stand and measured were altered from 30° C.-80% RH to 20° C.20% RH.

From the results shown in Table 15, it is understood that the combination of the support, a matt agent, and a latex, according to the present invention enabled to further improve each characteristics.

Example 6-3

The samples F101, F106, F109 to F111 were coated with the following compositions (1) and (2) by bar-coating hand application, prior to process in the processing step A5. Then, the samples were allowed to stand under a constant temperature and humidity condition of 40° C.80% RH for 24 hours, and then subjected to the processing step A5, followed by surface treatment under heat and pressure (110° C., 65 psi) to prepare samples F301 to F305. These samples were evaluated in the test d in Example 6-1.

TABLE 15

| Sample No. | Support | Matting agent Composition | Average particle diameter (μm) | Micropore diameter (Å) | Surface area (mg/m²) | Coating amount (mg/m²) | Latex Composition | Latex Coating amount (mg/m²) | Evaluation method c Curling at high humidity | Evaluation method e Curling at low humidity |
|---|---|---|---|---|---|---|---|---|---|---|
| F101 | A | — | — | — | — | — | — | — | 3.5 | 4.5 |
| F201 | A | — | — | — | — | — | LA-1 | 50 | 3.8 | 4.0 |
| F202 | B | Polymemethyl methacrylate | 3.5 | no micropore | — | 100 | — | — | 1.8 | 3.4 |
| F203 | B | Polymemethyl methacrylate | 3.5 | no micropore | — | 100 | LA-2 | 50 | 2.0 | 2.6 |
| F204 | B | Silicon dioxide | 3.5 | 50 | 550 | 100 | LA-1 | 60 | 1.8 | 2.6 |
| F205 | C | Polymemethyl methacrylate | 3.5 | no micropore | — | 50 | LA-6 | 50 | 1.8 | 2.5 |

| Composition (1) | |
|---|---|
| High density polyethylene having average particle diameter of 0.05 μm, melting point of 131 ° C.* (produced by ChemCor) | 1.2 g/m$^2$ |
| Gelatin | 0.4 g/m$^2$ |
| Composition (2) | |
| Polyester having average particle diameter of 12 μm | 6 g/m$^2$ |
| Gelatin | 4 g/m$^2$ |
| Latex binder (butylacrylate) | 0.6 g/m$^2$ |
| Sodium dodecylbenzene sulfonate | 0.1 g/m$^2$ |

*Value measured by differential scanning calorimetric measurement (DSC).

| | Taber rigidity (g · cm) | |
|---|---|---|
| Support | Vertical | Horizontal |
| A' | 16 | 9 |
| B' | 27 | 18 |
| C' | 25 | 17 |
| D' | 24 | 13 |
| B2' | 31 | 23 |
| C2' | 29 | 20 |
| D2' | 27 | 19 |

On the support A' manufactured in this manner, a first layer to a seventh layer as photographic structural layers were coated successively, in the same manner as in the sample A001A in Example 1-1, to prepare a sample G101 of a silver halide photographic light-sensitive material.

TABLE 16

| | | Matting agent | | | | | | | |
|---|---|---|---|---|---|---|---|---|---|
| Sample No. | Support | Composition | Average particle diameter (μm) | Micropore diameter (Å) | Surface area (mg/m$^2$) | Coating amount (mg/m$^2$) | Composition ① Heat and pressure treatment | Composition ② Heat and pressure treatment | Evaluation method d Damage resistance |
| F101 | A | — | — | — | — | — | — | — | 52 |
| F106 | B | Polymemethyl methacrylate | 3.5 | no micropore | — | 100 | — | — | 78 |
| F109 | C | Polymemethyl methacrylate | 3.5 | no micropore | — | 50 | — | — | 70 |
| F110 | D | Polymemethyl methacrylate | 3.5 | no micropore | — | 50 | — | — | 78 |
| F111 | C | Silicon dioxide | 5 | 210 | 300 | 50 | — | — | 75 |
| F301 | B | Polymemethyl methacrylate | 3.5 | no micropore | — | 100 | ○ | — | 84 |
| F302 | B | Polymemethyl methacrylate | 3.5 | no micropore | — | 100 | — | ○ | 82 |
| F303 | C | Polymemethyl methacrylate | 3.5 | no micropore | — | 50 | ○ | — | 88 |
| F304 | D | Polymemethyl methacrylate | 3.5 | no micropore | — | 50 | ○ | — | 85 |
| F305 | C | Silicon dioxide | 5 | 210 | 300 | 50 | ○ | — | 86 |

From the results shown in Table 16, it is found that further scratch resistance was imparted by the support, matt agent, and coating of a surface protective layer, according to the present invention.

Example 6-4

In Example 6-1, the exposure time was changed to $10^{-4}$ sec, and the resulting sample was evaluated like the above to obtain almost the same results.

Example 7-1

The taber rigidity in two directions of each of the following reflective supports, which were shown previously, was shown below.

A print was made, on the sample obtained in this manner, with a picture size of 127 mm×89 mm, by using a Mini-Lab Rocky S, manufactured by Fuji Photo Film Co., Ltd. The edge shape at portions corresponding to the four corners of the print, in a cutter of an stacking section of the device, was made into an arc form having a radius of 3 mm and a central angle of 90°, thereby making the corner of the print round (sample G102). For comparison, a print provided with no round corner was prepared (sample G101). Further, samples G103 to G114 were prepared in the same manner as in the preparation of the samples G101 and G102, except that the support and the shape of the corners were changed to those shown in Table 17. (One having the same round shape as the sample G102 was expressed as "Round", and one having no round shape was expressed as "Right angle", in Table 17).

For the evaluation of the strength, a part 10 mm in length from the end of each treated sample was wound around a 10-mm-diameter cylinder, so as to form an angle of 90° and fixed for 15 sec. Thereafter, the print was released from the cylinder, and curling (the height of the vertex of the corner from a flat plane, when the print was placed on the flat plane) was measured.

In addition, for the evaluation of the stacking property, printings of 1500 copies were made using each sample, and then these copies were piled up in 100 copies increment, to evaluate the number of copies that could be piled up.

As shown in Table 17, the use of the comparative support A attained a large degree of curling and was hence undesirable.

On the contrary, when each of the supports B' to D2' was used, the degree of curling was small.

Particularly, with the sample that employed one of the supports B' to D2' and provided with round corners, a photographic print, which had high strength (resistance to bending) and good stacking property was obtained resultantly.

TABLE 17

| Sample | Support | Shape of corner | Curling | Number of copies can be stacked |
|---|---|---|---|---|
| G101 | A | Right angle | 5 mm | 400 copies |
| G102 | A | Round | 4 mm | 400 copies |
| G103 | B | Right angle | 2 mm | 300 copies |
| G104 | B | Round | 1 mm | 400 copies |
| G105 | C | Right angle | 3 mm | 300 copies |
| G106 | C | Round | 2 mm | 400 copies |
| G107 | D | Right angle | 2 mm | 300 copies |
| G108 | D | Round | 1 mm | 400 copies |
| G109 | B2 | Right angle | 1 mm | 300 copies |
| G110 | B2 | Round | 0 mm | 400 copies |
| G111 | C2 | Right angle | 2 mm | 300 copies |
| G112 | C2 | Round | 1 mm | 400 copies |
| G113 | D2 | Right angle | 1 mm | 300 copies |
| G114 | D2 | Round | 0 mm | 400 copies |

Example 7-2

The mini-lab used in Example 7-1 was altered to Frontier 350 produced by Fuji Photo Film Co., Ltd. to make the same evaluation as in Example 7-1. As a consequence, each sample of the present invention had high strength and good stacking property.

Example 7-3

The composition of the fifth layer in each of the samples G101 to G114 used in Example 7-1 was replaced by that of the sample A201A used in Example 1-1, to make samples, and they were evaluated in the same manner. As a result, like in Example 7-1, each sample of the present invention had high strength and good stacking property.

Example 8

Among the high-boiling organic solvent used in Examples 1-1 to 7-3, Solv-2 was replaced with tributyl citrate, and Solv-6 was replaced with pentaglycerin tribenzoate, in an equal weight, to prepare corresponding samples. These samples were evaluated with the same evaluation tests conducted in the respective examples, and these samples obtained similar results as to those of the corresponding examples.

Having described our invention as related to the present embodiments, it is our intention that the invention not be limited by any of the details of the description, unless otherwise specified, but rather be construed broadly within its spirit and scope as set out in the accompanying claims.

What we claim is:

1. A silver halide color photographic light-sensitive material having at least three silver halide emulsion layers different in color sensitivity from each other, wherein the total amount of oil-soluble ingredients is 4.0 g/m$^2$ or less, on a reflective support, wherein said reflective support is one selected from the group consisting of the following (a), (b), and (c):

(a) the reflective support is a water-resistant resin-coated support, and at least one layer of the water-resistant resin layers between the support and the silver halide emulsion layers is a biaxially oriented polyolefin layer having micropores, (b) the reflective support is a water-resistant resin-coated support, and at least one layer of water-resistant resin layers between the support and the silver halide emulsion layers is a biaxially oriented polyolefin layer having micropores, and between the biaxially oriented polyolefin layer and the silver halide emulsion layers, a polyolefin layer having no micropore is provided, (c) the reflective support is one prepared by coating onto at least the side of the emulsion-coated surface of the support with a composition having a white pigment mixed and dispersed in a resin containing at least 50 wt % of a polyester synthesized by polycondensation of a dicarboxylic acid with a diol, and wherein the silver halide emulsions in the silver halide emulsion layers each comprise silver halide emulsion grains with a silver chloride content of 95 mol % or more.

2. A silver halide color photographic light-sensitive material according to claim 1, wherein said reflective support is one selected from the group consisting of (a) and (b):

wherein at least one layer of the silver halide emulsion layers contains a cyan dye-forming coupler represented by formula (IV):

formula (IV)

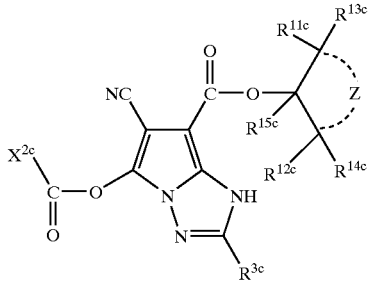

wherein, in formula (IV), $R^{3c}$ and $X^{2c}$ each independently represent a hydrogen atom or a substituent; Z represents a group of non-metallic atoms necessary for forming a 5- to 8-membered ring; $R^{11c}$, $R^{12c}$, $R^{13c}$, $R^{14c}$, and $R^{15c}$ each independently represent a hydrogen atom or a substituent.

3. A method of forming a color image, which comprises subjecting a silver halide color photographic light-sensitive material to scanning exposure with a light beam modulated on the basis of image information, and subjecting the silver halide color photographic light-sensitive material to development processing, wherein said silver halide color photographic light-sensitive material is the silver halide color photographic light-sensitive material according to claim 1.

4. A method of forming a color image, which comprises subjecting a silver halide color photographic light sensitive material according to claim 1 to light exposure and processing the silver halide color photographic light-sensitive material with a color-development processing time of 20 seconds or less.

5. The silver halide color photographic light-sensitive material according to claim 1, wherein the reflective support is a water-resistant resin-coated support, and at least one layer of water-resistant resin layers between the support and the silver halide emulsion layers is a biaxially oriented polyolefin layer having micropores, and between the biaxially oriented polyolefin layer and the silver halide emulsion layers, a polyolefin layer having no micropore is provided, wherein the biaxially oriented polyolefin layer having micropores is a sandwich-structured unit comprising (1) a core layer of polypropylene containing no titanium oxide and having micropores and (2) a polypropylene surface coating layer containing titanium oxide and containing no micropores on both sides of the core layer, and wherein the polyolefin layer having no micropore comprises polyethylene, wherein the thickness of the polyolefin layer having no micropore is 0.1 to 5 $\mu$m.

6. The silver halide color photographic light-sensitive material according to claim 1, wherein the reflective support is a water-resistant resin-coated support and at least one layer of the water resistant layers between the support and the silver halide emulsion layers is a biaxially oriented polyolefin layer having micropores, and the micropores have a size of 0.1 to 10 $\mu$m.

7. The silver halide color photographic light-sensitive material according to claim 1, wherein the silver halide color photographic light-sensitive material further comprises a protective layer formed by coating, onto the silver halide light-sensitive emulsion layers, with at least one layer of a coating comprising 30 to 95 wt % of hydrophobic polymer grains having an average particle size of 0.01 to 1 $\mu$m and a melting point of 55 to 200° C. and 5 to 70 wt % of gelatin, followed by fusion of the polymer grains.

8. The silver halide color photographic light-sensitive material according to claim 1, wherein said silver halide color photographic light-sensitive material further comprises a protective layer formed by coating, onto the silver halide light-sensitive emulsion layers, with at least one layer of an aqueous coating comprising 5 to 50 wt % of polymer grains having an average particle size of 0.01 to 50 $\mu$m and 1 to 3 wt % of a polymer latex binder, followed by fusion of the polymer grains.

9. A silver halide color photographic light-sensitive material having at least three silver halide emulsion layers different in color sensitivity from each other on a reflective support, wherein said reflective support is a water-resistant resin-coated support, and at least one layer of the water-resistant resin-coated layers between the support and the silver halide emulsion layers is a biaxially oriented polyolefin layer having micropores, wherein the silver halide emulsions in the silver halide emulsion layers each comprise silver halide emulsion grains with a silver chloride content of 95 mol % or more, and wherein when the light-sensitive material is subjected to gradation exposure for an exposure time of $10^{-4}$ second and then to a development processing under the following conditions:

| Processing step | Temperature | Time | Replenishment rate/m$^2$ of the light-sensitive material |
|---|---|---|---|
| Color developing | 38.5° C. | 45 sec | 45 ml |
| Bleach-fixing | 38.0° C. | 45 sec | 35 ml |
| Rinse (1) | 38.0° C. | 20 sec | — |
| Rinse (2) | 38.0° C. | 20 sec | — |
| Rinse (3) | 38.0° C. | 20 sec | — |
| Rinse (4) | 38.0° C. | 30 sec | 121 ml |

wherein (a) a rinse cleaning system is installed in the rinse (3) and a rinse solution is taken out from the rinse (3) and sent to a reverse osmosis membrane module by using a pump; (b) permeated water obtained is supplied to the rinse (4), and concentrated water is returned to the rinse (3); (c) pump pressure is controlled such that water to be permeated in the reverse osmosis membrane module is maintained in an amount of 50 to 300 ml/min; and (d) the rinse solution was circulated under controlled temperature for 10 hours a day;

wherein the rinse was made in a tank counter-current system from (1) to (4); and wherein each processing solution has the following composition:

| Color developer | Tank solution | Replenisher |
|---|---|---|
| Water | 800 ml | 800 ml |
| Dimethylpolysiloxane-series Surfactant | 0.1 g | 0.1 g |
| Tri(isopropanol)amine | 8.8 g | 8.8 g |
| Ethylenediamine tetraacetic acid | 4.0 g | 4.0 g |
| Polyethylene glycol (molecular weight: 300) | 10.0 g | 10.0 g |
| Sodium 4,5-dihydroxybenzene-1,3-Disulfonate | 0.5 g | 0.5 g |
| Potassium chloride | 10.0 g | — |
| Potassium bromide | 0.040 g | 0.010 g |
| Triazinylaminostilbene-series Fluorescent whitening Agent | 2.5 g | 5.0 g |
| Sodium sulfite | 0.1 g | 0.1 g |
| Disodium-N,N-bis(sulfonatoethyl)-Hydroxylamine | 8.5 g | 11.1 g |
| N-ethyl-N-(β-Methanesulfonamido-ethyl)-3-Methyl-4-amino-4-aminoaniline·3/2 sulfuric acid·1 hydrate | 5.0 g | 15.7 g |
| Potassium carbonate | 26.3 g | 26.3 g |
| Water to make | 1000 ml | 1000 ml |
| pH (25° C./adjusted using potassium hydroxide and sulfuric acid) | 10.15 | 12.50 |

| | Tank solution | Replenisher |
|---|---|---|
| Bleach-fixing solution | | |
| Water | 700 ml | 600 ml |
| Ethylenediaminetetraacetic acid iron (III) ammonium | 47.0 g | 94.0 g |
| Ethylenediamine tetraacetic acid | 1.4 g | 2.8 g |
| m-Carboxybenzenefulfinic acid | 8.3 g | 16.5 g |
| Nitric acid (67%) | 16.5 g | 33.0 g |
| Imidazole | 14.6 g | 29.2 g |
| Ammonium thiosulfate (750 g/l) | 107.0 ml | 214.0 ml |
| Ammonium sulfite | 16.0 g | 32.0 g |
| Ammonium bisulfite | 23.1 g | 46.2 g |
| Water to make | 1000 ml | 1000 ml |
| pH (25° C./adjusted using acetic acid and ammonia) | 6.0 | 6.0 |

the maximum gamma in the region where the density after processing is 1.5 to 2.0 is 1.1 or more but less than 4.2 for yellow, magenta and cyan, and the differences of maximum gamma among yellow, magenta and cyan are within 1.0.

10. The silver halide color photographic light-sensitive material according to claim 9, wherein when the light-sensitive material is subjected to gradation exposure for an exposure time of 1/10 second and then to said development processing, the maximum gamma in the region where the density after processing is 1.5 to 2.0 is 1.1 or more but less than 4.0 for yellow, magenta and cyan, and the differences of maximum gamma among yellow, magenta and cyan are within 1.0.

11. The silver halide color photographic light-sensitive material according to claim 9, wherein the differences of maximum gamma among yellow, magenta and cyan are within 0.5.

12. A silver halide color photographic light-sensitive material having at least three silver halide emulsion layers different in color sensitivity from each other on a reflective support, wherein said reflective support is a water-resistant resin-coated support, and at least one layer of the water-resistant resin-coated layers between the support and the silver halide emulsion layers is a biaxially oriented polyolefin layer having micropores, and between the biaxially oriented polyolefin layer and the silver halide emulsion layers, a polyolefin layer having no micropore is provided, wherein the silver halide emulsions in the silver halide emulsion layers each comprise silver halide emulsion grains with a silver chloride content of 95 mol % or more, and wherein when the light-sensitive material is subjected to gradation exposure for an exposure time of $10^4$ second and then to development processing under the following conditions:

| Processing step | Temperature | Time | Replenishment rate/$m^2$ of the light-sensitive material |
|---|---|---|---|
| Color developing | 38.5° C. | 45 sec | 45 ml |
| Bleach-fixing | 38.0° C. | 45 sec | 35 ml |
| Rinse (1) | 38.0° C. | 20 sec | — |
| Rinse (2) | 38.0° C. | 20 sec | — |
| Rinse (3) | 38.0° C. | 20 sec | — |
| Rinse (4) | 38.0° C. | 30 sec | 121 ml |

wherein (a) a rinse cleaning system is installed in the rinse (3) and a rinse solution is taken out from the rinse (3) and sent to a reverse osmosis membrane module by using a pump; (b) permeated water obtained is supplied to the rinse (4), and concentrated water is returned to the rinse (3); (c) pump pressure is controlled such that water to be permeated in the reverse osmosis membrane module is maintained in an amount of 50 to 300 ml/min; and (d) the rinse solution was circulated under controlled temperature for 10 hours a day;

wherein the rinse was made in a tank counter-current system from (1) to (4); and wherein each processing solution has the following composition:

| Color developer | Tank solution | Replenisher |
|---|---|---|
| Water | 800 ml | 800 ml |
| Dimethylpolysiloxane-series Surfactant | 0.1 g | 0.1 g |

-continued

| Color developer | Tank solution | Replenisher |
|---|---|---|
| Tri(isopropanol)amine | 8.8 g | 8.8 g |
| Ethylenediamine tetraacetic acid | 4.0 g | 4.0 g |
| Polyethylene glycol (molecular weight: 300) | 10.0 g | 10.0 g |
| Sodium 4,5-dihydroxybenzene-1,3-Disulfonate | 0.5 g | 0.5 g |
| Potassium chloride | 10.0 g | — |
| Potassium bromide | 0.040 g | 0.010 g |
| Triazinylaminostilbene-series Fluorescent whitening Agent | 2.5 g | 5.0 g |
| Sodium sulfite | 0.1 g | 0.1 g |
| Disodium-N,N-bis(sulfonatoethyl)-Hydroxylamine | 8.5 g | 11.1 g |
| N-ethyl-N-(β-Methanesulfonamido-ethyl)-3-Methyl-4-amino-4-aminoaniline·3/2 sulfuric acid·1 hydrate | 5.0 g | 15.7 g |
| Potassium carbonate | 26.3 g | 26.3 g |
| Water to make | 1000 ml | 1000 ml |
| pH (25° C./adjusted using potassium hydroxide and sulfuric acid) | 10.15 | 12.50 |

| Bleach-fixing solution | Tank solution | Replenisher |
|---|---|---|
| Water | 700 ml | 600 ml |
| Ethylenediaminetetraacetic acid iron (III) ammonium | 47.0 g | 94.0 g |
| Ethylenediamine tetraacetic acid | 1.4 g | 2.8 g |
| m-Carboxybenzenefulfinic acid | 8.3 g | 16.5 g |
| Nitric acid (67%) | 16.5 g | 33.0 g |
| Imidazole | 14.6 g | 29.2 g |
| Ammonium thiosulfate (750 g/l) | 107.0 ml | 214.0 ml |
| Ammonium sulfite | 16.0 g | 32.0 g |
| Ammonium bisulfite | 23.1 g | 46.2 g |
| Water to make | 1000 ml | 1000 ml |
| pH (25° C./adjusted using acetic acid and ammonia) | 6.0 | 6.0 |

| Rinse solution | Tank solution | Replenisher |
|---|---|---|
| Sodium chlorinated-isocyanurate | 0.02 g | 0.02 g |
| Deionized water (conductivity: 5 μmS/cm or less) | 1000 ml | 1000 ml |
| pH | 6.5 | 6.5, |

the maximum gamma in the region where the density after processing is 1.5 to 2.0 is 1.1 or more but less than 4.2 for yellow, magenta and cyan, and the differences of maximum gamma among yellow, magenta and cyan are within 1.0.

13. The silver halide color photographic light-sensitive material according to claim 12, wherein when the light-sensitive material is subjected to gradation exposure for an exposure time of 1/10 second and then to said development processing, the maximum gamma in the region where the density after processing is 1.5 to 2.0 is 1.1 or more but less than 4.0 for yellow, magenta and cyan, and the differences of maximum gamma among yellow, magenta and cyan are within 1.0.

14. The silver halide color photographic light-sensitive material according to claim 12, wherein the differences of maximum gamma among yellow, magenta and cyan are within 0.5.

15. A silver halide color photographic light-sensitive material having at least three silver halide emulsion layers different in color sensitivity from each other, wherein the total amount of oil-soluble ingredients is 4.0 g/m$^2$ or less, on a reflective support, wherein said reflective support is one prepared by coating onto at least the side of the emulsion-coated surface of the support with a composition having a white pigment mixed and dispersed in a resin containing at least 50 wt % of a polyester synthesized by polycondensation of a dicarboxylic acid with a diol, wherein the silver halide emulsions in the silver halide emulsion layers each comprise silver halide emulsion grains with a silver chloride content of 95 mol % or more, and wherein when the light sensitive material is subjected to gradation exposure for an exposure time of 10$^4$ second and then to development processing under the following conditions:

| Processing step | Temperature | Time | Replenishment rate/m$^2$ of the light-sensitive material |
|---|---|---|---|
| Color developing | 38.5° C. | 45 sec | 45 ml |
| Bleach-fixing | 38.0° C. | 45 sec | 35 ml |
| Rinse (1) | 38.0° C. | 20 sec | — |
| Rinse (2) | 38.0° C. | 20 sec | — |
| Rinse (3) | 38.0° C. | 20 sec | — |
| Rinse (4) | 38.0° C. | 30 sec | 121 ml |

wherein (a) a rinse cleaning system is installed in the rinse (3) and a rinse solution is taken out from the rinse (3) and sent to a reverse osmosis membrane module by using a pump; (b) permeated water obtained is supplied to the rinse (4), and concentrated water is returned to the rinse (3); (c) pump pressure is controlled such that water to be permeated in the reverse osmosis membrane module is maintained in an amount of 50 to 300 ml/min; and (d) the rinse solution was circulated under controlled temperature for 10 hours a day;

wherein the rinse was made in a tank counter-current system from (1) to (4); and wherein each processing solution has the following composition:

| Color developer | Tank solution | Replenisher |
|---|---|---|
| Water | 800 ml | 800 ml |
| Dimethylpolysiloxane-series Surfactant | 0.1 g | 0.1 g |
| Tri(isopropanol)amine | 8.8 g | 8.8 g |
| Ethylenediamine tetraacetic acid | 4.0 g | 4.0 g |
| Polyethylene glycol (molecular weight: 300) | 10.0 g | 10.0 g |
| Sodium 4,5-dihydroxybenzene-1,3-Disulfonate | 0.5 g | 0.5 g |
| Potassium chloride | 10.0 g | — |
| Potassium bromide | 0.040 g | 0.010 g |
| Triazinylaminostilbene-series Fluorescent whitening Agent | 2.5 g | 5.0 g |
| Sodium sulfite | 0.1 g | 0.1 g |
| Disodium-N,N-bis(sulfonatoethyl)-Hydroxylamine | 8.5 g | 11.1 g |
| N-ethyl-N-(β-Methanesulfonamido-ethyl)-3-Methyl-4-amino-4-aminoaniline·3/2 sulfuric acid·1 hydrate | 5.0 g | 15.7 g |
| Potassium carbonate | 26.3 g | 26.3 g |
| Water to make | 1000 ml | 1000 ml |
| pH (25° C./adjusted using potassium hydroxide and sulfuric acid) | 10.15 | 12.50 |

| | Tank solution | Replenisher |
|---|---|---|
| Bleach-fixing solution | | |
| Water | 700 ml | 600 ml |
| Ethylenediaminetetraacetic acid iron (III) ammonium | 47.0 g | 94.0 g |
| Ethylenediamine tetraacetic acid | 1.4 g | 2.8 g |
| m-Carboxybenzenefulfinic acid | 8.3 g | 16.5 g |
| Nitric acid (67%) | 16.5 g | 33.0 g |
| Imidazole | 14.6 g | 29.2 g |
| Ammonium thiosulfate (750 g/l) | 107.0 ml | 214.0 ml |
| Ammonium sulfite | 16.0 g | 32.0 g |
| Ammonium bisulfite | 23.1 g | 46.2 g |
| Water to make | 1000 ml | 1000 ml |
| pH (25° C./adjusted using acetic acid and ammonia) | 6.0 | 6.0 |

| Rinse solution | Tank solution | Replenisher |
|---|---|---|
| Sodium chlorinated-isocyanurate | 0.02 g | 0.02 g |
| Deionized water (conductivity: 5 μmS/cm or less) | 1000 ml | 1000 ml |
| pH | 6.5 | 6.5, |

the maximum gamma in the region where the density after processing is 1.5 to 2.0 is 1.1 or more but less than 4.2 for yellow, magenta and cyan, and the differences of maximum gamma among yellow, magenta and cyan are within 1.0.

16. The silver halide color photographic light-sensitive material according to claim 15, wherein the polyester in the reflective support is a polyester which is composed of polyethylene terephthalate as a main component.

17. The silver halide color photographic light-sensitive material according to claim 15, wherein when the light-sensitive material is subjected to gradation exposure for an exposure time of 1/10 second and then to said development processing, the maximum gamma in the region where the density after processing is 1.5 to 2.0 is 1.1 or more but less than 4.0 for yellow, magenta and cyan, and the differences of maximum gamma among yellow, magenta and cyan are within 1.0.

18. The silver halide color photographic light-sensitive material according to claim 15, wherein the differences of maximum gamma among yellow, magenta and cyan are within 0.5.

19. A silver halide color photographic light-sensitive material having at least three silver halide emulsion layers different in color sensitivity from each other, wherein the total amount of oil-soluble ingredients is 4.0 g/m$^2$ or less, on a reflective support, wherein said reflective support is a water-resistant resin-coated support, and at least one layer of the water-resistant resin layers between the support and the silver halide emulsion layers is a biaxially oriented polyolefin layer having micropores, and wherein the silver halide emulsion in the silver halide emulsion layers each comprise silver halide emulsion grains with a silver chloride content of 95 mol % or more, and the silver halide emulsion in at least one layer of the silver halide emulsion layers is occupied by tabular grains having an average aspect ratio of 2 or more and an average thickness of less than 0.3 μm, in an amount of 50% or more of the projected area of the total silver halide grains.

20. The silver halide color photographic light-sensitive material according to claim 19, wherein the tabular grains have a {100} principal surface.

21. The silver halide color photographic light-sensitive material according to claim 19, wherein the tabular grains have a {111} principal surface.

22. The silver halide color photographic light-sensitive material according to claim 19, wherein the silver halide emulsion in at least one layer of the silver halide emulsion layers has a silver iodide content of about 0.01 to 1 mol %.

23. The silver halide color photographic light-sensitive material according to claim 19, wherein the silver halide grains have a core/shell structure.

24. The silver halide color photographic light-sensitive material according to claim 23, wherein a shell section of the core/shell structure is composed of silver chloroiodide or silver chlorobromoiodide.

25. A silver halide color photographic light-sensitive material having at least three silver halide emulsion layers different in color sensitivity from each other, wherein the total amount of oil-soluble ingredients is 4.0 g/m$^2$ or less, on a reflective support, wherein the reflective support is a water-resistant resin-coated support, and at least one layer of the water-resistant resin layers between the support and the silver halide emulsion layers is a biaxially oriented polyolefin layer having micropores, and between the biaxially oriented polyolefin layer and the silver halide emulsion layers, a polyolefin layer having no micropore is provided, and wherein the silver halide emulsion in at least one layer of the silver halide emulsion layers has a silver chloride content of 95 mol % or more, and is occupied by tabular grains having an average aspect ratio of 2 or more and an average thickness of less than 0.3 $\mu$m, in an amount of 50% or more of the projected area of the total silver halide grains.

26. The silver halide color photographic light-sensitive material according to claim 25, wherein the tabular grains have a {100} principal surface.

27. The silver halide color photographic light-sensitive material according to claim 25, wherein the tabular grains have a {111} principal surface.

28. The silver halide color photographic light-sensitive material according to claim 25, wherein the silver halide grains have a core/shell structure.

29. The silver halide color photographic light-sensitive material according to claim 28, wherein the shell section of the core/shell structure is composed of silver chloroiodide or silver chlorobromoiodide.

30. A silver halide color photographic light-sensitive material having at least three silver halide emulsion layers different in color sensitivity from each other, wherein the total amount of oil-soluble ingredients is 4.0 g/m$^2$ or less, on a reflective support, wherein said reflective support is one prepared by coating onto at least the side of the emulsion-coated surface of the support with a composition having a white pigment mixed and dispersed in a resin containing at least 50 wt % of a polyester synthesized by polycondensation of a dicarboxylic acid with a diol, wherein the silver halide emulsions in the silver halide emulsion layers each comprise silver halide emulsion grains with a silver chloride content of 95 mol % or more, and wherein the silver halide emulsion in at least one layer of the silver halide emulsion layers is occupied by tabular grains having an average aspect ratio of 2 or more and an average thickness of less than 0.3 $\mu$m, in an amount of 50% or more of the projected area of the total silver halide grains.

31. The silver halide color photographic light-sensitive material according to claim 30, wherein the polyester in the reflective support is a polyester which is composed of polyethylene terephthalate as a main component.

32. The silver halide color photographic light-sensitive material according to claim 30, wherein the tabular grains have a {100} principal surface.

33. The silver halide color photographic light-sensitive material according to claim 30, wherein the tabular grains have a {111} principal surface.

34. The silver halide color photographic light-sensitive material according to claim 30, wherein the silver halide grains have a core/shell structure.

35. The silver halide color photographic light-sensitive material according to claim 34, wherein the shell section of the core/shell structure is composed of silver chloroiodide or silver chlorobromoiodide.

36. A silver halide color photographic light-sensitive material having at least three silver halide emulsion layers different in color sensitivity from each other, wherein the total amount of oil-soluble ingredients is 4.0 g/m$^2$ or less, on a reflective support, wherein said reflective support is one selected from the group consisting of the following (a) and (b):

(a) the reflective support is a water-resistant resin-coated support, and at least one layer of the water-resistant resin layers between the support and the silver halide emulsion layers is a biaxially oriented polyolefin layer having micropores, (b) the reflective support is a water-resistant resin-coated support, and at least one layer of water-resistant resin layers between the support and the silver halide emulsion layers is a biaxially oriented polyolefin layer having micropores, and between the biaxially oriented polyolefin layer and the silver halide emulsion layers, a polyolefin layer having no micropore is provided, and wherein the silver halide emulsions in the silver halide emulsion layers each comprise silver halide emulsion grains with a silver chloride content of 95 mol % or more, and which further comprises at least one non-light-sensitive layer on the reflective support, in which the ratio by weight of oil-soluble ingredients/hydrophilic binder in at least one layer of the non-light-sensitive layers is 0.50 to 2.00.

37. The silver halide color photographic light-sensitive material according to claim 36, wherein the at least one non-light-sensitive layer is provided more outside than the emulsion layer most apart from the support.

38. The silver halide color photographic light-sensitive material according to claim 37, wherein the at least one non-light-sensitive layer is provided more outside than the silver halide emulsion layer most apart from the support and adjacent to the silver halide emulsion layer most apart from the support.

39. The silver halide color photographic light-sensitive material according to claim 36, wherein the average grain diameter of the silver halide grains in one of the emulsion layers is not larger than the grain diameter in the layer more apart from the support.

40. The silver halide color photographic light-sensitive material according to claim 36, wherein the silver halide emulsion in at least one layer of the silver halide emulsion layers has a silver chloride content of 95 mol % and is occupied by tabular grains having an average aspect ratio of 2 or more and an average thickness of less than 0.3 $\mu$m, in an amount of 50% or more of the projected area of the total silver halide grains.

41. A silver halide color photographic light sensitive material having at least three silver halide emulsion layers different in color sensitivity from each other, wherein the total amount of oil-soluble ingredients is 4.0 g/m$^2$ or less, on a reflective support, wherein said reflective support is one selected from the group consisting of the following (a) and (b):

(a) the reflective support is a water-resistant resin-coated support, and at least one layer of the water-resistant resin layers between the support and the silver halide emulsion layers is a biaxially oriented polyolefin layer having micropores, (b) the reflective support is a water-resistant resin-coated support, and at least one layer of water-resistant resin layers between the support and the silver halide emulsion layers is a biaxially oriented polyolefin layer having micropores, and between the biaxially oriented polyolefin layer and the silver halide emulsion layers, a polyolefin layer having no micropore is provided, wherein the silver halide emulsions in the silver halide emulsion layers each comprise silver halide emulsion grains with a silver chloride content of 95 mol % or more, and wherein the at least three silver halide emulsion layers are a yellow coupler-containing silver halide emulsion layer, a magenta coupler-containing silver halide emulsion layer and a cyan coupler-containing silver halide emulsion layer, and wherein a non-light-sensitive layer is provided on the reflective support, and a matt agent is contained in the outermost layer among the non-light-sensitive layers.

42. The silver halide color photographic light-sensitive material according to claim 41, wherein the matt agent is contained in an amount of 10 mg or more per m$^2$.

43. The silver halide color photographic light-sensitive material according to claim 41, which further contains a latex in an amount of 40 mg or more per m$^2$ in the outermost layer of the non-light sensitive layers.

44. A silver halide photographic light-sensitive material having at least three silver halide emulsion layers different in color sensitivity from each other, wherein the total amount of oil-soluble ingredients is 4.0 g/m$^2$ or less, on a reflective support, wherein said reflective support is one selected from the group consisting of the following (a), (b) and (c):

(a) the reflective support is a water-resistant resin-coated support, and at least one layer of the water-resistant resin layers between the support and the silver halide emulsion layers is a biaxially oriented polyolefin layer having micropores, (b) the reflective support is a water-resistant resin-coated support, and at least one layer of water-resistant resin layers between the support and the silver halide emulsion layers is a biaxially oriented polyolefin layer having micropores, and between the biaxially oriented polyolefin layer and the silver halide emulsion layers, a polyolefin layer having no micropore is provided, (c) the reflective support is one prepared by coating onto at least the side of the emulsion-coated surface of the support with a composition having a white pigment mixed and dispersed in a resin containing at least 50 wt % of a polyester synthesized by polycondensation of a dicarboxylic acid with a diol, and wherein the silver halide emulsions in the silver halide emulsion layers each comprise silver halide emulsion grains with a silver chloride content of 95 mol % or more, which is one used for a reflective square or rectangular photographic print having four corners with a shape, wherein the shape of the four corners of the square or rectangular photographic print is an arc with a radius of 1 mm or more but 20 mm or less with the center placed in the photographic print and a central angle of 90° or less, and the Taber rigidity of the reflective support is 9.0 g·cm or more.

45. A silver halide color photographic light-sensitive material having at least three silver halide emulsion layers different in color sensitivity from each other on a reflective support, wherein said reflective support is a water-resistant resin-coated support, and at least one layer of the water-resistant resin layers between the support and the silver halide emulsion layers is a biaxially oriented polyolefin layer having micropores, wherein the silver halide emulsions in the silver halide emulsion layers each comprise silver halide emulsion grains with a silver chloride content of 95 mol % or more, and wherein the at least three silver halide emulsion layers are at least three kinds of light-sensitive hydrophilic colloidal layers respectively containing any one of yellow-, magenta- and cyan-color-forming couplers, and wherein a non-light-sensitive hydrophilic colloidal layer is provided on the reflective support, and wherein a pyrazolotriazole magenta coupler represented by formula (M-A):

formula (M-A):

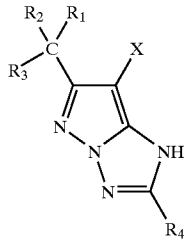

(wherein in the formula (M-A) $R_1$, $R_2$, $R_3$ and $R_4$ each independently represent an alkyl group or an aryl group; and X represents a halogen atom) and a non-color-forming oil-soluble organic compound are contained in the magenta-color-forming hydrophilic colloidal layer, in which the ratio by weight of the non-color-forming organic compound/magenta coupler is in the range of 2.0 to 6.0.

46. The silver halide color photographic light-sensitive material according to claim 45, which is hardened by using at least one hardening agent represented by the following formula (II):

formula (II)

$$X^1—SO_2—L—SO_2—X^2$$

wherein in formula (II), $X^1$ and $X^2$ are —CH═$CH_2$ or —$CH_2CH_2$—Y, in which $X^1$ and $X^2$ may be the same or different, Y represents a group which is substituted by a nucleophilic reagent (a nucleophilic group), or which can be split-off in the form of HY by a base, and L is a divalent linking group which may be further substituted.

47. The silver halide color photographic light-sensitive material according to claim 45, wherein the cyan-color-forming hydrophilic colloidal layer contains at least one pyrrolotriazole cyan coupler represented by the following formula (III):

(III)

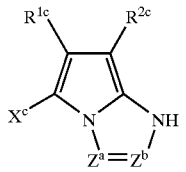

wherein, in formula (III), $Z^a$ and $Z^b$, which may be the same or different, each represent —C($R^{3c}$)= or —N=, provided that one of $Z^a$ and $Z^b$ is —C($R^{3c}$)= and the other is —N=; $R^{1c}$ and $R^{2c}$ each represent an electron-attracting group having a Hammett's substituent constant $\sigma_p$ value of 0.2 or more, and the total of the $\sigma_p$ values of $R^{1c}$ and $R^{2c}$ is 0.65 or more; $R^{3c}$ represents a hydrogen atom or a substituent, and $X^c$ represents a hydrogen atom or a group capable of being split-off upon reaction with an oxidized product of a color-developing agent.

48. A silver halide color photographic light-sensitive material having at least three silver halide emulsion layers different in color sensitivity from each other on a reflective support, wherein said reflective support is one selected from the group consisting of the following (a) and (b):

(a) the reflective support is a water-resistant resin-coated support, and at least one layer of the water-resistant resin layers between the support and the silver halide emulsion layers is a biaxially oriented polyolefin layer having micropores, (b) the reflective support is a water-resistant resin-coated support, and at least one layer of water-resistant resin layers between the support and the silver halide emulsion layers is a biaxially oriented polyolefin layer having micropores, and between the biaxially oriented polyolefin layer and the silver halide emulsion layers, a polyolefin layer having no micropore is provided, and wherein the silver halide emulsions in the silver halide emulsion layers each comprise silver halide emulsion grains with a silver chloride content of 95 mol % or more, and which further comprises at least one non-light-sensitive layer on the reflective support, in which the ratio by weight of oil-soluble ingredients/hydrophilic binder in at least one layer of the non-light-sensitive layers is 0.70 to 1.80 and at least one of the oil-soluble ingredients in the layer is a liquid high-boiling organic solvent.

49. The silver halide color photographic light-sensitive material according to claim 48, wherein the non-light-sensitive layer, in which the ratio by weight of oil-soluble ingredients/hydrophilic binder is 0.70 to 1.80 and at least one of the oil-soluble ingredients in the layer is a liquid high-boiling organic solvent, is coated more outside than but adjacent to the silver halide emulsion layer furthest away from the support.

50. A silver halide color photographic light-sensitive material having at least three silver halide emulsion layers different in color sensitivity from each other, wherein the total amount of oil soluble ingredients is 4.0 g/$m^2$ or less, on a reflective support, wherein said reflective support is one prepared by coating onto at least the side of the emulsion-coated surface of the support with a composition having a white pigment mixed and dispersed in a resin containing at least 50 wt % of a polyester synthesized by polycondensation of a dicarboxylic acid with a diol, and wherein the silver halide emulsions in the silver halide emulsion layers each comprise silver halide emulsion grains with a silver chloride content of 95 mol % or more:

wherein at least one layer of the silver halide emulsion layers contains a cyan dye-forming coupler represented by formula (IV):

formula (IV)

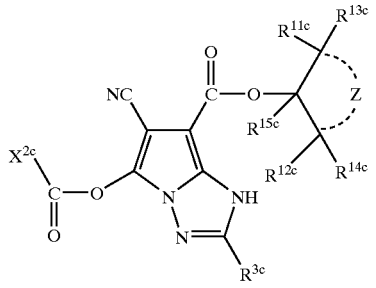

wherein, in formula (IV), $R^{3c}$ and $X^{2c}$ each independently represent a hydrogen atom or a substituent; Z represents a group of non-metallic atoms necessary for forming a 5- to 8-membered ring; $R^{11c}$, $R^{12c}$, $R^{13c}$, $R^{14c}$, and $R^{15c}$ each independently represent a hydrogen atom or a substituent.

51. The silver halide color photographic light-sensitive material according to claim 50, wherein a matt agent is contained in the outermost layer among the non-light-sensitive layers in an amount of 10 mg or more per $m^2$.

* * * * *